US012215900B2

(12) United States Patent
Mieda et al.

(10) Patent No.: US 12,215,900 B2
(45) Date of Patent: Feb. 4, 2025

(54) REFRIGERATION CYCLE DEVICE

(71) Applicant: DENSO CORPORATION, Kariya (JP)

(72) Inventors: Hiroshi Mieda, Kariya (JP); Atsushi Inaba, Kariya (JP); Yuuichi Kami, Kariya (JP); Mikiharu Kuwahara, Kariya (JP); Masafumi Nakashima, Kariya (JP)

(73) Assignee: DENSO CORPORATION, Kariya (JP)

( * ) Notice: Subject to any disclaimer, the term of this patent is extended or adjusted under 35 U.S.C. 154(b) by 264 days.

(21) Appl. No.: 17/749,258

(22) Filed: May 20, 2022

(65) Prior Publication Data

US 2022/0275982 A1 Sep. 1, 2022

Related U.S. Application Data

(63) Continuation of application No. PCT/JP2020/040088, filed on Oct. 26, 2020.

(30) Foreign Application Priority Data

Nov. 22, 2019 (JP) ..... 2019-211146
Mar. 25, 2020 (JP) ..... 2020-053930
Oct. 16, 2020 (JP) ..... 2020-174371

(51) Int. Cl.
*F25B 30/02* (2006.01)
*F25B 41/42* (2021.01)

(52) U.S. Cl.
CPC ..... *F25B 30/02* (2013.01); *F25B 41/42* (2021.01); *F25B 2400/053* (2013.01); (Continued)

(58) Field of Classification Search
CPC .. F25B 30/02; F25B 2500/31; F25B 2500/28; F25B 2400/23; F25B 2400/16; F25B 2400/054; F25B 2400/053; F25B 41/42
See application file for complete search history.

(56) References Cited

U.S. PATENT DOCUMENTS 6,148,632 A 11/2000 Kishita et al.
6,332,496 B1 12/2001 Takano et al.
(Continued)

FOREIGN PATENT DOCUMENTS

JP S59145453 A 8/1984
JP H11278045 A 10/1999
(Continued)

OTHER PUBLICATIONS

Translated_Hirokazu (Year: 2014).*

*Primary Examiner* — Elizabeth J Martin
*Assistant Examiner* — Samba Nmn Gaye
(74) *Attorney, Agent, or Firm* — Harness, Dickey & Pierce, P.L.C.

(57) ABSTRACT

A refrigeration cycle device includes a compressor, an upstream branch portion, a heating portion, a decompression portion, a bypass passage, a bypass flow adjustment portion, and a mixing portion. The mixing portion mixes a bypass side refrigerant flowing out from the bypass flow adjustment portion with a decompression-portion side refrigerant flowing out from the decompression portion, and causes the mixed refrigerant to flow to a suction port side of the compressor. The mixing portion mixes the bypass side refrigerant and the decompression-portion side refrigerant such that an enthalpy difference obtained by subtracting an enthalpy of an ideal homogeneously mixed refrigerant from an enthalpy of a suction side refrigerant actually sucked into the compressor is equal to or less than a predetermined reference value.

13 Claims, 46 Drawing Sheets

(52) U.S. Cl.
CPC ..... *F25B 2400/054* (2013.01); *F25B 2400/16* (2013.01); *F25B 2400/23* (2013.01); *F25B 2500/28* (2013.01); *F25B 2500/31* (2013.01)

(56) References Cited

U.S. PATENT DOCUMENTS

| | | | | |
|---|---|---|---|---|
| 6,467,291 | B1 | 10/2002 | Takano et al. | |
| 2016/0082810 | A1 | 3/2016 | Suzuki | |
| 2019/0070924 | A1 * | 3/2019 | Mancini | B60H 1/32281 |

FOREIGN PATENT DOCUMENTS

| | | | |
|---|---|---|---|
| JP | 2000-343934 | A | 12/2000 |
| JP | 2004061071 | A | 2/2004 |
| JP | 2006132800 | A | 5/2006 |
| JP | 2006321389 | A | 11/2006 |
| JP | 2012006514 | A | 1/2012 |
| JP | 2012183905 | A | 9/2012 |
| JP | 2013103522 | A | 5/2013 |
| JP | 2013231542 | A | 11/2013 |
| JP | 5401857 | B2 * | 1/2014 |
| JP | 2014226979 | A | 12/2014 |
| JP | 6199590 | B2 | 9/2017 |
| KR | 1020060055152 | A | 5/2006 |
| WO | WO-2016113899 | A1 | 7/2016 |

* cited by examiner

IV — IV

COOLING MODE/SERIES DEHUMIDIFYING AND HEATING MODE

PARALLEL DEHUMIDIFYING AND HEATING MODE

PARALLEL DEHUMIDIFYING HOT-GAS HEATING MODE

OUTSIDE AIR HEAT-ABSORPTION HEATING MODE

OUTSIDE AIR HEAT-ABSORPTION HOT-GAS HEATING MODE

HOT GAS HEATING MODE

XVI — XVI

PARALLEL DEHUMIDIFYING AND HEATING MODE

PARALLEL DEHUMIDIFYING HOT-GAS HEATING MODE

OUTSIDE AIR HEAT-ABSORPTION HEATING MODE

OUTSIDE AIR HEAT-ABSORPTION HOT-GAS HEATING MODE

HOT GAS HEATING MODE

HOT GAS HEATING MODE

ASSIST WARM-UP MODE

ASSISTLESS WARM-UP MODE

ASSIST WARM-UP MODE

HEATER WARM-UP MODE

REFRIGERANT WARM-UP MODE

AIR COOLING MODE/SERIES DEHUMIDIFYING AND HEATING MODE

PARALLEL DEHUMIDIFYING AND HEATING MODE

OUTSIDE AIR HEAT-ABSORPTION HEATING MODE

HOT GAS HEATING MODE/REFRIGERANT WARM-UP MODE

WARM-UP PREPARATION MODE

AIR COOLING MODE/ DEHUMIDIFYING AND HEATING MODE

OUTSIDE AIR HEAT-ABSORPTION HEATING MODE

HOT GAS HEATING MODE/REFRIGERANT WARM-UP MODE

WARM-UP PREPARATION MODE

REFRIGERATION CYCLE DEVICE

CROSS REFERENCE TO RELATED APPLICATION

The present application is a continuation application of International Patent Application No. PCT/JP2020/040088 filed on Oct. 26, 2020, which designated the U.S. and claims the benefit of priority from Japanese Patent Applications No. 2019-211146 filed on Nov. 22, 2019, No. 2020-053930 filed on Mar. 25, 2020, and No. 2020-174371 filed on Oct. 16, 2020. The entire disclosures of all of the above applications are incorporated herein by reference.

TECHNICAL FIELD

The present disclosure relates to a refrigeration cycle device.

BACKGROUND

In a refrigeration cycle device, refrigerants having different enthalpies may be mixed and sucked into a compressor.

For example, when frosting occurs in an exterior heat exchanger, the refrigeration cycle device is switched to a refrigerant circuit that branches a flow of a high-pressure refrigerant flowing out from a radiator, in order to suppress progress of frosting in the exterior heat exchanger. The exterior heat exchanger is a heat exchanger that exchanges heat between the refrigerant and outside air. The radiator is a heat exchanger that exchanges heat between the high-pressure refrigerant discharged from the compressor and air blown into a space to be air conditioned to heat the air.

SUMMARY

According to an aspect of the present disclosure, in a refrigeration cycle device, a bypass side refrigerant and a decompression-portion side refrigerant are mixed in a mixing portion such that an absolute value of an enthalpy difference is equal to or less than a reference value. Therefore, variation in enthalpy of the refrigerant actually flowing to a suction port side of a compressor can be suppressed.

According to another aspect of the present disclosure, in a refrigerant cycle device, a warm-up preparation mode is executed before an operation in a refrigerant warm-up mode is executed, so that the refrigerant in a refrigerant cycle can be stored in a high-pressure side gas-liquid separator before the operation in the refrigerant warm-up mode is executed.

As a result, it is possible to provide a refrigeration cycle device capable of appropriately protecting the compressor even when the refrigerants having different enthalpies are mixed and sucked into the compressor.

BRIEF DESCRIPTION OF DRAWINGS

The above and other objects, features and advantages of the present disclosure will become more apparent from the following detailed description made with reference to the accompanying drawings.

DESCRIPTION OF EMBODIMENTS

Figure 1:
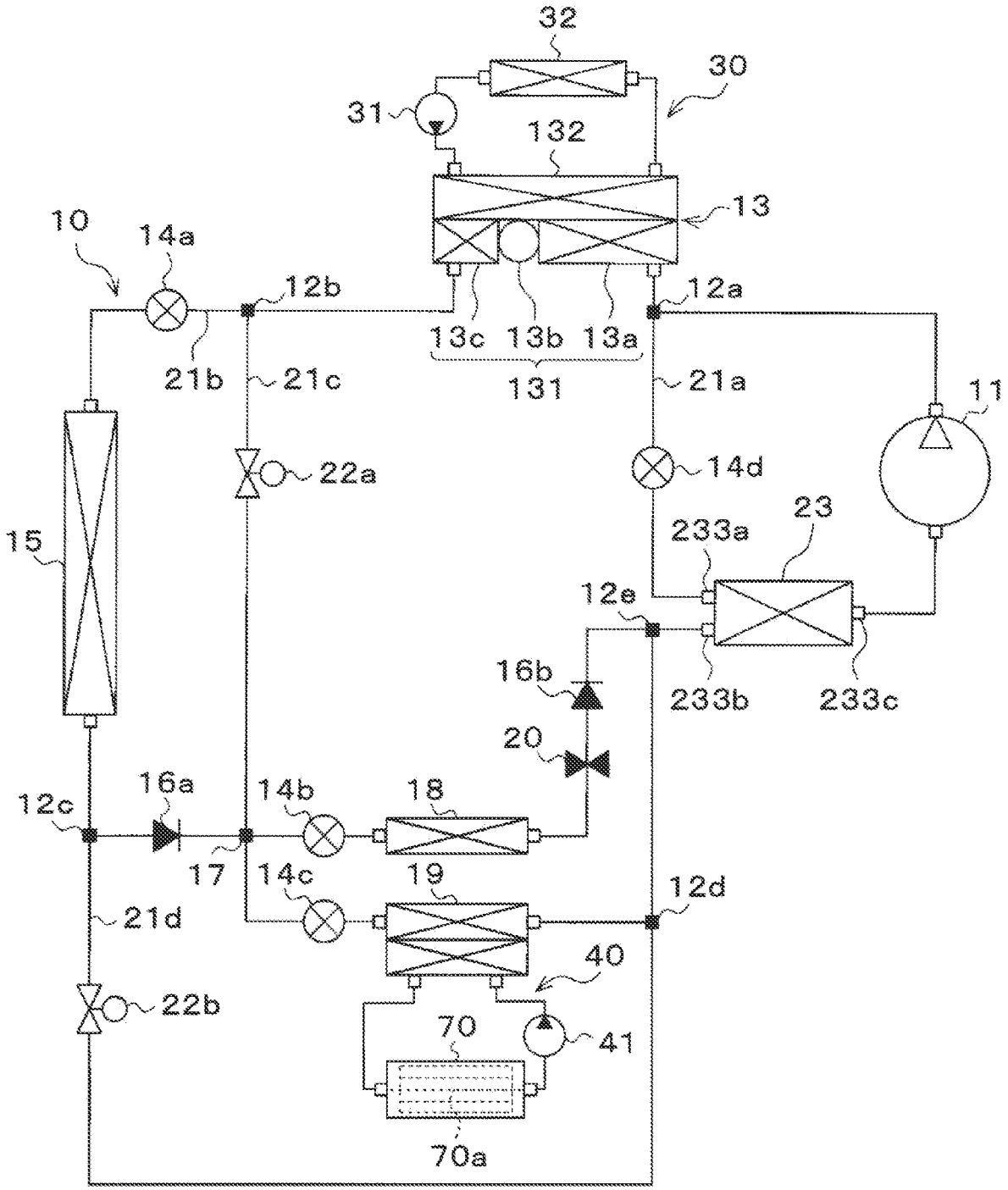
FIG. 1 is a schematic overall configuration diagram of a refrigeration cycle device according to a first embodiment.

In a refrigeration cycle device, refrigerants having different enthalpies may be mixed and sucked into a compressor.

More specifically, when frosting occurs in an exterior heat exchanger, the refrigeration cycle device performs switching to a refrigerant circuit that branches a flow of a high-pressure refrigerant flowing out from a radiator, in order to suppress progress of frosting in the exterior heat exchanger. The exterior heat exchanger is a heat exchanger that exchanges heat between the refrigerant and outside air. The radiator is a heat exchanger that exchanges heat between the high-pressure refrigerant discharged from the compressor and air blown into a space to be air conditioned to heat the air.

In the refrigeration cycle device, one branched refrigerant is decompressed and caused to flow into an accumulator through a bypass passage. The other branched refrigerant is decompressed and caused to flow into the accumulator via the exterior heat exchanger. The accumulator separates the refrigerant flowing into the accumulator into gas and liquid, stores the separated liquid-phase refrigerant as a surplus refrigerant in a cycle, and causes the separated gas-phase refrigerant to flow out to a suction port side of the compressor.

That is, in the refrigeration cycle device, when the frosting occurs in the exterior heat exchanger, the refrigerants having different enthalpies, such as the refrigerant flowing out from the bypass passage and the refrigerant flowing out from the exterior heat exchanger, are merged in the accumulator. The flow is switched to the refrigerant circuit that causes the refrigerant mixed in the accumulator to be sucked into the compressor. According to this, in the refrigeration cycle device, a decrease in a heating capacity of the air (that is, the heating capacity of the space to be air conditioned) in the radiator can be suppressed while suppressing the progress of the frosting in the exterior heat exchanger.

However, in a configuration in which refrigerants having different enthalpies are merged in an accumulator, mixing of the refrigerants may be insufficient. Therefore, the enthalpy of a suction side refrigerant actually flowing into a suction port side of the compressor from the accumulator may greatly deviate from the enthalpy of an ideal mixed refrigerant obtained by homogeneously mixing the refrigerants flowing into the accumulator.

For example, when an outside air temperature is low, heat exchange between the gas-phase refrigerant and the liquid-phase refrigerant is not sufficiently performed only at a gas-liquid interface in the accumulator, and thus the actual enthalpy of the suction side refrigerant becomes higher than the ideal enthalpy of the mixed refrigerant. As a result, the temperature of the high-pressure refrigerant discharged from the compressor increases more than necessary, and a refrigerant discharge capacity of the compressor may need to be decreased in order to protect the compressor.

That is, in the refrigeration cycle device in which the refrigerants having different enthalpies are mixed and sucked into the compressor, when the mixing of the refrigerants is insufficient, the heating capacity of the radiator may need to be decreased.

When the refrigerant having a relatively high temperature flows into the accumulator at a cryogenic outside air temperature, a so-called foaming phenomenon may occur in which a cryogenic liquid-phase refrigerant in the accumulator is rapidly boiled to make the refrigerant foam in the accumulator. When the foaming phenomenon occurs, the compressor sucks the refrigerant having low dryness and thus the compressor cannot be appropriately protected by liquid compression.

An object of the present disclosure is to provide a refrigeration cycle device capable of exhibiting a stable heating capacity even when refrigerants having different enthalpies are mixed and sucked into a compressor.

Another object of the present disclosure is to provide a refrigeration cycle device capable of appropriately protecting a compressor even when refrigerants having different enthalpies are mixed and sucked into a compressor.

To achieve the above and other objects, a refrigeration cycle device according to a first aspect of the present disclosure includes a compressor, an upstream branch portion, a heating portion, a decompression portion, a bypass passage, a bypass flow adjustment portion, and a mixing portion.

The compressor is configured to compress and discharge a refrigerant. The upstream branch portion is configured to branch a flow of the refrigerant discharged from the compressor. The heating portion is configured to heat a heating target by using one refrigerant branched at the upstream branch portion as a heat source. The decompression portion is configured to decompress the refrigerant flowing out from the heating portion. The bypass passage is configured to guide the other refrigerant branched at the upstream branch portion toward a suction port side of the compressor. The bypass flow adjustment portion is configured to adjust a flow rate of the refrigerant flowing through the bypass passage. The mixing portion is configured to mix a bypass side refrigerant flowing out from the bypass flow adjustment portion with a decompression-portion side refrigerant flowing out from the decompression portion, and to cause the mixed refrigerant to flow out to the suction port side of the compressor.

The mixing portion mixes the bypass side refrigerant and the decompression-portion side refrigerant to have the mixed refrigerant in which the bypass side refrigerant and the decompression-portion side refrigerant are homogeneously mixed, and an absolute value of an enthalpy difference obtained by subtracting an enthalpy of the mixed refrigerant from an enthalpy of a suction side refrigerant actually flowing to the suction port side of the compressor is equal to or less than a predetermined reference value.

According to this configuration, the bypass side refrigerant and the decompression-portion side refrigerant are mixed in the mixing portion such that the absolute value of the enthalpy difference is equal to or less than the reference value. Therefore, variation in enthalpy of the refrigerant actually flowing to the suction port side of the compressor can be suppressed. Accordingly, it is possible to avoid a decrease in the refrigerant discharge capacity of the compressor due to the insufficient mixing of the bypass side refrigerant and the decompression-portion side refrigerant.

As a result, it is possible to provide the refrigeration cycle device capable of exhibiting a stable heating capacity even when the refrigerants having different enthalpies are mixed and sucked into the compressor. Furthermore, it is possible to provide the refrigeration cycle device capable of protecting the compressor even when the refrigerants having different enthalpies are mixed and sucked into the compressor.

A refrigeration cycle device according to a second aspect of the present disclosure includes a compressor, an upstream branch portion, a heating portion, a high-pressure side gas-liquid separator a decompression portion, a bypass passage, a bypass flow adjustment portion, and a mixing portion.

The compressor is configured to compress and discharge a refrigerant. The upstream branch portion is configured to branch a flow of the refrigerant discharged from the compressor. The heating portion is configured to heat a heating target by using one refrigerant branched at the upstream branch portion as a heat source. The high-pressure side gas-liquid separator is configured to separate the refrigerant flowing out from the heating portion into gas and liquid and to store the separated liquid-phase refrigerant. The decompression portion is configured to decompress the refrigerant flowing out from the high-pressure side gas-liquid separator. The bypass passage is configured to guide the other refrigerant branched at the upstream branch portion toward a suction port side of the compressor. The bypass flow adjustment portion is configured to adjust a flow rate of the refrigerant flowing through the bypass passage. The mixing portion is configured (i) to mix a bypass side refrigerant flowing out from the bypass flow adjustment portion with a decompression-portion side refrigerant flowing out from the decompression portion and (ii) to cause the mixed refrigerant to flow to the suction port side of the compressor.

A refrigerant warm-up mode is performed (i) to mix the bypass side refrigerant and the decompression-portion side refrigerant by the mixing portion and (ii) to heat the refrigerant sucked into the compressor, when the compressor is started. A warm-up preparation mode is performed to store the refrigerant of a cycle in the high-pressure side gas-liquid separator, before execution of the refrigerant warm-up mode.

According to this, because warm-up preparation mode is executed before an operation in the refrigerant warm-up mode is executed, the refrigerant in the cycle can be stored in the high-pressure side gas-liquid separator before the operation in the refrigerant warm-up mode is executed. Accordingly, when the refrigerant discharge capacity of the compressor is increased in a case where the warm-up preparation mode is shifted to the refrigerant warm-up mode, it is possible to prevent the compressor from sucking the refrigerant having low dryness.

As a result, it is possible to provide the refrigeration cycle device capable of appropriately protecting the compressor even when the refrigerants having different enthalpies are mixed and sucked into the compressor.

Hereinafter, a plurality of embodiments for carrying out the present disclosure will be described with reference to the drawings. In each embodiment, parts corresponding to matters described in the preceding embodiment are denoted by the same reference numerals, and overlapped description may be omitted. In a case where only a part of the configuration is described in each embodiment, other embodiments previously described can be applied to other parts of the configuration. It is also possible to partially combine the embodiments even when it is not explicitly described, as long as there is no problem in the combination as well as the combination of the parts specifically and explicitly described that the combination is possible.

First Embodiment

A refrigeration cycle device 10 according to the first embodiment of the present disclosure will be described with reference to FIGS. 1 to 14. The refrigeration cycle device 10 is applied to a vehicle air conditioner mounted on an electric vehicle. The electric vehicle is a vehicle that obtains a traveling drive force from an electric motor. The vehicle air conditioner of the present embodiment is an air conditioner performing air conditioning of a vehicle interior which is a space to be air conditioned and having a temperature adjustment function for a heat generating device that adjusts the temperature of a battery 70 as the heat generating device.

The refrigeration cycle device 10 illustrated in an overall configuration diagram of FIG. 1 cools or heats air blown into the vehicle interior and performs the temperature adjustment of the battery 70 in the vehicle air conditioner. A heating target in the refrigeration cycle device 10 is the air. The refrigeration cycle device 10 can switch the refrigerant circuit in accordance with various operation modes to be described later in order to perform air conditioning of the vehicle interior and the temperature adjustment of the battery 70.

The refrigeration cycle device 10 uses an HFO refrigerant (specifically, R1234yf) as the refrigerant. The refrigeration cycle device 10 constitutes a subcritical refrigeration cycle in which a refrigerant pressure on a high pressure side does not exceed a critical pressure of the refrigerant. A refrigerant oil for lubricating a compressor 11 of the refrigeration cycle device 10 is mixed in the refrigerant. The refrigerant oil is a polyalkylene glycol oil (PAG oil) having compatibility with the liquid-phase refrigerant. A part of the refrigerant oil circulates through the refrigeration cycle device 10 together with the refrigerant.

The compressor 11 sucks, compresses, and discharges the refrigerant in the refrigeration cycle device 10. The compressor 11 is disposed in a drive device room on the front side of the vehicle interior. The drive device room forms a space in which at least some of devices (for example, motor generator 71) or the like used for generating or adjusting a vehicle traveling drive force is disposed.

The compressor 11 is an electric compressor that rotatably drives a fixed displacement compression mechanism with a fixed discharge capacity by use of an electric motor The number of rotations (that is, refrigerant discharge capacity) of the compressor 11 is controlled by a control signal output from a controller 60 to be described later.

The inflow port side of a first three-way joint 12*a* is connected to the discharge port of the compressor 11. The first three-way joint 12*a* has three inflow and outflow ports communicating with each other. As the first three-way joint 12*a*, a joint portion formed by joining a plurality of pipes or a joint portion formed by providing a plurality of refrigerant passages in a metal block or a resin block can be adopted.

As described later, the refrigeration cycle device 10 includes a second three-way joint 12*b* to a fifth three-way joint 12*e*. The second three-way joint 12*b* to the fifth three-way joint 12*e* have the same basic structure as that of the first three-way joint 12*a*. The basic structure of each three-way joint to be explained in an embodiment to be described later is similar to that of the first three-way joint 12*a*.

These three-way joints branch the flow of the refrigerant when one of the three inflow and outflow ports is used as the inflow port and the remaining two are used as the outflow port. The flows of the refrigerant are merged when two of the three inflow and outflow ports is used as the inflow port and the remaining one is used as the outflow port. The first three-way joint 12*a* is an upstream branch portion that branches the flow of the refrigerant discharged from the compressor 11.

An inlet side of a refrigerant passage 131 of a water refrigerant heat exchanger 13 is connected to one outflow port of the first three-way joint 12*a*. An inlet side of a bypass passage 21*a* to be described later is connected to the other outflow port of the first three-way joint 12*a*.

The water refrigerant heat exchanger 13 is a heat radiation heat exchanger that performs heat exchanging between the high-pressure refrigerant discharged from the compressor 11 and the heating-coolant circulating in a heating-coolant circuit 30 to radiate heat of the high-pressure refrigerant to the heating-coolant. In the present embodiment, a so-called subcooling heat exchanger is adopted as the water refrigerant heat exchanger 13. Therefore, a condensing portion 13*a*, a receiver portion 13*b*, and a subcooling portion 13*c* are provided in the refrigerant passage 131 of the water refrigerant heat exchanger 13.

The condensing portion 13*a* is a condensation heat exchange portion that exchanges heat between the high-pressure refrigerant discharged from the compressor 11 and a high-pressure side heat medium to condense the high-pressure refrigerant. The receiver portion 13*b* is a liquid receiving portion that separates the refrigerant flowing out from the condensing portion 13*a* into gas and liquid, and stores the separated liquid-phase refrigerant as a surplus refrigerant of the cycle. The subcooling portion 13*c* is a subcooling heat exchange portion that exchanges heat between the liquid-phase refrigerant flowing out from the receiver portion 13*b* and the high-pressure side heat medium to subcool the liquid-phase refrigerant.

An inlet side of the second three-way joint 12*b* is connected to an outlet (specifically, the outlet of the subcooling portion 13*c*) of the refrigerant passage 131 of the water refrigerant heat exchanger 13. An inlet side of the first passage 21*b* is connected to one outflow port of the second three-way joint 12*b*. An inlet side of the second passage 21*c* is connected to another outflow port of the second three-way joint 12*b*.

In the first passage 21*b*, a heating expansion valve 14*a* and an exterior heat exchanger 15 are disposed. The heating expansion valve 14*a* is a first decompression portion that decompresses one refrigerant branched at the second three-way joint 12*b* in a parallel dehumidifying hot-gas heating mode to be described, in an outside air heat-absorption hot-gas heating mode, and the like to be described later. The heating expansion valve 14*a* is an exterior heat exchanger flow rate adjustment portion that adjusts a flow rate (mass flow rate) of the refrigerant flowing into the exterior heat exchanger 15.

The heating expansion valve 14*a* is an electric variable throttle mechanism including a valve body for changing a throttle opening degree and an electric actuator (specifically, a stepping motor) that displaces the valve body. Operation of the heating expansion valve 14*a* is controlled by a control pulse output from the controller 60.

The heating expansion valve 14*a* has a fully opening function of simply serving as the refrigerant passage by fully opening the valve opening degree almost without exhibiting a refrigerant decompression effect and a flow rate adjustment effect. The heating expansion valve 14*a* has a fully closing function of closing the refrigerant passage by fully closing the valve opening degree.

As will be described later, the refrigeration cycle device 10 includes an air cooling expansion valve 14*b*, a cooling expansion valve 14*c*, and a bypass flow adjustment valve 14*d*. The air cooling expansion valve 14*b*, the cooling expansion valve 14*c*, and the bypass flow adjustment valve 14*d* have the same basic structure as that of the heating expansion valve 14*a*.

The heating expansion valve 14*a*, the air cooling expansion valve 14*b*, the cooling expansion valve 14*c*, and the bypass flow adjustment valve 14*d* can switch the refrigerant circuit by exhibiting the above-described fully closing function. That is, the heating expansion valve 14*a* the air cooling expansion valve 14*b*, the cooling expansion valve 14*c*, and the bypass flow adjustment valve 14*d* also function as a refrigerant circuit switching portion.

Of course, the heating expansion valve 14*a*, the air cooling expansion valve 14*b*, the cooling expansion valve 14*c*, and the bypass flow adjustment valve 14*d* may be formed by combining a variable throttle mechanism that does not have a fully closing function and an opening/closing valve. In this case, the opening/closing valve serves as the refrigerant circuit switching portion.

A refrigerant inlet side of the exterior heat exchanger 15 is connected to an outlet of the heating expansion valve 14*a*. The exterior heat exchanger 15 is an exterior heat exchange portion that exchanges heat between the refrigerant flowing out from the heating expansion valve 14*a* and the external air ventilated by an outside air fan (not illustrated). The exterior heat exchanger 15 is disposed on the front side of the drive device room. Therefore, during traveling of the vehicle, traveling air flowing into the drive device room through a grill can be blown against the exterior heat exchanger 15.

When a saturation temperature of the refrigerant flowing inside is higher than an outside air temperature, the exterior heat exchanger 15 functions as a condenser that radiates heat of the refrigerant to the outside air to condense the refrigerant. When the saturation temperature of the refrigerant flowing inside is lower than the outside air temperature, the exterior heat exchanger 15 functions as an evaporator that makes the refrigerant absorb heat of the outside air to evaporate the refrigerant.

In other words, the exterior heat exchanger 15 serves as the condensing portion in the air cooling mode to be described later. The exterior heat exchanger 15 serves as a heat absorption portion in a parallel dehumidifying hot-gas heating mode, in an outside air heat-absorption hot-gas heating mode, and the like to be described later. Accordingly, in the parallel dehumidifying hot-gas heating mode, in the outside air heat-absorption hot-gas heating mode, and the like, the outside air serves as a heat source fluid that causes the refrigerant to absorb the heat.

An inlet side of the third three-way joint 12*c* is connected to a refrigerant outlet of the exterior heat exchanger 15. One inflow port side of a four-way joint 17 is connected to one outflow port of the third three-way joint 12*c* through a first check valve 16*a*. An inlet side of a low-pressure passage 21*d* to be described later is connected to the other outflow port of the third three-way joint 12*c*.

The first check valve 16*a* allows the refrigerant to flow from the third three-way joint 12*c* side toward the four-way joint 17 side, and prevents the refrigerant from flowing from the four-way joint 17 side toward the third three-way joint 12*c* side. The four-way joint 17 is a joint portion that has four inflow and outflow ports communicating with each other. As the four-way joint 17, a joint portion formed in the same manner as the above-described three-way joint can be adopted. The four-way joint 17 formed by combining two three-way joints may be adopted.

An outlet side of the second passage 21*c* is connected to another inflow port of the four-way joint 17. The second passage 21*c* is a refrigerant passage that guides the refrigerant flowing out from the refrigerant passage 131 of the water refrigerant heat exchanger 13 to the inlet side of the air cooling expansion valve 14*b* or the cooling expansion valve 14*c* by bypassing the heating expansion valve 14*a* and the exterior heat exchanger 15.

A second passage opening/closing valve 22*a* that opens and closes the second passage 21*c* is disposed in the second passage 21*c*. The second passage opening/closing valve 22*a* is an electromagnetic valve of which opening/closing operation is controlled by a control voltage output from the controller 60. The second passage opening/closing valve 22*a* is a refrigerant circuit switching portion that switches the refrigerant circuit.

At least the second passage opening/closing valve 22*a* among the refrigerant circuit switching portions of the refrigeration cycle device 10 is a branch circuit switching portion. The branch circuit switching portion performs switching between a refrigerant circuit that causes the refrigerant to flow out from one outflow port of the second three-way joint 12*b* and a refrigerant circuit that causes the refrigerant to flow out from the other outflow port of the second three-way joint 12*b*.

A refrigerant inlet side of an interior evaporator 18 is connected to one outflow port of the four-way joint 17 via the air cooling expansion valve 14*b*. The air cooling expansion valve 14*b* is a second decompression portion that decompresses the other refrigerant branched at the second three-way joint 12*b* in a parallel dehumidifying hot-gas heating mode to be described. The air cooling expansion valve 14*b* is an interior evaporator flow rate adjustment portion that adjusts a flow rate (mass flow rate) of the refrigerant flowing into the interior evaporator 18.

The interior evaporator 18 is an auxiliary evaporating portion that exchanges heat between a low-pressure refrigerant decompressed by the air cooling expansion valve 14*b* and the air ventilated from the interior ventilator 52 toward the vehicle interior to evaporate the low-pressure refrigerant. The interior evaporator 18 is disposed in a casing 51 of an interior air-conditioning unit 50 to be described later. One inflow port side of the fifth three-way joint 12*e* is connected to a refrigerant outlet of the interior evaporator 18 via an evaporating pressure adjustment valve 20 and a second check valve 16*b*.

The evaporating pressure adjustment valve 20 is a variable throttle configured by a mechanical mechanism that increases a valve opening degree as the pressure of the refrigerant on the refrigerant outlet side of the interior evaporator 18 increases. The evaporating pressure adjustment valve 20 maintains the refrigerant evaporating temperature in the interior evaporator 18 to be equal to or higher than a frosting suppression temperature (in the present embodiment, 1° C.) at which the frosting in the interior evaporator 18 can be suppressed.

The second check valve 16*b* allows the refrigerant to flow from the outlet side of the evaporating pressure adjustment valve 20 toward the fifth three-way joint 12*e* side, and prevents the refrigerant from flowing from the fifth three-way joint 12*e* side toward the evaporating pressure adjustment valve 20 side.

An inlet side of the refrigerant passage of a chiller 19 is connected to another outflow port of the four-way joint 17 via the cooling expansion valve 14*c*. The cooling expansion valve 14*c* is a decompression portion that decompresses the refrigerant flowing into the chiller 19 in a hot-gas heating mode to be described later, in a device cooling mode for cooling the battery 70, and the like. The cooling expansion valve 14*c* is a chiller flow rate adjustment portion that adjusts the flow rate (mass flow rate) of the refrigerant flowing into the chiller 19.

The chiller 19 is an auxiliary evaporating portion that exchanges heat between the low-pressure refrigerant decompressed by the cooling expansion valve 14*c* and a device coolant circulating in a device coolant circuit 40 to evaporate the low-pressure refrigerant. The other inflow port side of the fifth three-way joint 12*e* is connected to the refrigerant outlet of the chiller 19 via a forth three-joint 12*d*. A decompression-portion side refrigerant inlet portion 233*b* side of a mixing portion 23 is connected to an outflow port of the fifth three-way joint 12*e*.

An outlet side of the low-pressure passage 21*d* is connected to the other inflow port of the forth three-joint 12*d*. The low-pressure passage 21*d* is a refrigerant passage that guides the refrigerant flowing out from the exterior heat exchanger 15 to the decompression-portion side refrigerant inlet portion 233*b* side of the mixing portion 23 by bypassing the air cooling expansion valve 14*b* and the interior evaporator 18, and the cooling expansion valve 14*c* and the chiller 19.

A low-pressure passage opening/closing valve 22*b* that opens and closes the low-pressure passage 21*d* is disposed in the low-pressure passage 21*d*. The low-pressure passage opening/closing valve 22*b* is an electromagnetic valve having the same configuration as that of the second passage opening/closing valve 22*a*. The low-pressure passage opening/closing valve 22*b* is a refrigerant circuit switching portion that switches the refrigerant circuit.

The mixing portion 23 mixes the bypass side refrigerant flowing out from the bypass flow adjustment valve 14*d* with the decompression-portion side refrigerant flowing out from the outflow port of the fifth three-way joint 12*e*, and causes the refrigerant to flow out to the suction port side of the compressor 11. The decompression-portion side refrigerant is a refrigerant flowing out from the decompression portion such as the heating expansion valve 14*a*, the air cooling expansion valve 14*b*, and the cooling expansion valve 14*c*.

The mixing portion 23 is disposed in the drive device room. An outlet side of the bypass passage 21*a* is connected to a bypass side refrigerant inlet portion 233*a* of the mixing portion 23.

The bypass passage 21*a* is a refrigerant passage that guides the other refrigerant branched at the first three-way joint 12*a* to the bypass side refrigerant inlet portion 233*a* of the mixing portion 23. More specifically, the bypass passage 21*a* is a refrigerant passage that guides the other refrigerant branched at the first three-way joint 12*a* to the suction port side of the compressor 11 through the mixing portion 23 by bypassing the water refrigerant heat exchanger 13.

The bypass flow adjustment valve 14*d* is disposed in the bypass passage 21*a*. The bypass flow adjustment valve 14*d* is a bypass flow adjustment portion that decompresses the refrigerant flowing through the bypass passage 21*a* and adjusts the flow rate (mass flow rate) of the refrigerant flowing through the bypass passage 21*a*.

Next, a detailed configuration of the mixing portion 23 will be described with reference to FIGS. 2 to 5. The mixing portion 23 of the present embodiment is a heat exchanger that exchanges heat between the bypass side refrigerant and the decompression-portion side refrigerant and then causes the bypass side refrigerant and the decompression-portion side refrigerant to be merged and flow out. In the present embodiment, a so-called stacked heat exchanger is adopted as the mixing portion 23.

Specifically, the mixing portion 23 includes a plurality of first heat transfer plates 231*a*, a plurality of second heat transfer plates 231*b*, a heat exchange fin 232, the bypass side refrigerant inlet portion 233*a*, the decompression-portion side refrigerant inlet portion 233*b*, a mixed refrigerant outflow portion 233*c*. These constituent members are formed of the same kind of metal (in the present embodiment, an aluminum alloy) having excellent heat conductivity. Each of the constituent members is integrated by brazing.

Each of the first heat transfer plates 231*a* and each of the second heat transfer plates 231*b* is a plate-like member formed in a rectangular shape. A plurality of the first heat transfer plates 231*a* and a plurality of the second heat transfer plates 231*b* are alternately stacked such that flat surfaces thereof are parallel to each other. A plurality of protruding portions protruding in a stacking direction are formed on the outer peripheral edge portion and the flat surface of each of the first heat transfer plate 231*a* and the second heat transfer plate 231*b*.

Each of the protruding portion is joined to the first heat transfer plate 231*a* or the second heat transfer plate 231*b*, which is disposed adjacent to each other. Therefore, a gap space is formed in a portion where the protruding portion between the first heat transfer plate 231*a* and the second heat transfer plate 231*b*, which are adjacent to each other, is not formed. The gap space serves as a bypass side refrigerant passage 23*a* through which the bypass refrigerant flows or a decompression-portion side refrigerant passage 23*b* through which the decompression-portion side refrigerant flows.

The protruding portion of the first heat transfer plate 231*a* and the protruding portion of the second heat transfer plate 231*b* are formed in different shapes. Therefore, by alternately stacking and joining the first heat transfer plates 231*a* and the second heat transfer plates 231*b*, the decompression-portion side refrigerant passage 23*b* and the bypass side refrigerant passage 23*a* are alternately formed in the stacking direction.

Therefore, the first heat transfer plate 231*a* and the second heat transfer plate 231*b* serve as a plurality of heat exchange members that exchange heat between the bypass side refrigerant and the decompression-portion side refrigerant by bringing the one surface into contact with the decompression-portion side refrigerant and bringing the other surface into contact with the bypass side refrigerant.

Figure 4:
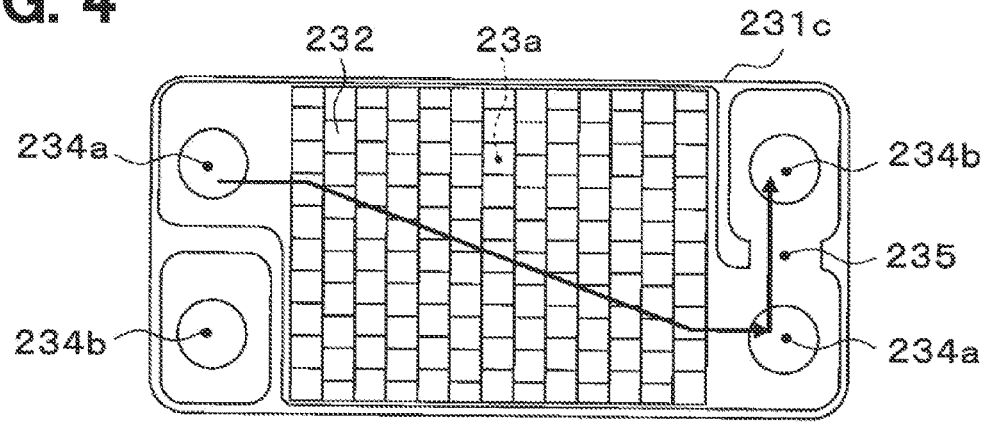
FIG. 4 is a cross-sectional view taken along line IV-IV of FIG. 2.
Figure 5:
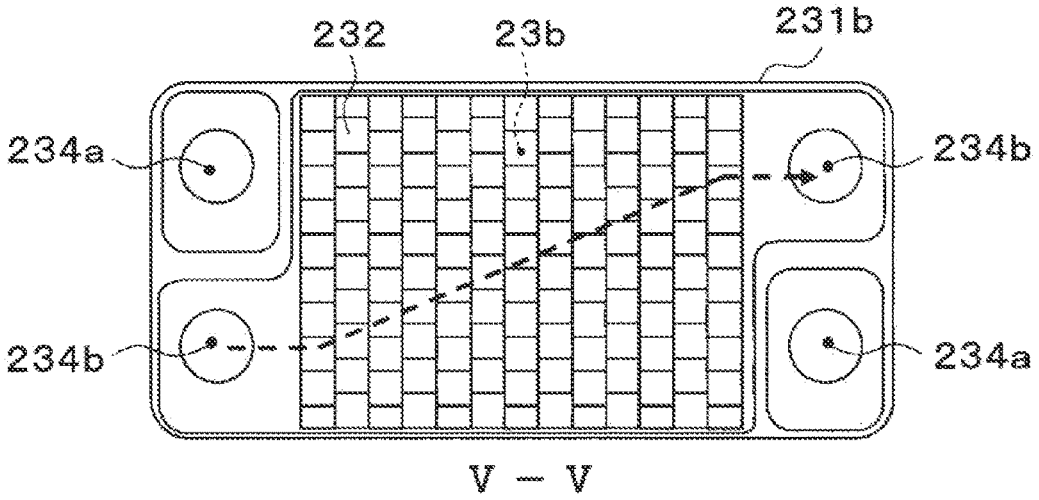
FIG. 5 is a cross-sectional view taken along line V-V of FIG. 2.

As illustrated in FIGS. 4 and 5, the heat exchange fin 232, which promotes heat exchange between the bypass side refrigerant and a heat absorption side heat medium by increasing a heat transfer area or a wetting area, is disposed in the decompression-portion side refrigerant passage 23*b* and the bypass side refrigerant passage 23*a*. As the heat exchange fin 232, a corrugated fin formed by folding a metal thin plate in a wavelike shape or an offset fin on which a plurality of raised portions are partially formed on the metal thin plate can be adopt.

In a corner portion located at a diagonal corner of the rectangular first heat transfer plate 231*a* and the rectangular second heat transfer plate 231*b*, a pair of bypass side tank forming portions and a pair of heat absorption side tank forming portions are formed by the protruding portion. According to this, when a plurality of the first heat transfer plates 231*a* and a plurality of the second heat transfer plates 231*b* are stacked, a pair of bypass side tank spaces 234*a* and a pair of heat absorption side tank spaces 234*b* are formed.

Each of the bypass side tank space 234*a* is a space that communicates with a plurality of the bypass side refrigerant passages 23*a* to collect or distribute the refrigerant. Each of the heat absorption side tank spaces 234*b* is a space that communicates with a plurality of the decompression-portion side refrigerant passages 23*b* to collect or distribute the refrigerant.

Figure 3:
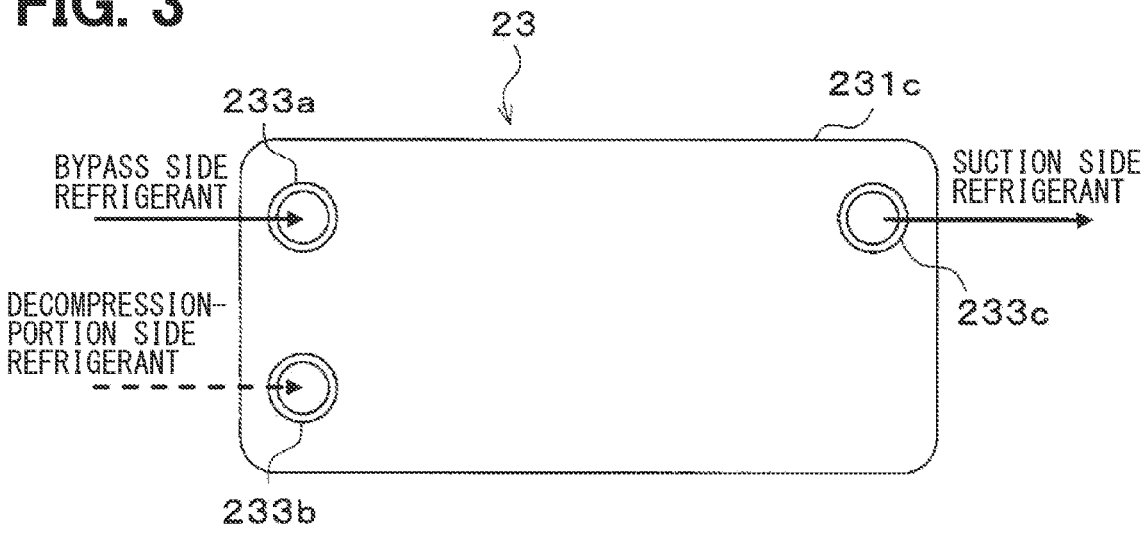
FIG. 3 is a top view of a mixing portion of the first embodiment.

As illustrated in FIG. 3, the tubular bypass side refrigerant inlet portion 233*a*, the tubular decompression-portion side refrigerant inlet portion 233*b*, and the tubular mixed refrigerant outflow portion 233*c* are joined to an end portion heat transfer plate 231*c* disposed at one end in the stacking direction. The bypass side refrigerant inlet portion 233*a* is joined to communicate with one bypass side tank space 234*a*. The decompression-portion side refrigerant inlet portion 233*b* is joined to communicate with one heat absorption side tank space 234*b*.

The mixed refrigerant outflow portion 233*c* is disposed coaxially with the other heat absorption side tank space 234*b*. As illustrated in FIG. 4, in the first heat transfer plate 231*a* adjacent to the end portion heat transfer plate 231*c*, a communication passage 235, which causes the other bypass side tank space 234*a* to communicate with the other heat absorption side tank space 234*b*, is formed. Therefore, the mixed refrigerant outflow portion 233*c* communicates with both of the other bypass side tank space 234*a* and the other heat absorption side tank space 234*b*.

Figure 2:
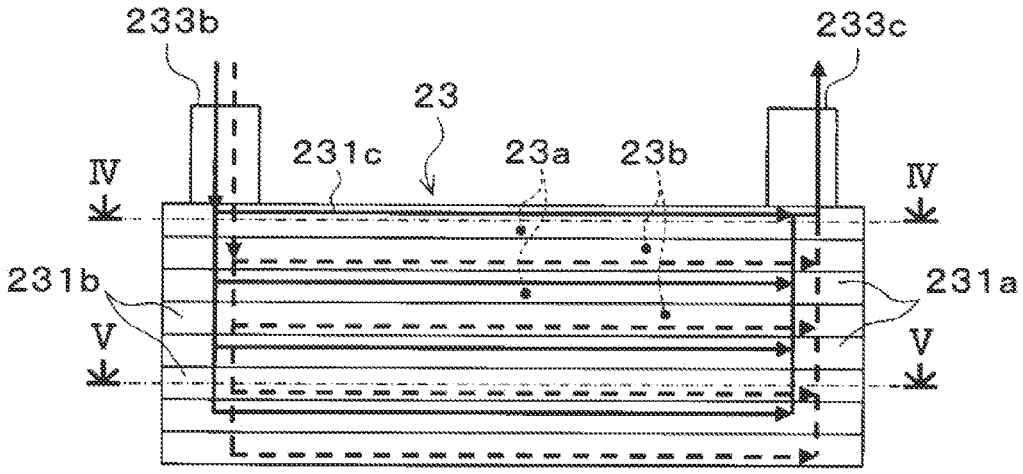
FIG. 2 is a front view of a mixing portion of the first embodiment.

Therefore, the bypass side refrigerant flowing in from the bypass side refrigerant inlet portion 233*a* flows as indicated by solid arrows in FIG. 2 and the like, is merged with the decompression-portion side refrigerant, and flows out from the mixed refrigerant outflow portion 233*c*. The decompression-portion side refrigerant flowing in from the decompression-portion side refrigerant inlet portion 233*b* flows as indicated by broken line arrows in FIG. 2 and the like, is merged with the bypass side refrigerant, and flows out from the mixed refrigerant outflow portion 233*c*. A suction port side of the compressor 11 is connected to the mixed refrigerant outflow portion 233*c*.

The refrigerant obtained by homogeneously mixing the bypass side refrigerant and the decompression-portion side refrigerant is defined as an ideal mixed refrigerant. In the present embodiment, as the mixing portion 23, one having a heat exchange capacity to the extent that the enthalpy of the suction side refrigerant actually flowing out from the mixed refrigerant outflow portion 233*c* to the suction port side of the compressor 11 is substantially equal to the enthalpy of the ideal mixed refrigerant in the hot-gas heating mode to be described later is adopted.

In other words, in the present embodiment, as the mixing portion 23, one having a heat exchange capacity in which an absolute value of the enthalpy difference obtained by subtracting the enthalpy of the ideal mixed refrigerant from the enthalpy of the suction side refrigerant is equal to or less than a predetermined reference value in the hot-gas heating mode is adopted. As the reference value, a value that does not adversely affect the durable life of the compressor 11 due to the variation in an enthalpy difference is set.

Next, the heating-coolant circuit 30 will be described. The heating-coolant circuit 30 is a high temperature side heat medium circuit that circulates the heating-coolant. In the heating-coolant circuit 30, an ethylene glycol aqueous solution is adopted as the heating-coolant. As illustrated in FIG. 1, a water passage 132 of the water refrigerant heat exchanger 13, a heating-coolant pump 31, a heater core 32, and the like are connected to the heating-coolant circuit 30.

The heating-coolant pump 31 is a water pump that pumps the heating-coolant to an inlet side of the water passage 132 of the water refrigerant heat exchanger 13. The heating-coolant pump 31 is an electric pump of which the number of rotations (that is, a pumping capacity) is controlled by the control voltage output from the controller 60.

A coolant inlet side of the heater core 32 is connected to an outlet of the water passage 132 of the water refrigerant heat exchanger 13. The heater core 32 is a heating heat exchange portion that exchanges heat between the heating-coolant heated by the water refrigerant heat exchanger 13 and the air having passed through the interior evaporator 18 to heat the air. The heater core 32 is disposed in the casing 51 of the interior air-conditioning unit 50.

A suction port side of the heating-coolant pump 31 is connected to a coolant outlet of the heater core 32. Therefore, in the present embodiment, the water refrigerant heat exchanger 13 of the refrigeration cycle device 10 and each component of the heating-coolant circuit 30 constitutes a heating portion that heats the air by using the refrigerant discharged from the compressor 11 as a heat source.

Accordingly, the receiver portion 13*b* of the water refrigerant heat exchanger 13 is a high-pressure side gas-liquid separator that separates the refrigerant flowing out from the condensing portion 13*a* forming the heating portion into gas and liquid, and stores the separated liquid-phase refrigerant as a surplus refrigerant of the cycle. The second three-way joint 12*b* of the refrigeration cycle device 10 is a downstream branch portion that branches the flow of the refrigerant flowing out from the heating portion.

Next, the device coolant circuit 40 will be described. The device coolant circuit 40 is a low-temperature side heat medium circuit that circulates the device coolant. As the device coolant, the same kind of fluid as the heating-coolant can be adopted. As illustrated in FIG. 1, a water passage of the chiller 19, a device coolant pump 41, and a coolant passage 70*a* of the battery 70, and the like are connected to the device coolant circuit 40.

The device coolant pump 41 is a water pump that pumps the device coolant to an inlet side of the water passage of the chiller 19. The device coolant pump 41 has the same basic structure as that of the heating-coolant pump 31. An inlet side of the coolant passage 70*a* of the battery 70 is connected to an outlet of the water passage of the chiller 19.

The battery 70 stores power supplied to a plurality of electric in-vehicle devices. The battery 70 is an assembled battery formed by electrically connecting a plurality of battery cells in series or in parallel. The battery cell is a chargeable/dischargeable secondary battery (in the present embodiment, a lithium ion battery). The battery 70 is formed by stacking a plurality of the battery cells in a substantially rectangular parallelepiped shape and is accommodated in a dedicated case.

The battery 70 is a heat generating device that generates heat during operation (that is, at the time of charging and discharging). The secondary battery forming the battery 70 is likely to deteriorate at a high temperature. In the secondary battery, a chemical reaction is less likely to occur at a low temperature and the output of the secondary battery is likely to decrease. Therefore, it is desirable that the temperature of the secondary battery is maintained within an appropriate temperature range (in the present embodiment, the temperature is 15° C. or higher and 55° C. or lower) in which a charge/discharge capacity of the secondary battery can be sufficiently utilized.

Therefore, in the present embodiment, the coolant passage 70*a* through which the device coolant flows is formed in the dedicated case of the battery 70. The passage configuration of the coolant passage 70*a* is a passage configuration in which a plurality of passages are connected in parallel in the dedicated case. According to this, the coolant passage 70*a* is formed so as to evenly exchange heat between the device coolant circulating inside and all the battery cells. A suction port side of the device coolant pump 41 is connected to an outlet of the coolant passage 70*a*.

Accordingly, the device coolant is a heat exchange target fluid. The coolant passage 70*a* is a heat exchange portion for a heat generating device, which exchanges heat between the battery 70 and the device coolant and between the battery 70 and the heat exchange target fluid.

Figure 6:
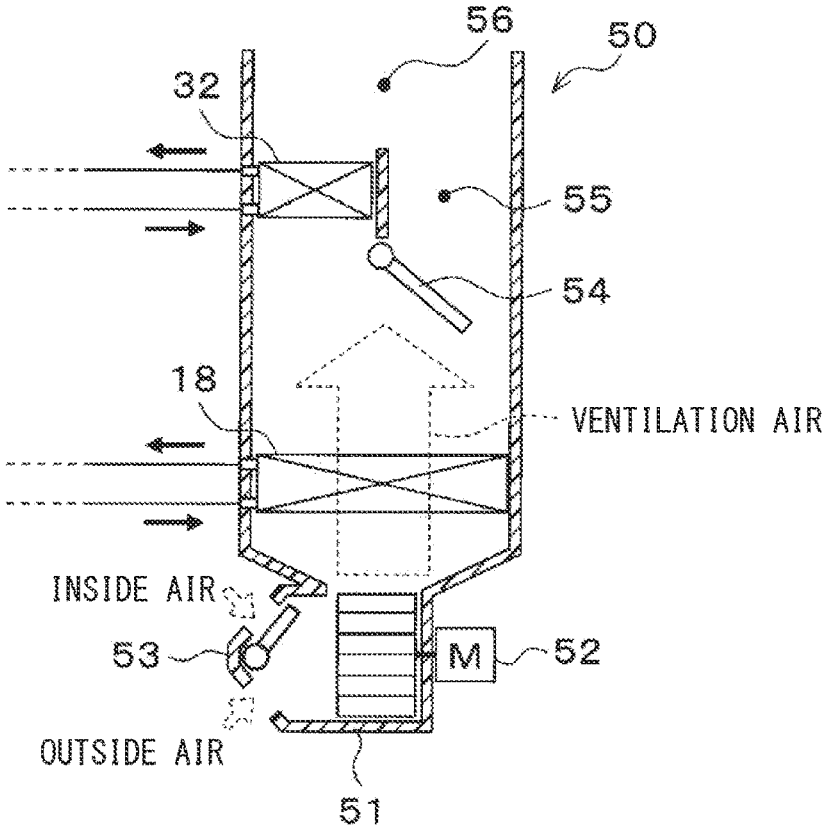
FIG. 6 is a schematic overall configuration diagram of an interior air-conditioning unit according to the first embodiment.

Next, the interior air-conditioning unit 50 will be described with reference to FIG. 6. The interior air-conditioning unit 50 is a unit for blowing the air adjusted at a temperature appropriate for air conditioning of the vehicle interior to an appropriate location in the vehicle interior. The interior air-conditioning unit 50 is disposed inside an instrument panel at the forefront portion of the vehicle interior.

In the interior air-conditioning unit 50, the interior ventilator 52, the interior evaporator 18 of the refrigeration cycle device 10, the heater core 32 of the heating-coolant circuit 30, and the like are accommodated in the casing 51 forming an air passage of the air. The casing 51 is formed of a resin (for example, polypropylene) having a certain degree of elasticity and excellent strength.

An inside/outside air switching device 53 is disposed on the most upstream side of the casing 51 in a air flow direction. The inside/outside air switching device 53 performs switching between inside air (air inside the vehicle interior) and outside air (air outside the vehicle interior) and introduces the switched air into the casing 51. Operation of the inside/outside air switching device 53 is controlled by the control signal output from the controller 60.

The interior ventilator 52 is disposed on the downstream side of the inside/outside air switching device 53 in the air flow direction. The interior ventilator 52 ventilates air sucked through the inside/outside air switching device 53 toward the vehicle interior. The interior ventilator 52 is an electric ventilator of which the number of rotations (that is, a ventilating capacity) is controlled by the control voltage output from the controller 60.

The interior evaporator 18 and the heater core 32 are disposed in this order with respect to the flow of the air on the downstream side of the interior ventilator 52 in the air flow direction. That is, the interior evaporator 18 is disposed on the upstream side of the air flow from the heater core 32. In the casing 51, a cold air bypass passage 55, through which the air after passing through the interior evaporator 18 flows downstream by bypassing the heater core 32, is formed.

An air mix door 54 is disposed on the downstream side of the interior evaporator 18 in the air flow direction and on the upstream side of the heater core 32 in the air flow direction. The air mix door 54 is an air volume ratio adjustment portion that adjusts an air volume ratio between an air volume passing through the heater core 32 and an air volume passing through the cold air bypass passage 55 in the air after passing through the interior evaporator 18. Operation of an air mix door driving electric actuator is controlled by the control signal output from the controller 60.

A mixing space 56 is provided on the downstream side of the heater core 32 and the cold air bypass passage 55 in the air flow direction. The mixing space 56 is a space for mixing the air heated by the heater core 32 and the air passing through the cold air bypass passage 55 and not heated. A plurality of opening holes (not illustrated) for blowing the air mixed and temperature-adjusted in the mixing space 56 into the vehicle interior are disposed on the most downstream side of the casing 51 in the air flow direction.

A plurality of the opening holes communicate with a plurality of blow-out ports formed in the vehicle interior. As a plurality of the blow-out ports, a face blow-out port, a foot blow-out port, and a defroster blow-out port are provided. The face blow-out port is a blow-out port that blows out the air toward an upper body of an occupant. The foot blow-out port is a blow-out port that blows out the air toward a foot of the occupant. The defroster blow-out port is a blow-out port that blows out the air toward a windshield of the vehicle.

Accordingly, the temperature of conditioned air mixed in the mixing space 56 is adjusted by the air mix door 54 adjusting the air volume ratio between the air volume passing through the heater core 32 and the air volume passing through the cold air bypass passage 55. As a result, the temperature of the air blown into the vehicle interior from each of the blow-out ports is adjusted.

Next, the electric control unit according to the present embodiment will be described. The controller 60 includes a known microcomputer including a CPU, a ROM, a RAM, and the like, and peripheral circuits thereof. The controller 60 performs various calculations and processing based on a control program stored in the ROM. The controller 60 controls the operations of the various control target devices 11, 14*a* to 14*d*, 22*b*, 22*c*, 31, 41, 52, 53, and the like connected to the output side based on the calculation and processing results.

Figure 7:
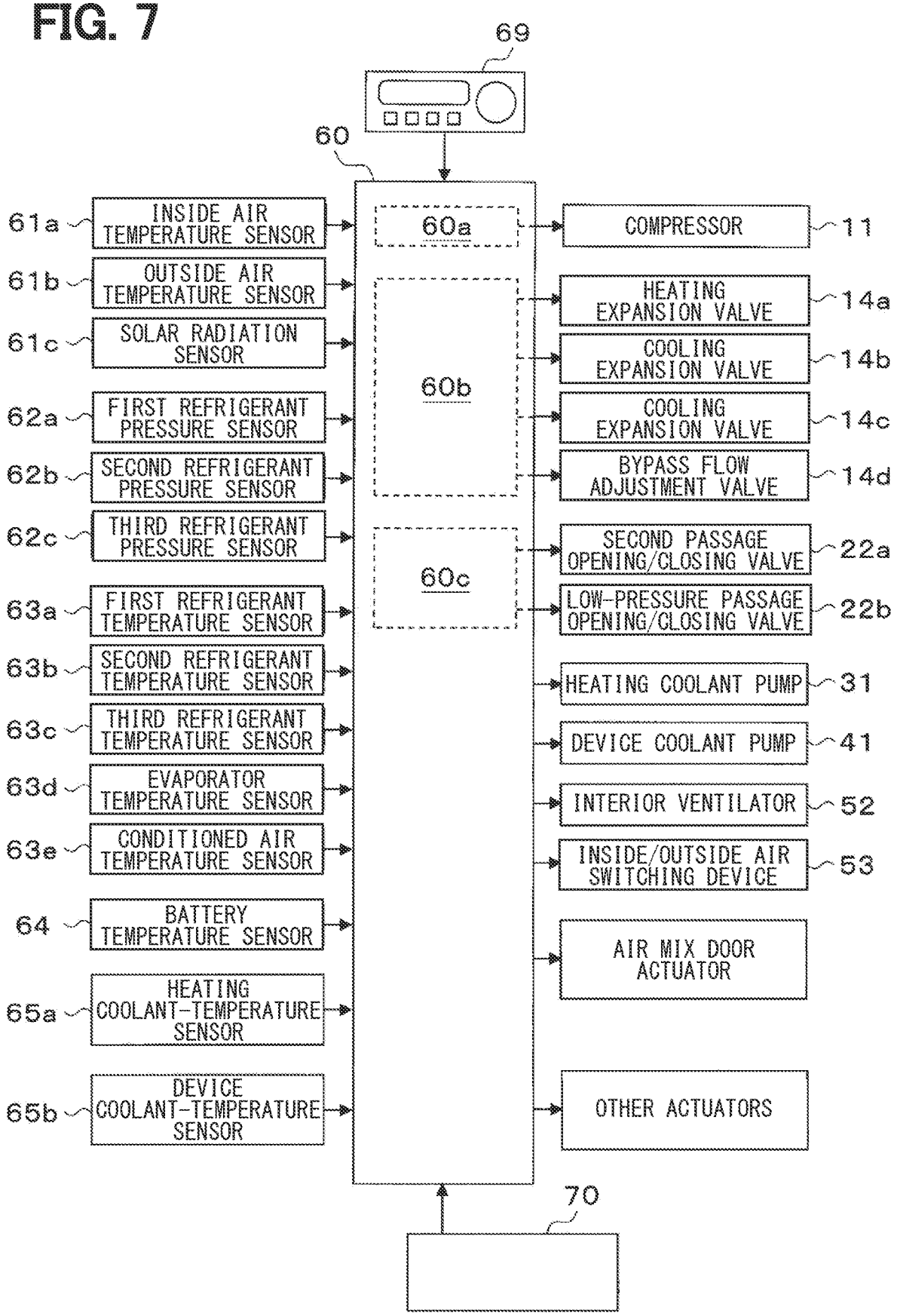
FIG. 7 is a block diagram illustrating an electric control unit of the refrigeration cycle device according to the first embodiment.

As illustrated in the block diagram of FIG. 7, various control sensors are connected to the input side of the controller 60. Specifically, an inside air temperature sensor 61*a*, an outside air temperature sensor 61*b*, a solar radiation sensor 61*c*, a first refrigerant pressure sensor 62*a*, a second refrigerant pressure sensor 62*b*, a third refrigerant pressure sensor 62*c*, a first refrigerant temperature sensor 63*a*, a second refrigerant temperature sensor 63*b*, a third refrigerant temperature sensor 63*c*, an evaporator temperature sensor 63*d*, a conditioned air temperature sensor 63*e*, a battery temperature sensor 64, a heating coolant-temperature sensor 65*a*, a device coolant-temperature sensor 65*b*, and the like are connected. Detection signals of these control sensor groups are input to the controller 60.

The inside air temperature sensor 61*a* is an inside air temperature detector that detects a vehicle interior temperature (inside air temperature) Tr. The outside air temperature sensor 61*b* is an outside air temperature detector that detects a vehicle exterior temperature (outside air temperature) Tam. The solar radiation sensor 61*c* is a solar radiation amount detector that detects a solar radiation amount As with which the solar radiation is performed to the vehicle interior.

The first refrigerant pressure sensor 62*a* is a high-pressure detector that detects a first pressure P1 that is a pressure of the high-pressure refrigerant discharged from the compressor 11. The second refrigerant pressure sensor 62*b* is an outdoor unit pressure detector that detects a second pressure P2 that is a pressure of the refrigerant on the outlet side of the exterior heat exchanger 15. The third refrigerant pressure sensor 62*c* is a mixer pressure detector that detects a third pressure P3 that is a pressure of the refrigerant on the outlet side of the mixing portion 23.

The first refrigerant temperature sensor 63*a* is a high-pressure temperature detector that detects a first temperature T1 that is a temperature of the refrigerant discharged from the compressor 11 and flowing into the refrigerant passage 131 of the water refrigerant heat exchanger 13. The second refrigerant temperature sensor 63*b* is an outdoor unit temperature detector that detects a second temperature T2 that is a temperature of the refrigerant on the outlet side of the exterior heat exchanger 15. The third refrigerant temperature sensor 63*c* is a mixer temperature detector that detects a third temperature T3 that is a temperature of the refrigerant on the outlet side of the mixing portion 23.

The evaporator temperature sensor 63*d* is an evaporator temperature detector that detects a refrigerant evaporating temperature (evaporator temperature) Tefin in the interior evaporator 18. Specifically, the evaporator temperature sensor 63*d* detects the temperature of the heat exchange fin of the interior evaporator 18. The conditioned air temperature sensor 63*e* is a conditioned air temperature detector that detects a air temperature TAV blown into the vehicle interior from the mixing space.

The battery temperature sensor 64 is a battery temperature detector that detects a battery temperature TB that is a temperature of the battery 70. The battery temperature sensor 64 includes a plurality of temperature detectors, and detects temperatures of a plurality of locations of the battery 70. Therefore, the controller 60 can also detect a temperature distribution of each part of the battery 70. As the battery temperature TB, an average value of detection values of a plurality of the temperature sensors is used.

The heating coolant-temperature sensor 65*a* is a heating-coolant temperature detector that detects a heating-coolant temperature TWH that is a temperature of the heating-coolant flowing into the heater core 32. The device coolant-temperature sensor 65*b* is a device coolant temperature detector that detects a device coolant temperature TWL that is a temperature of the device coolant flowing into the coolant passage 70*a* of the battery 70.

As illustrated in FIG. 7, an operation panel 69 disposed in the vicinity of the instrument panel in the front portion of the vehicle interior is connected to the input side of the controller 60. Operation signals from various operation switches provided on the operation panel 69 are input to the controller 60.

Specific examples of the various operation switches provided on the operation panel 69 include an auto switch, an air conditioner switch, an air volume setting switch, and a temperature setting switch.

The auto switch is an operation switch that sets or cancels automatic control operation of the vehicle air conditioner. The air conditioner switch is an operation switch that requests the interior evaporator 18 to cool the air. The air volume setting switch is an operation switch that manually sets the air volume of the interior ventilator 52. The temperature setting switch is an operation switch that sets a set temperature Tset in the vehicle interior.

The controller 60 of the present embodiment is integrally configured with control units that control various control target devices connected to an output side thereof. Accordingly, configurations (hardware and software) that control the operation of each control target device constitute each of the control units that control the operation of each control target device.

For example, in the controller 60, configurations that control the refrigerant discharge capacity of the compressor 11 (specifically, the number of rotations of the compressor 11) constitute a discharge capacity control unit 60*a*. Configurations that control operations of the heating expansion valve 14*a*, the air cooling expansion valve 14*b*, the cooling expansion valve 14*c*, and the bypass flow adjustment valve 14*d* constitute a refrigerant flow rate control unit 60*b*. Configurations that control operations of the second passage opening/closing valve 22*a*, the low-pressure passage opening/closing valve 22*b*, and the like, which are the refrigerant circuit switching portions, constitute a refrigerant circuit control unit 60*c*.

Next, operation of the vehicle air conditioner of the present embodiment having the above configuration will be described. In the vehicle air conditioner of the present embodiment, various operation modes are switched in order to perform air conditioning of the vehicle interior and temperature adjustment of the battery 70.

Specifically, the vehicle air conditioner switches, as an air conditioning operation mode, (a) air cooling mode, (b) series dehumidifying and heating mode, (c) parallel dehumidifying and heating mode, (d) parallel dehumidifying hot-gas heating mode, (e) outside air heat-absorption heating mode, (f) outside air heat-absorption hot-gas heating mode, and (g) hot-gas heating mode. The vehicle air conditioner performs the operation in the device cooling mode in which the battery 70 is cooled as necessary in the operation modes (a) to (f).

Switching between the various operation modes is performed by executing an air conditioning control program stored in advance in the controller 60. The air conditioning control program is executed when the auto switch of the operation panel 69 is turned on (ON).

In the air conditioning control program, the operation mode is switched based on detection signals of various control sensors and an operation signal of the operation panel. More specifically, in the air conditioning control program of the present embodiment, the air conditioning operation mode is switched mainly based on the outside air temperature Tam detected by the outside air temperature sensor 61*b*. Hereinafter, the operation of each operation mode will be described in detail.

(a) Air Cooling Mode

The air cooling mode is an operation mode in which cooled air is blown into the vehicle interior in order to cool the vehicle interior. The air cooling mode is an operation mode that is switched when the air conditioner switch is turned on by the operation of the occupant, or when the outside air temperature Tam detected by the outside air temperature sensor 61*b* is 25° C. or higher.

In the air cooling mode, the controller 60 closes the second passage opening/closing valve 22*a* and closes the low-pressure passage opening/closing valve 22*b*. The controller 60 makes the heating expansion valve 14*a* in a fully opened state, the air cooling expansion valve 14*b* in a throttled state that exhibits a refrigerant decompression effect, and the bypass flow adjustment valve 14*d* in a fully closed state.

Figure 8:
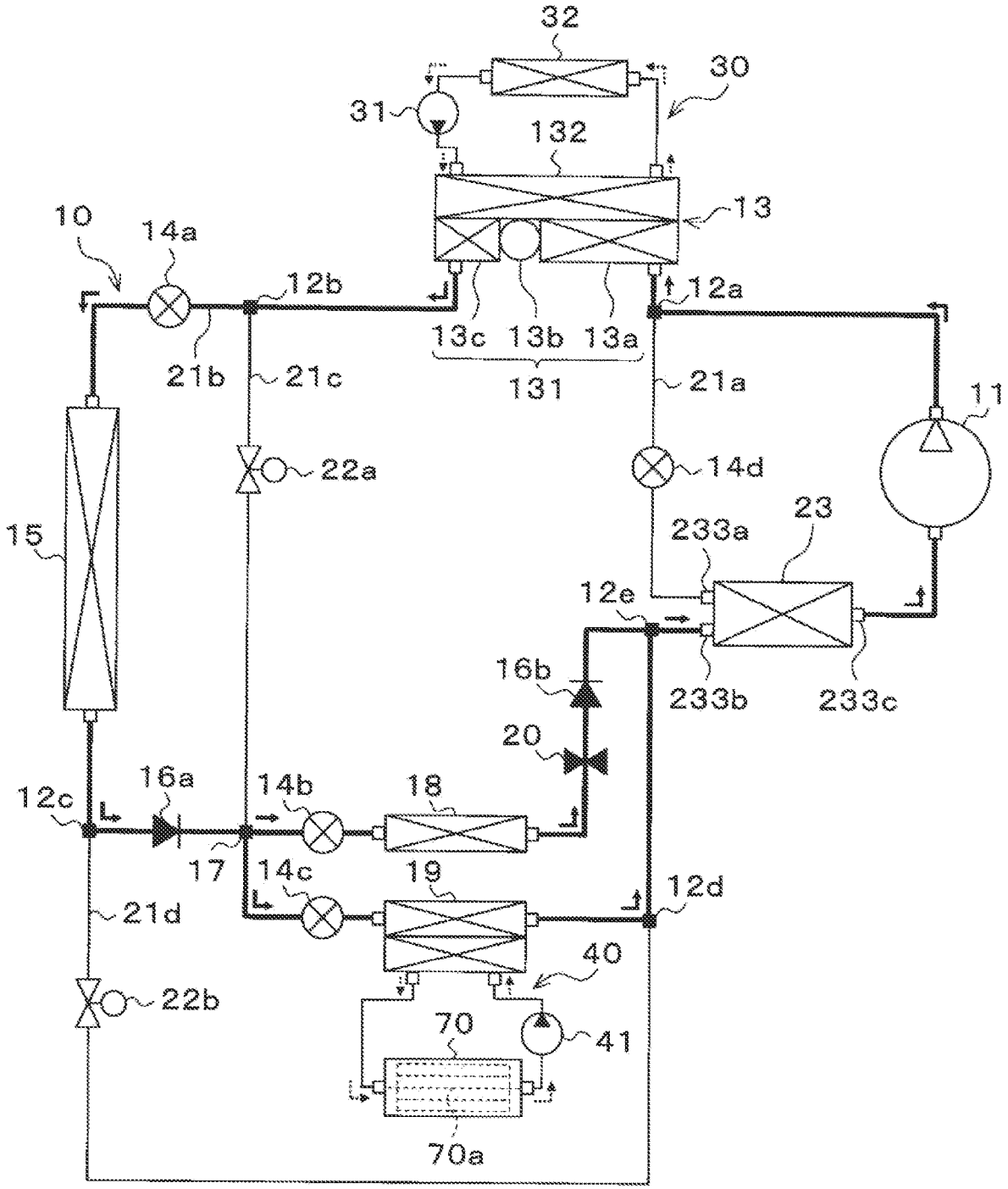
FIG. 8 is a schematic overall configuration diagram illustrating a refrigerant flow in an air cooling mode and a series dehumidifying and heating mode of a refrigeration cycle device according to the first embodiment.

Therefore, in the refrigeration cycle device 10 in the air cooling mode, as indicated by solid arrows in FIG. 8, the refrigerant discharged from the compressor 11 circulates through the water refrigerant heat exchanger 13, the heating expansion valve 14*a* that is fully opened, the exterior heat exchanger 15, the first check valve 16*a*, the four-way joint 17, the air cooling expansion valve 14*b*, the interior evaporator 18, the evaporating pressure adjustment valve 20, the second check valve 16*b*, the mixing portion 23, and the suction port of the compressor 11 in this order. In FIG. 8, the flow of the refrigerant in the air cooling mode during execution of the device cooling mode is indicated by solid arrows.

The controller 60 appropriately controls the operation of other control target devices. For example, the refrigerant discharge capacity of the compressor 11 is controlled such that the evaporator temperature Tefin detected by the evaporator temperature sensor 63*d* approaches a target evaporator temperature TEO.

The target evaporator temperature TEO is determined based on a target blown air temperature TAO with reference to a control map stored in advance in the controller 60.

The target blown air temperature TAO is a target temperature of the air blown into the vehicle interior. The target blown air temperature TAO is calculated using the inside air temperature Tr detected by the inside air temperature sensor 61*a*, the outside air temperature Tam, the solar radiation amount As detected by the solar radiation sensor 61*c*, the set temperature Tset set by the temperature setting switch. In the control map, the target evaporator temperature TEO is determined to increase as the target blown air temperature TAO increases.

The controller 60 controls the throttle opening degree of the air cooling expansion valve 14*b* such that a superheat degree SH of the refrigerant on the outlet side of the mixing portion 23 approaches a predetermined reference superheat degree KSH (in the present embodiment, 5° C.). The superheat degree SH is calculated using the third pressure P3 detected by the third refrigerant pressure sensor 62*c* and the third temperature T3 detected by the third refrigerant temperature sensor 63*c*.

The controller 60 controls a water pumping capacity of each of the heating-coolant pump 31 and the device coolant pump 41 so as to exhibit a predetermined air cooling mode reference pumping capacity.

The controller 60 controls the ventilating capacity of the interior ventilator 52 based on the target blown air temperature TAO with reference to the control map stored in advance in the controller 60. In the control map, the ventilating capacity is determined such that a ventilation amount is maximized when the target blown air temperature TAO is in a cryogenic temperature range or an extremely high temperature range, and the ventilation amount gradually decreases from the cryogenic temperature range or the extremely high temperature range toward an intermediate temperature range.

The controller 60 causes the air mix door driving electric actuator to displace the air mix door 54 such that the air temperature TAV detected by the conditioned air temperature sensor 63*e* approaches the target blown air temperature TAO. In the air cooling mode, the air mix door 54 is displaced such that the cold air bypass passage 55 is substantially fully opened and the air passage on the heater core 32 side is fully closed.

Therefore, in the heater core 32 of the heating-coolant circuit 30 in the air cooling mode, the heating-coolant circulates as indicated by a thin broken line arrow in FIG. 8, but the heat exchange between the heating-coolant and the air is hardly performed. When the temperature of the heating-coolant becomes equal to the temperature of the high-pressure refrigerant discharged from compressor 11, the heat exchange between the high-pressure refrigerant and the heating-coolant is hardly performed also in the water refrigerant heat exchanger 13.

Accordingly, in the refrigeration cycle device 10 in the air cooling mode, a vapor compression refrigeration cycle is configured in which the exterior heat exchanger 15 functions as a condenser that condenses the refrigerant and the interior evaporator 18 functions as an evaporator that evaporates the refrigerant. In the exterior heat exchanger 15, the refrigerant radiates heat to the outside air and is condensed. In the interior evaporator 18, the refrigerant absorbs heat from the air and is evaporated. According to this, the air is cooled.

In the interior air-conditioning unit 50 in the air cooling mode, the air cooled by the interior evaporator 18 is blown into the vehicle interior via the cold air bypass passage 55. According to this, air cooling of the vehicle interior is realized.

In the refrigeration cycle device 10 in the air cooling mode, the bypass flow adjustment valve 14*d* is fully closed. Therefore, the bypass side refrigerant does not flow into the mixing portion 23. Accordingly, in the air cooling mode, the decompression-portion side refrigerant flowing into the mixing portion 23 flows out from the mixing portion 23 without exchanging heat with or being mixed with the bypass side refrigerant in the mixing portion 23.

The vehicle air conditioner of the present embodiment can execute the device cooling mode in which the battery 70 is cooled in the air cooling mode. The device cooling mode is executed when the battery temperature TB detected by the battery temperature sensor 64 becomes equal to or higher than a predetermined reference battery temperature KTB. When the device cooling mode is executed, the controller 60 not only controls the operation of the control target device in a similar manner to the air cooling mode, but also makes the cooling expansion valve 14*c* in the throttled state.

According to this, in the refrigeration cycle device 10 in the device cooling mode, as indicated by solid arrows in FIG. 8, the refrigerant branched at the four-way joint 17 flows through the cooling expansion valve 14*c*, the chiller 19, and the mixing portion 23 in this order. That is, in the air cooling mode during execution of the device cooling mode, the flow of the refrigerant flowing out from the exterior heat exchanger 15 is switched to the refrigerant circuit in which the interior evaporator 18 is connected to the chiller 19 in parallel.

The controller 60 controls the throttle opening degree of the cooling expansion valve 14*c* such that the device coolant temperature TWL detected by the device coolant-temperature sensor 65*b* approaches a predetermined target device water temperature TWLO. The target device water temperature TWLO is set such that the battery temperature TB is maintained within an appropriate temperature range of the battery 70.

Accordingly, in the refrigeration cycle device 10 in the air cooling mode during execution of the device cooling mode, the refrigerant flowing into the chiller 19 absorbs heat from the device coolant and is evaporated. According to this, the device coolant is cooled.

In the device coolant circuit 40 in the air cooling mode during execution of the device cooling mode, as indicated by the thin broken line arrow in FIG. 8, the device coolant cooled in the chiller 19 flows through the coolant passage 70*a* of the battery 70. According to this, the battery 70 is cooled.

As a result, in the air cooling mode during execution of the device cooling mode, the battery 70 can be cooled while cooling the vehicle interior. In a case where the device cooling mode is not executed in the air cooling mode, the controller 60 only needs to make the cooling expansion valve 14*c* in the fully closed state.

(b) Series Dehumidifying and Heating Mode

The series dehumidifying and heating mode is an operation mode in which cooled and dehumidified air is reheated and blown into the vehicle interior in order to dehumidify and heat the vehicle interior. The series dehumidifying and heating mode is an operation mode that is switched when the outside air temperature Tam is 10° C. or higher and lower than 25° C.

In the series dehumidifying and heating mode, the controller 60 closes the second passage opening/closing valve 22*a* and closes the low-pressure passage opening/closing valve 22*b*. The controller 60 makes the heating expansion valve 14*a* in a throttled state, the air cooling expansion valve 14*b* in the throttled state, and the bypass flow adjustment valve 14*d* in a fully closed state.

Therefore, in the refrigeration cycle device 10 in the series dehumidifying and heating mode, in the similar manner to the air cooling mode, as indicated by the solid arrows in FIG. 8, the refrigerant discharged from the compressor 11 circulates through the water refrigerant heat exchanger 13, the heating expansion valve 14*a*, the exterior heat exchanger 15, the first check valve 16*a*, the four-way joint 17, the air cooling expansion valve 14*b*, the interior evaporator 18, the evaporating pressure adjustment valve 20, the second check valve 16*b*, the mixing portion 23, and the suction port of the compressor 11 in this order.

The controller 60 appropriately controls the operation of other control target devices. For example, the compressor 11 is controlled in a similar manner to the air cooling mode.

The controller 60 controls the throttle opening degree of both of the heating expansion valve 14*a* and the air cooling expansion valve 14*b* such that the superheat degree SH of the refrigerant on the outlet side of the mixing portion 23 approaches the reference superheat degree KSH. More specifically, in the series dehumidifying and heating mode, the throttle opening degree of the heating expansion valve 14*a* is decreased and the throttle opening degree of the air cooling expansion valve 14*b* is increased as the target blown air temperature TAO increases.

The controller 60 controls the heating-coolant pump 31, the device coolant pump 41, the interior ventilator 52, and the air mix door driving electric actuator in the similar manner to the air cooling mode.

Accordingly, in the refrigeration cycle device 10 in the series dehumidifying and heating mode, the water refrigerant heat exchanger 13 functions as a condenser, and the interior evaporator 18 functions as an evaporator. In a case where the saturation temperature of the refrigerant in the exterior heat exchanger 15 is higher than the outside air temperature Tam, the vapor compression refrigeration cycle in which the exterior heat exchanger 15 functions as a condenser is configured. In a case where the saturation temperature of the refrigerant in the exterior heat exchanger 15 is lower than the outside air temperature Tam, the vapor compression refrigeration cycle in which the exterior heat exchanger 15 functions as an evaporator is configured.

In the water refrigerant heat exchanger 13, the refrigerant radiates heat to the heating-coolant and is condensed. According to this, the heating-coolant is heated. In the interior evaporator 18, the refrigerant absorbs heat from the air and is evaporated. According to this, the air is cooled.

In the heating-coolant circuit 30 in the series dehumidifying and heating mode, as indicated by the thin broken line arrow in FIG. 8, the heating-coolant heated by the water refrigerant heat exchanger 13 is pumped to the heater core 32. The heating-coolant flowing into the heater core 32 radiates heat to the air cooled by the interior evaporator 18.

In the interior air-conditioning unit 50 in the series dehumidifying and heating mode, the air cooled and dehumidified by the interior evaporator 18 is reheated by the heater core 32 and blown into the vehicle interior. According to this, dehumidifying and heating of the vehicle interior is realized.

In the refrigeration cycle device 10 in the series dehumidifying and heating mode, the throttle opening degree of the heating expansion valve 14*a* is decreased and the throttle opening degree of the air cooling expansion valve 14*b* is increased as the target blown air temperature TAO increases. According to this, the heating capacity of the air in the heater core 32 can be improved as the target blown air temperature TAO increases.

More specifically, when the saturation temperature of the refrigerant in the exterior heat exchanger 15 is higher than the outside air temperature Tam, the saturation temperature of the refrigerant in the exterior heat exchanger 15 can be decreased and a temperature difference between the target blown air temperature TAO and the outdoor air temperature Tam is reduced as the target blown air temperature TAO increases. According to this, a heat radiation amount of the refrigerant in the exterior heat exchanger 15 is decreased and a heat radiation amount from the refrigerant in the water refrigerant heat exchanger 13 to the heating-coolant is increased.

When the saturation temperature of the refrigerant in the exterior heat exchanger 15 is lower than the outside air temperature Tam, the saturation temperature of the refrigerant in the exterior heat exchanger 15 can be decreased and the temperature difference between the target blown air temperature TAO and the outdoor air temperature Tam is increased as the target blown air temperature TAO increases. According to this, a heat absorption amount of the refrigerant in the exterior heat exchanger 15 is increased and the heat radiation amount from the refrigerant in the water refrigerant heat exchanger 13 to the heating-coolant is increased.

As a result, in the refrigeration cycle device 10 in the series dehumidifying and heating mode, the heating capacity of the air in the heater core 32 can be improved as the target blown air temperature TAO increases.

In the refrigeration cycle device 10 in the series dehumidifying and heating mode, the bypass flow adjustment valve 14*d* is fully closed. Accordingly, in the similar manner to the air cooling mode, the decompression-portion side refrigerant flowing into the mixing portion 23 flows out from the mixing portion 23 without exchanging heat with or being mixed with the bypass side refrigerant in the mixing portion 23.

Also in the series dehumidifying and heating mode, the device cooling mode can be executed in a similar manner to the air cooling mode. In the refrigeration cycle device 10, since the water refrigerant heat exchanger 13 includes the receiver portion 13*b* as the high-pressure side gas-liquid separator, the series dehumidifying and heating mode is executed in a temperature range in which the saturation temperature of the refrigerant in the exterior heat exchanger 15 is higher than the outside air temperature Tam.

(c) Parallel Dehumidifying and Heating Mode

The parallel dehumidifying and heating mode is an operation mode in which the cooled and dehumidified air is reheated with the heating capacity higher than that in the series dehumidifying and heating mode and blown into the vehicle interior in order to dehumidify and heat the vehicle interior. The parallel dehumidifying and heating mode is an operation mode that is switched when the outside air temperature Tam is 0° C. or higher and lower than 10° C.

In the parallel dehumidifying and heating mode, the controller 60 opens the second passage opening/closing valve 22*a* and opens the low-pressure passage opening/closing valve 22*b*. The controller 60 makes the heating expansion valve 14*a* in a throttled state, the air cooling expansion valve 14*b* in the throttled state, and the bypass flow adjustment valve 14*d* in a fully closed state.

Figure 9:
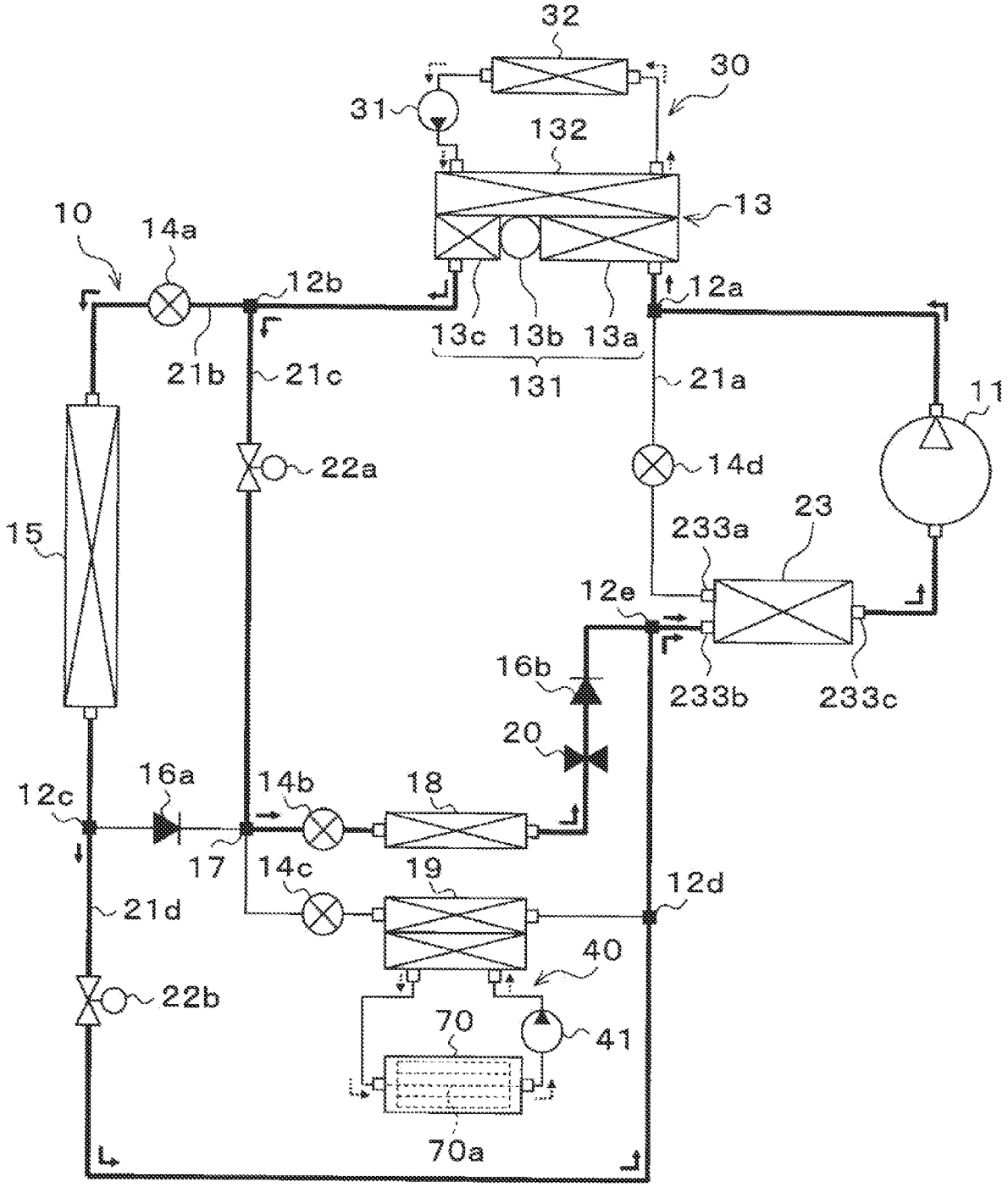
FIG. 9 is a schematic overall configuration diagram illustrating a refrigerant flow in a parallel dehumidifying and heating mode of a refrigeration cycle device according to the first embodiment.

Therefore, in the refrigeration cycle device 10 in the parallel dehumidifying and heating mode, as indicated by solid arrows in FIG. 9, the refrigerant discharged from the compressor 11 circulates through the water refrigerant heat exchanger 13, the second three-way joint 12*b*, the second passage 21*c*, the air cooling expansion valve 14*b*, the interior evaporator 18, the evaporating pressure adjustment valve 20, the second check valve 16*b*, the mixing portion 23, and the suction port of the compressor 11 in this order. At the same time, the refrigerant discharged from compressor 11 circulates through the water refrigerant heat exchanger 13, the second three-way joint 12*b*, the heating expansion valve 14*a*, the exterior heat exchanger 15, the low-pressure passage 21*d*, the mixing portion 23, and the suction port of compressor 11 in this order.

That is, in the parallel dehumidifying and heating mode, the flow of the refrigerant flowing out from the refrigerant passage 131 of the water refrigerant heat exchanger 13 is switched to the refrigerant circuit in which the interior evaporator 18 is connected to the exterior heat exchanger 15 in parallel. In FIG. 9, the refrigerant flow in the parallel dehumidifying and heating mode when the device cooling mode is not executed is illustrated.

The controller 60 appropriately controls the operation of other control target devices. For example, the refrigerant discharge capacity of the compressor 11 is controlled such that the first pressure P1 detected by the first refrigerant pressure sensor 62*a* approaches a target condensing pressure PDO. The target condensing pressure PDO is determined such that the heating-coolant temperature TWH detected by the heating coolant-temperature sensor 65*a* becomes a predetermined target water temperature TWHO. The target water temperature TWHO is set to a temperature at which heating of the vehicle interior can be realized.

The controller 60 controls the throttle opening degree of the air cooling expansion valve 14*b* such that the superheat degree SH of the refrigerant on the outlet side of the mixing portion 23 approaches the reference superheat degree KSH. The controller 60 controls the heating expansion valve 14*a* to decrease the throttle opening degree as the target blown air temperature TAO increases. Other control target devices are controlled in a similar manner to the air cooling mode.

Accordingly, in the refrigeration cycle device 10 in the parallel dehumidifying and heating mode, the vapor compression refrigeration cycle is configured in which the water refrigerant heat exchanger 13 functions as a condenser and the interior evaporator 18 and the exterior heat exchanger 15 function as an evaporator.

In the water refrigerant heat exchanger 13, the refrigerant radiates heat to the heating-coolant and is condensed. According to this, the heating-coolant is heated. In the interior evaporator 18, the refrigerant absorbs heat from the air and is evaporated. According to this, the air is cooled. In the exterior heat exchanger 15, the refrigerant absorbs heat from the outside air and is evaporated.

In the heating-coolant circuit 30 in the parallel dehumidifying and heating mode, as indicated by a thin broken line arrow in FIG. 9, the heating-coolant heated by the water refrigerant heat exchanger 13 is pumped to the heater core 32. The heating-coolant flowing into the heater core 32 radiates heat to the air cooled by the interior evaporator 18.

In the interior air-conditioning unit 50 in the parallel dehumidifying and heating mode, the air cooled and dehumidified by the interior evaporator 18 is reheated by the heater core 32 and blown into the vehicle interior. According to this, dehumidifying and heating of the vehicle interior is realized.

In the refrigeration cycle device 10 in the parallel dehumidifying and heating mode, the throttle opening degree of the heating expansion valve 14*a* is decreased as the target blown air temperature TAO increases. Accordingly, when the target blown air temperature TAO increases, the refrigerant evaporating temperature in the exterior heat exchanger 15 can be decreased to be lower than the refrigerant evaporating temperature in the interior evaporator 18.

According to this, a heat absorption amount of the refrigerant from the outside air in the exterior heat exchanger 15 is increased as compared with that in the series dehumidifying and heating mode and the heat radiation amount from the refrigerant in the water refrigerant heat exchanger 13 to the heating-coolant is increased. As a result, in the refrigeration cycle device 10 in the parallel dehumidifying and heating mode, the heating capacity of the air in the heater core 32 can be improved as compared with that in the series dehumidifying and heating mode.

In the refrigeration cycle device 10 in the parallel dehumidifying and heating mode, the bypass flow adjustment valve 14*d* is fully closed. Accordingly, in the similar manner to the air cooling mode, the decompression-portion side refrigerant flowing into the mixing portion 23 flows out from the mixing portion 23 without exchanging heat with or being mixed with the bypass side refrigerant in the mixing portion 23.

Also in the parallel dehumidifying and heating mode, the device cooling mode can be executed in a similar manner to the air cooling mode.

(d) Parallel Dehumidifying Hot-Gas Heating Mode

The parallel dehumidifying hot-gas heating mode is an operation mode executed to suppress a decrease in the heating capacity of the air when it is determined that frosting has occurred in the exterior heat exchanger 15 during execution of the parallel dehumidifying and heating mode.

In the air conditioning control program of the present embodiment, it is determined that the frosting has occurred in the exterior heat exchanger 15 when the time when the second temperature T2 detected by the second refrigerant temperature sensor 63*b* is equal to or lower than a frosting determination temperature is equal to or longer than a frosting determination time. Specifically, in the present embodiment, the frosting determination temperature is −5° C., and the frosting determination time is 5 minutes.

In the parallel dehumidifying hot-gas heating mode, the controller 60 opens the second passage opening/closing valve 22*a* and opens the low-pressure passage opening/closing valve 22*b*. The controller 60 makes the heating expansion valve 14*a* in a throttled state, the air cooling expansion valve 14*b* in the throttled state, and the bypass flow adjustment valve 14*d* in the throttled state.

Figure 10:
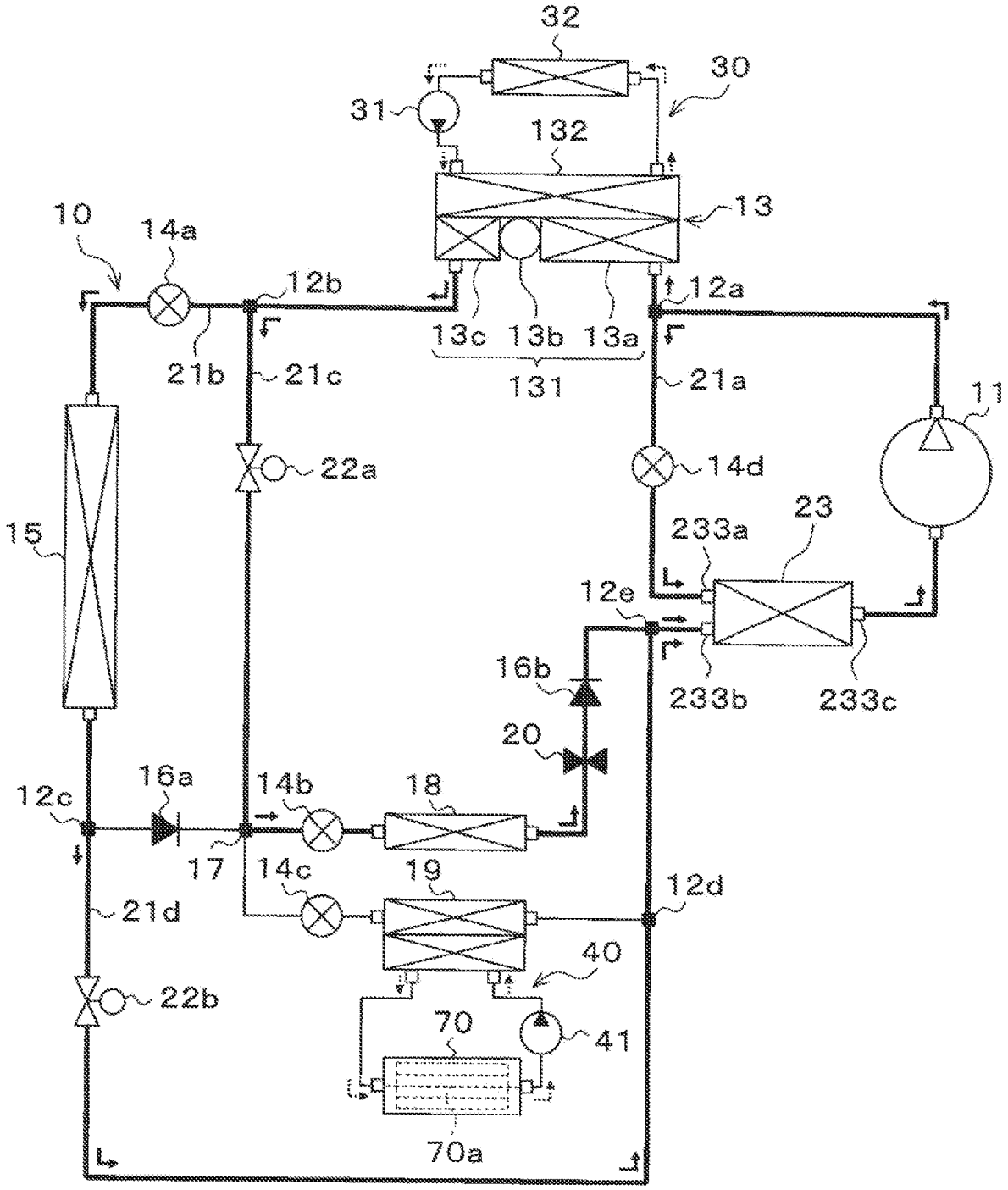
FIG. 10 is a schematic overall configuration diagram illustrating a refrigerant flow in a parallel dehumidifying hot-gas heating mode of a refrigeration cycle device according to the first embodiment.

Therefore, the in refrigeration cycle device 10 in the parallel dehumidifying hot-gas heating mode, as indicated by solid arrows in FIG. 10, the refrigerant circulates in a similar manner to the parallel dehumidifying and heating mode. At the same time, a part of the refrigerant discharged from the compressor 11 circulates through the bypass flow adjustment valve 14*d*, the mixing portion 23, and the suction port of the compressor 11 in this order via the bypass passage 21*a*. In FIG. 10, the refrigerant flow in the parallel dehumidifying and heating mode when the device cooling mode is not executed is illustrated.

The controller 60 appropriately controls the operation of other control target devices. For example, the refrigerant discharge capacity of the compressor 11 is increased by a predetermined amount, than that in the parallel dehumidifying and heating mode. The controller 60 controls the bypass flow adjustment valve 14*d* to have a predetermined opening degree for the parallel dehumidifying hot-gas heating mode determined in advance. Other control target devices are controlled in a similar manner to the parallel dehumidifying and heating mode.

Accordingly, in the refrigeration cycle device 10 in the parallel dehumidifying hot-gas heating mode, in a similar manner to the parallel dehumidifying and heating mode, the vapor compression refrigeration cycle is configured in which the water refrigerant heat exchanger 13 functions as a condenser and the interior evaporator 18 and the exterior heat exchanger 15 function as an evaporator. In the similar manner to the parallel dehumidifying and heating mode, the heating-coolant is heated by the water refrigerant heat exchanger 13. The air is cooled by the interior evaporator 18.

In the heating-coolant circuit 30 in the parallel dehumidifying hot-gas heating mode, as indicated by a thin broken line arrow in FIG. 10, the heating-coolant heated by the water refrigerant heat exchanger 13 is pumped to the heater core 32. The heating-coolant flowing into the heater core 32 radiates heat to the air cooled by the interior evaporator 18.

In the interior air-conditioning unit 50 in the parallel dehumidifying hot-gas heating mode, the air cooled and dehumidified by the interior evaporator 18 is reheated by the heater core 32 and blown into the vehicle interior. According to this, dehumidifying and heating of the vehicle interior is realized.

In the refrigeration cycle device 10 in the parallel dehumidifying hot-gas heating mode, since the frosting occurs in the exterior heat exchanger 15, the heat absorption amount of the refrigerant from the outside air in the exterior heat exchanger 15 decreases as compared with that in the parallel dehumidifying and heating mode. Therefore, the enthalpy of the refrigerant flowing out from the exterior heat exchanger 15 decreases, and the enthalpy of the decompression-portion side refrigerant flowing into the mixing portion 23 also easily decreases.

Since the heat radiation amount from the refrigerant to the heating-coolant in the water refrigerant heat exchanger 13 decreases as the heat absorption amount of the refrigerant from the outside air in the exterior heat exchanger 15 decreases, there is a possibility that the heating capacity of the air decreases.

On the other hand, in the parallel dehumidifying hot-gas heating mode of the present embodiment, since the bypass flow adjustment valve 14*d* is opened, the bypass side refrigerant having a relatively high enthalpy can flow into the mixing portion 23. The decompression-portion side refrigerant having the relatively low enthalpy and the bypass side refrigerant having the relatively high enthalpy can be mixed in the mixing portion 23.

Accordingly, in the refrigeration cycle device 10 in the parallel dehumidifying hot-gas heating mode, even when the refrigerant discharge capacity of the compressor 11 is increased as compared with that in the parallel dehumidifying and heating mode, the suction side refrigerant flowing out from the mixing portion 23 to the suction port side of the compressor 11 can be a gas-phase refrigerant having a superheat degree. By increasing a compression workload of the compressor 11, it is possible to suppress a decrease in the heat radiation amount from the refrigerant to the heating-coolant in the water refrigerant heat exchanger 13.

As a result, in the parallel dehumidifying hot-gas heating mode, it is possible to suppress a decrease in a heating capacity of the air as compared with the parallel dehumidifying and heating mode.

Also in the parallel dehumidifying hot-gas heating mode, the device cooling mode can be executed in a similar manner to the parallel dehumidifying and heating mode.

(e) Outside Air Heat-Absorption Heating Mode

The outside air heat-absorption heating mode is an operation mode in which heated air is blown into the vehicle interior in order to heat the vehicle interior. The outside air heat-absorption heating mode is an operation mode that is switched when the outside air temperature Tam is −10° C. or higher and lower than 0° C.

In the outside air heat-absorption heating mode, the controller 60 closes the second passage opening/closing valve 22*a* and opens the low-pressure passage opening/closing valve 22*b*. The controller 60 makes the heating expansion valve 14*a* in a throttled state, the air cooling expansion valve 14*b* in a fully closed state, and the bypass flow adjustment valve 14*d* in the fully closed state.

Figure 11:
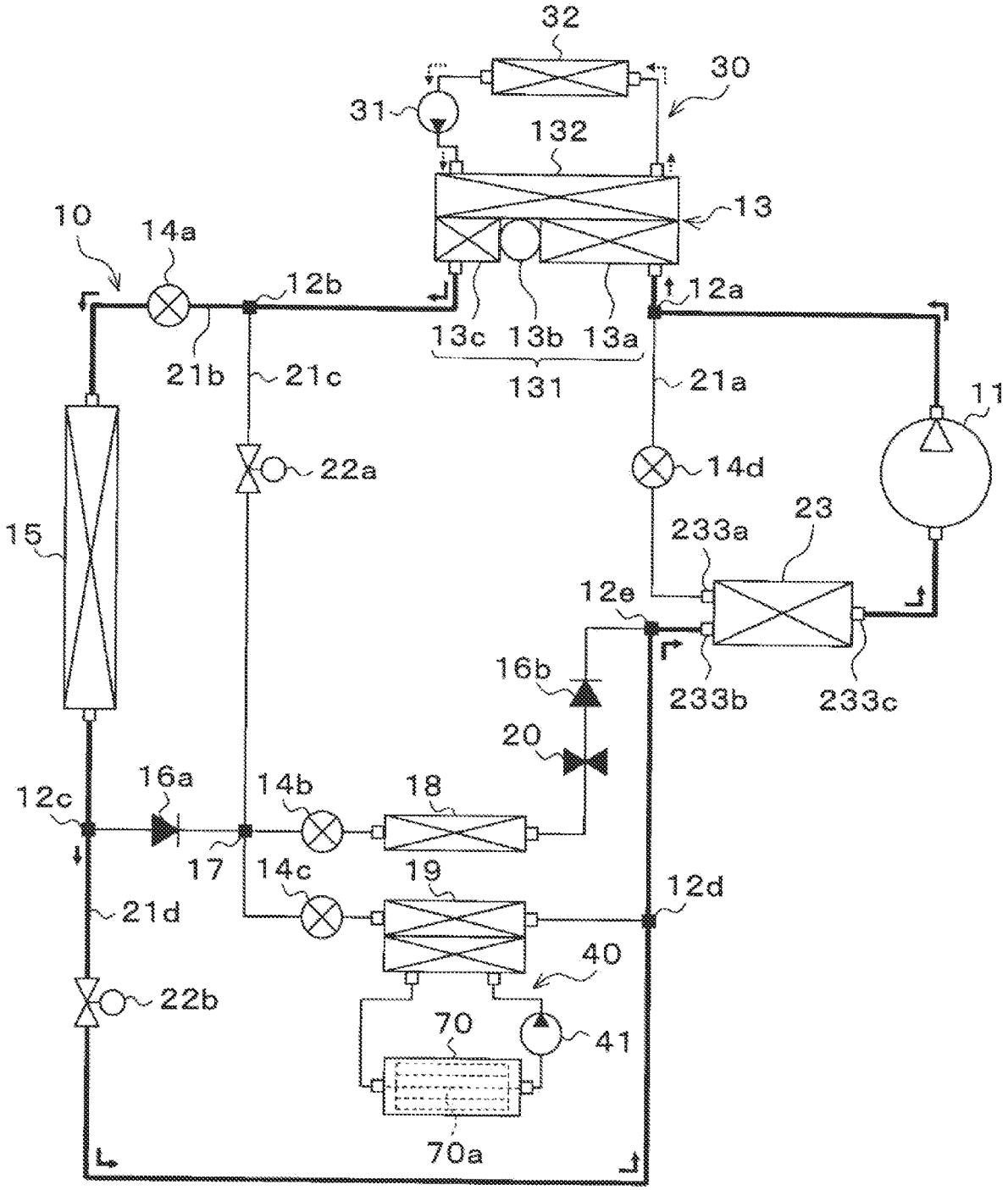
FIG. 11 is a schematic overall configuration diagram illustrating a refrigerant flow in an outside air heat-absorption heating mode of a refrigeration cycle device according to the first embodiment.

Therefore, in the refrigeration cycle device 10 in the outside air heat-absorption heating mode, as indicated by solid arrows in FIG. 11, the refrigerant discharged from the compressor 11 circulates through the water refrigerant heat exchanger 13, the heating expansion valve 14*a*, the exterior heat exchanger 15, the low-pressure passage 21*d*, the mixing portion 23, and the suction port of the compressor 11 in this order. In FIG. 11, the refrigerant flow in the outside air heat-absorption heating mode when the device cooling mode is not executed is illustrated.

The controller 60 appropriately controls the operation of other control target devices. For example, the compressor 11 is controlled in a similar manner to the parallel dehumidifying and heating mode.

The controller 60 controls the throttle opening degree of the heating expansion valve 14*a* such that the superheat degree SH of the refrigerant on the outlet side of the mixing portion 23 approaches the reference superheat degree KSH.

The controller 60 controls the air mix door driving electric actuator in the similar manner to the air cooling mode. In the outside air heat-absorption heating mode, the air mix door 54 is displaced such that the air passage on the heater core 32 is substantially fully opened and the cold air bypass passage 55 is fully closed. Other control target devices are controlled in a similar manner to the parallel dehumidifying and heating mode.

Accordingly, in the refrigeration cycle device 10 in the outside air heat-absorption heating mode, the vapor compression refrigeration cycle is configured in which the water refrigerant heat exchanger 13 functions as a condenser and the exterior heat exchanger 15 function as an evaporator. In the water refrigerant heat exchanger 13, the refrigerant radiates heat to the heating-coolant and is condensed. According to this, the heating-coolant is heated. In the exterior heat exchanger 15, the refrigerant absorbs heat from the outside air and is evaporated.

In the heating-coolant circuit 30 in the outside air heat-absorption heating mode, as indicated by a thin broken line arrow in FIG. 11, the heating-coolant heated by the water refrigerant heat exchanger 13 is pumped to the heater core 32. The heating-coolant flowing into the heater core 32 radiates heat to the air having passed through the interior evaporator 18.

In the interior air-conditioning unit 50 in the outside air heat-absorption heating mode, the air having passed through the interior evaporator 18 is heated by the heater core 32 and blown into the vehicle interior. According to this, heating of the vehicle interior is realized.

In the refrigeration cycle device 10 in the outside air heat-absorption heating mode, the bypass flow adjustment valve 14*d* is fully closed. Accordingly, in the similar manner to the air cooling mode, the decompression-portion side refrigerant flowing into the mixing portion 23 flows out from the mixing portion 23 without exchanging heat with or being mixed with the bypass side refrigerant in the mixing portion 23.

Also in the outside air heat-absorption heating mode, the device cooling mode can be executed. When the device cooling mode is executed in the outside air heat-absorption heating mode, the controller 60 only needs to open the second passage opening/closing valve 22*a*, make the cooling expansion valve 14*c* in the throttled state, and operate the device coolant pump 41. However, since the outside air heat-absorption heating mode is executed at a low outside air temperature, the device cooling mode is not executed in many cases.

(f) Outside Air Heat-Absorption Hot-Gas Heating Mode

The outside air heat-absorption hot-gas heating mode is an operation mode in which heated air is blown into the vehicle interior in order to heat the vehicle interior at a cryogenic outside air temperature. The outside air heat-absorption hot-gas heating mode is an operation mode switched when the outside air temperature Tam is −20° C. or higher and lower than −10° C., or when it is determined that the frosting has occurred in the exterior heat exchanger 15 during execution of the outside air heat-absorption heating mode.

In the outside air heat-absorption hot-gas heating mode, the controller 60 closes the second passage opening/closing valve 22*a* and opens the low-pressure passage opening/closing valve 22*b*. The controller 60 makes the heating expansion valve 14*a* in a throttled state, the air cooling expansion valve 14*b* in a fully closed state, and the bypass flow adjustment valve 14*d* in the throttled state.

Figure 12:
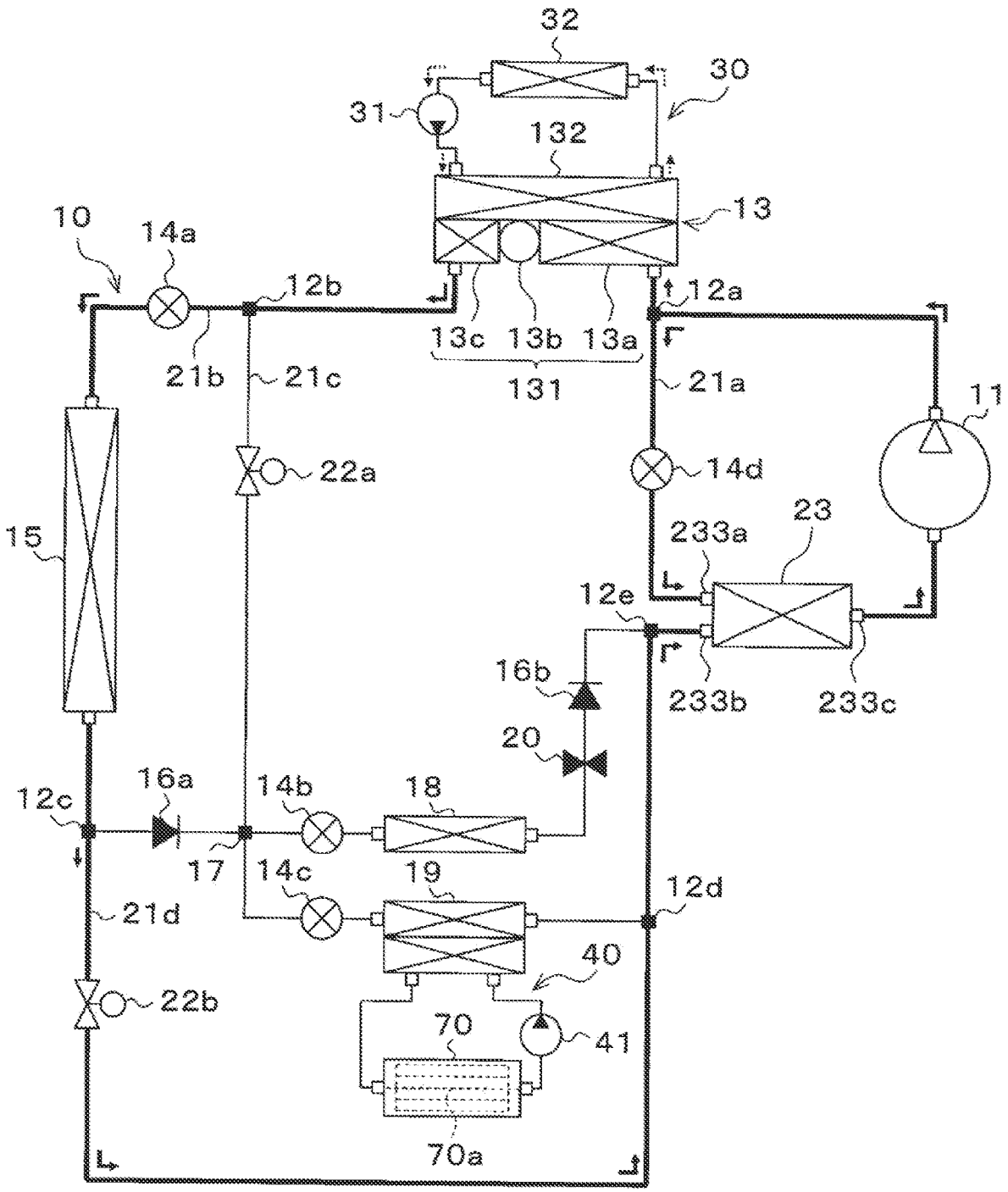
FIG. 12 is a schematic overall configuration diagram illustrating a refrigerant flow in an outside air heat-absorption hot-gas heating mode of a refrigeration cycle device according to the first embodiment.

Therefore, the in refrigeration cycle device 10 in the outside air heat-absorption hot-gas heating mode, as indicated by solid arrows in FIG. 12, the refrigerant circulates in a similar manner to the outside air heat-absorption heating mode. At the same time, a part of the refrigerant discharged from the compressor 11 circulates through the bypass flow adjustment valve 14*d*, the mixing portion 23, and the suction port of the compressor 11 in this order via the bypass passage 21*a*. In FIG. 12, the refrigerant flow in the outside air heat-absorption hot-gas heating mode when the device cooling mode is not executed is illustrated.

The controller 60 appropriately controls the operation of other control target devices. For example, the refrigerant discharge capacity of the compressor 11 is increased by a predetermined amount than that in the outside air heat-absorption heating mode. The controller 60 controls the bypass flow adjustment valve 14*d* to have a predetermined opening degree for the outside air heat-absorption hot-gas heating mode determined in advance. Other control target devices are controlled in a similar manner to the outside air heat-absorption heating mode.

Accordingly, in the refrigeration cycle device 10 in the outside air heat-absorption hot-gas heating mode, in a similar manner to the outside air heat-absorption heating mode, the vapor compression refrigeration cycle is configured in which the water refrigerant heat exchanger 13 functions as a condenser and the exterior heat exchanger 15 function as an evaporator. In the similar manner to the outside air heat-absorption heating mode, the heating-coolant is heated by the water refrigerant heat exchanger 13. In the exterior heat exchanger 15, the refrigerant absorbs heat from the outside air and is evaporated.

In the heating-coolant circuit 30 in the outside air heat-absorption hot-gas heating mode, as indicated by a thin broken line arrow in FIG. 12, the heating-coolant heated by the water refrigerant heat exchanger 13 is pumped to the heater core 32. The heating-coolant flowing into the heater core 32 radiates heat to the air having passed through the interior evaporator 18.

In the interior air-conditioning unit 50 in the outside air heat-absorption hot-gas heating mode, the air having passed through the interior evaporator 18 is heated by the heater core 32 and blown into the vehicle interior. According to this, heating of the vehicle interior is realized.

In the outside air heat-absorption hot-gas heating mode, since the outside air temperature Tam is low or the frosting occurs in the exterior heat exchanger 15, the heat absorption amount of the refrigerant from the outside air in the exterior heat exchanger 15 decrease as compared with that in the outside air heat-absorption heating mode. Therefore, in a similar manner to the parallel dehumidifying hot-gas heating mode, there is a possibility that the enthalpy of the decompression-portion side refrigerant flowing into the mixing portion 23 is likely to decrease and the heating capacity of the air decreases.

On the other hand, in the outside air heat-absorption hot-gas heating mode of the present embodiment, since the bypass flow adjustment valve 14*d* is opened, in a similar manner to the parallel dehumidifying hot-gas heating mode, the bypass side refrigerant having a relatively high enthalpy can flow into the mixing portion 23. The decompression-portion side refrigerant having the relatively low enthalpy and the bypass side refrigerant having the relatively high enthalpy can be mixed in the mixing portion 23.

Accordingly, in the refrigeration cycle device 10 in the outside air heat-absorption hot-gas heating mode, even when the refrigerant discharge capacity of the compressor 11 is increased as compared with that in the outside air heat-absorption heating mode, the suction side refrigerant flowing out from the mixing portion 23 to the suction port side of the compressor 11 can be a gas-phase refrigerant having a superheat degree. By increasing a compression workload of the compressor 11, it is possible to suppress a decrease in the heat radiation amount from the refrigerant to the heating-coolant in the water refrigerant heat exchanger 13.

As a result, in the refrigeration cycle device 10 in the outside air heat-absorption hot-gas heating mode, it is possible to suppress a decrease in a heating capacity of the air as compared with the outside air heat-absorption heating mode.

Also in the outside air heat-absorption hot-gas heating mode, the device cooling mode can be executed in a similar manner to the outside air heat-absorption heating mode.

Also in the outside air heat-absorption hot-gas heating mode, the device cooling mode can be executed in a similar manner to the outside air heat-absorption heating mode. Since the outside air heat-absorption hot-gas heating mode is also executed at a low outside air temperature, the device cooling mode is not executed in many cases.

(g) Hot-Gas Heating Mode

The hot-gas heating mode is an operation mode for suppressing a decrease in a heating capacity in the vehicle interior at a cryogenic outside air temperature. The hot-gas heating mode is an operation mode that is switched at the cryogenic outside air temperature at which the outside air temperature Tam is lower than −20° C.

In the hot-gas heating mode, the controller 60 opens the second passage opening/closing valve 22*a* and closes the low-pressure passage opening/closing valve 22*b*. The controller 60 makes the heating expansion valve 14*a* in a fully closed state, the air cooling expansion valve 14*b* in the fully closed state, the cooling expansion valve 14*c* in a throttled state, and the bypass flow adjustment valve 14*d* in the throttled state.

Figure 13:
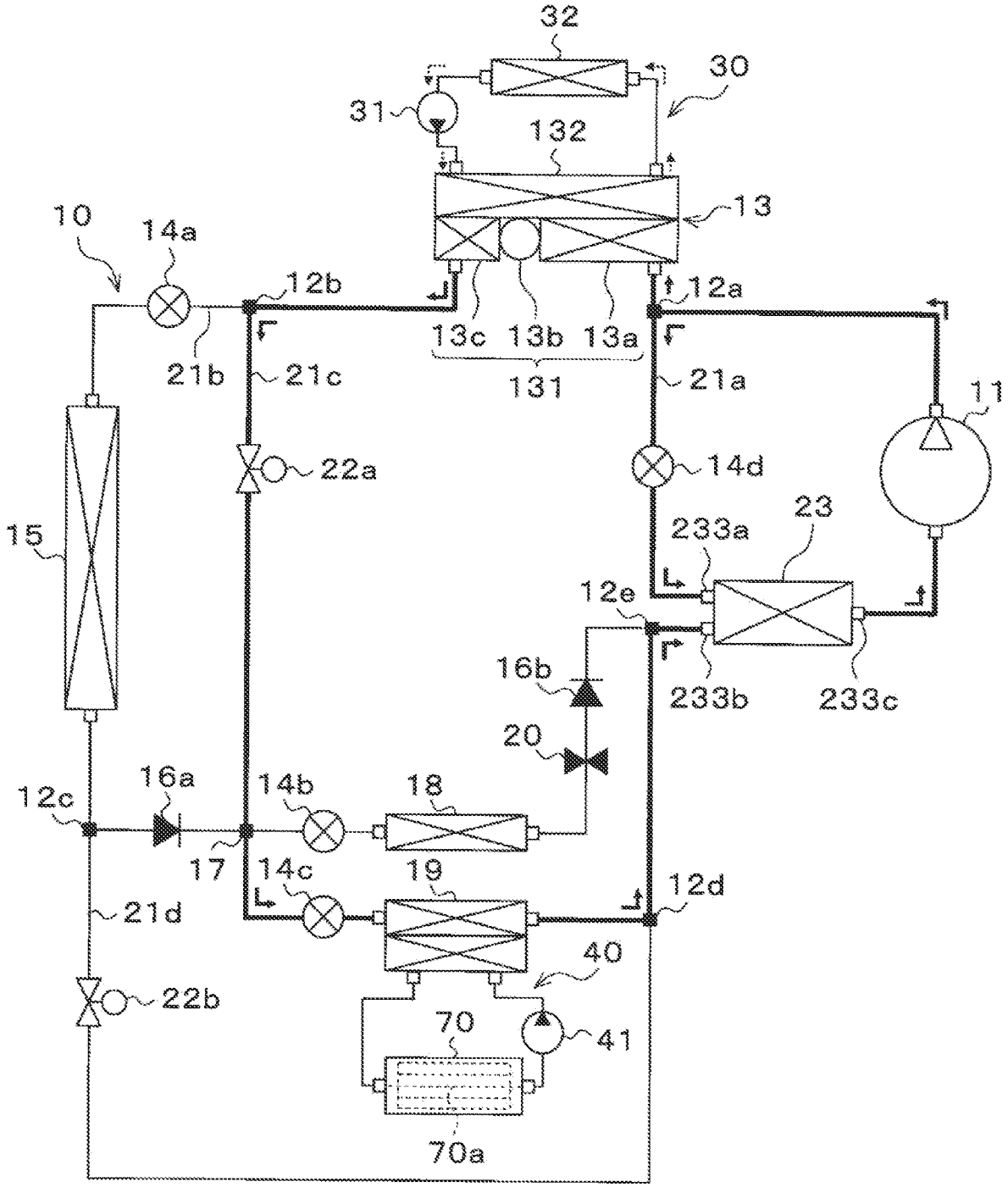
FIG. 13 is a schematic overall configuration diagram illustrating a refrigerant flow in a hot-gas heating mode of a refrigeration cycle device according to the first embodiment.

Therefore, in the refrigeration cycle device 10 in the hot-gas heating mode, as indicated by solid arrows in FIG. 13, the refrigerant discharged from the compressor 11 circulates through the first three-way joint 12*a*, the water refrigerant heat exchanger 13, the second three-way joint 12*b*, the second passage 21*c*, the cooling expansion valve 14*c*, the chiller 19, the mixing portion 23, and the suction port of the compressor 11 in this order. At the same time, a part of the refrigerant discharged from the compressor 11 circulates through the bypass flow adjustment valve 14*d*, the mixing portion 23, and the suction port of the compressor 11 in this order via the bypass passage 21*a*.

The controller 60 appropriately controls the operation of other control target devices. For example, the refrigerant discharge capacity of the compressor 11 is increased by a predetermined amount determined than that in the outside air heat-absorption heating mode. The controller 60 stops the device coolant pump 41.

The controller 60 controls the throttle opening degree of the cooling expansion valve 14*c* such that the superheat degree SH of the refrigerant on the outlet side of the mixing portion 23 approaches the reference superheat degree KSH. The controller 60 controls the bypass flow adjustment valve 14*d* to have a predetermined opening degree for the hot-gas heating mode determined in advance. Other control target devices are controlled in a similar manner to the outside air heat-absorption heating mode.

Figure 14:
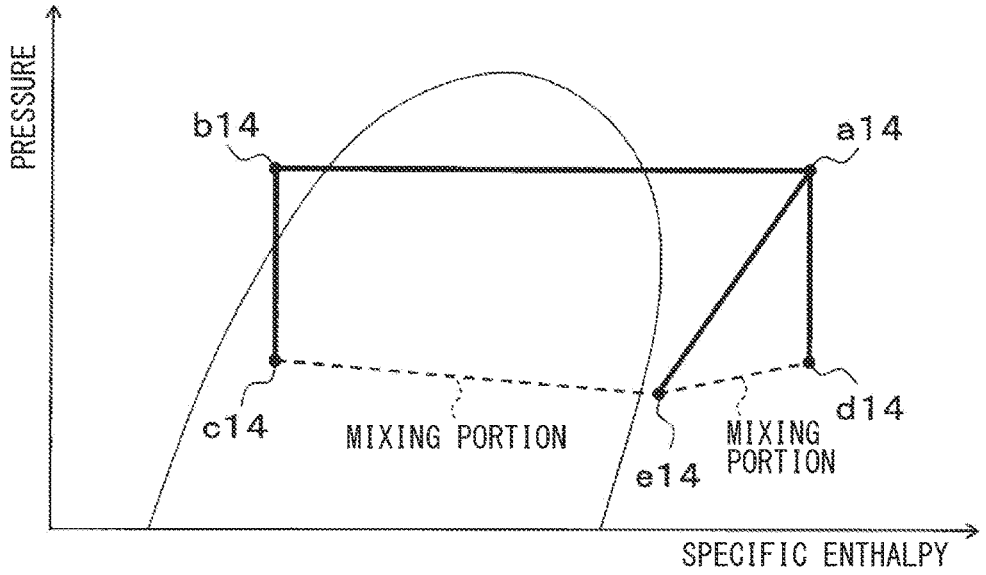
FIG. 14 is a Mollier diagram illustrating a change in a state of a refrigerant in a hot-gas heating mode in a refrigeration cycle device according to the first embodiment.

Therefore, in the refrigeration cycle device 10 in the hot-gas heating mode, a state of the refrigerant changes as illustrated in a Mollier diagram of FIG. 14. That is, the refrigerant discharged from compressor 11 (a point of a14 in FIG. 14) is branched at the first three-way joint 12*a*. One refrigerant branched at the first three-way joint 12*a* flows into the refrigerant passage 131 of the water refrigerant heat exchanger 13, and radiates heat to the heating-coolant (from a point of a14 to a point of b14 in FIG. 14). According to this, the heating-coolant is heated.

Since the heating expansion valve 14*a* is fully closed, the refrigerant flowing out from the refrigerant passage 131 of the water refrigerant heat exchanger 13 flows into the second passage 21*c* from the second three-way joint 12*b*. Since the air cooling expansion valve 14*b* is in the fully closed state, the refrigerant flowing into the second passage 21*c* flows into the cooling expansion valve 14*c* and is decompressed (from a point of b14 to a point of c14 in FIG. 14).

The refrigerant having a relatively low enthalpy flowing out from the cooling expansion valve 14*c* flows into the chiller 19. Since the device coolant pump 41 stops in the hot-gas heating mode, the refrigerant flowing into the chiller 19 flows into the decompression-portion side refrigerant inlet portion 233*b* of the mixing portion 23 as a decompression-portion side refrigerant (a point of c14 in FIG. 14) without exchanging heat with the device coolant.

On the other hand, the other refrigerant branched at the first three-way joint 12*a* flows into the bypass passage 21*a*. The flow rate of the refrigerant flowing into the bypass passage 21*a* is adjusted by the bypass flow adjustment valve 14*d* to be decompressed (from a point of a14 to a point of d14 in FIG. 14). The refrigerant having a relatively high enthalpy and decompressed by the bypass flow adjustment valve 14*d* flows into the bypass side refrigerant inlet portion 233*a* of the mixing portion 23 as the bypass side refrigerant (a point of d14 in FIG. 14).

The bypass side refrigerant and the decompression-portion side refrigerant, which are mixed in the mixing portion 23, become a suction side refrigerant having a enthalpy substantially equal to that of the ideal mixed refrigerant (from a point of c14 to a point of e14 and from a point of d14 to a point of e14 in FIG. 14), and flow out from the mixed refrigerant outflow portion 233*c* of the mixing portion 23. At this time, the superheat degree SH of the suction side refrigerant approaches the reference superheat degree KSH. The refrigerant flowing out from the mixed refrigerant outflow portion 233*c* of the mixing portion 23 is sucked into the compressor 11 and is compressed again.

In the heating-coolant circuit 30 in the hot-gas heating mode, as indicated by a thin broken line arrow in FIG. 13, the heating-coolant heated by the water refrigerant heat exchanger 13 is pumped to the heater core 32. The heating-coolant flowing into the heater core 32 radiates heat to the air having passed through the interior evaporator 18.

In the interior air-conditioning unit 50 in the hot-gas heating mode, the air having passed through the interior evaporator 18 is heated by the heater core 32 and blown into the vehicle interior. According to this, heating of the vehicle interior is realized.

Since the hot-gas heating mode is an operation mode executed at the cryogenic outside air temperature, when the refrigerant flowing out from the water refrigerant heat exchanger 13 flows into the exterior heat exchanger 15, there is a possibility that the refrigerant radiates heat to the outside air, and the enthalpy of the refrigerant decreases. Therefore, the refrigerant flowing out from the water refrigerant heat exchanger 13 flows into the exterior heat exchanger 15, the enthalpy of the decompression-portion side refrigerant flowing into the mixing portion 23 also easily decreases.

Since the heat radiation amount of the refrigerant radiated to the heating-coolant in the water refrigerant heat exchanger 13 decreases when the refrigerant radiates heat to the outside air in the exterior heat exchanger 15, there is a possibility that the heating capacity of the air decreases.

On the other hand, in the hot-gas heating mode of the present embodiment, the refrigerant flowing out from the water refrigerant heat exchanger 13 flows into the cooling expansion valve 14*c* without flowing into the exterior heat exchanger 15. The device coolant pump 41 is stopped, and thus the decompression-portion side refrigerant does not decrease the enthalpy in the chiller 19. The decompression-portion side refrigerant having the relatively low enthalpy and the bypass side refrigerant having the relatively high enthalpy can be mixed in the mixing portion 23.

Accordingly, in the refrigeration cycle device 10 in the hot-gas heating mode, even when the refrigerant discharge capacity of the compressor 11 is increased as compared with that in the outside air heat-absorption heating mode, the suction side refrigerant flowing out from the mixing portion 23 to the suction port side of the compressor 11 can be a gas-phase refrigerant having a superheat degree. By increasing a compression workload of the compressor 11, it is possible to suppress a decrease in the heat radiation amount from the refrigerant to the heating-coolant in the water refrigerant heat exchanger 13.

As a result, in the refrigeration cycle device 10 in the hot-gas heating mode, it is possible to suppress a decrease in a heating capacity of the air.

Since the hot-gas heating mode is an operation mode executed at a cryogenic outside air temperature, it is not necessary to execute the device cooling mode. On the other hand, it may be necessary to warm up the heat generating device at the low outside air temperature. Therefore, the vehicle air conditioner can execute a device warm-up mode in the hot-gas heating mode instead of the device cooling mode. The device warm-up mode is executed when the battery temperature TB becomes equal to or lower than a predetermined reference low temperature side battery temperature KTBL.

In the device warm-up mode, the controller 60 fully opens the cooling expansion valve 14*c*. The controller 60 controls the water pumping capacity of the device coolant pump 41 such that the device coolant temperature TWL approaches a predetermined target device water temperature TWLO.

Accordingly, in the refrigeration cycle device 10 in the hot-gas heating mode during execution of the device warm-up mode, the refrigerant flowing into the chiller 19 radiates heat to the device coolant. According to this, the device coolant is heated. In the device coolant circuit 40 in the hot-gas heating mode during execution of the device warm-up mode, the device coolant heated in the chiller 19 flows through the coolant passage 70*a* of the battery 70. According to this, the battery 70 is warmed up.

As a result, in the hot-gas heating mode during execution of the device warm-up mode, the warm-up of the battery 70 or a decrease in a temperature of the battery 70 can be suppressed while heating the vehicle interior.

As described above, in the vehicle air conditioner of the present embodiment, the refrigeration cycle device 10 switches the refrigerant circuit according to each operation mode, and thus comfortable air conditioning in the vehicle interior can be realized. The vehicle air conditioner of the present embodiment can appropriately adjust the temperature of the battery 70 by executing the device cooling mode or the device warm-up mode.

In the refrigeration cycle device 10 in the (d) parallel dehumidifying hot-gas heating mode, the (f) outside air heat-absorption hot-gas heating mode, and the (g) hot-gas heating mode, which are described above, the flow is switched to the refrigerant circuit in which the decompression-portion side refrigerant flowing out from the decompression portion such as the heating expansion valve 14*a*, the air cooling expansion valve 14*b*, or the cooling expansion valve 14*c* is mixed with the bypass side refrigerant flowing out from the bypass flow adjustment valve 14*d*, and the mixed refrigerant is sucked into the compressor 11. In other words, the flow is switched to the refrigerant circuit in which the refrigerants having different enthalpies are mixed and sucked into the compressor 11.

In the refrigerant circuit in which the refrigerants having different enthalpies are mixed and sucked into the compressor 11, when the refrigerants having different enthalpies are not sufficiently mixed, the enthalpy of the suction side refrigerant flowing out to the suction port side of the compressor 11 also varies. When the enthalpy of the suction side refrigerant becomes higher than the ideal enthalpy of the mixed refrigerant due to variations, for example, the refrigerant discharged from the compressor 11 is unnecessarily heated to a high temperature. Therefore, there is a possibility that the durable life of the compressor 11 is adversely affected.

On the other hand, the refrigeration cycle device 10 of the present embodiment includes the mixing portion 23. Accordingly, the absolute value of the enthalpy difference obtained by subtracting the enthalpy of the ideal mixed refrigerant from an actual enthalpy of the suction side refrigerant can be made equal to or less than the reference value determined so as not to adversely affect the durable life of the compressor 11. That is, variations in the enthalpy of the suction side refrigerant can be suppressed.

Accordingly, the durable life of the compressor 11 is not adversely affected since the bypass side refrigerant is insufficiently mixed with the decompression-portion side refrigerant. In order to protect the compressor 11, it is also possible to avoid a decrease in the refrigerant discharge capacity of the compressor 11, which is caused by the insufficient mixing of the bypass side refrigerant and the decompression-portion side refrigerant.

As a result, in the refrigeration cycle device 10, even when the flow is switched to the refrigerant circuit in which the refrigerants having different enthalpies are mixed and sucked into the compressor 11, a stable heating capacity can be exhibited. In the refrigeration cycle device 10, even when the flow is switched to the refrigerant circuit in which the refrigerants having different enthalpies are mixed and sucked into the compressor 11, the protection of the compressor 11 can be achieved.

In the present embodiment, the stacked heat exchanger is adopted as the mixing portion 23. According to this, the first heat transfer plate 231*a* and the second heat transfer plate 231*b* can easily form a plurality of the heat exchange members for exchanging heat between the bypass side refrigerant and the decompression-portion side refrigerant. That is, a mixing portion capable of suppressing variations in the enthalpy of the suction side refrigerant can be easily realized.

The refrigeration cycle device 10 of the present embodiment includes the exterior heat exchanger 15 as a heat absorption portion. According to this, in a similar manner to the (e) outside air heat-absorption heating mode, the air as a heating target can be heated using heat of the outside air as the heat source fluid.

The same applies to the (c) parallel dehumidifying and heating mode, the (d) parallel dehumidifying hot-gas heating mode, and the (f) outside air heat-absorption hot-gas heating mode.

The refrigeration cycle device 10 of the present embodiment includes the second three-way joint 12*b* as the downstream branch portion and the second passage opening/closing valve 22*a* as the branch circuit switching portion.

As the decompressor, the heating expansion valve 14*a* as the first decompression portion that decompresses one refrigerant branched at the second three-way joint 12*b* is provided. In addition to this, as the decompressor, the air cooling expansion valve 14*b* as the second decompression portion that decompresses the other refrigerant branched at the second three-way joint 12*b* and the cooling expansion valve 14*c* are provided. The exterior heat exchanger 15 functioning as the heat absorption portion is disposed to evaporate the refrigerant decompressed by the heating expansion valve 14*a*.

According to this, in the exterior heat exchanger 15, not only the operation mode in which the air is heated using heat absorbed from the outside air by the refrigerant but also the refrigerant circuit in which the refrigerant flows by bypassing the exterior heat exchanger 15 can be realized. The operation of the (g) hot-gas heating mode can be realized by guiding the decompression-portion side refrigerant decompressed by the air cooling expansion valve 14*b* or the cooling expansion valve 14*c* to the mixing portion 23.

The refrigeration cycle device 10 of the present embodiment includes the interior evaporator 18 as the auxiliary evaporating portion that evaporates the refrigerant decompressed by the second decompression portion. According to this, the air can be cooled in a similar manner to the (a) air cooling mode. The same applies to the (b) series dehumidifying and heating mode, the (c) parallel dehumidifying and heating mode, and the (d) parallel dehumidifying hot-gas heating mode. The chiller 19 is provided as the auxiliary evaporating portion. According to this, the temperature of the device coolant can be adjusted in a similar manner to the device cooling mode and the device warm-up mode.

Since the coolant passage 70*a* of the battery 70 is connected to the device coolant circuit 40 in which the device coolant circulates, the temperature of the battery 70 can be adjusted by the temperature-adjusted device coolant.

In the refrigeration cycle device 10 of the present embodiment, the operation of at least one of the heating expansion valve 14*a*, the air cooling expansion valve 14*b*, the cooling expansion valve 14*c*, or the bypass flow adjustment valve 14*d*, as the decompression portion, is controlled such that the superheat degree SH of the refrigerant on the outlet side of the mixing portion 23 approaches the reference superheat degree KSH. According to this, the superheat degree of the suction side refrigerant can be secured, and the liquid compression of the compressor 11 can be suppressed.

Second Embodiment

Figure 15:
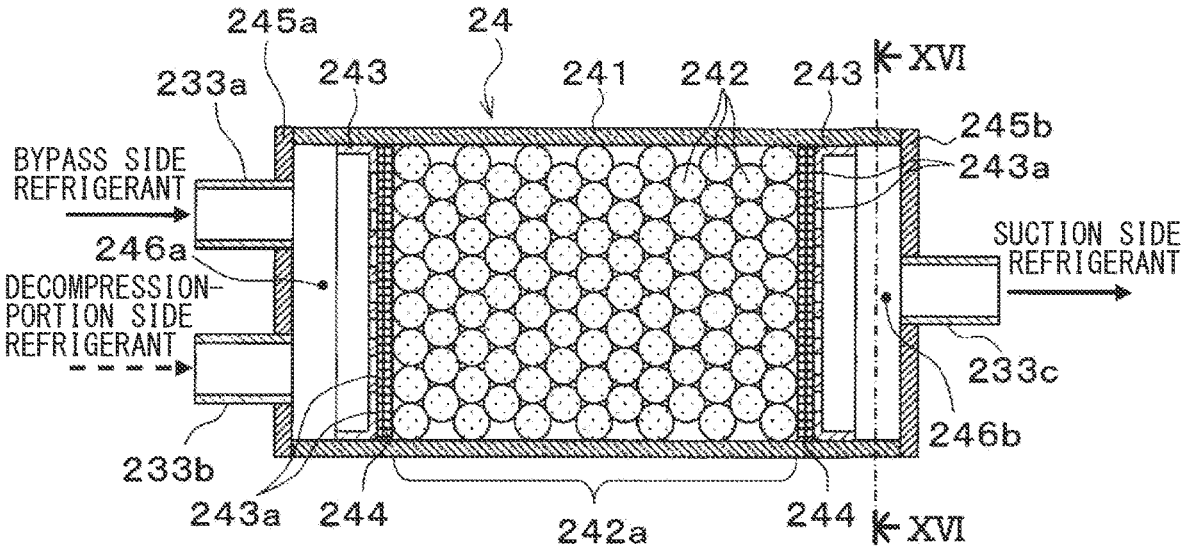
FIG. 15 is an axial sectional view of a mixing portion according to a second embodiment.
Figure 16:
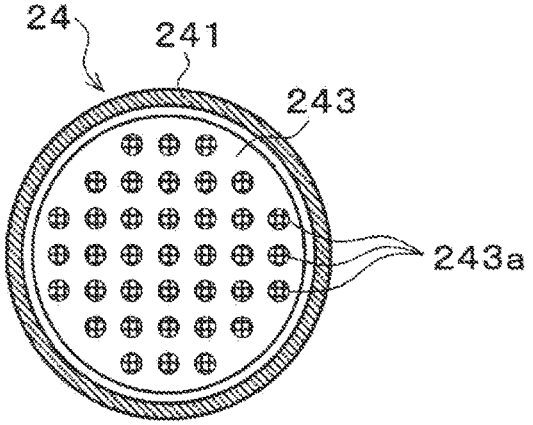
FIG. 16 is a cross-sectional view taken along line XVI-XVI of FIG. 15.

In the refrigeration cycle device 10 of the present embodiment, a mixing portion 24 illustrated in FIGS. 15 and 16 is adopted instead of the mixing portion 23 described in the first embodiment.

The mixing portion 24 is formed by filling a plurality of particulate members 242 inside a metal body 241 formed in a bottomed cylindrical shape. Each of the particulate members 242 is a wetting area enlargement member that enlarges an area in which the liquid-phase refrigerant among the refrigerants flowing into the mixing portion 24 spreads in a wetting manner, that is, a wetting area. In the present embodiment, zeolite formed in a spherical shape is adopted as the particulate member 242.

A pair of pressing members 243 that prevent a plurality of the particulate members 242 from moving in the body 241 is fixed inside the body 241. Each of the pressing members 243 is a disk-like member made of metal. The pressing members 243 are fixed to both axial end portions of the portion filled with the particulate members 242 by press fitting or the like. According to this, a particle-filled layer 242*a* filled with a plurality of the particulate members 242 is formed between the pressing members 243.

The pressing member 243 is formed with a plurality of through holes 243*a* penetrating a front and back side. A plurality of the through holes 243*a* form a refrigerant passage through which the refrigerant obtained by mixing the bypass side refrigerant and the decompression-portion side refrigerant flows into the particle-filled layer 242*a* or a refrigerant passage through which the refrigerant flows out from the particle-filled layer 242*a*.

A filter 244 is disposed between the pressing member 243 and the particulate member 242. The filter 244 is made of a mesh-like resin. The filter 244 captures foreign substances in the refrigerant passing through the filter 244 and prevents the particulate members 242 from flowing out from the particle-filled layer 242*a* through the through holes 243*a* of the pressing member 243.

The bypass side refrigerant inlet portion 233*a* and the decompression-portion side refrigerant inlet portion 233*b* are joined to one bottom surface 245*a* of the body 241. A refrigerant mixing space 246*a* for mixing the bypass side refrigerant flowing in from the bypass side refrigerant inlet portion 233*a* and the decompression-portion side refrigerant flowing in from the decompression-portion side refrigerant inlet portion 233*b* is formed between the one bottom surface 245*a* and the pressing member 243 on one bottom surface 245*a* side.

The mixed refrigerant outflow portion 233*c* is joined to the other bottom surface 245*b* of the body 241. A refrigerant collection space 246*b* into which the refrigerant having passed through the particle-filled layer 242*a* flows is formed between the other bottom surface 245*b* and the pressing member 243 on the other bottom surface 245*b* side.

Accordingly, the bypass side refrigerant flowing in from the bypass side refrigerant inlet portion 233*a* and the decompression-portion side refrigerant flowing in from the decompression-portion side refrigerant inlet portion 233*b* are mixed in the refrigerant mixing space 246*a*. The refrigerant mixed in the refrigerant mixing space 246*a* is further homogeneously mixed when passing through the particle-filled layer 242*a*, and flows into the refrigerant collection space 246*b*. The refrigerant flowing into the refrigerant collection space 246*b* becomes the suction side refrigerant and flows out from the mixed refrigerant outflow portion 233*c*.

Other configurations and operations of the refrigeration cycle device 10 are similar to those of the first embodiment. Accordingly, in the vehicle air conditioner of the present embodiment, similarly to the first embodiment, the refrigeration cycle device 10 switches the refrigerant circuit according to each operation mode, and thus the comfortable air conditioning in the vehicle interior and the appropriate temperature adjustment of the battery 70 can be performed.

In the present embodiment, the mixing portion 24 is adopted. The mixing portion 24 includes the particulate member 242 which is the wetting area enlargement member. According to this, the liquid-phase refrigerant among the refrigerants flowing into the particle-filled layer 242*a* of the mixing portion 24 spreads in a wetting manner on a surface of the particulate member 242, and thus a heat exchange area between the liquid-phase refrigerant and the gas-phase refrigerant can be increased. As a result, in the mixing portion 24, the bypass side refrigerant and the decompression-portion side refrigerant can be sufficiently and quickly subjected to heat exchange.

Accordingly, in the mixing portion 24, variations in the enthalpy of the suction side refrigerant can be sufficiently suppressed. As a result, the refrigeration cycle device 10 of the present embodiment can also achieve the same effect as that of the first embodiment. That is, when the flow is switched to the refrigerant circuit in which the refrigerants having different enthalpies are mixed and sucked into the compressor 11, a stable heating capacity can be exhibited, and the compressor 11 can be protected.

In the mixing portion 24 of the present embodiment, the particulate member 242 formed of zeolite is adopted as the wetting area enlargement member. According to this, moisture in the refrigerant can be adsorbed to the particulate members 242.

Figure 17:
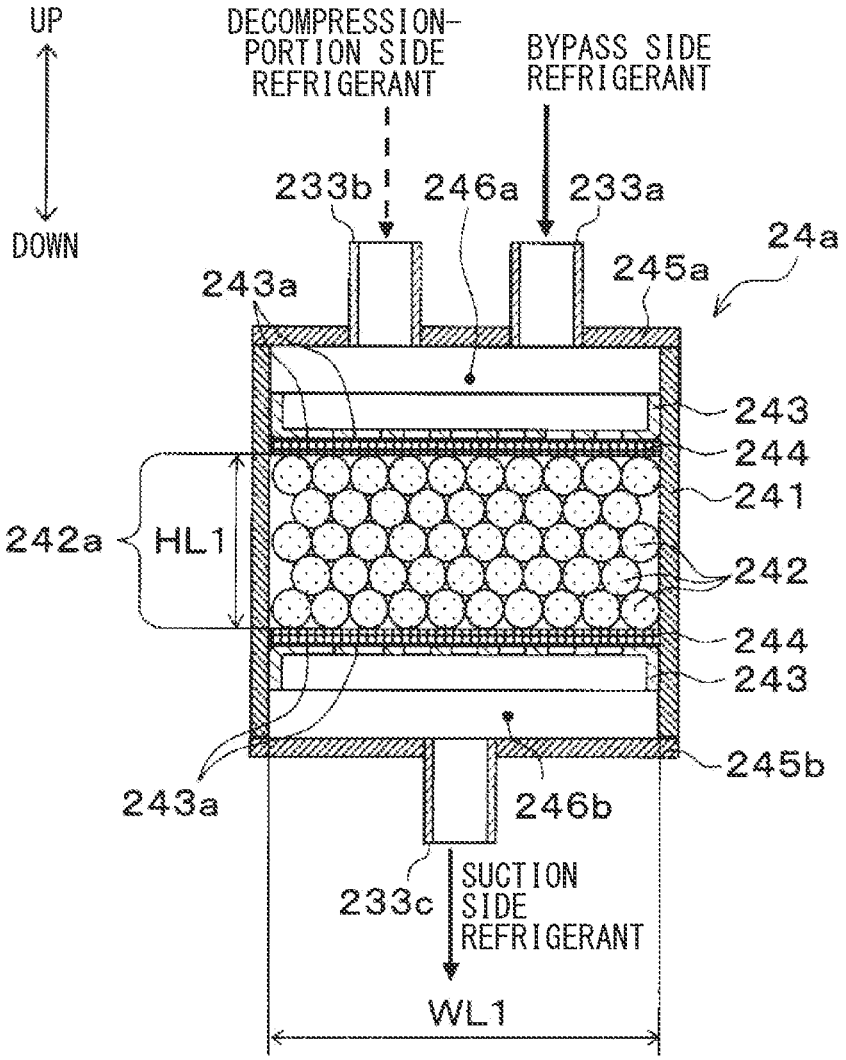
FIG. 17 is an axial sectional view of a mixing portion according to a modification of the second embodiment.

Here, a modification of the mixing portion 24 will be described. For example, a mixing portion 24*a* illustrated in FIG. 17 may be adopted as the modification of the mixing portion 24. In the mixing portion 24*a*, an axial direction of the body 241 is disposed to be parallel to a vertical direction. A radial length WL1 is greater than an axial length HL1 of the particle-filled layer 242*a*.

Other configurations of the mixing portion 24*a* are similar to those of the mixing portion 24. Accordingly, in the refrigeration cycle device 10, even when the mixing portion 24*a* is adopted, it is possible to obtain the same effect as in the case where the mixing portion 24 is adopted.

In the mixing portion 24*a*, a moving distance of the refrigerant from the refrigerant mixing space 246*a* to the refrigerant collection space 246*b* can be reduced. Accordingly, in the mixing portion 24*a*, a pressure loss generated when the refrigerant passes through the particle-filled layer 242*a* can be reduced.

Figure 18:
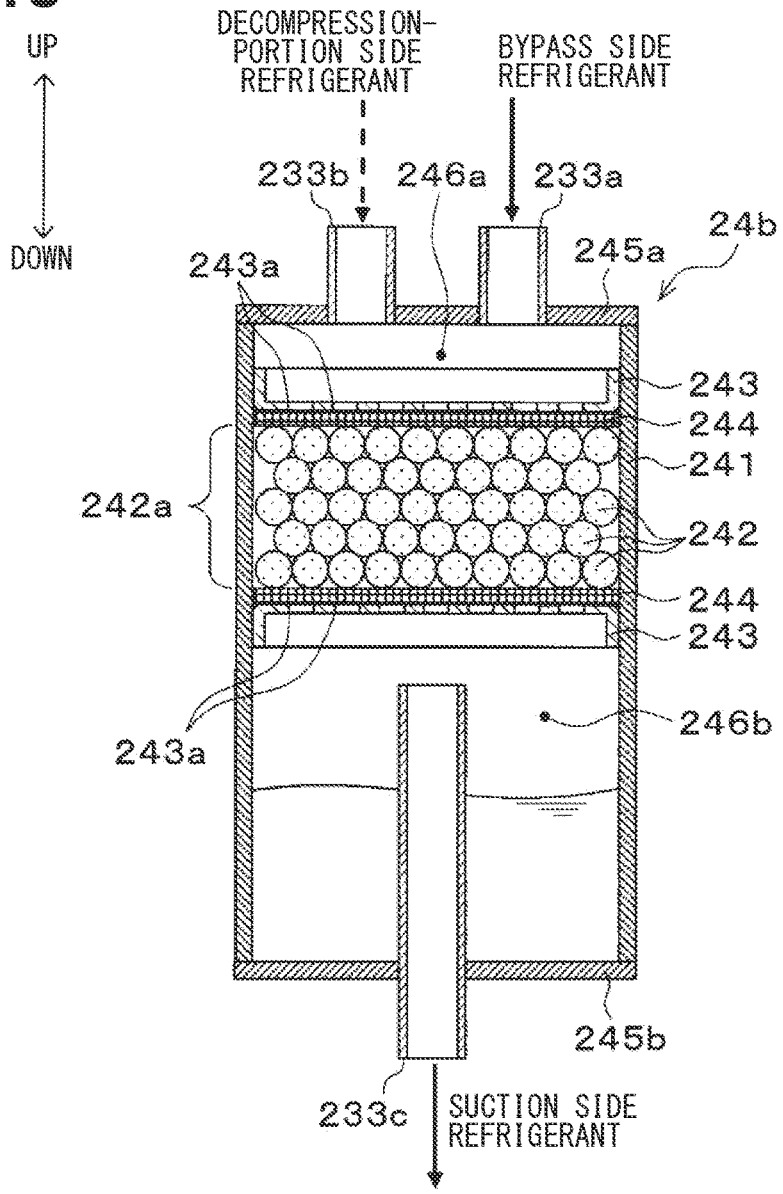
FIG. 18 is an axial sectional view of a mixing portion according to another modification of the second embodiment.

A mixing portion 24*b* illustrated in FIG. 18 may be adopted as the modification of the mixing portion 24. In the mixing portion 24*b*, the axial length of the body 241 is extended more than the mixing portion 24*a*. In the mixing portion 24*b*, the axial length of the mixed refrigerant outflow portion 233*c* is extended more than the mixing portion 24*a*, and the mixed refrigerant outflow portion 233*c* protrudes into the refrigerant collection space 246*b*.

According to this, in the mixing portion 24*b*, the refrigerant collection space 246*b* is enlarged to become a liquid storage space. The surplus refrigerant of the cycle can be stored as the liquid-phase refrigerant in the liquid storage space.

Other configurations of the mixing portion 24*b* are similar to those of the mixing portion 24*a*. Accordingly, in the refrigeration cycle device 10, even when the mixing portion 24*b* is adopted, it is possible to obtain the same effect as in the case where the mixing portion 24*a* is adopted. The bypass side refrigerant and the decompression-portion side refrigerant can be mixed also in the refrigerant collection space 246*b* used as the liquid storage space. Accordingly, variations in the enthalpy of the suction side refrigerant can be more suppressed.

In the mixing portion 24*b*, the refrigerant collection space 246*b* can be used as the liquid storage space. Accordingly, in the refrigeration cycle device 10 using the mixing portion 24*b*, the operation of at least one of the heating expansion valve 14*a*, the air cooling expansion valve 14*b*, the cooling expansion valve 14*c*, or the bypass flow adjustment valve 14*d* only needs to be controlled such that coefficient of performance (COP) of the cycle approaches a maximum value.

Third Embodiment

Figure 19:
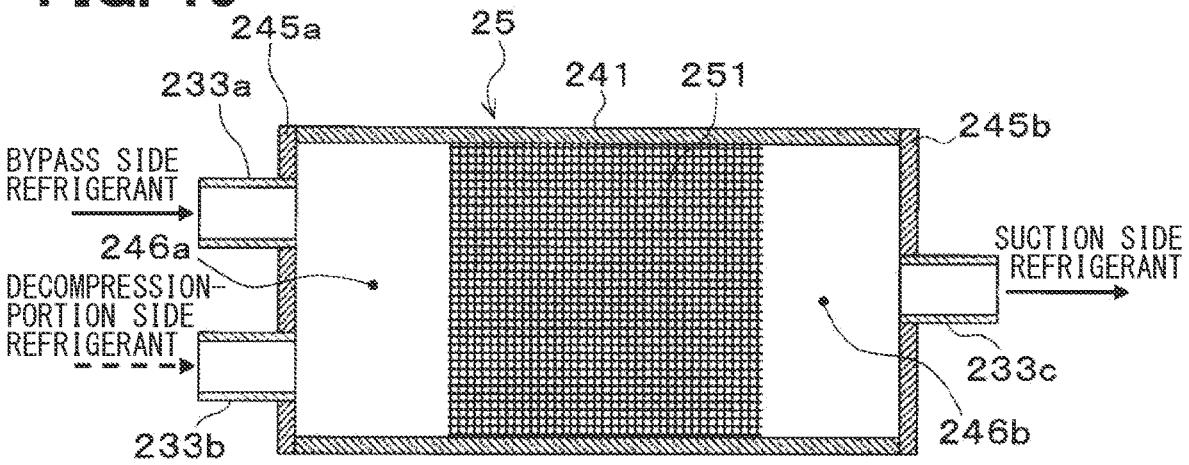
FIG. 19 is an axial sectional view of a mixing portion according to a third embodiment.

In the refrigeration cycle device 10 of the present embodiment, a mixing portion 25 illustrated in FIG. 19 is adopted instead of the mixing portion 23 described in the first embodiment.

The mixing portion 25 has the same basic structure as that of the mixing portion 24 described in the second embodiment. In the mixing portion 25, a porous member 251 is fixed inside the body 241 instead of the particulate member 242, the pressing member 243, and the filter 244, which are described in the second embodiment.

The porous member 251 is a passage forming member that forms a plurality of small-diameter passages for allowing the bypass side refrigerant and the decompression-portion side refrigerant to flow inside the body 241. A plurality of the small-diameter passages communicate with each other.

The corresponding diameters of a plurality of the small-diameter passages are formed to be sufficiently smaller (specifically, 1/10 or less) than the corresponding diameter of the bypass side refrigerant inlet portion 233*a* and the corresponding diameter of the decompression-portion side refrigerant inlet portion 233*b*. In the present embodiment, a metal net-like member formed in a columnar shape is adopted as the porous member 251.

Other configurations and operations of the refrigeration cycle device 10 are similar to those of the first embodiment. Accordingly, in the vehicle air conditioner of the present embodiment, similarly to the first embodiment, the refrigeration cycle device 10 switches the refrigerant circuit according to each operation mode, and thus the comfortable air conditioning in the vehicle interior and the appropriate temperature adjustment of the battery 70 can be performed.

In the present embodiment, the mixing portion 25 is adopted. The mixing portion 25 includes the porous member 251 which is the passage forming member. According to this, flow velocity of the refrigerant is decreased in a plurality of the small-diameter passages having a small corresponding diameter formed by the porous member 251, and the bypass side refrigerant and the decompression-portion side refrigerant can be sufficiently subjected to heat exchange.

Accordingly, in the mixing portion 25, variations in the enthalpy of the suction side refrigerant can be sufficiently suppressed. As a result, the refrigeration cycle device 10 of the present embodiment can also achieve the same effect as that of the first embodiment. That is, when the flow is switched to the refrigerant circuit in which the refrigerants having different enthalpies are mixed and sucked into the compressor 11, a stable heating capacity can be exhibited, and the compressor 11 can be protected.

The porous member 251 enlarges the wetting area of the liquid-phase refrigerant flowing into the mixing portion 25 by forming a plurality of the small-diameter passages. Accordingly, the porous member 251 also has a function as the wetting area enlargement member described in the second embodiment.

Similarly, the particle-filled layer 242*a* described in the second embodiment forms a plurality of the small-diameter passages in the mixing portion 24. Accordingly, the particle-filled layer 242*a* also has a function as the passage forming member.

Fourth Embodiment

Figure 20:
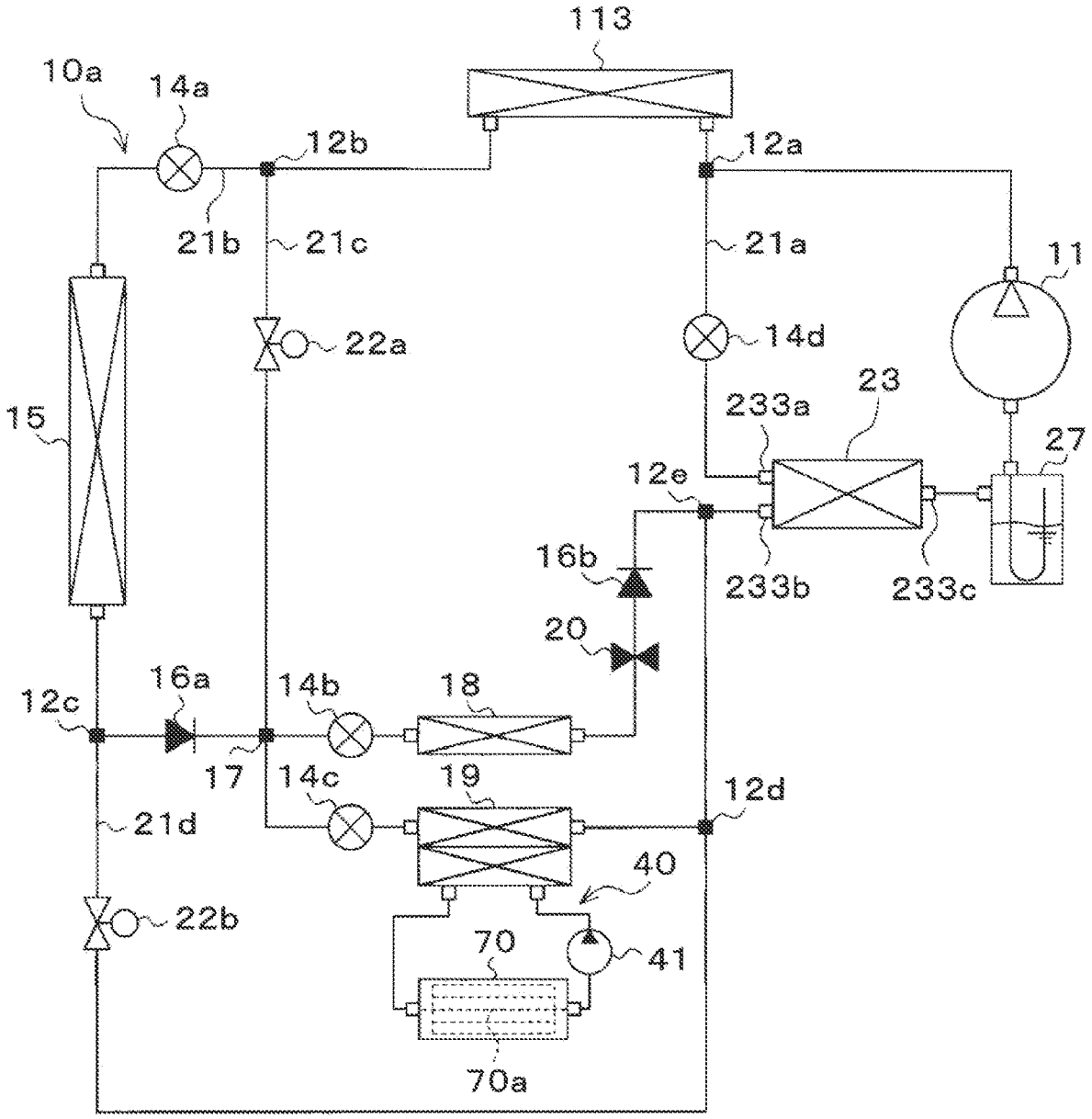
FIG. 20 is a schematic overall configuration diagram of a refrigeration cycle device according to a fourth embodiment.

In the present embodiment, as illustrated in FIG. 20, a refrigeration cycle device 10*a* using an interior condenser 113 instead of the water refrigerant heat exchanger 13 will be described. In the refrigeration cycle device 10*a*, each component constituting the heating-coolant circuit 30 is removed.

The interior condenser 113 is a heating portion that exchanges heat between one refrigerant branched at the first three-way joint 12*a* and the air having passed through the interior evaporator 18 to heat the air. The interior condenser 113 is disposed in the casing 51 of the interior air-conditioning unit 50 in a similar manner to the heater core 32 described in the first embodiment.

In the refrigeration cycle device 10*a*, an inlet side of an accumulator 27 is connected to the mixed refrigerant outflow portion 233*c* of the mixing portion 23. The accumulator 27 is a low-pressure side gas-liquid separator that separates the refrigerant flowing out from the mixed refrigerant outflow portion 233*c* of the mixing portion 23 into gas and liquid, stores the separated liquid-phase refrigerant as a surplus refrigerant in the cycle, and causes the separated gas-phase refrigerant to flow out to a suction port side of the compressor 11.

Therefore, in the present embodiment, the refrigerant flow rate control unit 60*b* of the controller 60 controls the operation of at least one of the heating expansion valve 14*a*, the air cooling expansion valve 14*b*, the cooling expansion valve 14*c*, or the bypass flow adjustment valve 14*d* such that coefficient of performance (COP) of the cycle approaches a maximum value.

Other configurations and operations of the refrigeration cycle device 10*a* are similar to those of the refrigeration cycle device 10 of the first embodiment. Accordingly, in the vehicle air conditioner of the present embodiment, similarly to the first embodiment, the refrigeration cycle device 10*a* switches the refrigerant circuit according to each operation mode, and thus the comfortable air conditioning in the vehicle interior and the appropriate temperature adjustment of the battery 70 can be performed.

Since the refrigeration cycle device 10*a* includes the mixing portion 23, similarly to the first embodiment, it is possible to sufficiently suppress variation in the enthalpy of the suction side refrigerant. Accordingly, also in the refrigeration cycle device 10*a* of the present embodiment, when the flow is switched to the refrigerant circuit in which the refrigerants having different enthalpies are mixed and sucked into the compressor 11, a stable heating capacity can be exhibited, and the compressor 11 can be protected.

Fifth Embodiment

Figure 21:
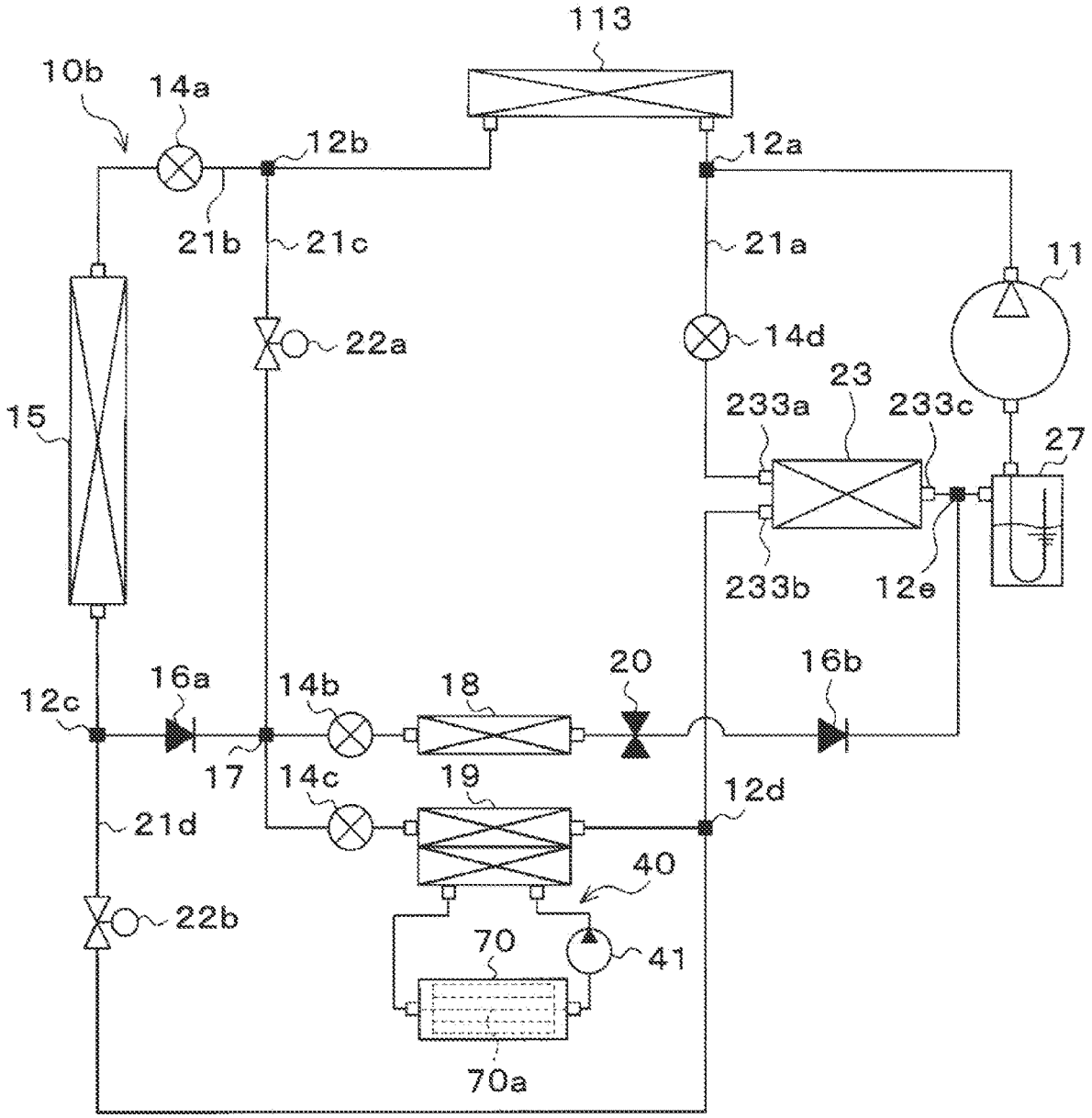
FIG. 21 is a schematic overall configuration diagram of a refrigeration cycle device according to a fifth embodiment.

In the present embodiment, as illustrated in FIG. 21, a refrigeration cycle device 10*b* in which an arrangement of the fifth three-way joint 12*e* is changed will be described as compared with the fourth embodiment.

Specifically, in the refrigeration cycle device 10*b*, an outlet side of the second check valve 16*b* is connected to one inflow port of the fifth three-way joint 12*e*. The mixed refrigerant outflow portion 233*c* side of the mixing portion 23 is connected to the other inflow port of the fifth three-way joint 12*e*. An inlet side of the accumulator 27 is connected to an outflow port of the fifth three-way joint 12*e*.

Therefore, the refrigerant outlet of the interior evaporator 18 is connected to the mixed refrigerant outflow portion 233*c* side of the mixing portion 23 via the evaporating pressure adjustment valve 20 and the second check valve 16*b*.

Other configurations and operations of the refrigeration cycle device 10*b* are similar to those of the refrigeration cycle device 10*a* of the fourth embodiment. Accordingly, in the vehicle air conditioner of the present embodiment, similarly to the fourth embodiment, the refrigeration cycle device 10*b* switches the refrigerant circuit according to each operation mode, and thus the comfortable air conditioning in the vehicle interior and the appropriate temperature adjustment of the battery 70 can be performed.

Since the refrigeration cycle device 10*b* includes the mixing portion 23, similarly to the first embodiment, it is possible to sufficiently suppress variation in the enthalpy of the suction side refrigerant. Accordingly, also in the refrigeration cycle device 10*b* of the present embodiment, when the flow is switched to the refrigerant circuit in which the refrigerants having different enthalpies are mixed and sucked into the compressor 11, a stable heating capacity can be exhibited, and the compressor 11 can be protected.

In the refrigeration cycle device 10*b*, an arrangement of the fifth three-way joint 12*e* is changed, and thus the refrigerant flowing out from the interior evaporator 18 can flow into the accumulator 27 via the evaporating pressure adjustment valve 20 and the second check valve 16*b* in the (a) air cooling mode, the (b) series dehumidifying and heating mode, the (c) parallel dehumidifying and heating mode, and the (d) parallel dehumidifying hot-gas heating mode.

In other words, in each of the operation modes (a) to (d) described above, the refrigerant flowing out from the interior evaporator 18 can flow into the accumulator 27 by bypassing the mixing portion 23 having a relatively large pressure loss. Accordingly, in each of the operation modes (a) to (d) described above, power consumption of the compressor 11 can be decreased, and the coefficient of performance (COP) of the cycle can be improved.

In the refrigeration cycle device 10*b*, when the mode is switched to the (d) parallel dehumidifying hot-gas heating mode, the refrigerant flowing out from the air cooling expansion valve 14*b* cannot flow into the mixing portion 23.

On the other hand, in the (d) parallel dehumidifying hot-gas heating mode, the refrigerant flowing into the interior evaporator 18 is evaporated in order to dehumidify the air, and thus the refrigerant flowing out from the interior evaporator 18 absorbs heat from the air and becomes a refrigerant having a relatively high enthalpy. In the (d) parallel dehumidifying hot-gas heating mode, the flow rate of the refrigerant flowing through the interior evaporator 18 is also reduced as compared with the (a) air cooling mode or the like.

Accordingly, a difference between the enthalpy of the refrigerant flowing out from the interior evaporator 18 and the enthalpy of the refrigerant flowing out from the mixing portion 23 is also relatively small. Accordingly, even when the refrigerant flowing out from the interior evaporator 18 and the refrigerant flowing out from the mixing portion 23 are merged at the fifth three-way joint 12*e*, variation in the enthalpy of the suction side refrigerant does not increase.

In the refrigeration cycle device 10*b* of the present embodiment, the refrigerant flowing out from the interior evaporator 18 and the refrigerant flowing out from the mixing portion 23 can be mixed also in the accumulator 27, and thus variation in the enthalpy of the suction side refrigerant can be further suppressed.

Sixth Embodiment

Figure 22:
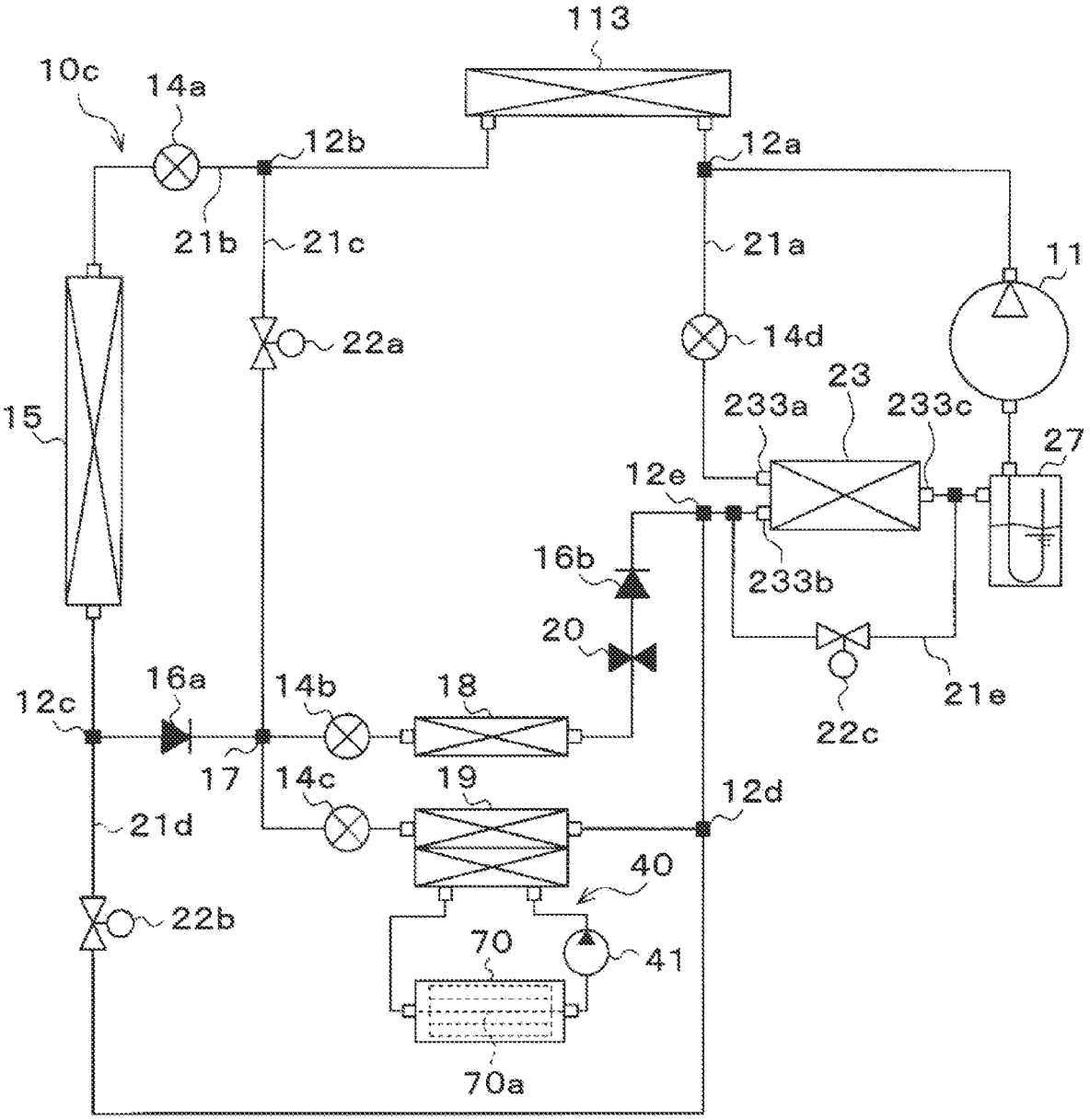
FIG. 22 is a schematic overall configuration diagram of a refrigeration cycle device according to a sixth embodiment.

In the present embodiment, as illustrated in FIG. 22, a refrigeration cycle device 10*c* in which a mixing-portion bypass passage 21*e* and a bypass passage opening/closing valve 22*c* are added will be described as compared with the fourth embodiment.

More specifically, the mixing-portion bypass passage 21*e* is a refrigerant passage that guides the decompression-portion side refrigerant to the mixed refrigerant outflow portion 233*c* side by bypassing the mixing portion 23 from the decompression-portion side refrigerant inlet portion 233*b*. The bypass passage opening/closing valve 22*c* is a bypass passage opening/closing portion that opens and closes the mixing-portion bypass passage 21*e*. The bypass passage opening/closing valve 22*c* is an electromagnetic valve having the same configuration as that of the second passage opening/closing valve 22*a*. Operation of the bypass passage opening/closing valve 22*c* is controlled by the refrigerant circuit control unit 60*c* of the controller 60.

The pressure loss generated when the decompression-portion side refrigerant flows through the mixing-portion bypass passage 21*e* is extremely smaller than the pressure loss generated when the decompression-portion side refrigerant flows through the decompression-portion side refrigerant passage 23*b* of the mixing portion 23. Therefore, when the bypass passage opening/closing valve 22*c* opens the mixing-portion bypass passage 21*e*, the decompression-portion side refrigerant of almost the entire flow rate flows through the mixing-portion bypass passage 21*e* and is guided to the accumulator 27.

Therefore, in the refrigeration cycle device 10*c* of the present embodiment, the refrigerant circuit control unit 60*c* of the controller 60 controls the operation of the bypass passage opening/closing valve 22*c* so as to open the mixing-portion bypass passage 21*e* in the (a) air cooling mode, the (b) series dehumidifying and heating mode, the (c) parallel dehumidifying and heating mode, and the (e) outside air heat-absorption heating mode.

Other configurations and operations of the refrigeration cycle device 10*c* are similar to those of the refrigeration cycle device 10*a* of the fourth embodiment. Accordingly, in the vehicle air conditioner of the present embodiment, similarly to the fourth embodiment, the refrigeration cycle device 10*c* switches the refrigerant circuit according to each operation mode, and thus the comfortable air conditioning in the vehicle interior and the appropriate temperature adjustment of the battery 70 can be performed.

Since the refrigeration cycle device 10*c* includes the mixing portion 23, similarly to the first embodiment, it is possible to sufficiently suppress variation in the enthalpy of the suction side refrigerant. Accordingly, also in the refrigeration cycle device 10*c* of the present embodiment, when the flow is switched to the refrigerant circuit in which the refrigerants having different enthalpies are mixed and sucked into the compressor 11, a stable heating capacity can be exhibited, and the compressor 11 can be protected.

In the refrigeration cycle device 10*c*, in each of the operation modes of the (a) air cooling mode, the (b) series dehumidifying and heating mode, the (c) parallel dehumidifying and heating mode, and the (e) outside air heat-absorption heating mode, the decompression-portion side refrigerant can flow into the accumulator 27 by bypassing the mixing portion 23 having a relatively large pressure loss.

Accordingly, in each of the operation modes of the (a) air cooling mode, the (b) series dehumidifying and heating mode, the (c) parallel dehumidifying and heating mode, and the (e) outside air heat-absorption heating mode, the power consumption of the compressor 11 can be reduced, and the coefficient of performance (COP) of the cycle can be improved.

Seventh Embodiment

Figure 23:
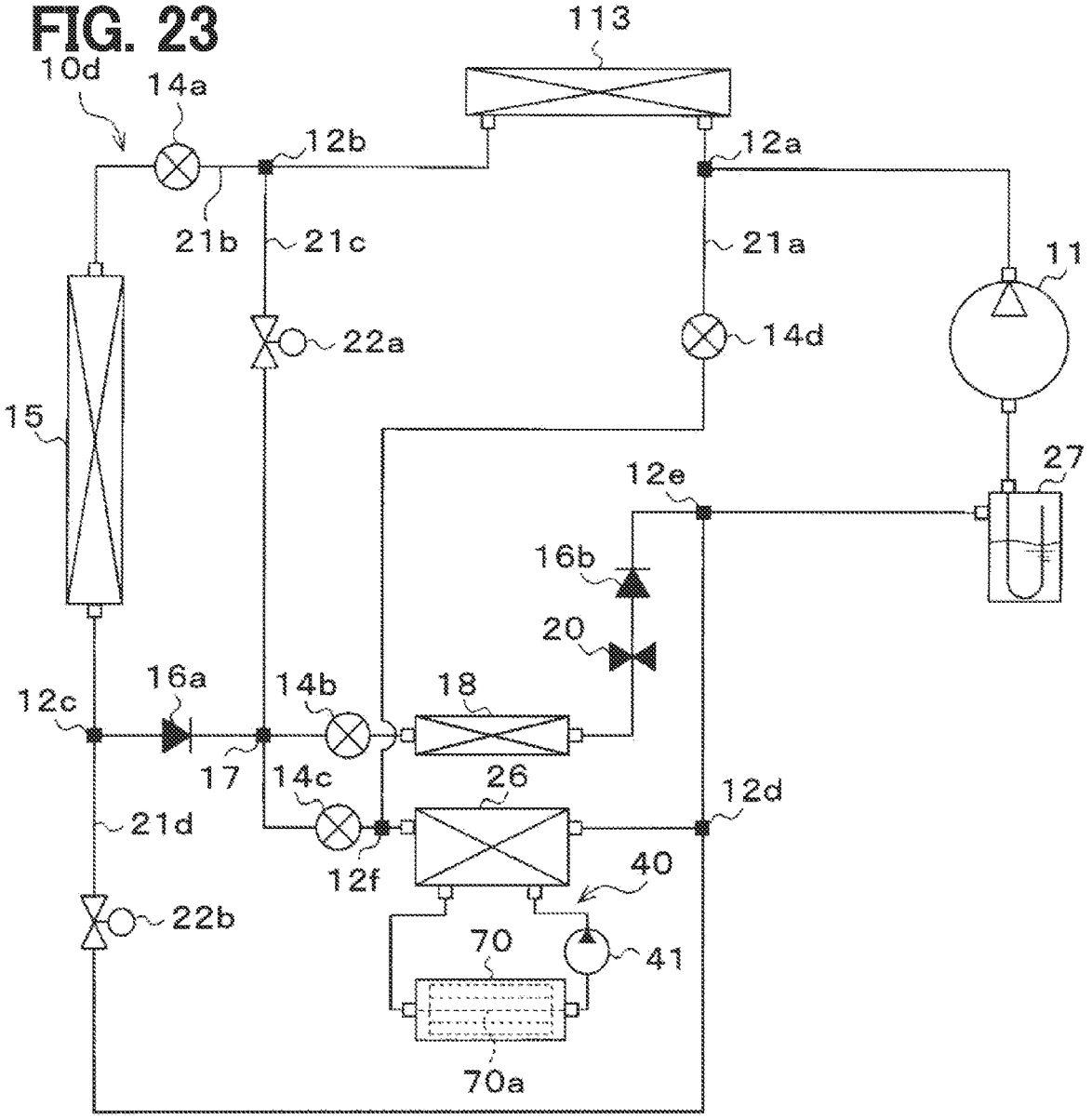
FIG. 23 is a schematic overall configuration diagram of a refrigeration cycle device according to a seventh embodiment.

In the present embodiment, as illustrated in FIG. 23, a refrigeration cycle device 10*d* in which a mixing-portion integrated chiller 26 is adopted will be described as compared with the fourth embodiment.

The mixing-portion integrated chiller 26 is a heat exchange portion configured to be capable of exchanging heat between at least two of the bypass side refrigerant, the decompression-portion side refrigerant, and the device coolant which is a heat exchange target fluid. In the present embodiment, a stacked heat exchanger similar to the mixing portion 23 described in the first embodiment is adopted as the mixing-portion integrated chiller 26.

A specific configuration of the mixing-portion integrated chiller 26 will be described with reference to FIGS. 24 and 25. In the mixing-portion integrated chiller 26, similarly to the mixing portion 23, a plurality of the first heat transfer plate 231*a* and a plurality of the second heat transfer plate 231*b* are alternately stacked. According to this, a refrigerant passage 26*a* and a coolant passage 26*b* are alternately formed between the first heat transfer plate 231*a* and the second heat transfer plate 231*b* which are disposed adjacent to each other.

The refrigerant passage 26*a* is a passage through which the decompression-portion side refrigerant or a merged refrigerant obtained by merging the bypass side refrigerant and the decompression-portion side refrigerant in advance flows. The coolant passage 26*b* is a passage through which the device coolant pumped from the device coolant pump 41 flows.

In the mixing-portion integrated chiller 26, a plurality of the first heat transfer plate 231*a* and a plurality of the second heat transfer plate 231*b* are stacked to form a pair of refrigerant side tank space and coolant side tank space, similarly to the mixing portion 23 described in the first embodiment. A tubular refrigerant inlet portion 263*a*, a tubular refrigerant outlet portion 263*b*, a tubular coolant inlet portion 263*c*, and a coolant outlet portion 263*d* are joined to the end portion heat transfer plate 231*c* disposed at one end portion in the stacking direction.

The refrigerant inlet portion 263*a* is joined to communicate with one refrigerant side tank space. The refrigerant outlet portion 263*b* is joined to communicate with the other refrigerant side tank space. The coolant inlet portion 263*c* is joined to communicate with one coolant side tank space. The coolant outlet portion 263*d* is joined to communicate with the other coolant side tank space.

In the mixing-portion integrated chiller 26, a passage corresponding to the communication passage 235 of the mixing portion 23 described in the first embodiment is not formed. Therefore, the mixed refrigerant flowing through the refrigerant passage 26*a* and the device coolant flowing through the coolant passage 26*b* are not mixed.

Figure 24:
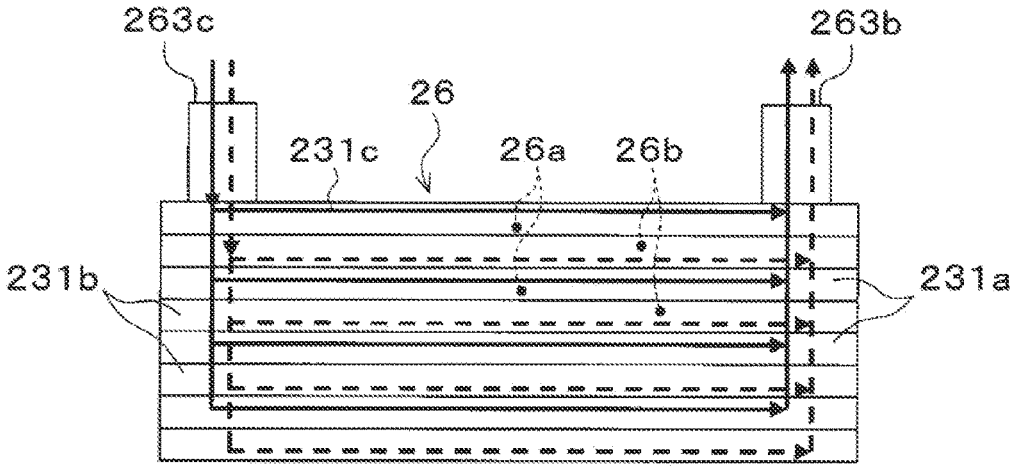
FIG. 24 is a front view of a mixing portion of the seventh embodiment.
Figure 25:
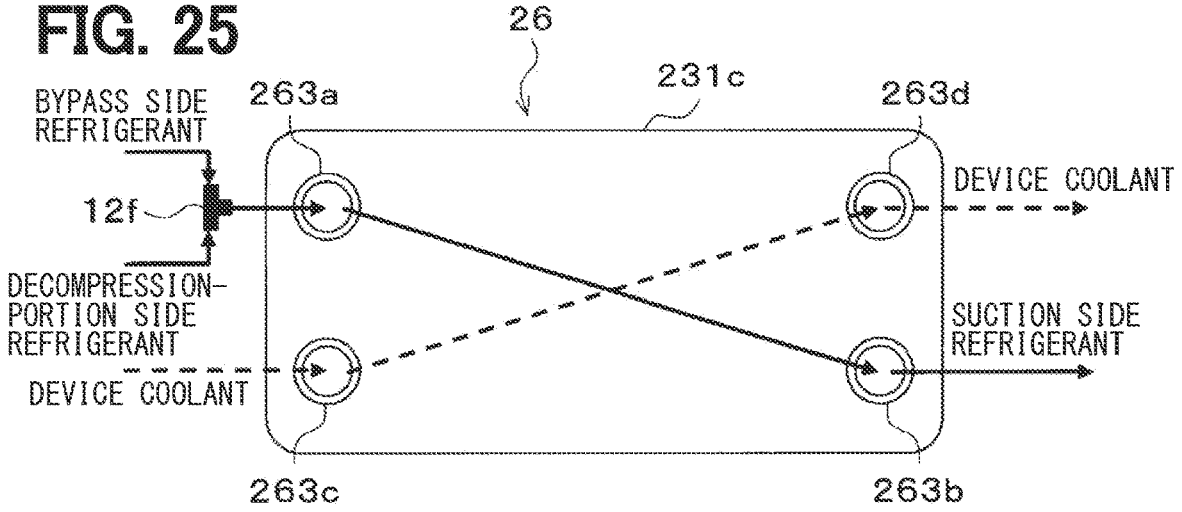
FIG. 25 is a top view of a mixing portion of the seventh embodiment.

Accordingly, the refrigerant flowing in from the refrigerant inlet portion 263*a* flows as indicated by solid arrows in FIG. 24 and flows out from the refrigerant outlet portion 263*b*. The device coolant flowing in from the coolant inlet portion 263*c* flows as indicated by broken line arrows in FIG. 24 and flows out from the coolant outlet portion 263*d*.

As illustrated in FIG. 23, an outflow port side of a sixth three-way joint 12*f* is connected to the refrigerant inlet portion 263*a*. The sixth three-way joint 12*f* is a merging portion that merges the flow of the bypass side refrigerant and the flow of the decompression-portion side refrigerant and causes the merged refrigerant to flow to the refrigerant inlet portion 263*a* of the mixing-portion integrated chiller 26. The sixth three-way joint 12*f* has the same basic structure as that of the first three-way joint 12*a*.

An outlet side of the bypass passage 21*a* is connected to one inflow port of the sixth three-way joint 12*f*. An outlet side of the cooling expansion valve 14*c* is connected to the other inflow port of the sixth three-way joint 12*f*.

Therefore, when the bypass flow adjustment valve 14*d* opens the bypass passage 21*a*, the merged refrigerant obtained by merging the bypass side refrigerant and the decompression-portion side refrigerant at the sixth three-way joint 12*f* can flow into the refrigerant inlet portion 263*a*. When the merged refrigerant flows through the refrigerant passage 26*a*, the bypass side refrigerant and the decompression-portion side refrigerant can be sufficiently mixed to exchange heat with each other.

The suction port side of the compressor 11 is connected to the refrigerant outlet portion 263*b* via the forth three-joint 12*d*.

A discharge port side of the device coolant pump 41 is connected to the coolant inlet portion 263*c*. Therefore, when the device coolant pump 41 is operated, the device coolant pumped from the device coolant pump 41 can flow into the coolant inlet portion 263*c*. When the device coolant flows through the coolant passage 26*b*, heat can be exchanged with the refrigerant flowing through the refrigerant passage 26*a*.

The inlet side of the coolant passage 70*a* of the battery 70 is connected to the coolant outlet portion 263*d*.

In the present embodiment, as the mixing-portion integrated chiller 26, a heat exchanger having a heat exchange capacity to the extent that the enthalpy of the suction side refrigerant actually flowing out from the refrigerant outlet portion 263*b* to the suction port side of the compressor 11 is substantially equal to the enthalpy of the ideal mixed refrigerant in the hot-gas heating mode is adopted.

Other configurations and operations of the refrigeration cycle device 10*d* are similar to those of the refrigeration cycle device 10*a* of the fourth embodiment. Accordingly, in the vehicle air conditioner of the present embodiment, similarly to the fourth embodiment, the refrigeration cycle device 10*d* switches the refrigerant circuit according to each operation mode, and thus the comfortable air conditioning in the vehicle interior and the appropriate temperature adjustment of the battery 70 can be performed.

Since the refrigeration cycle device 10*d* includes the mixing-portion integrated chiller 26, similarly to the first embodiment, it is possible to sufficiently suppress variation in the enthalpy of the suction side refrigerant. Accordingly, also in the refrigeration cycle device 10*d* of the present embodiment, when the flow is switched to the refrigerant circuit in which the refrigerants having different enthalpies are mixed and sucked into the compressor 11, a stable heating capacity can be exhibited, and the compressor 11 can be protected.

In the mixing-portion integrated chiller 26, the decompression-portion side refrigerant flowing out from the cooling expansion valve 14*c* and the bypass side refrigerant flowing through the bypass passage 21*a* can be mixed. However, in the mixing-portion integrated chiller 26, the decompression-portion side refrigerant flowing out from the exterior heat exchanger 15 and the bypass side refrigerant cannot be mixed.

Therefore, in the (d) parallel dehumidifying hot-gas heating mode and the (f) outside air heat-absorption hot-gas heating mode of the present embodiment, the decompression-portion side refrigerant flowing out from the exterior heat exchanger 15 and the refrigerant flowing out from the mixing-portion integrated chiller 26 are merged at the forth three-joint 12*d*.

In the (d) parallel dehumidifying hot-gas heating mode and the (f) outside air heat-absorption hot-gas heating mode, the decompression-portion side refrigerant flowing out from the exterior heat exchanger 15 becomes the refrigerant having the relatively high enthalpy in which heat is absorbed from the outside air in the exterior heat exchanger 15. Accordingly, even when the decompression-portion side refrigerant flowing out from the exterior heat exchanger 15 and the refrigerant flowing out from the mixing-portion integrated chiller 26 are merged at the forth three-joint 12*d*, variation in the enthalpy of the suction side refrigerant does not increase.

The mixing-portion integrated chiller 26 of the present embodiment is configured to be capable of exchanging heat among the bypass side refrigerant, the decompression-portion side refrigerant, and the device coolant. Accordingly, the heat of the device coolant can be absorbed by the decompression-portion side refrigerant having a relatively low enthalpy to cool the device coolant. The heat of the bypass side refrigerant having a relatively high enthalpy can be radiated to the device coolant to heat the device coolant.

In the (g) hot-gas heating mode of the refrigeration cycle device 10*d* of the present embodiment, the mixed refrigerant obtained by mixing the bypass side refrigerant having a relatively high enthalpy and the decompression-portion side refrigerant having a relatively low enthalpy in advance can flow into the mixing-portion integrated chiller 26. Therefore, the temperature of the device coolant can be maintained at a constant value by adjusting the pressure (or temperature) of the refrigerant flowing into the mixing-portion integrated chiller 26 so as to approach a predetermined value.

Therefore, for example, when the temperature of the heat generating device (in the present embodiment, the battery 70) is decreased as in starting at a low outside air temperature, the device coolant can be heated to warm up the heat generating device. When the temperature of the heat generating device increases due to self-heating or the like, the heat generating device can be cooled by the device coolant.

Eighth Embodiment

Figure 26:
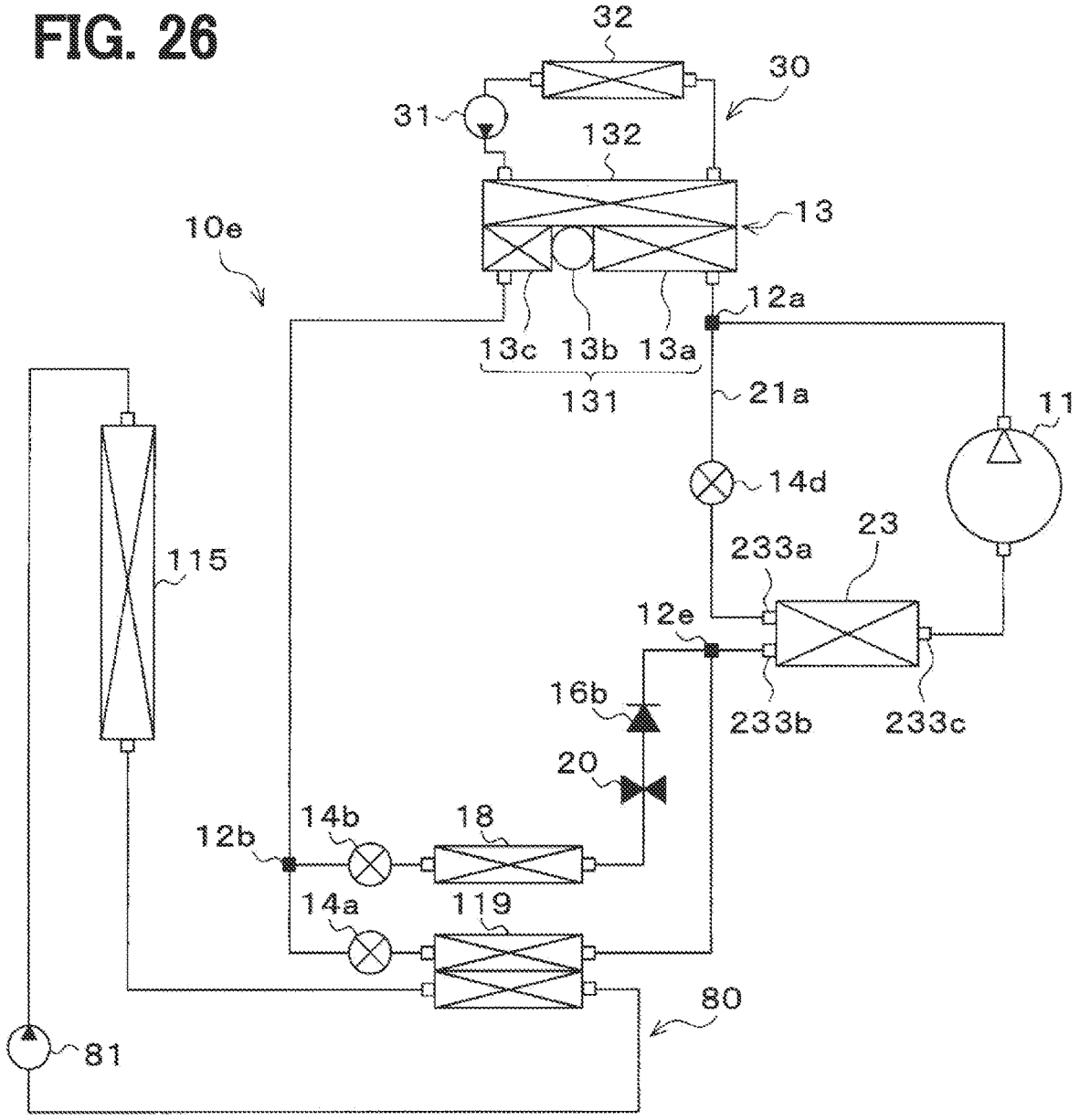
FIG. 26 is a schematic overall configuration diagram of a refrigeration cycle device according to an eighth embodiment.

In the present embodiment, as illustrated in FIG. 26, a refrigeration cycle device 10*e* in which the refrigerant circuit is changed will be described as compared with the first embodiment. The vehicle air conditioner to which the refrigeration cycle device 10*e* is applied does not have a function of cooling the heat generating device. Therefore, in the refrigeration cycle device 10*e*, the chiller 19 and the device coolant circuit 40 are removed.

In the refrigeration cycle device 10*e*, the second passage opening/closing valve 22*a* and the four-way joint 17 are removed. Therefore, the inlet side of the air cooling expansion valve 14*b* is connected to the other outflow port of the second three-way joint 12*b*.

In the refrigeration cycle device 10*e*, the exterior heat exchanger 15, the third three-way joint 12*c*, the forth three-joint 12*d*, the first check valve 16*a*, the low-pressure passage 21*d*, and the low-pressure passage opening/closing valve 22*b* are removed. Therefore, the refrigerant inlet side of an outside air heat absorption chiller 119 is connected to the outlet of the heating expansion valve 14*a*. The heating expansion valve 14*a* of the present embodiment is an outside air heat absorption chiller flow rate adjustment portion that adjusts the flow rate (mass flow rate) of the refrigerant flowing into the outside air heat absorption chiller 119.

The outside air heat absorption chiller 119 is a heat absorption portion that exchanges heat between the low-pressure refrigerant decompressed by the heating expansion valve 14*a* and an outside air heat absorption coolant circulating in an outside air heat absorption coolant circuit 80 to evaporate the low-pressure refrigerant. The outside air heat absorption coolant is a heat source fluid. In the present embodiment, a stacked heat exchanger similar to the mixing-portion integrated chiller 26 described in the seventh embodiment is adopted as the outside air heat absorption chiller 119. The other inflow port side of the fifth three-way joint 12*e* is connected to the refrigerant outlet of the outside air heat absorption chiller 119.

Next, an outside air heat absorption coolant circuit 80 will be described. The outside air heat absorption coolant circuit 80 is an outside air heat absorption heat medium circuit that circulates the outside air heat absorption coolant. As the outside air heat absorption coolant, a heat medium similar to the heating-coolant can be adopted. As illustrated in FIG. 26, the outside air heat absorption coolant circuit 80 includes a water passage of the outside air heat absorption chiller 119, an outside air heat absorption coolant pump 81, and an outside air heat exchanger 115.

The outside air heat absorption coolant pump 81 is a water pump that pumps the refrigerant flowing out from the water passage of the outside air heat absorption chiller 119 to the coolant inlet side of the outside air heat exchanger 115. The outside air heat absorption coolant pump 81 has the same basic structure as that of the heating-coolant pump 31.

The outside air heat exchanger 115 is an exterior heat exchange portion that exchanges heat between the outside air heat absorption coolant pumped from the device coolant pump 41 and the outside air ventilated by an outside air fan (not illustrated). Similarly to the exterior heat exchanger 15 described in the first embodiment, the outside air heat exchanger 115 is disposed on a front side of the drive device room. The inlet side of the water passage of the outside air heat absorption chiller 119 is connected to a coolant outlet of the outside air heat exchanger 115.

Other configurations of the refrigeration cycle device 10*e* are similar to those of the refrigeration cycle device 10 described in the first embodiment.

Next, operation of the vehicle air conditioner of the present embodiment having the above configuration will be described. In the vehicle air conditioner of the present embodiment, various operation modes are switched in order to perform air conditioning of the vehicle interior.

Specifically, in the vehicle air conditioner of the present embodiment, an operation mode corresponding to the (c) parallel dehumidifying and heating mode, the (d) parallel dehumidifying hot-gas heating mode, the (e) outside air heat-absorption heating mode, the (f) outside air heat-absorption hot-gas heating mode, or the (g) hot-gas heating mode, which is described in the first embodiment, can be switched. In the vehicle air conditioner of the present embodiment, the operation in the device cooling mode is not performed. Hereinafter, the operation of each operation mode will be described in detail.

(c) Parallel Dehumidifying and Heating Mode

The parallel dehumidifying and heating mode of the present embodiment is an operation mode that is switched when the outside air temperature Tam is equal to or higher than 0° C. In the parallel dehumidifying and heating mode, the controller 60 makes the heating expansion valve 14*a* in a throttled state, the air cooling expansion valve 14*b* in the throttled state, and the bypass flow adjustment valve 14*d* in a fully closed state.

Figure 27:
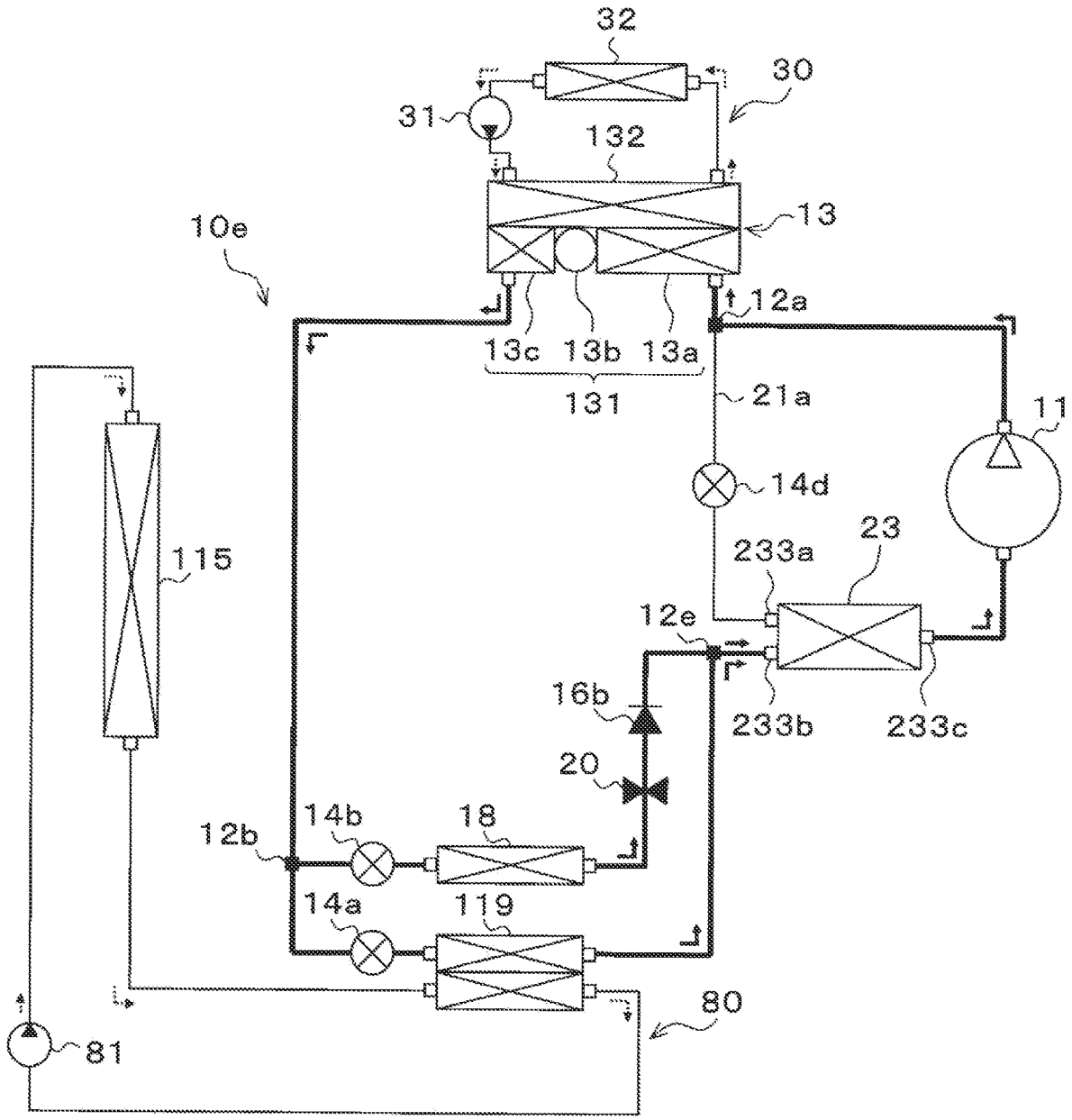
FIG. 27 is a schematic overall configuration diagram illustrating a refrigerant flow in a parallel dehumidifying and heating mode of a refrigeration cycle device according to the eighth embodiment.

Therefore, in the refrigeration cycle device 10*e* in the parallel dehumidifying and heating mode, as indicated by solid arrows in FIG. 27, the refrigerant discharged from the compressor 11 circulates through the water refrigerant heat exchanger 13, the second three-way joint 12*b*, the air cooling expansion valve 14*b*, the interior evaporator 18, the evaporating pressure adjustment valve 20, the second check valve 16*b*, the mixing portion 23, and the suction port of the compressor 11 in this order. At the same time, the refrigerant discharged from compressor 11 circulates through the water refrigerant heat exchanger 13, the second three-way joint 12*b*, the heating expansion valve 14*a*, the outside air heat absorption chiller 119, the mixing portion 23, and the suction port of compressor 11 in this order.

That is, in the parallel dehumidifying and heating mode, the flow of the refrigerant flowing out from the refrigerant passage 131 of the water refrigerant heat exchanger 13 is switched to the refrigerant circuit in which the interior evaporator 18 is connected to the outside air heat absorption chiller 119 in parallel. In a similar manner to the parallel dehumidifying and heating mode of the first embodiment, the controller 60 appropriately controls the operation of other control target devices.

Accordingly, in the refrigeration cycle device 10*e* in the parallel dehumidifying and heating mode, the vapor compression refrigeration cycle is configured in which the water refrigerant heat exchanger 13 functions as a condenser and the interior evaporator 18 and the outside air heat absorption chiller 119 function as an evaporator.

In the water refrigerant heat exchanger 13, the refrigerant radiates heat to the heating-coolant and is condensed. According to this, the heating-coolant is heated. In the interior evaporator 18, the refrigerant absorbs heat from the air and is evaporated. According to this, the air is cooled. In the outside air heat absorption chiller 119, the refrigerant absorbs heat from the outside air heat absorption coolant and is evaporated. According to this, the outside air heat absorption coolant is cooled.

In the heating-coolant circuit 30 in the parallel dehumidifying and heating mode, as indicated by a thin broken line arrow in FIG. 27, the heating-coolant heated by the water refrigerant heat exchanger 13 is pumped to the heater core 32. The heating-coolant flowing into the heater core 32 radiates heat to the air cooled by the interior evaporator 18. According to this, the air is heated.

In the outside air heat absorption coolant circuit 80 in the parallel dehumidifying and heating mode, as indicated by a thin broken line arrow in FIG. 27, the outside air heat absorption coolant cooled by the outside air heat absorption chiller 119 is pumped to the outside air heat exchanger 115. The heating-coolant flowing into the outside air heat exchanger 115 absorbs heat from the outside air and the temperature of the heating-coolant increases.

In the interior air-conditioning unit 50 in the parallel dehumidifying and heating mode, similarly to the first embodiment, the air cooled and dehumidified by the interior evaporator 18 is reheated by the heater core 32 and blown into the vehicle interior. According to this, dehumidifying and heating of the vehicle interior is realized.

In the refrigeration cycle device 10*e* in the parallel dehumidifying and heating mode, similarly to the first embodiment, the refrigerant evaporating temperature in the outside air heat absorption chiller 119 can be lower than the refrigerant evaporating temperature in the interior evaporator 18.

According to this, the heating capacity of the air is improved, and dehumidifying and heating of the vehicle interior can be performed in a wide temperature range.

(d) Parallel Dehumidifying Hot-Gas Heating Mode

In the parallel dehumidifying hot-gas heating mode, the controller 60 makes the heating expansion valve 14*a* in a throttled state, the air cooling expansion valve 14*b* in the throttled state, and the bypass flow adjustment valve 14*d* in the throttled state.

Figure 28:
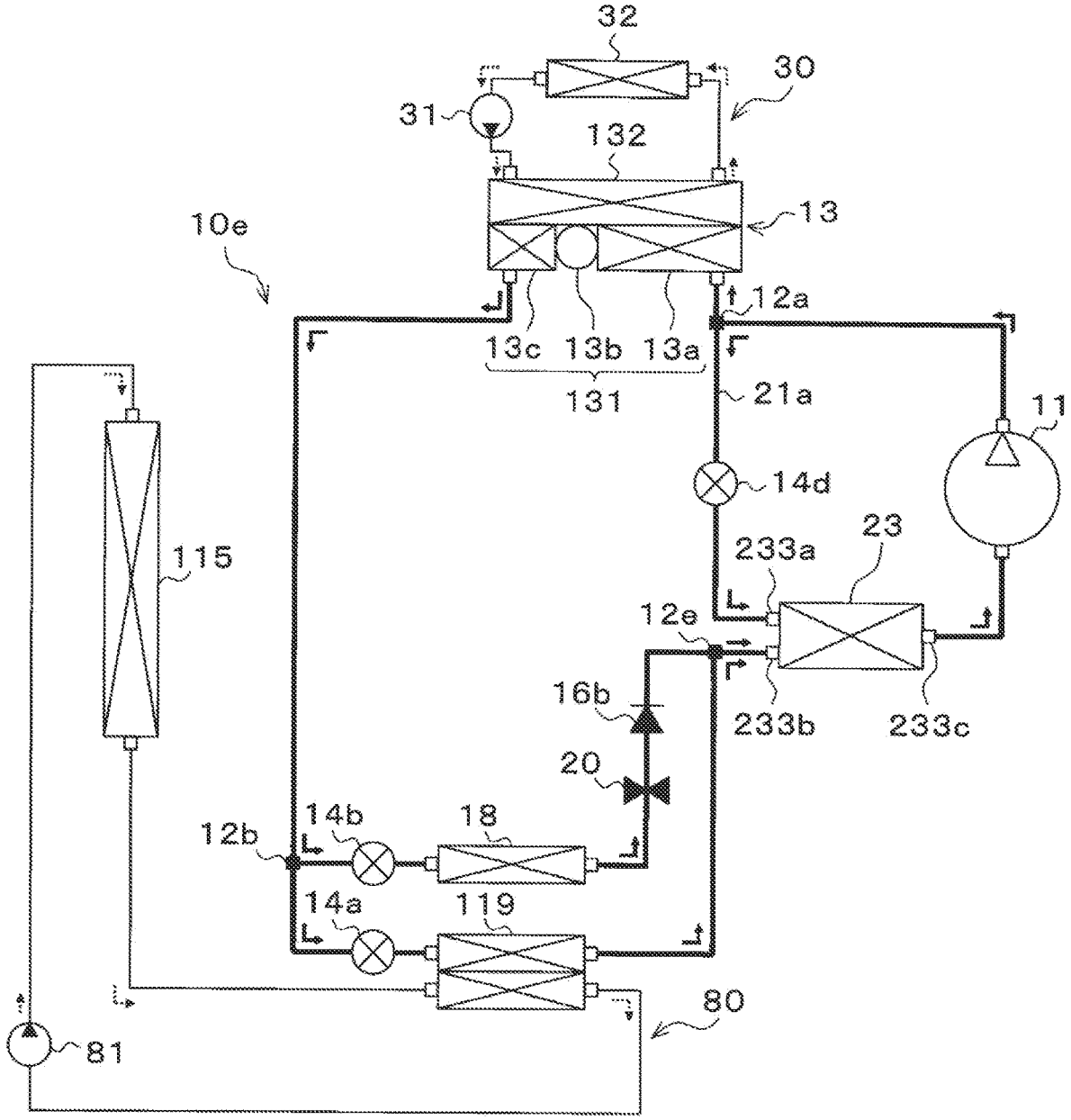
FIG. 28 is a schematic overall configuration diagram illustrating a refrigerant flow in a parallel dehumidifying hot-gas heating mode of a refrigeration cycle device according to the eighth embodiment.

Therefore, the in refrigeration cycle device 10*e* in the parallel dehumidifying hot-gas heating mode, as indicated by solid arrows in FIG. 28, the refrigerant circulates in a similar manner to the parallel dehumidifying and heating mode. At the same time, a part of the refrigerant discharged from the compressor 11 circulates through the mixing portion 23, and the suction port of the compressor 11 in this order via the bypass passage 21*a*. Similarly to the first embodiment, the controller 60 appropriately controls the operation of other control target devices.

Accordingly, in the refrigeration cycle device 10*e* in the parallel dehumidifying hot-gas heating mode, in a similar manner to the parallel dehumidifying and heating mode, the vapor compression refrigeration cycle is configured in which the water refrigerant heat exchanger 13 functions as a condenser and the interior evaporator 18 and the outside air heat absorption chiller 119 function as an evaporator.

In the water refrigerant heat exchanger 13, the refrigerant radiates heat to the heating-coolant and is condensed. According to this, the heating-coolant is heated. In the interior evaporator 18, the refrigerant absorbs heat from the air and is evaporated. According to this, the air is cooled. In the outside air heat absorption chiller 119, the refrigerant absorbs heat from the outside air heat absorption coolant and is evaporated. According to this, the outside air heat absorption coolant is cooled.

In the heating-coolant circuit 30 in the parallel dehumidifying hot-gas heating mode, as indicated by a thin broken line arrow in FIG. 28, the heating-coolant heated by the water refrigerant heat exchanger 13 is pumped to the heater core 32. The heating-coolant flowing into the heater core 32 radiates heat to the air cooled by the interior evaporator 18. According to this, the air is heated.

In the outside air heat absorption coolant circuit 80 in the parallel dehumidifying hot-gas heating mode, as indicated by a thin broken line arrow in FIG. 28, the outside air heat absorption coolant cooled by the outside air heat absorption chiller 119 is pumped to the outside air heat exchanger 115. The heating-coolant flowing into the outside air heat exchanger 115 absorbs heat from the outside air and the temperature of the heating-coolant increases.

In the interior air-conditioning unit 50 in the parallel dehumidifying hot-gas heating mode, the air cooled and dehumidified by the interior evaporator 18 is reheated by the heater core 32 and blown into the vehicle interior. According to this, dehumidifying and heating of the vehicle interior is realized.

In the refrigeration cycle device 10*e* in the parallel dehumidifying hot-gas heating mode, even when the frosting occurs in the outside air heat exchanger 115, similarly to the first embodiment, it is possible to suppress a decrease in the heating capacity of the air in the parallel dehumidifying and heating mode.

(e) Outside Air Heat-Absorption Heating Mode

In the outside air heat-absorption heating mode, the controller 60 makes the heating expansion valve 14*a* in a throttled state, the air cooling expansion valve 14*b* in a fully closed state, and the bypass flow adjustment valve 14*d* in the fully closed state.

Figure 29:
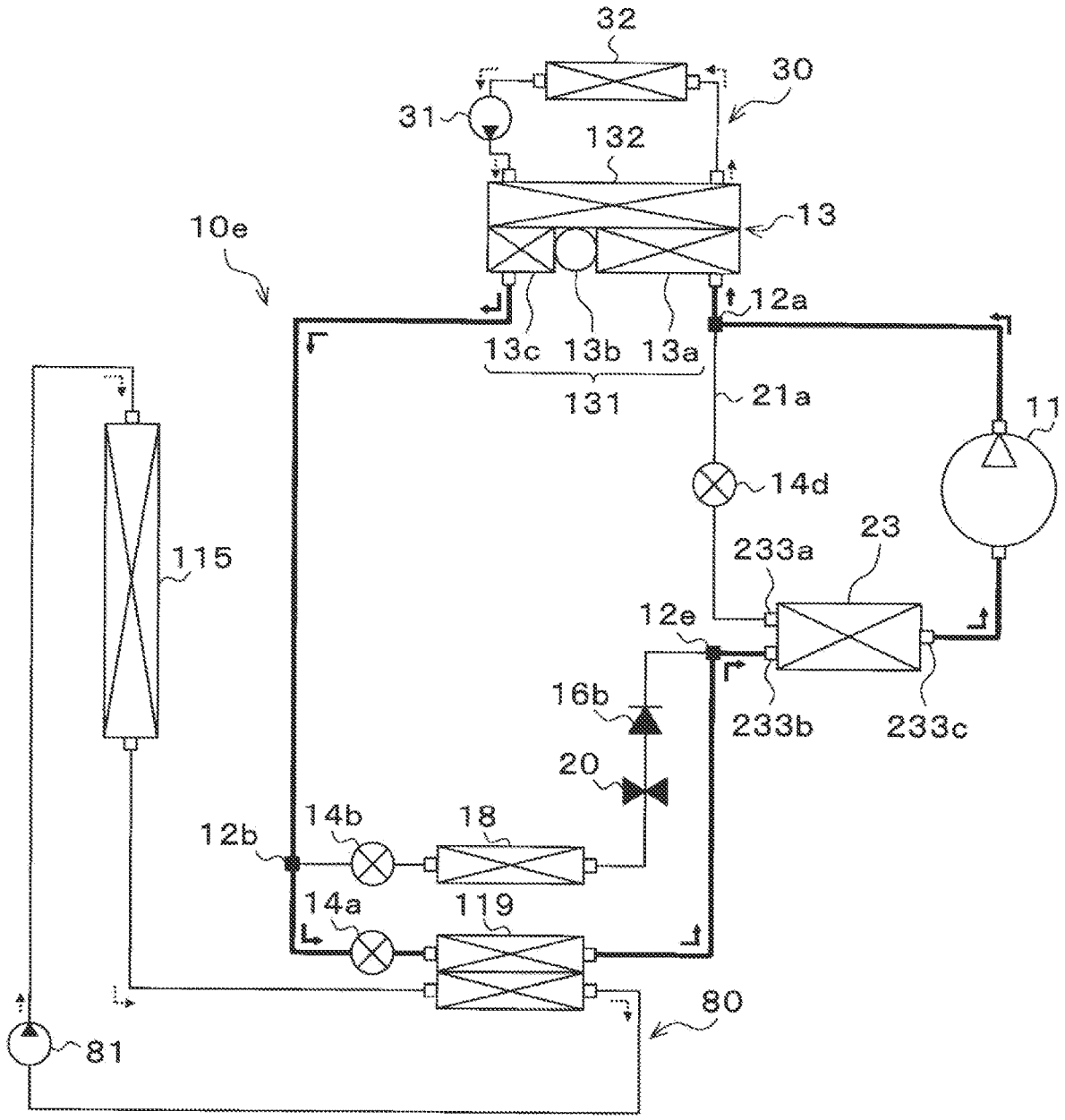
FIG. 29 is a schematic overall configuration diagram illustrating a refrigerant flow in an outside air heat-absorption heating mode of a refrigeration cycle device according to the eighth embodiment.

Therefore, in the refrigeration cycle device 10*e* in the outside air heat-absorption heating mode, as indicated by solid arrows in FIG. 29, the refrigerant discharged from the compressor 11 circulates through the water refrigerant heat exchanger 13, the heating expansion valve 14*a*, the outside air heat absorption chiller 119, the mixing portion 23, and the suction port of the compressor 11 in this order. Similarly to the first embodiment, the controller 60 appropriately controls the operation of other control target devices.

Accordingly, in the refrigeration cycle device 10*e* in the outside air heat-absorption heating mode, the vapor compression refrigeration cycle is configured in which the water refrigerant heat exchanger 13 functions as a condenser and the outside air heat absorption chiller 119 function as an evaporator.

In the water refrigerant heat exchanger 13, the refrigerant radiates heat to the heating-coolant and is condensed. According to this, the heating-coolant is heated. In the outside air heat absorption chiller 119, the refrigerant absorbs heat from the outside air heat absorption coolant and is evaporated. According to this, the outside air heat absorption coolant is cooled.

In the heating-coolant circuit 30 in the outside air heat-absorption heating mode, as indicated by a thin broken line arrow in FIG. 29, the heating-coolant heated by the water refrigerant heat exchanger 13 is pumped to the heater core 32. The heating-coolant flowing into the heater core 32 radiates heat to the air having passed through the interior evaporator 18. According to this, the air is heated.

In the outside air heat absorption coolant circuit 80 in the outside air heat-absorption heating mode, as indicated by a thin broken line arrow in FIG. 29, the outside air heat absorption coolant cooled by the outside air heat absorption chiller 119 is pumped to the outside air heat exchanger 115. The outside air heat absorption coolant flowing into the outside air heat exchanger 115 absorbs heat from the outside air and the temperature of the outside air heat absorption coolant increases.

In the interior air-conditioning unit 50 in the outside air heat-absorption heating mode, the air having passed through the interior evaporator 18 is heated by the heater core 32 and blown into the vehicle interior. According to this, heating of the vehicle interior is realized.

(f) Outside Air Heat-Absorption Hot-Gas Heating Mode

In the outside air heat-absorption hot-gas heating mode, the controller 60 makes the heating expansion valve 14*a* in a throttled state, the air cooling expansion valve 14*b* in a fully closed state, and the bypass flow adjustment valve 14*d* in the throttled state.

Figure 30:
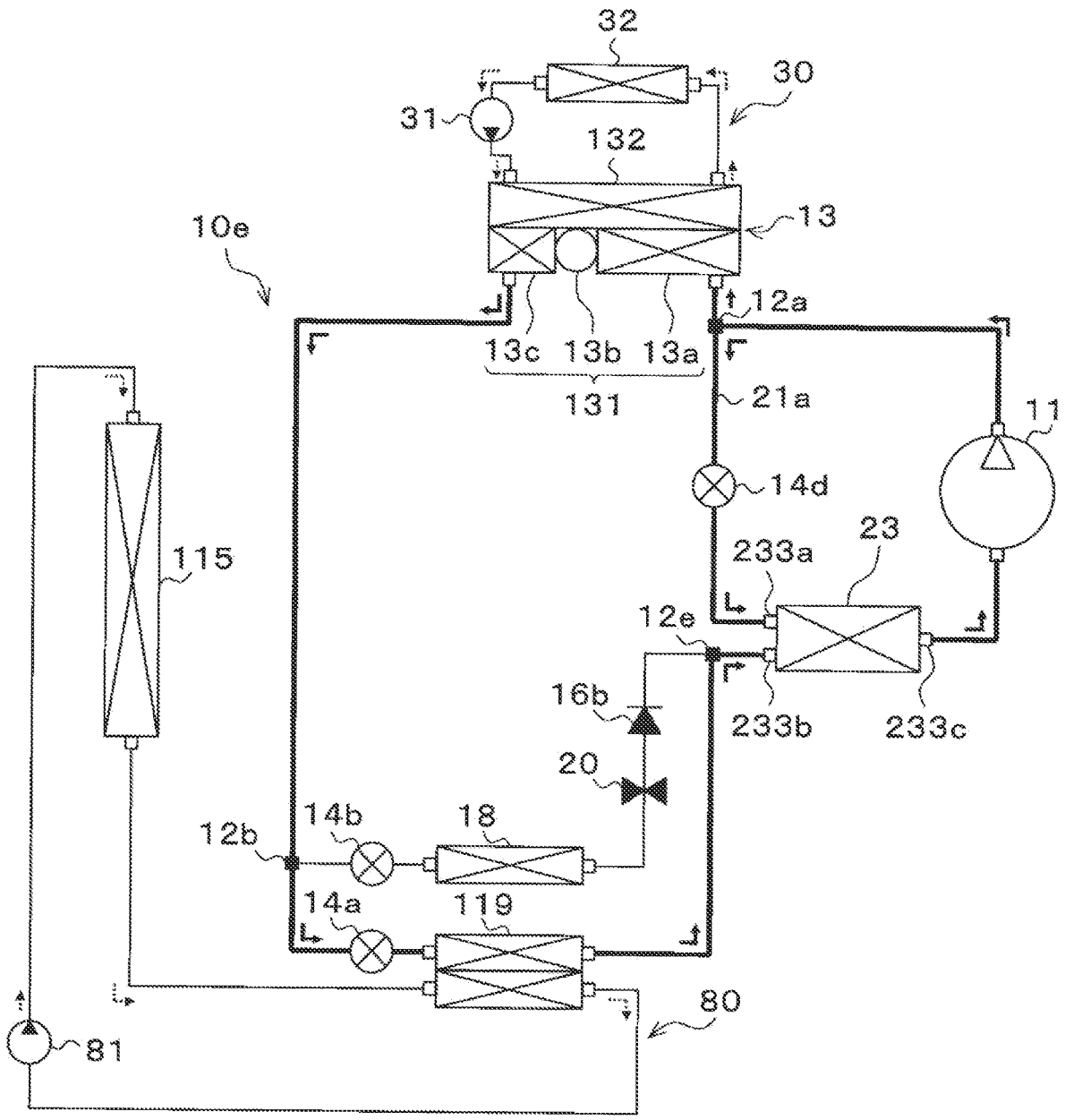
FIG. 30 is a schematic overall configuration diagram illustrating a refrigerant flow in an outside air heat-absorption hot-gas heating mode of a refrigeration cycle device according to the eighth embodiment.

Therefore, the in refrigeration cycle device 10 in the outside air heat-absorption hot-gas heating mode, as indicated by solid arrows in FIG. 30, the refrigerant circulates in a similar manner to the outside air heat-absorption heating mode. At the same time, a part of the refrigerant discharged from the compressor 11 circulates through the mixing portion 23, and the suction port of the compressor 11 in this order via the bypass passage 21*a*. Similarly to the first embodiment, the controller 60 appropriately controls the operation of other control target devices.

Accordingly, in the refrigeration cycle device 10*e* in the outside air heat-absorption hot-gas heating mode, in a similar manner to the outside air heat-absorption heating mode, the vapor compression refrigeration cycle is configured in which the water refrigerant heat exchanger 13 functions as a condenser and the outside air heat absorption chiller 119 function as an evaporator.

In the water refrigerant heat exchanger 13, the refrigerant radiates heat to the heating-coolant and is condensed. According to this, the heating-coolant is heated. In the outside air heat absorption chiller 119, the refrigerant absorbs heat from the outside air heat absorption coolant and is evaporated. According to this, the outside air heat absorption coolant is cooled.

In the heating-coolant circuit 30 in the outside air heat-absorption hot-gas heating mode, as indicated by a thin broken line arrow in FIG. 30, the heating-coolant heated by the water refrigerant heat exchanger 13 is pumped to the heater core 32. The heating-coolant flowing into the heater core 32 radiates heat to the air having passed through the interior evaporator 18. According to this, the air is heated.

In the outside air heat absorption coolant circuit 80 in the outside air heat-absorption hot-gas heating mode, as indicated by a thin broken line arrow in FIG. 30, the outside air heat absorption coolant cooled by the outside air heat absorption chiller 119 is pumped to the outside air heat exchanger 115. The outside air heat absorption coolant flowing into the outside air heat exchanger 115 absorbs heat from the outside air and the temperature of the outside air heat absorption coolant increases.

In the interior air-conditioning unit 50 in the outside air heat-absorption hot-gas heating mode, the air having passed through the interior evaporator 18 is heated by the heater core 32 and blown into the vehicle interior. According to this, heating of the vehicle interior is realized.

In the refrigeration cycle device 10*e* in the outside air heat-absorption hot-gas heating mode, even when the frosting occurs in the outside air heat exchanger 115, similarly to the first embodiment, it is possible to suppress a decrease in the heating capacity of the air in the outside air heat-absorption heating mode.

(g) Hot-Gas Heating Mode

In the hot-gas heating mode, the controller 60 makes the heating expansion valve 14*a* in a throttled state, the air cooling expansion valve 14*b* in a fully closed state, and the bypass flow adjustment valve 14*d* in the throttled state.

Figure 31:
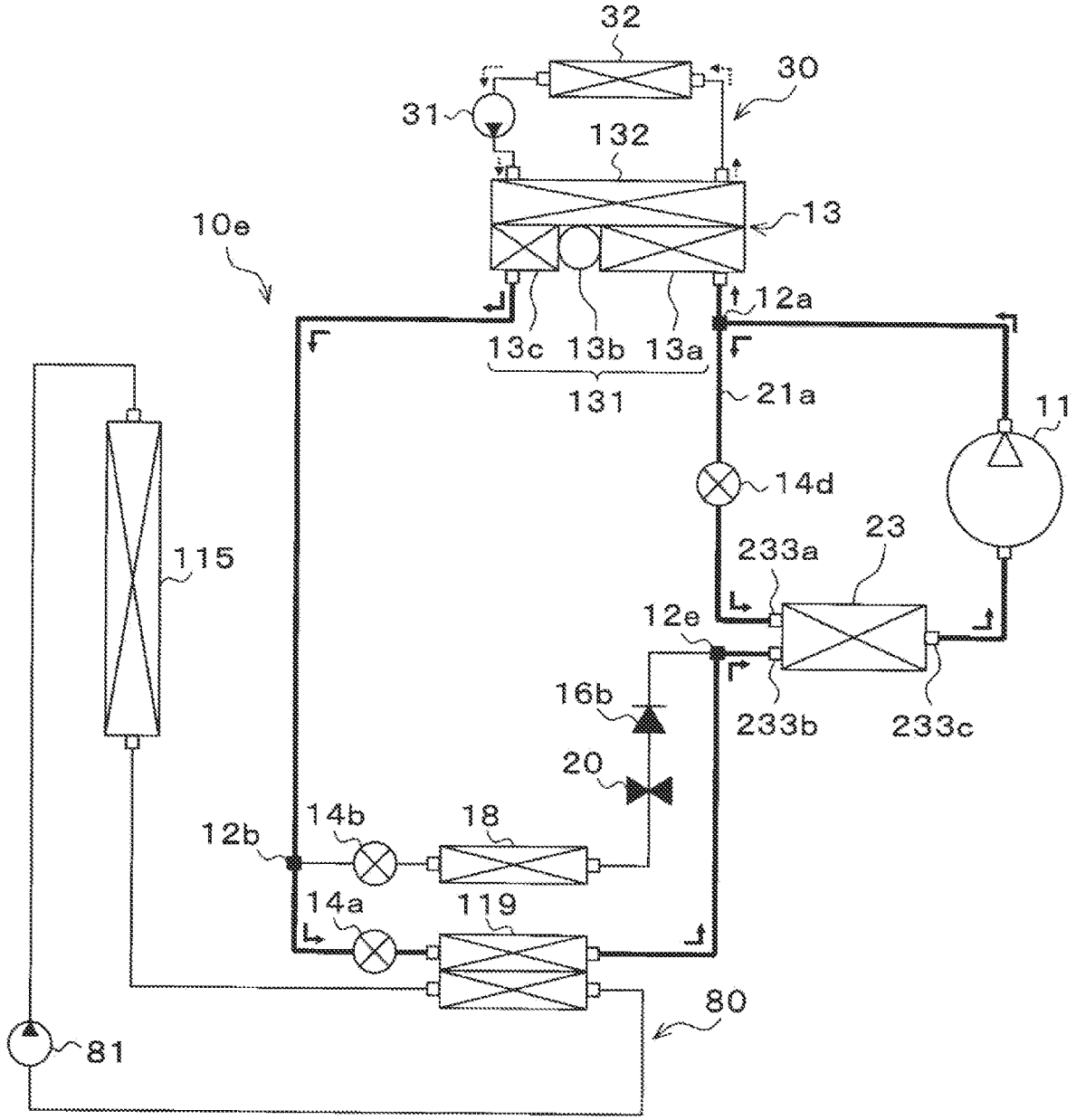
FIG. 31 is a schematic overall configuration diagram illustrating a refrigerant flow in a hot-gas heating mode of a refrigeration cycle device according to the eighth embodiment.

Therefore, in the refrigeration cycle device 10 in the hot-gas heating mode, as indicated by solid arrows in FIG. 31, the refrigerant discharged from the compressor 11 circulates through the first three-way joint 12*a*, the outside air heat absorption chiller 119, the mixing portion 23, and the suction port of the compressor 11 in this order. At the same time, a part of the refrigerant discharged from the compressor 11 circulates through the mixing portion 23, and the suction port of the compressor 11 in this order via the bypass passage 21*a*.

The controller 60 operates the heating-coolant pump 31 so as to exhibit a predetermined reference discharge capacity. The controller 60 stops the outside air heat absorption coolant pump 81. In a similar manner to the hot-gas heating mode of the first embodiment, the controller 60 appropriately controls the operation of other control target devices.

Accordingly, in the refrigeration cycle device 10*e* in the hot-gas heating mode, the refrigerant circuit, in which the water refrigerant heat exchanger 13 functions as a condenser, is configured. In the mixing portion 23, the refrigerant having a relatively low enthalpy and decompressed by the heating expansion valve 14*a*, and the refrigerant having a relatively high enthalpy and decompressed by the bypass flow adjustment valve 14*d* are mixed. The suction side refrigerant flowing out from the mixing portion 23 is sucked into the compressor 11 and is compressed again.

In the hot-gas heating mode, the outside air heat absorption coolant pump 81 is stopped. Accordingly, the refrigerant flowing through the outside air heat absorption chiller 119 hardly absorbs heat from the outside air heat absorption coolant.

In the heating-coolant circuit 30 in the hot-gas heating mode, as indicated by a thin broken line arrow in FIG. 31, the heating-coolant heated by the water refrigerant heat exchanger 13 is pumped to the heater core 32. The heating-coolant flowing into the heater core 32 radiates heat to the air having passed through the interior evaporator 18. According to this, the air is heated.

In the interior air-conditioning unit 50 in the hot-gas heating mode, the air having passed through the interior evaporator 18 is heated by the heater core 32 and blown into the vehicle interior. According to this, heating of the vehicle interior is realized.

In the refrigeration cycle device 10*e* in the hot-gas heating mode, similarly to the first embodiment, it is possible to suppress a decrease in a heating capacity of the air.

As described above, in the vehicle air conditioner of the present embodiment, the refrigeration cycle device 10*e* switches the refrigerant circuit according to each operation mode, and thus comfortable air conditioning in the vehicle interior can be realized.

Since the refrigeration cycle device 10*e* includes the mixing portion 23, similarly to the first embodiment, it is possible to sufficiently suppress variation in the enthalpy of the suction side refrigerant. Accordingly, also in the refrigeration cycle device 10*d* of the present embodiment, when the flow is switched to the refrigerant circuit in which the refrigerants having different enthalpies are mixed and sucked into the compressor 11, a stable heating capacity can be exhibited, and the compressor 11 can be protected.

Ninth Embodiment

Figure 32:
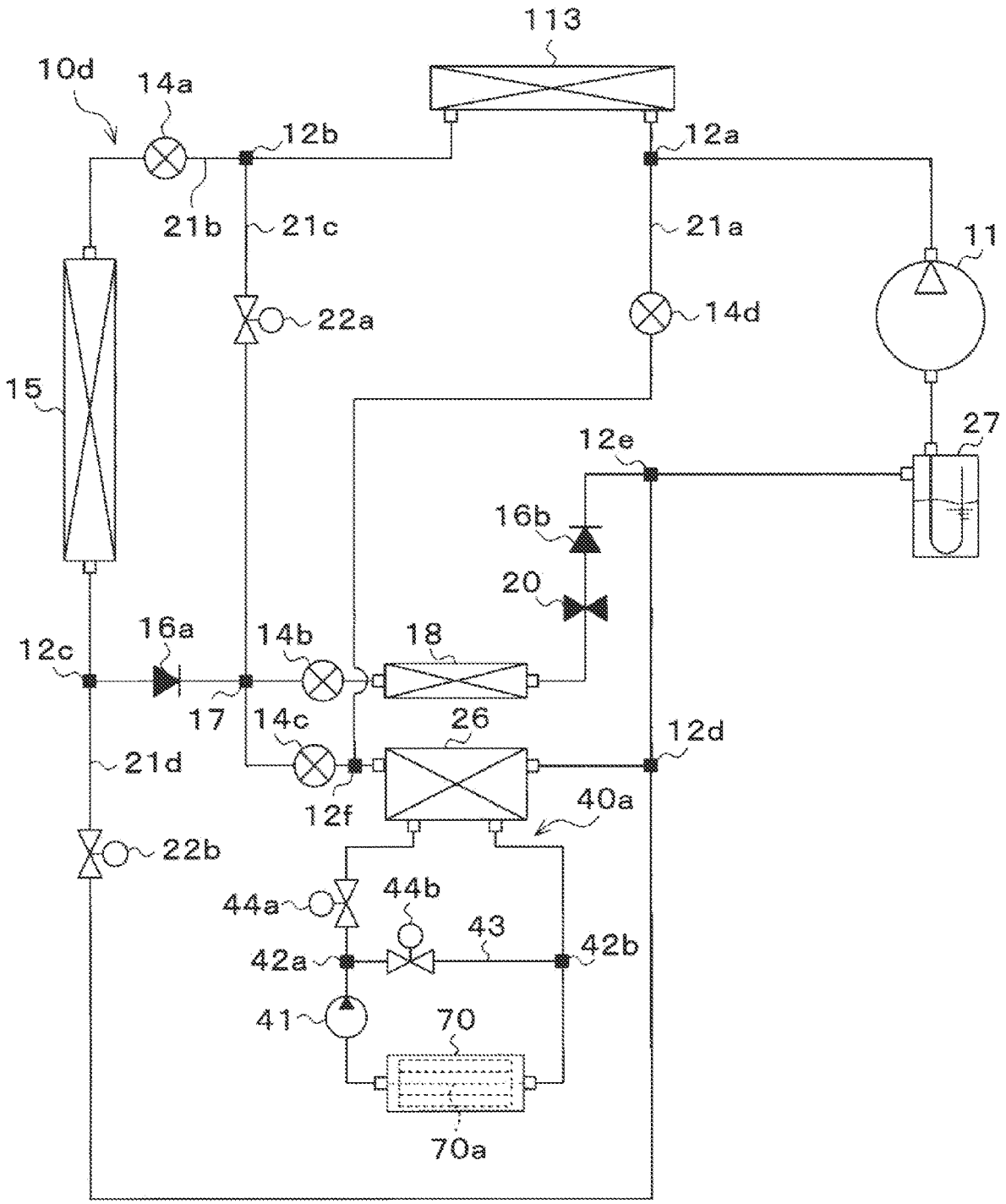
FIG. 32 is a schematic overall configuration diagram of a refrigeration cycle device according to a ninth embodiment.

In the present embodiment, as illustrated in FIG. 32, the refrigeration cycle device 10*d* including a device coolant circuit 40*a* will be described as compared with the seventh embodiment. In addition to the water passage of the mixing-portion integrated chiller 26 and the device coolant pump 41, a first water three-way joint 42*a*, a second water three-way joint 42*b*, a first water opening/closing valve 44*a*, a second water opening/closing valve 44*b*, and the like are connected to the device coolant circuit 40*a*.

In the device coolant circuit 40*a*, the inflow port of the first water three-way joint 42*a* is connected to the discharge port of the device coolant pump 41. The first water three-way joint 42*a* and the second water three-way joint 42*b* are device coolant three-way joints formed in a similar manner to the first three-way joint 12*a* for the refrigerant.

A coolant inlet portion side of the mixing-portion integrated chiller 26 is connected to one outflow port of the first water three-way joint 42*a*. The first water opening/closing valve 44*a* is disposed in the coolant passage from one outflow port of the first water three-way joint 42*a* to the coolant inlet portion of the mixing-portion integrated chiller 26.

The first water opening/closing valve 44*a* is an opening/closing valve that opens and closes the coolant passage from one outflow port of the first water three-way joint 42*a* to the coolant inlet portion of the mixing-portion integrated chiller 26. The first water opening/closing valve 44*a* and the second water opening/closing valve 44*b* have the same basic structure as that of the second passage opening/closing valve 22*a* for the refrigerant. One inflow port side of the second water three-way joint 42*b* is connected to the coolant outlet portion of the mixing-portion integrated chiller 26.

An inlet side of a water bypass passage 43 is connected to the other outflow port of the first water three-way joint 42*a*. The water bypass passage 43 is a heat medium bypass passage through which the device coolant pumped from the device coolant pump 41 flows by bypassing the mixing-portion integrated chiller 26. The second water opening/closing valve 44*b* that opens and closes the water bypass passage 43 is disposed in the water bypass passage 43. The other inflow port side of the second water three-way joint 42*b* is connected to an outlet of the water bypass passage 43.

The inlet side of the coolant passage 70*a* of the battery 70 is connected to an outflow port of the second water three-way joint 42*b*. The suction port side of the device coolant pump 41 is connected to an inlet of the coolant passage 70*a* of the battery 70.

In the device coolant circuit 40*a*, the controller 60 can switch a circuit configuration of the device coolant circuit 40*a* by controlling the opening/closing operations of the first water opening/closing valve 44*a* and the second water opening/closing valve 44*b*. Accordingly, the first water opening/closing valve 44*a* and the second water opening/closing valve 44*b* are device coolant circuit switching portions. Other configurations of the refrigeration cycle device 10*d* are similar to those of the seventh embodiment.

Next, operation of the vehicle air conditioner of the present embodiment having the above configuration will be described. In the vehicle air conditioner of the present embodiment, similarly to the seventh embodiment, the refrigeration cycle device 10*d* switches the refrigerant circuit according to each operation mode, and thus comfortable air conditioning in the vehicle interior can be realized.

In each operation mode, the appropriate temperature adjustment of the battery 70 can be realized by executing the device cooling mode or the device warm-up mode.

In the hot-gas heating mode during execution of the device warm-up mode, the controller 60 opens the second passage opening/closing valve 22*a* and closes the low-pressure passage opening/closing valve 22*b*. The controller 60 makes the heating expansion valve 14*a* in a fully closed state, the air cooling expansion valve 14*b* in the fully closed state, the cooling expansion valve 14*c* in a throttled state, and the bypass flow adjustment valve 14*d* in the throttled state.

Figure 33:
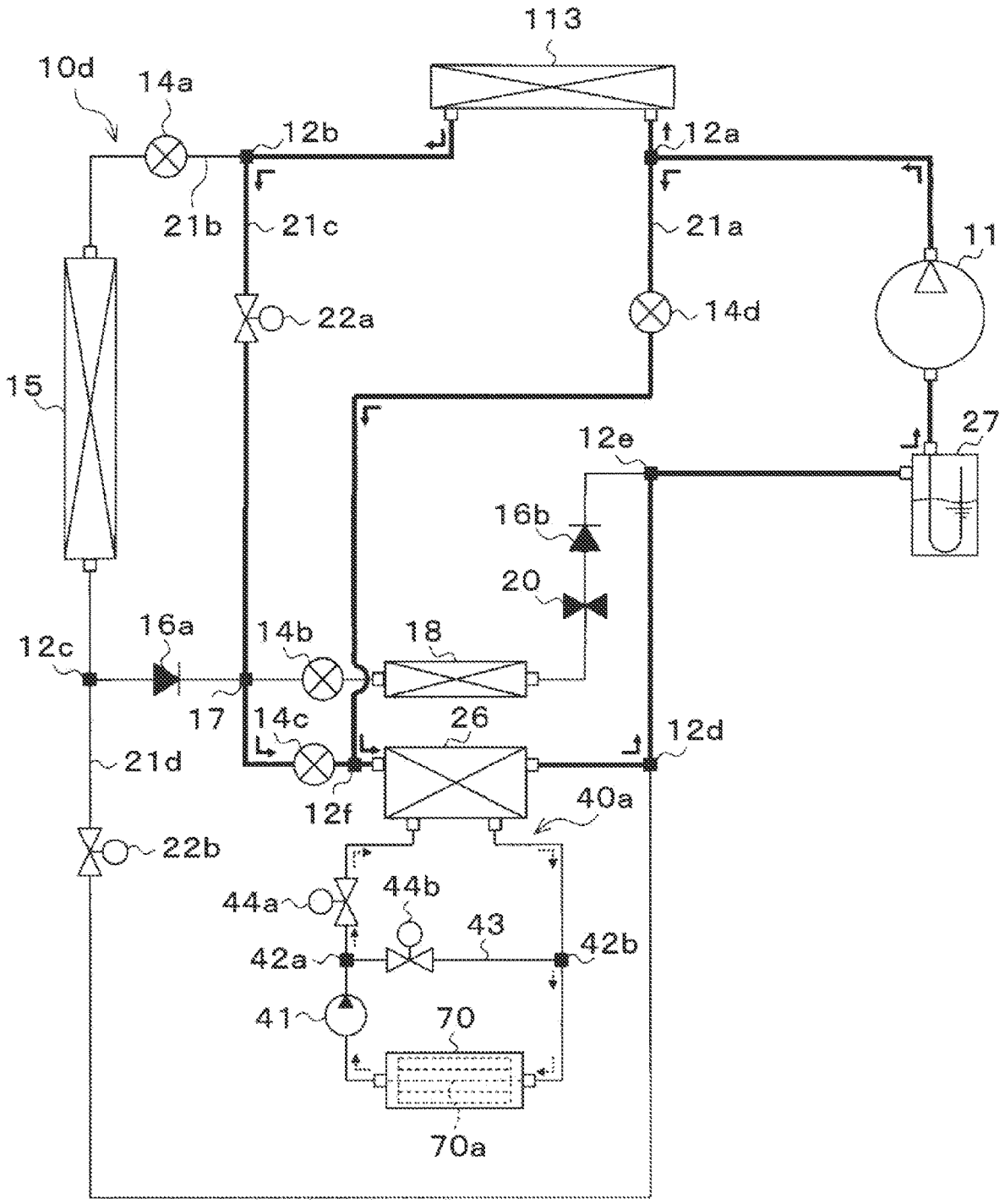
FIG. 33 is a schematic overall configuration diagram illustrating a refrigerant flow in a hot-gas heating mode of a refrigeration cycle device according to the ninth embodiment.

Therefore, in the refrigeration cycle device 10*d* in the hot-gas heating mode during execution of the device warm-up mode, as indicated by solid arrows in FIG. 33, the refrigerant discharged from the compressor 11 circulates through the first three-way joint 12*a*, the water refrigerant heat exchanger 13, the second three-way joint 12*b*, the second passage 21*c*, the cooling expansion valve 14*c*, the mixing-portion integrated chiller 26, the accumulator 27, and the suction port of the compressor 11 in this order. At the same time, a part of the refrigerant discharged from the compressor 11 circulates through the bypass flow adjustment valve 14*d*, the mixing-portion integrated chiller 26, the accumulator 27, and the suction port of the compressor 11 in this order via the bypass passage 21*a*.

Accordingly, in the refrigeration cycle device 10*d* in the hot-gas heating mode during the execution of the device warm-up mode, the vehicle interior can be heated in a similar manner to the hot-gas heating mode of the seventh embodiment.

The controller 60 opens the first water opening/closing valve 44*a* of the device coolant circuit 40*a* and closes the second water opening/closing valve 44*b* of the device coolant circuit 40*a*. The controller 60 operates the device coolant pump 41 so as to exhibit a predetermined reference discharge capacity.

Therefore, in the device coolant circuit 40*a* in the device warm-up mode, as indicated by a thin broken line arrow in FIG. 33, the device coolant pumped from the device coolant pump 41 circulates through the water passage of the mixing-portion integrated chiller 26, the coolant passage 70*a* of the battery 70, and the suction port of the device coolant pump 41 in this order. Accordingly, the battery 70 can be warmed up in a similar manner to the device warm-up mode of the seventh embodiment.

Since the refrigeration cycle device 10*d* of the present embodiment includes the mixing-portion integrated chiller 26, similarly to the seventh embodiment, it is possible to sufficiently suppress variation in the enthalpy of the suction side refrigerant. Accordingly, even when the flow is switched to the refrigerant circuit in which the refrigerants having different enthalpies are mixed and sucked into the compressor 11, a stable heating capacity can be exhibited, and the compressor 11 can be protected.

When the refrigeration cycle device 10*d* is stopped at the cryogenic outside air temperature (specifically, when the outside air temperature Tam is lower than about −20° C.), the temperature of each component of the refrigeration cycle device 10 also decreases to substantially the same outside air temperature Tam. Therefore, at the cryogenic outside air temperature, the temperature and density of the refrigerant on the suction side of the compressor 11 may extremely decrease.

Accordingly, even when the refrigerant whose temperature and density are extremely decreased is sucked into the compressor 11, the refrigerant cannot be sufficiently increased in pressure to increase the temperature, and the air cannot be sufficiently heated by the interior condenser 113. That is, heating of the vehicle interior cannot be realized.

At the cryogenic outside air temperature, the temperatures of the components constituting the refrigeration cycle device 10*d* also decreases to substantially the same outside air temperature Tam. Therefore, even when the refrigerant discharged from the compressor 11 and not sufficiently increased in temperature is circulated in the refrigerant circuit, each component cannot be quickly warmed up, and the start of heating in the vehicle interior is delayed.

In the vehicle air conditioner of the present embodiment, in a case where heating of the vehicle interior is started at the cryogenic outside air temperature, (h-1) assist warm-up mode or (h-2) assistless warm-up mode is executed. Each warm-up mode will be described below.

(h-1) Assist Warm-Up Mode

The assist warm-up mode is executed when the heating of the vehicle interior is started at a cryogenic outside air temperature and the device coolant temperature TWL is higher than the third temperature T3 on the outlet side of the refrigerant passage of the mixing-portion integrated chiller 26. In a case where the assist warm-up mode is executed, for example, it is assumed that the battery 70 is charged while the vehicle is stopped at the cryogenic outside air temperature, and the occupant gets on the vehicle after the charging is completed and start heating the vehicle interior.

In the assist warm-up mode, the controller 60 makes the heating expansion valve 14*a* in a fully closed state, the air cooling expansion valve 14*b* in the fully closed state, the cooling expansion valve 14*c* in the fully closed state, and the bypass flow adjustment valve 14*d* in a throttled state. The controller 60 closes the second passage opening/closing valve 22*a* and closes the low-pressure passage opening/closing valve 22*b*.

Figure 34:
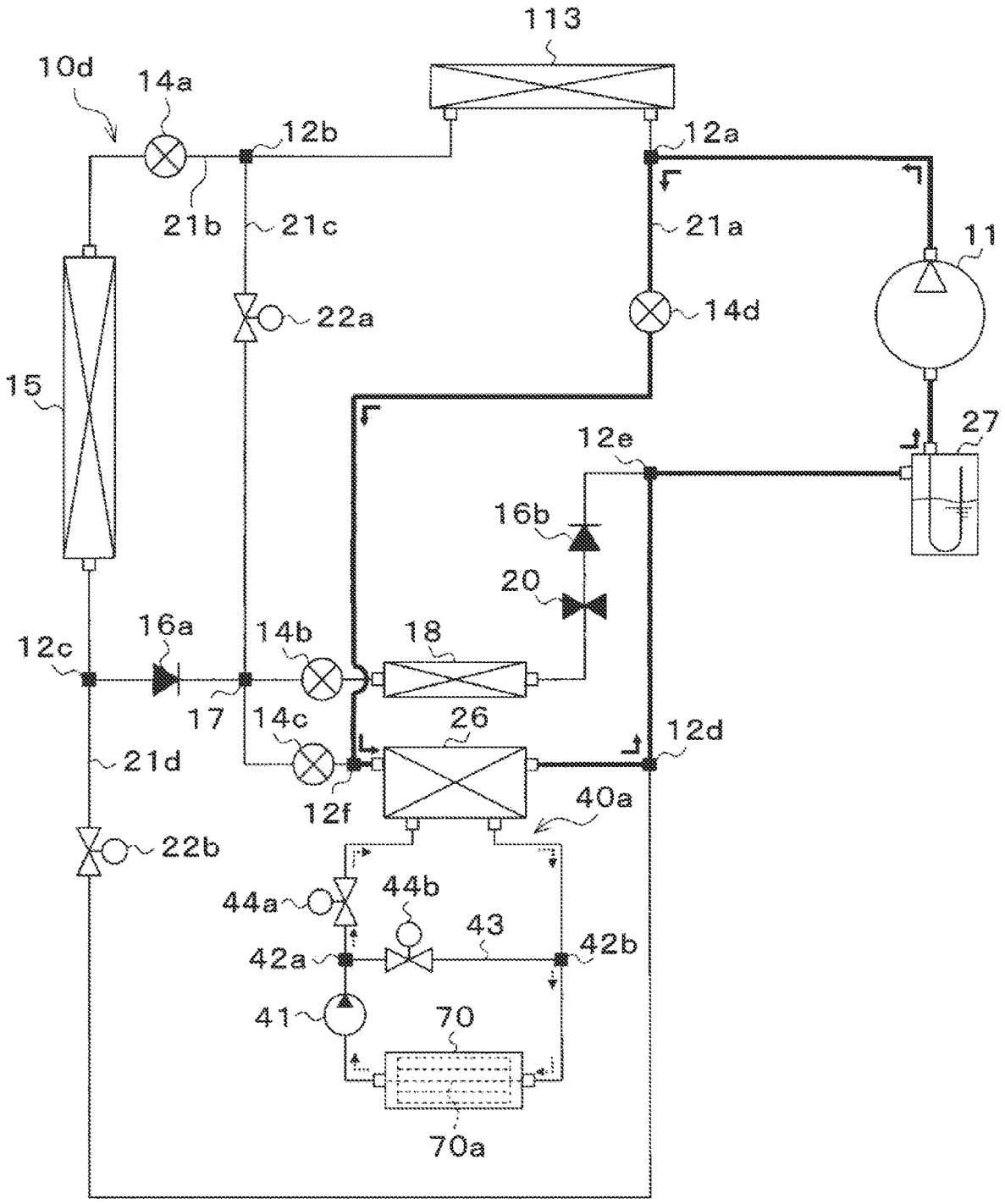
FIG. 34 is a schematic overall configuration diagram illustrating a refrigerant flow in an assist warm-up mode of a refrigeration cycle device according to the ninth embodiment.

Therefore, in the refrigeration cycle device 10*d* in the assist warm-up mode, as indicated by solid arrows in FIG. 34, the refrigerant discharged from the compressor 11 circulates through the bypass flow adjustment valve 14*d*, the mixing-portion integrated chiller 26, and the suction port of the compressor 11 in this order via the bypass passage 21*a*.

In a similar manner to the device cooling mode and the device warm-up mode, the controller 60 opens the first water opening/closing valve 44*a* and closes the second water opening/closing valve 44*b*. The controller 60 operates the device coolant pump 41 so as to exhibit a predetermined reference discharge capacity.

Therefore, in the device coolant circuit 40*a* in the assist warm-up mode, as indicated by a thin broken line arrow in FIG. 34, the device coolant pumped from the device coolant pump 41 circulates through the water passage of the mixing-portion integrated chiller 26, the coolant passage 70*a* of the battery 70, and a suction side of the device coolant pump 41 in this order.

The controller 60 appropriately controls the operation of other control target devices. Accordingly, in the refrigeration cycle device 10*d* in the assist warm-up mode, the bypass side refrigerant having a relatively low temperature flows into the refrigerant passage of the mixing-portion integrated chiller 26. In the device coolant circuit 40*a*, the device coolant heated when passing through the coolant passage 70*a* of the battery 70 and having a relatively high temperature flows into the water passage of the mixing-portion integrated chiller 26.

Therefore, in the mixing-portion integrated chiller 26 in the assist warm-up mode, it is possible to exchange heat between the bypass side refrigerant and the device coolant and heat the bypass side refrigerant. As a result, in the assist warm-up mode, the temperatures of the refrigerant and each component of the refrigeration cycle device 10*d* can be quickly increased, and heating of the vehicle interior can be quickly started.

The assist warm-up mode is continued until the third temperature T3 on the outlet side of the refrigerant passage of the mixing-portion integrated chiller 26 becomes equal to or higher than a predetermined reference warm-up temperature. When the assist warm-up mode is ended, the mode shifts to the hot-gas heating mode.

(h-2) Assistless Warm-Up Mode

The assistless warm-up mode is executed when the heating of the vehicle interior is started at a cryogenic outside air temperature and the device coolant temperature TWL is lower than the third temperature T3 on the outlet side of the refrigerant passage of the mixing-portion integrated chiller 26.

In the assistless warm-up mode, the controller 60 makes the heating expansion valve 14*a* in a fully closed state, the air cooling expansion valve 14*b* in the fully closed state, the cooling expansion valve 14*c* in the fully closed state, and the bypass flow adjustment valve 14*d* in a throttled state. The controller 60 closes the second passage opening/closing valve 22*a* and closes the low-pressure passage opening/closing valve 22*b*.

Figure 35:
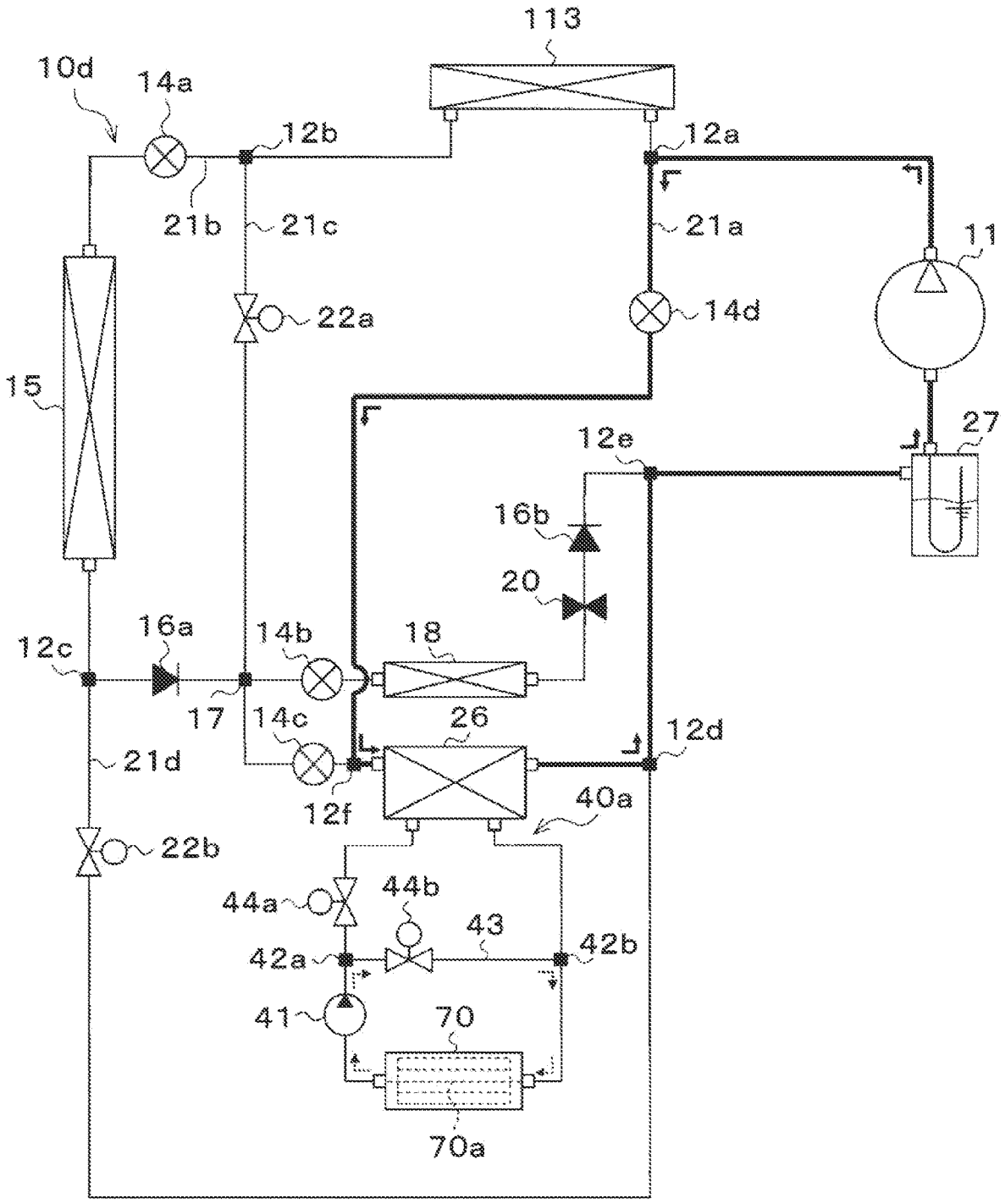
FIG. 35 is a schematic overall configuration diagram illustrating a refrigerant flow in an assistless warm-up mode of a refrigeration cycle device according to the ninth embodiment.

Therefore, in the refrigeration cycle device 10*d* in the assistless warm-up mode, as indicated by a solid arrow in FIG. 35, the refrigerant discharged from the compressor 11 circulates in the same order in a similar manner to the assist warm-up mode.

The controller 60 closes the first water opening/closing valve 44*a* and opens the second water opening/closing valve 44*b*. The controller 60 operates the device coolant pump 41 so as to exhibit a predetermined reference discharge capacity.

Therefore, in the device coolant circuit 40*a* in the assistless warm-up mode, as indicated by a thin broken line arrow in FIG. 35, the device coolant pumped from the device coolant pump 41 circulates through the water bypass passage 43, the coolant passage 70*a* of the battery 70, and the suction side of the device coolant pump 41 in this order.

The controller 60 appropriately controls the operation of other control target devices. Accordingly, in the refrigeration cycle device 10*d* in the assistless warm-up mode, the bypass side refrigerant having a relatively low temperature flows into the refrigerant passage of the mixing-portion integrated chiller 26. In the device coolant circuit 40*a*, the device coolant does not flow into the water passage of the mixing-portion integrated chiller 26.

Therefore, in the mixing-portion integrated chiller 26 in the assistless warm-up mode, heat exchange between the bypass side refrigerant and the device coolant is not performed. In other words, in the mixing-portion integrated chiller 26, the bypass side refrigerant is not cooled by the device coolant. As a result, in the assistless warm-up mode, delay of the warm-up of the refrigerant and each component of the refrigeration cycle device 10*d* can be prevented.

In the assistless warm-up mode, means for stopping the device coolant pump 41 is also conceivable. However, as described above, in the battery 70, it is desirable that the temperatures of all the battery cells are uniformly adjusted. Therefore, even in the assistless warm-up mode, it is desirable to operate the device coolant pump 41 as in the present embodiment.

In a similar manner to the assist warm-up mode, the assistless warm-up mode is continued until the third temperature T3 on the outlet side of the refrigerant passage of the mixing-portion integrated chiller 26 becomes equal to or higher than a predetermined reference heating temperature. When the assistless warm-up mode is ended, the mode shifts to the hot-gas heating mode.

As described above, the device coolant circuit 40*a* of the present embodiment includes the first water opening/closing valve 44*a* and the second water opening/closing valve 44*b*, which are heat medium circuit switching portions.

In a case where the refrigerant can be heated using the heat stored in the battery 70, the flow is switched to a coolant circuit in which the device coolant flowing out from the coolant passage 70*a* of the battery 70 flows into the mixing-portion integrated chiller 26. According to this, the device coolant and the refrigerant can be heated by heat exchange in the mixing-portion integrated chiller 26, and heating of the vehicle interior can be promptly started.

In a case where the refrigerant cannot be heated using the heat stored in the battery 70, the flow is switched to the coolant circuit in which the device coolant flowing out from the coolant passage 70*a* of the battery 70 flows into the water bypass passage 43. According to this, unnecessary heat exchange between the device coolant and the refrigerant in the mixing-portion integrated chiller 26 can be suppressed, and the delay of the warm-up of the refrigerant and each component of the refrigeration cycle device 10*d* can be prevented.

Tenth Embodiment

Figure 36:
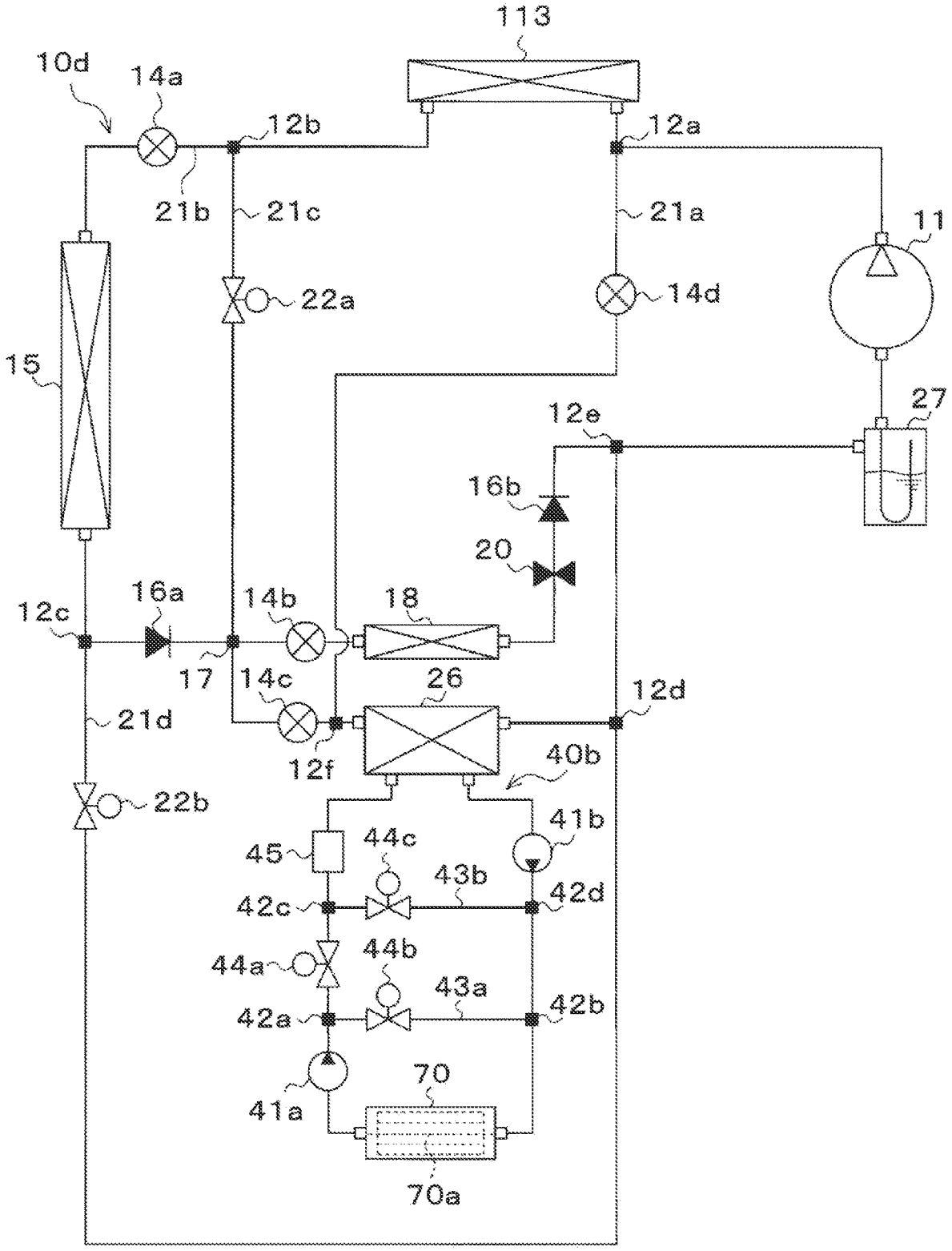
FIG. 36 is a schematic overall configuration diagram of a refrigeration cycle device according to a tenth embodiment.

In the present embodiment, as illustrated in FIG. 36, the refrigeration cycle device 10*d* including a device coolant circuit 40*b* will be described as compared with the seventh embodiment. In addition to the water passage of the mixing-portion integrated chiller 26, a first device coolant pump 41*a*, a second device coolant pump 41*b*, a first water three-way joint 42*a* to a fourth water three-way joint 42*d*, a first water opening/closing valve 44*a* to a third water opening/closing valve 44*c*, and an electric heater 45, and the like are connected to the device coolant circuit 40*b*.

In the device coolant circuit 40*b*, the inflow port side of the first water three-way joint 42*a* is connected to the discharge port of the first device coolant pump 41*a*. The first device coolant pump 41*a* and the second device coolant pump 41*b* have the same basic structure as that of the device coolant pump 41.

One inflow port side of the third water three-way joint 42*c* is connected to one outflow port of the first water three-way joint 42*a*. The third water three-way joint 42*c* and the fourth water three-way joint 42*d* are three-way joints similar to the first water three-way joint 42*a*. The first water opening/closing valve 44*a* is disposed in the coolant passage from one outflow port of the first water three-way joint 42*a* to one inflow port of the third water three-way joint 42*c*.

The coolant inlet portion side of the mixing-portion integrated chiller 26 is connected to the outflow port of the third water three-way joint 42*c*. The electric heater 45 is disposed in the coolant passage from the outflow port of the third water three-way joint 42*c* to the coolant inlet portion of the mixing-portion integrated chiller 26. The electric heater 45 is a heat medium heating unit that heats the device coolant flowing into the mixing-portion integrated chiller 26.

In the device coolant circuit 40*b*, a PTC heater having a PTC element (that is, positive thermistor) that generates heat by being supplied with power is adopted as the electric heater 45. The heat generation amount of the electric heater 45 is controlled by a control voltage output from the controller 60.

The suction port side of the second device coolant pump 41*b* is connected to the coolant outlet portion of the mixing-portion integrated chiller 26. The inflow port side of the fourth water three-way joint 42*d* is connected to the discharge port of the second device coolant pump 41*b*. An inlet side of a second water bypass passage 43*b* is connected to one outflow port of the fourth water three-way joint 42*d* The other inflow port side of the third water three-way joint 42*c* is connected to an outlet of the second water bypass passage 43*b*.

The inflow port side of the second water three-way joint 42*b* is connected to the other outflow port of the fourth water three-way joint 42*d*. An inlet side of a first water bypass passage 43*a* is connected to one outflow port of the second water three-way joint 42*b*. The other inflow port side of the first water three-way joint 42*a* is connected to an outlet of the first water bypass passage 43*a*.

The inlet side of the coolant passage 70*a* of the battery 70 is connected to the other outflow port of the second water three-way joint 42*b*. The suction port side of the first device coolant pump 41*a* is connected to an inlet of the coolant passage 70*a* of the battery 70.

The second water opening/closing valve 44*b* that opens and closes the first water bypass passage 43*a* is disposed in the first water bypass passage 43*a*. The third water opening/closing valve 44*c* that opens and closes the second water bypass passage 43*b* is disposed in the second water bypass passage 43*b*. The third water opening/closing valve 44*c* has the same basic structure as those of the first water opening/closing valve 44*a* and the second water opening/closing valve 44*b*.

In the device coolant circuit 40*b*, the controller 60 can switch a circuit configuration of the device coolant circuit 40*b* by controlling the opening/closing operations of the first water opening/closing valve 44*a* to the third water opening/closing valve 44*c*. Accordingly, the first water opening/closing valve 44*a* to the third water opening/closing valve 44*c* are heat medium circuit switching portions. Other configurations of the refrigeration cycle device 10*d* are similar to those of the seventh embodiment.

Next, operation of the vehicle air conditioner of the present embodiment having the above configuration will be described. In the vehicle air conditioner of the present embodiment, similarly to the seventh embodiment, the refrigeration cycle device 10*d* switches the refrigerant circuit according to each operation mode, and thus comfortable air conditioning in the vehicle interior can be realized.

In each operation mode, the appropriate temperature adjustment of the battery 70 can be realized by executing the device cooling mode or the device warm-up mode.

Specifically, in the device cooling mode and the device warm-up mode, the controller 60 opens the first water opening/closing valve 44*a*, closes the second water opening/closing valve 44*b*, and closes the third water opening/closing valve 44*c* in the device coolant circuit 40*b*. The controller 60 operates the first device coolant pump 41*a* and the second device coolant pump 41*b* so as to exhibit a predetermined reference discharge capacity. The controller 60 does not supply power to the electric heater 45.

Therefore, in the device coolant circuit 40*b* in the device cooling mode and the device warm-up mode, the device coolant circulates through the first device coolant pump 41*a*, the electric heater 45 that does not generate heat, the water passage of the mixing-portion integrated chiller 26, the second device coolant pump 41*b*, and the coolant passage 70*a* of the battery 70 in this order. Accordingly, in the vehicle air conditioner of the present embodiment, similarly to the seventh embodiment, the appropriate temperature adjustment of the battery 70 can be performed.

Since the refrigeration cycle device 10*d* of the present embodiment includes the mixing-portion integrated chiller 26, similarly to the seventh embodiment, it is possible to sufficiently suppress variation in the enthalpy of the suction side refrigerant. Accordingly, even when the flow is switched to the refrigerant circuit in which the refrigerants having different enthalpies are mixed and sucked into the compressor 11, a stable heating capacity can be exhibited, and the compressor 11 can be protected.

In the vehicle air conditioner of the present embodiment, as a warm-up mode when heating of the vehicle interior is started at the cryogenic outside air temperature, the (h-1) assist warm-up mode or the (h-3) heater warm-up mode is executed. Each warm-up mode will be described below.

(h-1) Assist Warm-Up Mode

The assist warm-up mode of the present embodiment is executed when an execution condition similar to that of the assist warm-up mode of the ninth embodiment is satisfied.

In the assist warm-up mode, the controller 60 closes the second passage opening/closing valve 22*a* and closes the low-pressure passage opening/closing valve 22*b*. The controller 60 makes the heating expansion valve 14*a* in a fully closed state, the air cooling expansion valve 14*b* in a fully closed state, the cooling expansion valve 14*c* in the fully closed state, and the bypass flow adjustment valve 14*d* in the throttled state.

Figure 37:
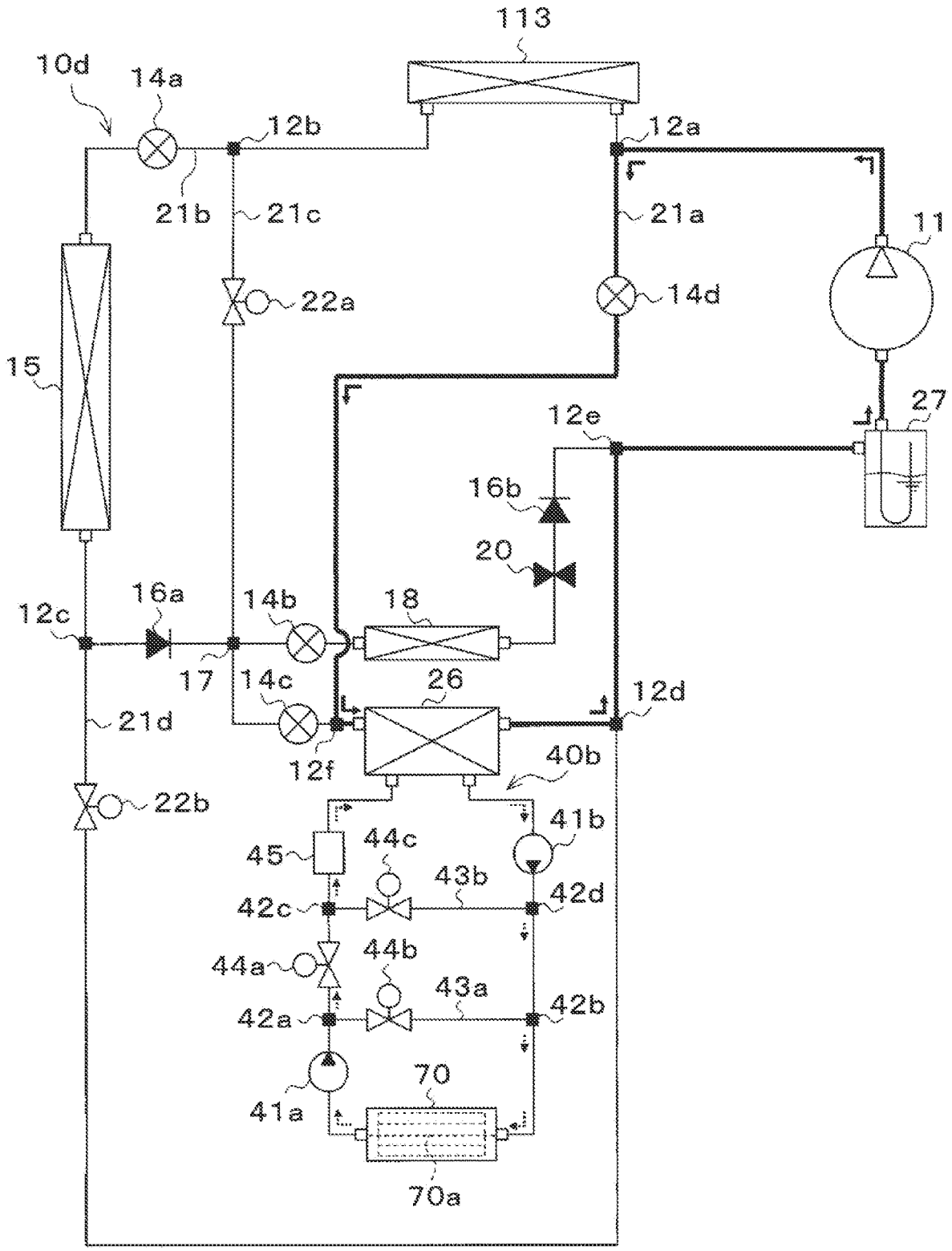
FIG. 37 is a schematic overall configuration diagram illustrating a refrigerant flow in an assist warm-up mode of a refrigeration cycle device according to the tenth embodiment.

Therefore, in the refrigeration cycle device 10*d* in the assist warm-up mode, as indicated by solid arrows in FIG. 37, the flow is switched to the refrigerant circuit as in the ninth embodiment.

The controller 60 opens the first water opening/closing valve 44*a*, closes the second water opening/closing valve 44*b*, and closes the third water opening/closing valve 44*c*. The controller 60 operates the first device coolant pump 41*a* and the second device coolant pump 41*b* so as to exhibit a predetermined reference discharge capacity. The controller 60 does not supply power to the electric heater 45.

Therefore, in the device coolant circuit 40*b* in the assist warm-up mode, as indicated by a thin broken line arrow in FIG. 37, the device coolant pumped from the first device coolant pump 41*a* flows through the electric heater 45 that does not generate heat, the water passage of the mixing-portion integrated chiller 26, and the suction side of the second device coolant pump 41*b* in this order. The device coolant pumped from the second device coolant pump 41*b* flows through the coolant passage 70*a* of the battery 70 and the suction side of the device coolant pump 41 in this order.

The controller 60 appropriately controls the operation of other control target devices. Accordingly, in the mixing-portion integrated chiller 26 in the assist warm-up mode, similarly to the ninth embodiment, it is possible to exchange heat between the bypass side refrigerant and the device coolant and heat the bypass side refrigerant. As a result, in the assist warm-up mode, the temperatures of the refrigerant and each component of the refrigeration cycle device 10*d* can be quickly increased, and heating of the vehicle interior can be quickly started.

Similarly to the ninth embodiment, the assist warm-up mode is continued until the third temperature T3 on the outlet side of the refrigerant passage of the mixing-portion integrated chiller 26 becomes equal to or higher than a predetermined reference warm-up temperature. When the assist warm-up mode is ended, the mode shifts to the hot-gas heating mode.

(h-3) Heater Warm-Up Mode

The heater warm-up mode of the present embodiment is executed when an execution condition similar to that of the assistless warm-up mode of the ninth embodiment is satisfied.

In the heater warm-up mode, the controller 60 closes the second passage opening/closing valve 22*a* and closes the low-pressure passage opening/closing valve 22*b*. The controller 60 makes the heating expansion valve 14*a* in a fully closed state, the air cooling expansion valve 14*b* in a fully closed state, the cooling expansion valve 14*c* in the fully closed state, and the bypass flow adjustment valve 14*d* in the throttled state.

Figure 38:
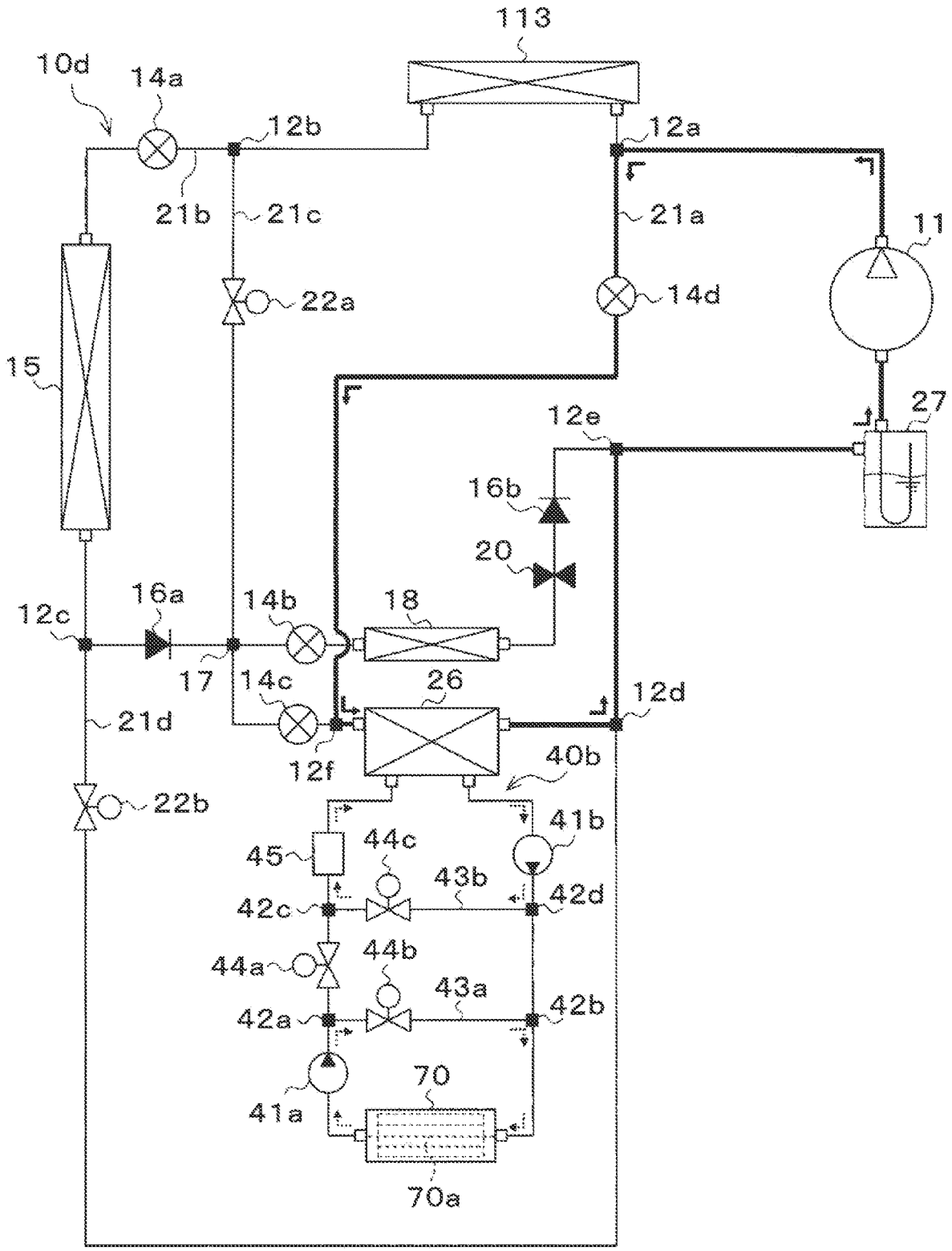
FIG. 38 is a schematic overall configuration diagram illustrating a refrigerant flow in a heater warm-up mode of a refrigeration cycle device according to the tenth embodiment.

Therefore, in the refrigeration cycle device 10*d* in the heater warm-up mode, as indicated by solid arrows in FIG. 38, the refrigerant discharged from the compressor 11 circulates in the same order in a similar manner to the assist warm-up mode.

The controller 60 closes the first water opening/closing valve 44*a*, opens the second water opening/closing valve 44*b*, and opens the third water opening/closing valve 44*c*. The controller 60 operates the first device coolant pump 41*a* and the second device coolant pump 41*b* so as to exhibit a predetermined reference discharge capacity. The controller 60 energizes the electric heater 45 so as to exhibit a predetermined heating capacity.

Therefore, in the device coolant circuit 40*b* in the heater warm-up mode, as indicated by a thin broken line arrow in FIG. 38, the device coolant pumped from the first device coolant pump 41*a* circulates through the first water bypass passage 43*a*, the coolant passage 70*a* of the battery 70, and the suction side of the first device coolant pump 41*a* in this order. At the same time, the flow is switched to a circuit in which the device coolant pumped from the second device coolant pump 41*b* circulates through the second water bypass passage 43*b*, the electric heater 45 that generates heat, the water passage of the mixing-portion integrated chiller 26, and the suction side of the second device coolant pump 41*b* in this order.

In a similar manner to the assistless warm-up mode of the ninth embodiment, the controller 60 appropriately controls the operation of other control target devices. Accordingly, in the refrigeration cycle device 10*d* in the heater warm-up mode, the bypass side refrigerant having a relatively low temperature flows into the refrigerant passage of the mixing-portion integrated chiller 26. In the device coolant circuit 40*a*, the device coolant heated by the electric heater 45 and having a relatively high temperature flows into the water passage of the mixing-portion integrated chiller 26.

Therefore, in the mixing-portion integrated chiller 26 in the heater warm-up mode, heat is exchanged between the bypass side refrigerant and the device coolant and the bypass side refrigerant is heated. In other words, in the mixing-portion integrated chiller 26, the bypass side refrigerant is heated using the heat generated by the electric heater 45 as a heat source. As a result, in the heater warm-up mode, the temperature of the refrigerant and each component of the refrigeration cycle device 10*d* can be quickly increased, and heating of the vehicle interior can be quickly started.

In a similar manner to the assist warm-up mode, the heater warm-up mode is continued until the third temperature T3 on the outlet side of the refrigerant passage of the mixing-portion integrated chiller 26 becomes equal to or higher than a predetermined reference heating temperature. When the heater warm-up mode is ended, the power supply to the electric heater 45 is stopped, and the mode shifts to the hot-gas heating mode.

As described above, the device coolant circuit 40*b* of the present embodiment includes the electric heater 45 as the heat medium heating unit, and the first water opening/closing valve 44*a* to the third water opening/closing valve 44*c*, which are heat medium circuit switching portions.

In a case where the refrigerant can be heated using the heat stored in the battery 70, the flow is switched to a coolant circuit in which the device coolant flowing out from the coolant passage 70*a* of the battery 70 flows into the mixing-portion integrated chiller 26. According to this, the device coolant and the refrigerant can be heated by heat exchange in the mixing-portion integrated chiller 26, and heating of the vehicle interior can be promptly started.

In a case where the refrigerant cannot be heated using the heat stored in the battery 70, the flow is switched to the coolant circuit in which the device coolant heated by the electric heater 45 flows into the water bypass passage 43. According to this, the device coolant and the refrigerant can be heated by heat exchange in the mixing-portion integrated chiller 26, and heating of the vehicle interior can be promptly started.

Eleventh Embodiment

An example of adopting a branch portion 121 instead of the first three-way joint 12*a* described in the first embodiment in the refrigeration cycle device 10 of the present embodiment will be described.

When the refrigeration cycle device 10 is stopped at the low outside air temperature (specifically, when the outside air temperature Tam is lower than about 0° C.), the temperature of each component of the refrigeration cycle device 10 also decreases to substantially the same outside air temperature Tam. Accordingly, there is a possibility that the refrigerant on the suction side of the compressor 11 is condensed at a low outside air temperature.

Therefore, when the compressor 11 is started to start heating the vehicle interior at a low outside air temperature, the compressor 11 sucks the liquid-phase refrigerant, and the refrigerant discharged from the compressor 11 is also in a gas-liquid mixed state.

In a case where the refrigerant circuit of the refrigeration cycle device 10 is switched to a refrigerant circuit in which the refrigerant flows out to the bypass passage 21*a* when heating of the vehicle interior is started, the refrigerant in the gas-liquid mixed state discharged from the compressor 11 flows into the bypass passage 21*a*. The bypass passage 21*a* has a heat capacity relatively smaller than that of the other components of the refrigeration cycle device 10. Therefore, when the refrigerant discharged from the compressor 11 flows into the bypass passage 21*a*, the temperature of the bypass passage 21*a* increases in a relatively short time.

Therefore, when the refrigerant in the gas-liquid mixed state flows into the bypass passage 21*a*, the liquid-phase refrigerant is evaporated, and a refrigerant oil mixed in the liquid-phase refrigerant stagnates in the bypass passage 21*a*. When the refrigerant oil in the bypass passage 21*a* stagnates, the refrigerant oil cannot be sufficiently returned to the compressor 11, which adversely affects the durable life of the compressor 11.

Therefore, in the refrigeration cycle device 10 of the present embodiment, the branch portion 121 having a dryness adjusting function is adopted as an upstream branch portion. In the branch portion 121, by making the dryness of one branched refrigerant and the dryness of the other branched refrigerant have values different from each other, the refrigerant having the higher dryness as the other refrigerant can flow out to the bypass passage 21*a* side.

Figure 39:
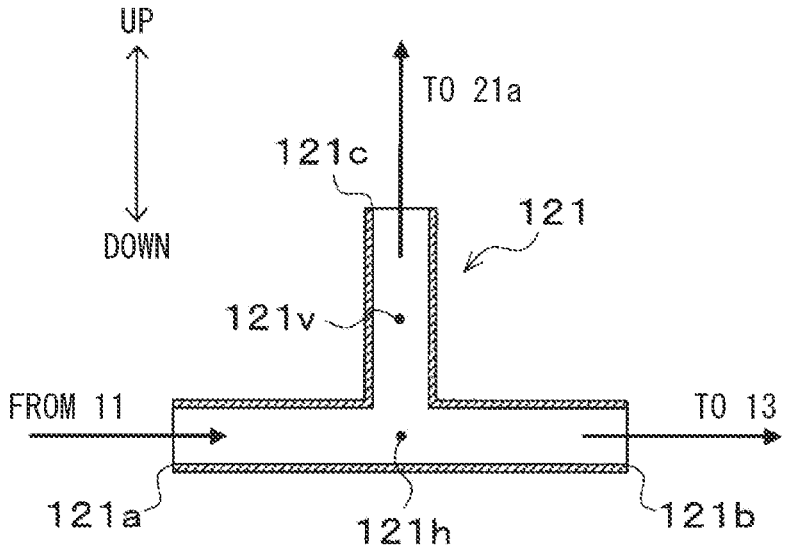
FIG. 39 is a schematic axial sectional view of a branch portion according to an eleventh embodiment.

A specific configuration of the branch portion 121 will be described with reference to FIG. 39. A horizontal passage 121*h* extending in a substantially horizontal direction and a vertical passage 121*v* extending in a substantially vertical direction are formed in the branch portion 121.

An inflow port 121*a* into which the refrigerant discharged from the compressor 11 flows is formed at one end portion of the horizontal passage 121*h*. One outflow port 121*b* from which one branched refrigerant flows out to the refrigerant passage 131 side of the water refrigerant heat exchanger 13 is formed at the other end portion of the horizontal passage 121*h*.

One end portion of the vertical passage 121*v* is connected to an intermediate portion of the horizontal passage 121*h*. The other outflow port 121*c* from which the other branched refrigerant flows out to the bypass passage 21*a* side is formed at the other end portion of the vertical passage 121*v*.

In the branch portion 121, the flow direction of the refrigerant flowing into the inflow port 121*a* coincides with the flow direction of the refrigerant flowing out from the one outflow port 121*b*. According to this, when a gas-liquid mixed refrigerant flows into the inflow port 121*a*, the liquid-phase refrigerant having high density easily flows out from one outflow port 121*b* by action of an inertial force.

Therefore, when the bypass flow adjustment valve 14*d* is opened, the gas-phase refrigerant easily flows out from the other outflow port 121*c*. Accordingly, in the branch portion 121, the refrigerant having the higher dryness among the branched refrigerants can flow out to the bypass passage 21*a* side.

Other configurations and operations of the refrigeration cycle device 10 are similar to those of the first embodiment. Accordingly, the refrigeration cycle device 10 of the present embodiment can also achieve the same effect as that of the first embodiment. That is, even when the flow is switched to the refrigerant circuit in which the refrigerants having different enthalpies are mixed and sucked into the compressor 11, a stable heating capacity can be exhibited.

In the refrigeration cycle device 10 of the present embodiment, the branch portion 121 is adopted. According to this, even in a case where the flow is switched to the refrigerant circuit through which the refrigeration cycle device 10 causes the refrigerant to flow out into the bypass passage 21*a* when the vehicle air conditioner starts heating the vehicle interior, the refrigerant having relatively high dryness can flow into the bypass passage 21*a*.

Accordingly, it is possible to prevent the refrigerant oil from stagnating in the bypass passage 21*a*. According to this, insufficient lubrication of the compressor 11 can be suppressed, and the compressor 11 can be protected.

Figure 40:
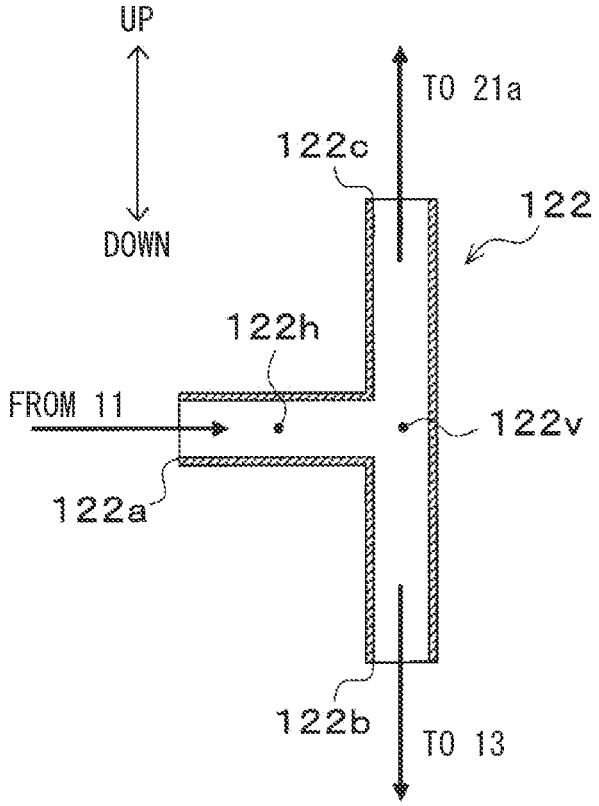
FIG. 40 is a schematic axial sectional view of a branch portion according to a modification of the eleventh embodiment.

The upstream branch portion having a gas-liquid separation function is not limited to the branch portion 121. For example, a branch portion 122 illustrated in FIG. 40 may be adopted. Specifically, a horizontal passage 122*h* extending in a substantially horizontal direction and a vertical passage 122*v* extending in a substantially vertical direction are formed in the branch portion 122.

One outflow port 122*b* from which one branched refrigerant flows out to the refrigerant passage 131 side of the water refrigerant heat exchanger 13 is formed at a lower end portion of the vertical passage 122*v*. The other outflow port 122*c* from which the other branched refrigerant flows out to the bypass passage 21*a* side is formed at an upper end portion of the vertical passage 122*v*.

One end portion of the horizontal passage 122*h* is connected to an intermediate portion of the vertical passage 122*v*. An inflow port 122*a* into which the refrigerant discharged from the compressor 11 flows is formed at the other end portion of the horizontal passage 122*h*.

In the branch portion 122, the gas-liquid mixed refrigerant flowing into the inflow port 122*a* collides with a wall surface of the vertical passage 122*v*, and thus the flow velocity of the gas-liquid mixed refrigerant can be decreased. According to this, the flow velocity of the refrigerant is decreased, and the liquid-phase refrigerant having a great specific gravity easily flows out from one outflow port 122*b* disposed on the lower side by action of gravity.

Therefore, when the bypass flow adjustment valve 14*d* is opened, the gas-phase refrigerant easily flows out from the other outflow port 122*c*. Accordingly, in the branch portion 122, the refrigerant having the higher dryness among the branched refrigerants can flow out to the bypass passage 21*a* side.

Figure 41:
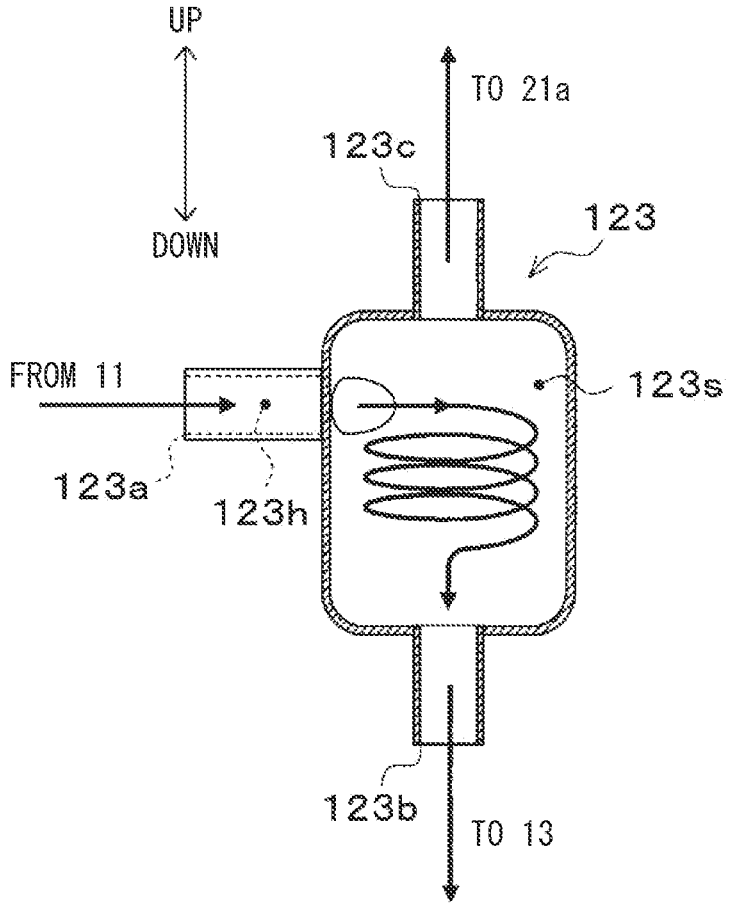
FIG. 41 is a schematic axial sectional view of a branch portion according to another modification of the eleventh embodiment.

As the upstream branch portion having a gas-liquid separation function, a branch portion 123 illustrated in FIG. 41 may be adopted. Specifically, a separation space 123*s* formed in a substantially columnar rotational body shape is formed inside the branch portion 123. A central axis of the separation space 123*s* extends in the vertical direction.

One outflow port 123*b* from which one branched refrigerant flows out to the refrigerant passage 131 side of the water refrigerant heat exchanger 13 is formed on an axially lower side of the separation space 123*s*. The other outflow port 123*c* from which the other branched refrigerant flows out to the bypass passage 21*a* side is formed on an axially upper side of the separation space 123*s*.

A horizontal passage 123*h* extending in a substantially horizontal direction is connected to a cylindrical side surface of the separation space 123*s*. An inflow port 123*a* into which the refrigerant discharged from the compressor 11 flows is formed at an end portion of a horizontal passage 123*h*. The horizontal passage 123*h* is connected such that the refrigerant discharged from the compressor 11 flows along an inner wall surface of the separation space 123*s* and extends in a tangential direction of the inner wall surface of the separation space 123*s*.

In the branch portion 123, the gas-liquid mixed refrigerant flowing into the separation space 123*s* is rotated around the central axis, and thus the refrigerant can be separated into gas and liquid by action of a centrifugal force. The separated liquid-phase refrigerant easily flows out from the one outflow port 123*b* disposed on the axially lower side by the action of gravity.

Therefore, when the bypass flow adjustment valve 14*d* is opened, the gas-phase refrigerant easily flows out from the other outflow port 123*c*. Accordingly, in the branch portion 123, the refrigerant having the higher dryness among the branched refrigerants can flow out to the bypass passage 21*a* side.

Twelfth Embodiment

Figure 42:
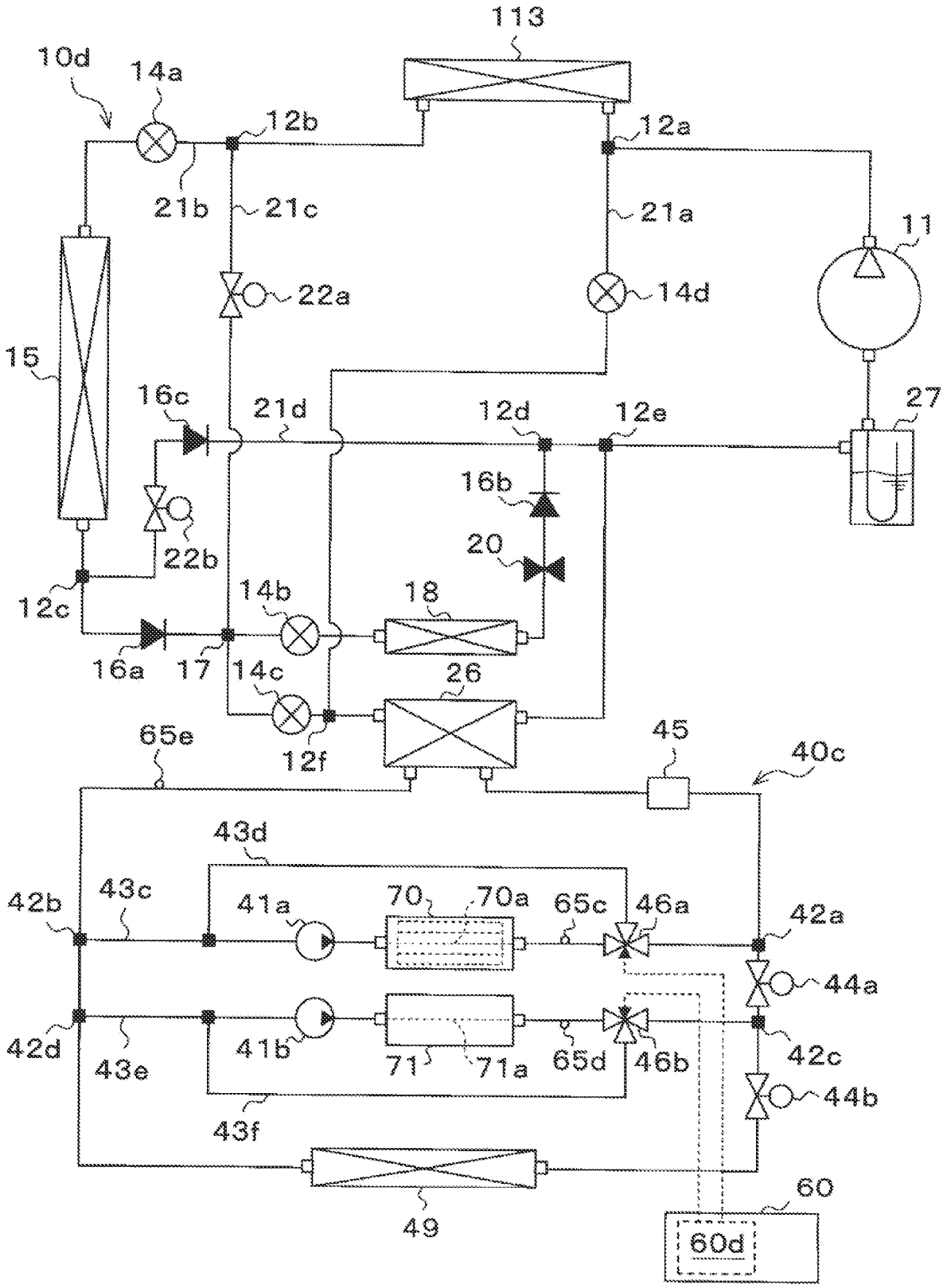
FIG. 42 is a schematic overall configuration diagram of a refrigeration cycle device according to a twelfth embodiment.

In the present embodiment, as illustrated in FIG. 42, the refrigeration cycle device 10*d* including a device coolant circuit 40*c* will be described as compared with the seventh embodiment.

In the refrigeration cycle device 10*d* of the present embodiment, one inflow port side of the forth three-joint 12*d* is connected to the outlet of the second check valve 16*b*. One inflow port side of the fifth three-way joint 12*e* is connected to the refrigerant outlet portion of the mixing-portion integrated chiller 26. A third check valve 16*c* is disposed in the low-pressure passage 21*d*. The third check valve 16*c* allows the refrigerant to flow from the third three-way joint 12*c* side toward the forth three-joint 12*d* side, and prevents the refrigerant from flowing from the forth three-joint 12*d* side toward the third three-way joint 12*c* side.

In addition to the water passage of the mixing-portion integrated chiller 26, a first device coolant pump 41*a*, a second device coolant pump 41*b*, a first water three-way joint 42*a* to a fourth water three-way joint 42*d*, a first water opening/closing valve 44*a*, a second water opening/closing valve 44*b*, an electric heater 45, a first water flow rate adjustment valve 46*a*, a second water flow rate adjustment valve 46*b*, a low temperature side radiator 49, and the like are connected to the device coolant circuit 40*c*.

The first device coolant pump 41*a*, the coolant passage 70*a* of the battery 70, and the first water flow rate adjustment valve 46*a* are disposed in a first device passage 43*c* of the device coolant circuit 40*c*. One inflow port of the first water three-way joint 42*a* is connected to an outlet of the first device passage 43*c*. One outflow port of the second water three-way joint 42*b* is connected to an inlet of the first device passage 43*c*.

In the first device passage 43*c*, an inlet side of the coolant passage 70*a* of the battery 70 is connected to a discharge port of the first device coolant pump 41*a*. An inlet side of the first water flow rate adjustment valve 46*a* is connected to an outlet of the coolant passage 70*a* of the battery 70.

The first water flow rate adjustment valve 46*a* is a three-way fluid flow adjustment portion that can continuously adjust a flow rate ratio between a coolant flow rate returning to the suction port side of the first device coolant pump 41*a* via a first return passage 43*d* and a coolant flow rate flowing out to the mixing-portion integrated chiller 26 side via the first water three-way joint 42*a* in the device coolant flowing out from the coolant passage 70*a*. Operation of the first water flow rate adjustment valve 46*a* is controlled by the control signal output from the controller 60.

The first water flow rate adjustment valve 46*a* can also allow the device coolant flowing into the first water flow rate adjustment valve 46*a* to flow out to only one of the suction port side of the first device coolant pump 41*a* and the first water three-way joint 42*a* side.

The second device coolant pump 41*b*, a coolant passage 71*a* of the motor generator 71, and the second water flow rate adjustment valve 46*b* are disposed in a second device passage 43*e* of the device coolant circuit 40*c*. An inflow port of the third water three-way joint 42*c* is connected to an outlet of the second device passage 43*e*. An outflow port of the fourth water three-way joint 42*d* is connected to an inlet of the second device passage 43*e*.

In the second device passage 43*e*, the coolant passage 71*a* of the motor generator 71 is connected to a discharge port of the second device coolant pump 41*b*.

The motor generator 71 functions as a motor that outputs a traveling drive force at the time of the vehicle traveling and functions as a generator at the time of energy regeneration. The motor generator 71 is a heat generating device that generates heat during operation. An inlet side of the second water flow rate adjustment valve 46*b* is connected to an outlet of the coolant passage 71*a* of the motor generator 71.

The second water flow rate adjustment valve 46*b* is a three-way fluid flow adjustment portion that can continuously adjust a flow rate ratio between a coolant flow rate returning to the suction port side of the second device coolant pump 41*b* via a second return passage 43*f* and a coolant flow rate flowing out to the mixing-portion integrated chiller 26 side or the low temperature side radiator 49 via the third water three-way joint 42*c* in the device coolant flowing out from the coolant passage 71*a*.

The second water flow rate adjustment valve 46*b* has the same basic structure as that of the first water flow rate adjustment valve 46*a*. Accordingly, the second water flow rate adjustment valve 46*b* can also allow the device coolant flowing into the second water flow rate adjustment valve 46*b* to flow out to only one of the suction port side of the second device coolant pump 41*b* and the third water three-way joint 42*c* side.

The first water flow rate adjustment valve 46*a* and the second water flow rate adjustment valve 46*b* are fluid flow adjustment portions that adjust the flow rate of the device coolant flowing into the mixing-portion integrated chiller 26. In other words, the first water flow rate adjustment valve 46*a* and the second water flow rate adjustment valve 46*b* are heat exchange amount adjustment portions that adjust a heat exchange amount between the device coolant and the refrigerant (that is, at least one of the bypass side refrigerant or the decompression-portion side refrigerant) in the mixing-portion integrated chiller 26.

One outflow port side of the third water three-way joint 42*c* is connected to the other inflow port of the first water three-way joint 42*a*. The first water opening/closing valve 44*a* is disposed in the coolant passage connecting the other inflow port of the first water three-way joint 42*a* with one outflow port of the third water three-way joint 42*c*.

The coolant inlet portion side of the mixing-portion integrated chiller 26 is connected to the outflow port of the first water three-way joint 42*a*. The electric heater 45 is disposed in the coolant passage connecting the first water three-way joint 42*a* with the coolant inlet portion of the mixing-portion integrated chiller 26.

The inflow port side of the second water three-way joint 42*b* is connected to the coolant outlet portion of the mixing-portion integrated chiller 26. One inflow port side of the fourth water three-way joint 42*d* is connected to the other outflow port of the second water three-way joint 42*b*.

A coolant inlet side of the low temperature side radiator 49 is connected to the other outflow port of the third water three-way joint 42*c*. The low temperature side radiator 49 is a heat exchanger that exchanges heat between the device coolant and the outside air. The low temperature side radiator 49 has the same basic structure as that of the outside air heat exchanger 115 described in the eighth embodiment. The second water opening/closing valve 44*b* is disposed in the coolant passage connecting the other outflow port of the third water three-way joint 42*c* with a coolant inlet of the low temperature side radiator 49.

The other inflow port side of the fourth water three-way joint 42*d* is connected to a coolant outlet of the low temperature side radiator 49.

Accordingly, in the device coolant circuit 40*c*, the controller 60 operates the first device coolant pump 41*a* and closes the first water opening/closing valve 44*a*. According to this, the flow can be switched to the coolant circuit that circulates the device coolant between the coolant passage 70*a* of the battery 70 and the mixing-portion integrated chiller 26.

In device coolant circuit 40*c*, the controller 60 stops the first device coolant pump 41*a*, operates the second device coolant pump 41*b*, opens the first water opening/closing valve 44*a*, and closes the second water opening/closing valve 44*b*. According to this, the flow can be switched to the coolant circuit that circulates the device coolant between the coolant passage 71*a* of the motor generator 71 and the mixing-portion integrated chiller 26.

In device coolant circuit 40*c*, the controller 60 operates the first device coolant pump 41*a* and the second device coolant pump 41*b*, closes the first water opening/closing valve 44*a*, and opens the second water opening/closing valve 44*b*. According to this, the flow can be switched to the coolant circuit that circulates the device coolant between the coolant passage 70*a* of the battery 70 and the mixing-portion integrated chiller 26 and circulates the device coolant between the coolant passage 71*a* of the motor generator 71 and the low temperature side radiator 49.

In device coolant circuit 40*c*, the controller 60 operates the first device coolant pump 41*a* and the second device coolant pump 41*b*, opens the first water opening/closing valve 44*a*, and closes the second water opening/closing valve 44*b*. Accordingly, the flow can be switched to the coolant circuit in which the device coolant flowing out from the mixing-portion integrated chiller 26 flows to both of the coolant passage 70*a* of the battery 70 and the coolant passage 71*a* of the motor generator 71.

In the device coolant circuit 40*c*, the controller 60 controls the operation of the first water flow rate adjustment valve 46*a* in a state in which the first device coolant pump 41*a* is operated, and thus the temperature of the battery 70 can be adjusted.

More specifically, the temperature of the device coolant sucked into the first device coolant pump 41*a* can be adjusted by adjusting the flow rate of the device coolant returning from the first water flow rate adjustment valve 46*a* to the suction port side of the first device coolant pump 41*a* via the first return passage 43*d*. According to this, the temperature of the battery 70 can be adjusted.

In the device coolant circuit 40*c*, the controller 60 controls the operation of the second water flow rate adjustment valve 46*b* in a state in which the second device coolant pump 41*b* is operated, and thus the temperature of the motor generator 71 can be adjusted.

More specifically, the temperature of the device coolant sucked into the second device coolant pump 41*b* can be adjusted by adjusting the flow rate of the device coolant returning from the second water flow rate adjustment valve 46*b* to the suction port side of the second device coolant pump 41*b* via the second return passage 43*f*. According to this, the temperature of the motor generator 71 can be adjusted.

A first device coolant-temperature sensor 65*c* to a third device coolant-temperature sensor 65*e* are connected to the input side of the controller 60 of the present embodiment.

The first device coolant-temperature sensor 65*c* is a detector that detects a first device coolant temperature TWL1 of the device coolant flowing out from the coolant passage 70*a* of the battery 70 and flowing into the first water flow rate adjustment valve 46*a*. The second device coolant-temperature sensor 65*d* is a detector that detects a second device coolant temperature TWL2 of the device coolant flowing out from the coolant passage 71*a* of the motor generator 71 and flowing into the second water flow rate adjustment valve 46*b*.

The third device coolant-temperature sensor 65*e* is a detector that detects a third device coolant temperature TWL3 of the device coolant flowing out from the mixing-portion integrated chiller 26.

In the present embodiment, in the controller 60, the configuration for controlling the operations of the first water flow rate adjustment valve 46*a* and the second water flow rate adjustment valve 46*b*, which are fluid flow adjustment portions, constitutes a fluid flow rate control unit 60*d*.

Next, operation of the vehicle air conditioner of the present embodiment having the above configuration will be described. In the vehicle air conditioner of the present embodiment, similarly to the seventh embodiment, the refrigeration cycle device 10*d* switches the refrigerant circuit according to each operation mode, and thus comfortable air conditioning in the vehicle interior can be realized.

In each operation mode, the appropriate temperature adjustment of the battery 70 and the motor generator 71 can be realized by executing the device cooling mode or the device warm-up mode and switching a circuit configuration of the device coolant circuit 40*c*.

For example, in the hot-gas heating mode, the controller 60 opens the second passage opening/closing valve 22*a* and closes the low-pressure passage opening/closing valve 22*b*. The controller 60 makes the heating expansion valve 14*a* in a fully closed state, the air cooling expansion valve 14*b* in the fully closed state, the cooling expansion valve 14*c* in a throttled state, and the bypass flow adjustment valve 14*d* in the throttled state.

Therefore, in the refrigeration cycle device 10*d* in the hot-gas heating mode, the coolant circulates in the same order as in the seventh embodiment. In a similar manner to the hot-gas heating mode of the seventh embodiment, the controller 60 appropriately controls the operation of other control target devices. Accordingly, in the refrigeration cycle device 10*d* in the hot-gas heating mode, it is possible to suppress a decrease in a heating capacity of the air.

In the device warm-up mode of the present embodiment, the controller 60 opens the first water opening/closing valve 44*a* and closes the second water opening/closing valve 44*b*. The controller 60 operates the first device coolant pump 41*a* and the second device coolant pump 41*b* so as to exhibit a predetermined reference discharge capacity.

Therefore, in the device coolant circuit 40*c* during execution of the device warm-up mode, the flow is switched to the coolant circuit in which the device coolant flowing out from the mixing-portion integrated chiller 26 flows to both of the coolant passage 70*a* of the battery 70 and the coolant passage 71*a* of the motor generator 71.

The controller 60 controls the operations of the first water flow rate adjustment valve 46*a* and the second water flow rate adjustment valve 46*b* according to the temperature of an inflow side refrigerant flowing into the mixing-portion integrated chiller 26 and the temperature of an inflow side device coolant flowing into the mixing-portion integrated chiller 26.

More specifically, when the temperature of the inflow side refrigerant is higher than the temperature of the inflow side device coolant, the operation of the first water flow rate adjustment valve 46*a* is controlled so as to decrease the flow rate of the device coolant returning to the first device coolant pump 41*a* in accordance with an increase in the temperature of the inflow side refrigerant. In a similar manner, the operation of the second water flow rate adjustment valve 46*b* is controlled so as to decrease the flow rate of the device coolant returning to the second device coolant pump 41*b* in accordance with an increase in the temperature of the inflow side refrigerant.

That is, the operations of the first water flow rate adjustment valve 46*a* and the second water flow rate adjustment valve 46*b* are controlled so as to increase the flow rate of the device coolant flowing out to the mixing-portion integrated chiller 26 side in accordance with an increase in the temperature of the inflow side refrigerant. According to this, the battery 70 and the motor generator 71 can be quickly warmed up by increasing the flow rate of the device coolant heated in the mixing-portion integrated chiller 26 in accordance with an increase in the temperature of the inflow side refrigerant.

When the temperature of the inflow side refrigerant is lower than the temperature of the inflow side device coolant, the operation of the first water flow rate adjustment valve 46*a* is controlled such that the first device coolant temperature TWL1 detected by the first device coolant-temperature sensor 65*c* approaches a predetermined reference first coolant temperature KTWL1. Similarly, the operation of the second water flow rate adjustment valve 46*b* is controlled such that the second device coolant temperature TWL2 detected by the second device coolant-temperature sensor 65*d* approaches a predetermined reference second coolant temperature KTWL2.

According to this, heat of the device coolant can be absorbed by the refrigerant in the mixing-portion integrated chiller 26 while appropriately adjusting the temperatures of the battery 70 and the motor generator 71. In the mixing-portion integrated chiller 26, the heat absorbed by the refrigerant can be used as a heat source for heating the air.

Accordingly, in the hot-gas heating mode during execution of the device warm-up mode, the battery 70 and the motor generator 71 can be quickly warmed up by appropriately adjusting the heat exchange amount between the device coolant in the mixing-portion integrated chiller 26 and the refrigerant. After completion of the warm-up of the battery 70 and the motor generator 71, the temperatures of the battery 70 and the motor generator 71 can be maintained at appropriate temperatures.

Since the refrigeration cycle device 10*d* of the present embodiment includes the mixing-portion integrated chiller 26, similarly to the seventh embodiment, it is possible to sufficiently suppress variation in the enthalpy of the suction side refrigerant. Accordingly, even when the flow is switched to the refrigerant circuit in which the refrigerants having different enthalpies are mixed and sucked into the compressor 11, a stable heating capacity can be exhibited, and the compressor 11 can be protected.

In the vehicle air conditioner of the present embodiment, before heating of the vehicle interior is started at the cryogenic outside air temperature, the operation in the (h-1) assist warm-up mode or the (h-2) assistless warm-up mode, which is described in the ninth embodiment, can be executed. In a similar manner to the (h-3) heater warm-up mode described in the tenth embodiment, the device coolant can be heated by the electric heater 45.

However, when each warm-up mode described above is executed at the cryogenic outside air temperature, the refrigerant having a relatively high temperature discharged from the compressor 11 flows into the accumulator 27 via the bypass passage 21*a* and the mixing-portion integrated chiller 26. On the other hand, the temperature of the refrigerant in the accumulator 27 may be decreased by a suction negative pressure of the compressor 11 to be lower than the outside air temperature Tam.

According to the study of the inventors of the present disclosure, for example, when the warm-up mode is executed in a case where the outside air temperature decreases to about −30° C., it is determined that the temperature of the refrigerant in the accumulator 27 decreases to about −40° C.

Therefore, when the refrigerant having a relatively high temperature flows into the accumulator at the cryogenic outside air temperature, a so-called foaming phenomenon may occur in which a cryogenic liquid-phase refrigerant in the accumulator is rapidly boiled to make the refrigerant foam in the accumulator. When the foaming phenomenon occurs, the compressor 11 sucks the refrigerant having low dryness and thus the durable life of the compressor 11 is adversely affected by the liquid compression.

In the refrigeration cycle device 10*d* of the present embodiment, the (h-4) refrigerant warm-up mode is executed instead of each warm-up mode described above. The (h-4) refrigerant warm-up mode of the present embodiment is an operation mode (that is, the refrigerant heating mode) for heating the refrigerant sucked into the compressor 11 while suppressing the occurrence of the foaming phenomenon.

In other words, the (h-4) refrigerant warm-up mode is a warm-up mode in which at least one of the cycle configuration components such as the compressor 11, the bypass flow adjustment valve 14*d*, the interior condenser 113, the second passage opening/closing valve 22*a*, the cooling expansion valve 14*c*, the mixing-portion integrated chiller 26, and the accumulator 27 is heated while protecting the compressor 11. The detailed operation of the (h-4) refrigerant warm-up mode will be described below.

(h-4) Refrigerant Warm-Up Mode

The refrigerant warm-up mode is executed when heating of the vehicle interior is started at a cryogenic outside air temperature. In the refrigerant warm-up mode, the controller 60 opens the second passage opening/closing valve 22*a* and closes the low-pressure passage opening/closing valve 22*b*. The controller 60 makes the heating expansion valve 14*a* in a fully closed state, the air cooling expansion valve 14*b* in the fully closed state, the cooling expansion valve 14*c* in a throttled state, and the bypass flow adjustment valve 14*d* in the throttled state.

Figure 43:
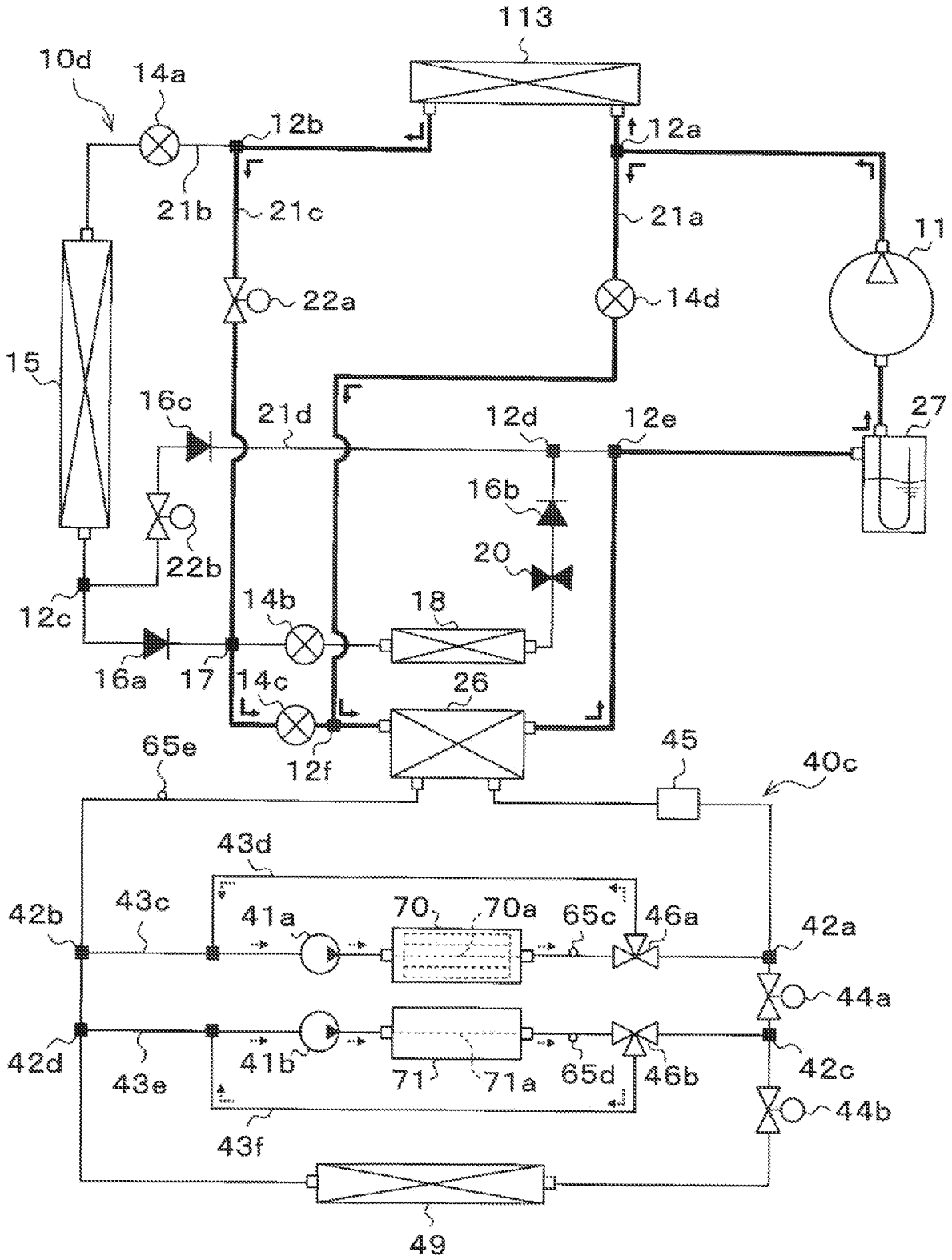
FIG. 43 is a schematic overall configuration diagram illustrating a refrigerant flow in a refrigerant warm-up mode of a refrigeration cycle device according to the twelfth embodiment.

Therefore, in the refrigeration cycle device 10*d* in the refrigerant warm-up mode, as indicated by solid arrows in FIG. 43, the refrigerant discharged from the compressor 11 circulates in the same order in a similar manner to the hot-gas heating mode.

The controller 60 appropriately controls the operation of other control target devices. For example, the compressor 11 is controlled so as to exhibit a predetermined refrigerant discharge capacity for the predetermined refrigerant warm-up mode.

The controller 60 controls the bypass flow adjustment valve 14*d* so as to have a predetermined opening degree for the predetermined refrigerant warm-up mode. The controller 60 controls the cooling expansion valve 14*c* such that a bypass side flow rate, which is the flow rate of the bypass side refrigerant flowing into the sixth three-way joint 12*f*, is greater than a decompression portion side flow rate, which is the flow rate of the decompression-portion side refrigerant flowing into the sixth three-way joint 12*f*.

The controller 60 stops the interior ventilator 52 of the interior air-conditioning unit 50. The controller 60 operates the first device coolant pump 41*a* and the second device coolant pump 41*b* so as to exhibit a predetermined reference discharge capacity. The first water opening/closing valve 44*a* is closed and the second water opening/closing valve 44*b* is opened.

The controller 60 controls the first water flow rate adjustment valve 46*a* such that the first device coolant temperature TWL1 approaches the reference first coolant temperature KTWL1. In the first water flow rate adjustment valve 46*a* in the refrigerant warm-up mode, as indicated by a thin broken line arrow in FIG. 43, substantially the entire flow rate of the device coolant flowing into the first water flow rate adjustment valve 46*a* returns to the inlet side of the coolant passage 70*a* of the battery 70. In other words, in the refrigerant warm-up mode, the device coolant is prevented from flowing out to the mixing-portion integrated chiller 26 side.

The controller 60 controls the second water flow rate adjustment valve 46*b* such that the second device coolant temperature TWL2 approaches the reference second coolant temperature KTWL2. In the second water flow rate adjustment valve 46*b* in the refrigerant warm-up mode, as indicated by the thin broken line arrow in FIG. 43, substantially the entire flow rate of the device coolant flowing into the second water flow rate adjustment valve 46*b* returns to the inlet side of the coolant passage 71*a* of the motor generator 71.

Accordingly, in the refrigeration cycle device 10*d* in the refrigerant warm-up mode, the refrigerant having a relatively high temperature discharged from the compressor 11 is branched at the first three-way joint 12*a*. The other refrigerant branched at the first three-way joint 12*a* is decompressed by the bypass flow adjustment valve 14*d* of the bypass passage 21*a*, and flows into one inflow port of the sixth three-way joint 12*f*.

One refrigerant branched at the first three-way joint 12*a* flows into the interior condenser 113. In the refrigerant warm-up mode, since the interior ventilator 52 is stopped, heat exchange between the refrigerant and the air is not performed in the interior condenser 113. However, in the refrigerant warm-up mode, since the interior condenser 113 has a cryogenic temperature substantially equal to the outside air temperature Tam, the refrigerant flowing into the interior condenser 113 radiates heat to the interior condenser 113 and is cooled when passing through the interior condenser 113.

The refrigerant flowing out from the interior condenser 113 is decompressed by the cooling expansion valve 14*c*, and flows into the other inflow port of the sixth three-way joint 12*f*. At this time, the temperature of the decompression-portion side refrigerant decompressed by the cooling expansion valve 14*c* is lower than the temperature of the bypass side refrigerant decompressed by the bypass flow adjustment valve 14*d*.

The refrigerant flowing out from the sixth three-way joint 12*f* flows into the mixing-portion integrated chiller 26 to be mixed. Accordingly, the temperature of the refrigerant flowing out from the mixing-portion integrated chiller 26 is lower than the temperature of the bypass side refrigerant flowing into the sixth three-way joint 12*f*. In the refrigerant warm-up mode, the device coolant hardly flows into the mixing-portion integrated chiller 26. Therefore, in the mixing-portion integrated chiller 26, heat exchange between the refrigerant and the device coolant is not performed.

The refrigerant flowing out from the mixing-portion integrated chiller 26 flows into the accumulator 27 via the fifth three-way joint 12*e*. The refrigerant flowing into the accumulator 27 is separated into gas and liquid. The gas-phase refrigerant separated in the accumulator 27 is sucked into the compressor 11 and compressed again. According to this, the refrigerant circulating in the cycle is heated by compression work of the compressor 11.

In a similar manner to other warm-up modes, the refrigerant warm-up mode is continued until the third temperature T3 on the outlet side of the refrigerant passage of the mixing-portion integrated chiller 26 becomes equal to or higher than a predetermined reference heating temperature. When the refrigerant warm-up mode is ended, the mode shifts to the hot-gas heating mode.

As described above, in the refrigerant warm-up mode, since the bypass side refrigerant and the decompression-portion side refrigerant are mixed in the mixing-portion integrated chiller 26, the temperature of the refrigerant flowing into the accumulator 27 can be decreased as compared with other warm-up modes. Accordingly, it is possible to heat the refrigerant sucked into the compressor 11 while suppressing the occurrence of the foaming phenomenon in the accumulator 27.

In the refrigerant warm-up mode, the operation of the cooling expansion valve 14*c* is controlled such that the bypass side flow rate is greater than the decompression portion side flow rate. According to this, it is possible to shorten a warm-up time (that is, time interval at which the refrigerant warm-up mode is continued) while suppressing the occurrence of the foaming phenomenon.

Even when the bypass side flow rate is greater than the decompression portion side flow rate, there is a possibility that the above-described foaming phenomenon of the accumulator 27 cannot be reliably avoided. The controller 60 of the present embodiment controls the operation of the cooling expansion valve 14*c* so as not to excessively increase the superheat degree of the refrigerant flowing out from the mixing-portion integrated chiller 26. According to this, the occurrence of the foaming phenomenon is suppressed.

Since the decompression-portion side refrigerant decompressed by the cooling expansion valve 14*c* flows into the mixing-portion integrated chiller 26 disposed on an upstream side from the accumulator 27 in the refrigerant flow direction, in the mixing-portion integrated chiller 26, the decompression-portion side refrigerant can be heated by using the bypass side refrigerant as a heat source. The temperature of the refrigerant flowing into the accumulator 27 can be more reliably decreased than that of the bypass side refrigerant flowing into the mixing-portion integrated chiller 26.

As a result, in the refrigerant warm-up mode of the present embodiment, it is possible to shorten the warm-up time while suppressing the occurrence of the foaming phenomenon.

In addition, by reducing the throttle opening degree of the cooling expansion valve 14*c*, the pressure difference of the cycle can be easily increased. Accordingly, the temperature of the refrigerant and each component of the refrigeration cycle device 10*d* can be quickly increased, and heating of the vehicle interior can be quickly started.

Since the refrigeration cycle device 10*d* of the present embodiment includes the first water flow rate adjustment valve 46*a*, the first device coolant temperature TWL1 can approaches the reference first coolant temperature KTWL1. Accordingly, the temperature of the battery 70 can be stabilized regardless of the operation mode. Similarly, since the second water flow rate adjustment valve 46*b* is provided, the temperature of the motor generator 71 can be stabilized regardless of the operation mode.

Thirteenth Embodiment

Figure 44:
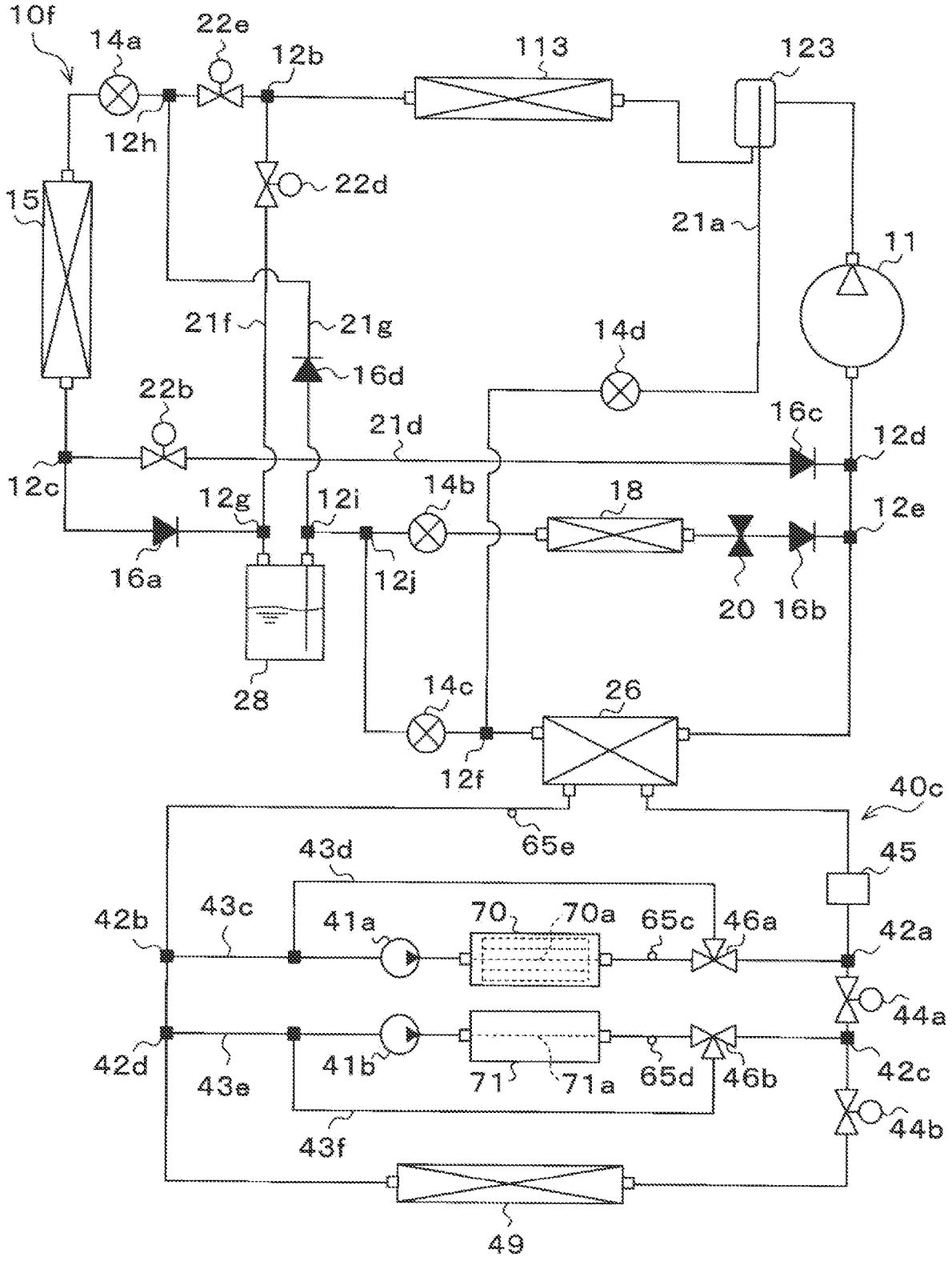
FIG. 44 is a schematic overall configuration diagram of a refrigeration cycle device according to a thirteenth embodiment.

In the present embodiment, a refrigeration cycle device 10*f* will be described. In the refrigeration cycle device 10*f*, as illustrated in FIG. 44, the accumulator 27 is removed from the refrigeration cycle device 10*d* described in the twelfth embodiment, and a receiver 28 is adopted.

More specifically, in the refrigeration cycle device 10*f*, the branch portion 123 described in the eleventh embodiment is adopted as an upstream branch portion. An inlet side of the receiver 28 is connected to one outflow port of the second three-way joint 12*b*. A first inlet side opening/closing valve 22*d* and a seventh three-way joint 12*g* are disposed in an inlet side passage 21*f* connecting one outflow port of the second three-way joint 12*b* with the inlet of the receiver 28.

The receiver 28 is a high-pressure side gas-liquid separator that separates the refrigerant flowing out from the interior condenser 113, which is a heating portion, into gas and liquid, and stores the separated liquid-phase refrigerant as a surplus refrigerant of the cycle. The receiver 28 causes a part of the separated liquid-phase refrigerant to flow out to the downstream side. The first inlet side opening/closing valve 22*d* is an opening/closing valve that opens and closes the refrigerant passage from one outflow port of the second three-way joint 12*b* to one inflow port of the seventh three-way joint 12*g* in the inlet side passage 21*f*.

One inflow port side of an eighth three-way joint 12*h* is connected to the other outflow port of the second three-way joint 12*b*. A second inlet side opening/closing valve 22*e* is disposed in the refrigerant passage connecting the other outflow port of the second three-way joint 12*b* with one inflow port of the eighth three-way joint 12*h*. The second inlet side opening/closing valve 22*e* is an electromagnetic valve that opens and closes the refrigerant passage connecting the other outflow port of the second three-way joint 12*b* with one inflow port of the eighth three-way joint 12*h*.

A refrigerant inlet side of the exterior heat exchanger 15 is connected to an outflow port of the eighth three-way joint 12*h* via the heating expansion valve 14*a*. The other inlet side of the seventh three-way joint 12*g* disposed in the inlet side passage 21*f* is connected to one outflow port of the third three-way joint 12*c* connected to the outlet side of the exterior heat exchanger 15 via the first check valve 16*a*.

The other inflow port side of the eighth three-way joint 12*h* is connected to an outlet of the receiver 28. A ninth three-way joint 12*i* and a fourth check valve 16*d* are disposed in an outlet side passage 21*g* connecting the outlet of the receiver 28 with the other inflow port of the eighth three-way joint 12*h*. The fourth check valve 16*d* allows the refrigerant to flow from the ninth three-way joint 12*i* side toward the eighth three-way joint 12*h* side, and prevents the refrigerant from flowing from the eighth three-way joint 12*h* side toward the ninth three-way joint 12*i* side.

An inflow port side of a tenth three-way joint 12*j* is connected to the other outflow port of the ninth three-way joint 12*i*. The refrigerant inlet side of the interior evaporator 18 is connected to one outflow port of the tenth three-way joint 12*j* via the air cooling expansion valve 14*b*. The inlet side of the refrigerant passage of the chiller 19 is connected to the other outflow port of the tenth three-way joint 12*j* via the cooling expansion valve 14*c*.

In the refrigeration cycle device 10*f*, the other inflow port side of the forth three-joint 12*d* is connected to the outflow port of the fifth three-way joint 12*e*. The suction port side of the compressor 11 is connected to the outflow port of the forth three-joint 12*d*. Other configurations of the refrigeration cycle device 10*f* are similar to those of the refrigeration cycle device 10*d* described in the twelfth embodiment.

Next, operation of the vehicle air conditioner of the present embodiment having the above configuration will be described. In the vehicle air conditioner of the present embodiment, various operation modes similar to those of the seventh embodiment are switched in order to perform air conditioning of the vehicle interior and temperature adjustment of the in-vehicle devices (specifically, the battery 70 and the motor generator 71). Hereinafter, the operation of each operation mode will be described in detail.

(a) Air Cooling Mode

In the air cooling mode, the controller 60 closes the first inlet side opening/closing valve 22*d*, opens the second inlet side opening/closing valve 22*e*, and closes the low-pressure passage opening/closing valve 22*b*. The controller 60 makes the heating expansion valve 14*a* in a fully opened state, the air cooling expansion valve 14*b* in a throttled state, and the bypass flow adjustment valve 14*d* in a fully closed state.

Figure 45:
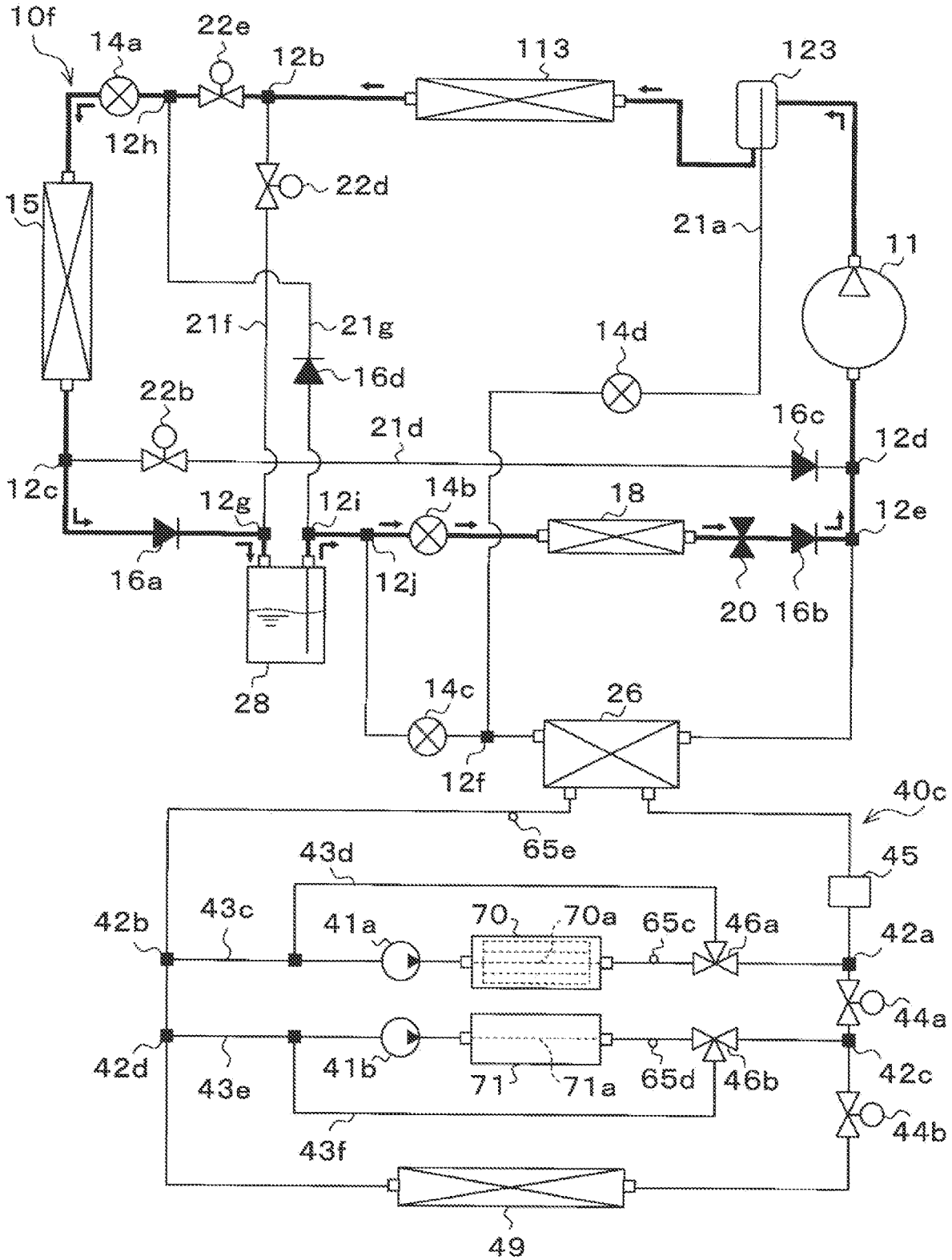
FIG. 45 is a schematic overall configuration diagram illustrating a refrigerant flow in an air cooling mode and a series dehumidifying and heating mode of a refrigeration cycle device according to the thirteenth embodiment.

Therefore, in the refrigeration cycle device 10*f* in the air cooling mode, as indicated by solid arrows in FIG. 45, the refrigerant discharged from the compressor 11 circulates through the interior condenser 113, the heating expansion valve 14*a* that is fully opened, the exterior heat exchanger 15, the first check valve 16*a*, the receiver 28, the air cooling expansion valve 14*b*, the interior evaporator 18, the evaporating pressure adjustment valve 20, the second check valve 16*b*, and the suction port of the compressor 11 in this order. In FIG. 45, the flow of the refrigerant in the air cooling mode in which the device cooling mode is not executed is indicated by solid arrows.

In a similar manner to the air cooling mode of the first embodiment, the controller 60 appropriately controls the operation of other control target devices.

Accordingly, in the refrigeration cycle device 10*f* in the air cooling mode, a vapor compression refrigeration cycle is configured in which the exterior heat exchanger 15 functions as a condenser that condenses the refrigerant and the interior evaporator 18 functions as an evaporator that evaporates the refrigerant. In the interior air-conditioning unit 50 in the air cooling mode, the air cooled by the interior evaporator 18 is blown into the vehicle interior. According to this, air cooling of the vehicle interior is realized.

Also in the vehicle air conditioner of the present embodiment, similarly to the first embodiment, the controller 60 makes the cooling expansion valve 14*c* in a throttled state and operates the first device coolant pump 41*a* and the second device coolant pump 41*b*, and thus the device cooling mode can be executed.

In the device cooling mode, as described in the twelfth embodiment, at least one of the battery 70 or the motor generator 71 can be cooled by switching the circuit configuration of the device coolant circuit 40*c*.

(b) Series Dehumidifying and Heating Mode

In the series dehumidifying and heating mode, the controller 60 closes the first inlet side opening/closing valve 22*d*, opens the second inlet side opening/closing valve 22*e*, and closes the low-pressure passage opening/closing valve 22*b*. The controller 60 makes the heating expansion valve 14*a* in a throttled state, the air cooling expansion valve 14*b* in the throttled state, and the bypass flow adjustment valve 14*d* in a fully closed state.

Therefore, in the refrigeration cycle device 10*f* in the series dehumidifying and heating mode, in a similar manner to the air cooling mode, as indicated by solid arrows in FIG. 45, the refrigerant discharged from the compressor 11 circulates through the interior condenser 113, the heating expansion valve 14*a*, the exterior heat exchanger 15, the first check valve 16*a*, the receiver 28, the air cooling expansion valve 14*b*, the interior evaporator 18, the evaporating pressure adjustment valve 20, the second check valve 16*b*, and the suction port of the compressor 11 in this order.

In a similar manner to the series dehumidifying and heating mode of the first embodiment, the controller 60 appropriately controls the operation of other control target devices.

Accordingly, in the refrigeration cycle device 10*f* in the series dehumidifying and heating mode, the interior condenser 113 functions as a condenser, and the interior evaporator 18 functions as an evaporator. In a case where the saturation temperature of the refrigerant in the exterior heat exchanger 15 is higher than the outside air temperature Tam, the vapor compression refrigeration cycle in which the exterior heat exchanger 15 functions as a condenser is configured. In a case where the saturation temperature of the refrigerant in the exterior heat exchanger 15 is lower than the outside air temperature Tam, the vapor compression refrigeration cycle in which the exterior heat exchanger 15 functions as an evaporator is configured.

In the interior air-conditioning unit 50 in the series dehumidifying and heating mode, the air cooled by the interior evaporator 18 is reheated by the interior condenser 113 and blown into the vehicle interior. According to this, dehumidifying and heating of the vehicle interior is realized. Also in the series dehumidifying and heating mode, the device cooling mode can be executed in a similar manner to the air cooling mode.

In the refrigeration cycle device 10*f* of the present embodiment, since the receiver 28 as the high-pressure side gas-liquid separator is provided, the series dehumidifying and heating mode is executed in a temperature range in which the saturation temperature of the refrigerant in the exterior heat exchanger 15 is higher than the outside air temperature Tam.

(c) Parallel Dehumidifying and Heating Mode

In the parallel dehumidifying and heating mode, the controller 60 opens the first inlet side opening/closing valve 22*d*, closes the second inlet side opening/closing valve 22*e*, and opens the low-pressure passage opening/closing valve 22*b*. The controller 60 makes the heating expansion valve 14*a* in a throttled state, the air cooling expansion valve 14*b* in the throttled state, and the bypass flow adjustment valve 14*d* in a fully closed state.

Figure 46:
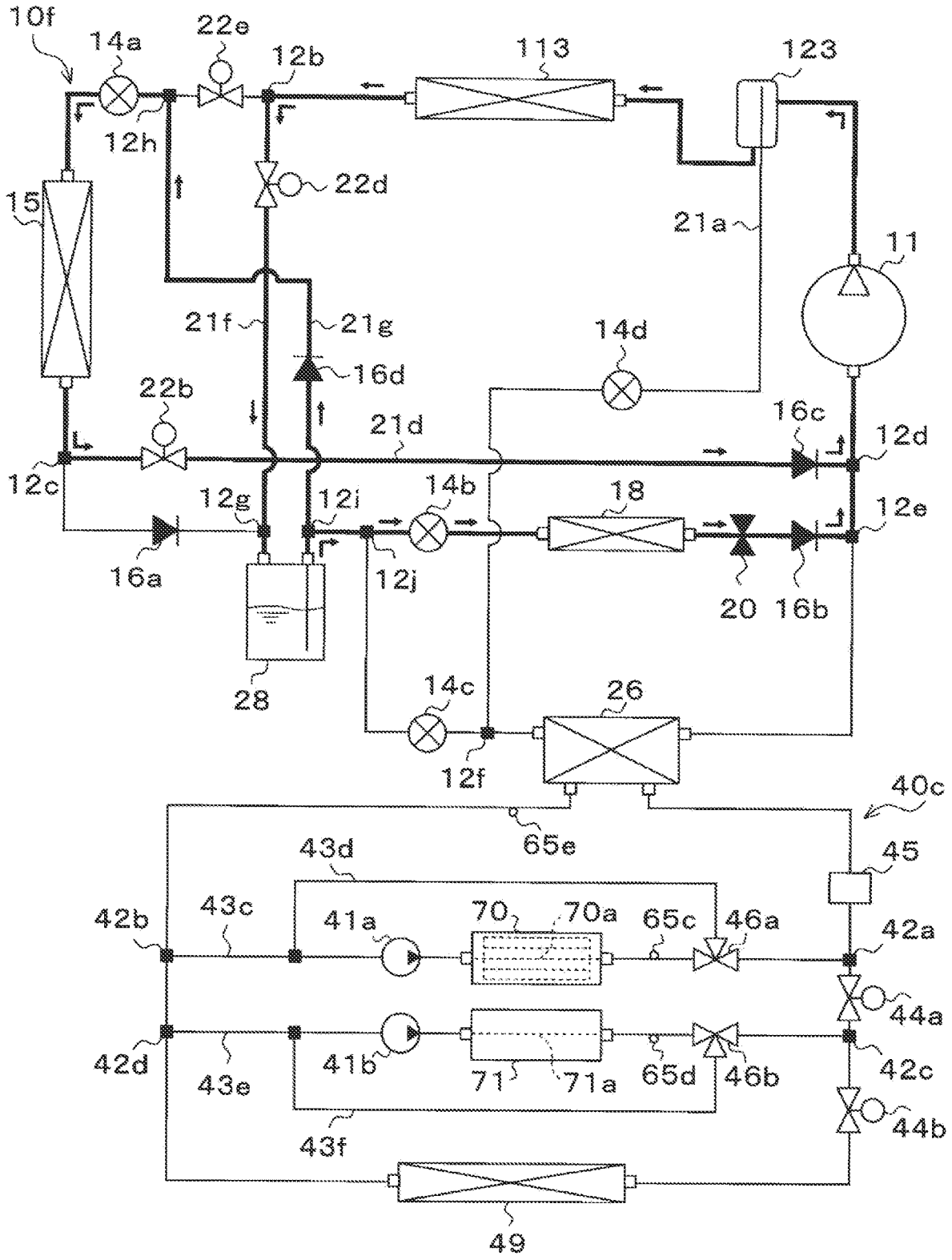
FIG. 46 is a schematic overall configuration diagram illustrating a refrigerant flow in a parallel dehumidifying and heating mode of a refrigeration cycle device according to the thirteenth embodiment.

Therefore, in the refrigeration cycle device 10*f* in the parallel dehumidifying and heating mode, as indicated by solid arrows in FIG. 46, the refrigerant discharged from the compressor 11 circulates through the interior condenser 113, the receiver 28, the ninth three-way joint 12*i*, the air cooling expansion valve 14*b*, the interior evaporator 18, the evaporating pressure adjustment valve 20, the second check valve 16*b*, and the suction port of the compressor 11 in this order. At the same time, the refrigerant discharged from compressor 11 circulates through the interior condenser 113, the receiver 28, the ninth three-way joint 12*i*, the fourth check valve 16*d*, the heating expansion valve 14*a*, the exterior heat exchanger 15, the low-pressure passage 21*d*, and the suction port of compressor 11 in this order.

That is, in the parallel dehumidifying and heating mode, the flow of the refrigerant flowing out from the receiver 28 is switched to the refrigerant circuit in which the interior evaporator 18 is connected to the exterior heat exchanger 15 in parallel. In FIG. 46, the refrigerant flow in the parallel dehumidifying and heating mode when the device cooling mode is not executed is illustrated.

In a similar manner to the parallel dehumidifying and heating mode of the first embodiment, the controller 60 appropriately controls the operation of other control target devices.

Accordingly, in the refrigeration cycle device 10*f* in the parallel dehumidifying and heating mode, the vapor compression refrigeration cycle is configured in which the interior condenser 113 functions as a condenser and the interior evaporator 18 and the exterior heat exchanger 15 function as an evaporator.

In the interior air-conditioning unit 50 in the parallel dehumidifying and heating mode, the air cooled by the interior evaporator 18 is reheated by the interior condenser 113 and blown into the vehicle interior. According to this, dehumidifying and heating of the vehicle interior is realized. Also in the parallel dehumidifying and heating mode, the device cooling mode can be executed in a similar manner to the air cooling mode.

(e) Outside Air Heat-Absorption Heating Mode

In the outside air heat-absorption heating mode, the controller 60 opens the first inlet side opening/closing valve 22*d*, closes the second inlet side opening/closing valve 22*e*, and opens the low-pressure passage opening/closing valve 22*b*. The controller 60 makes the heating expansion valve 14*a* in a throttled state, the air cooling expansion valve 14*b* in a fully closed state, and the bypass flow adjustment valve 14*d* in the fully closed state.

Figure 47:
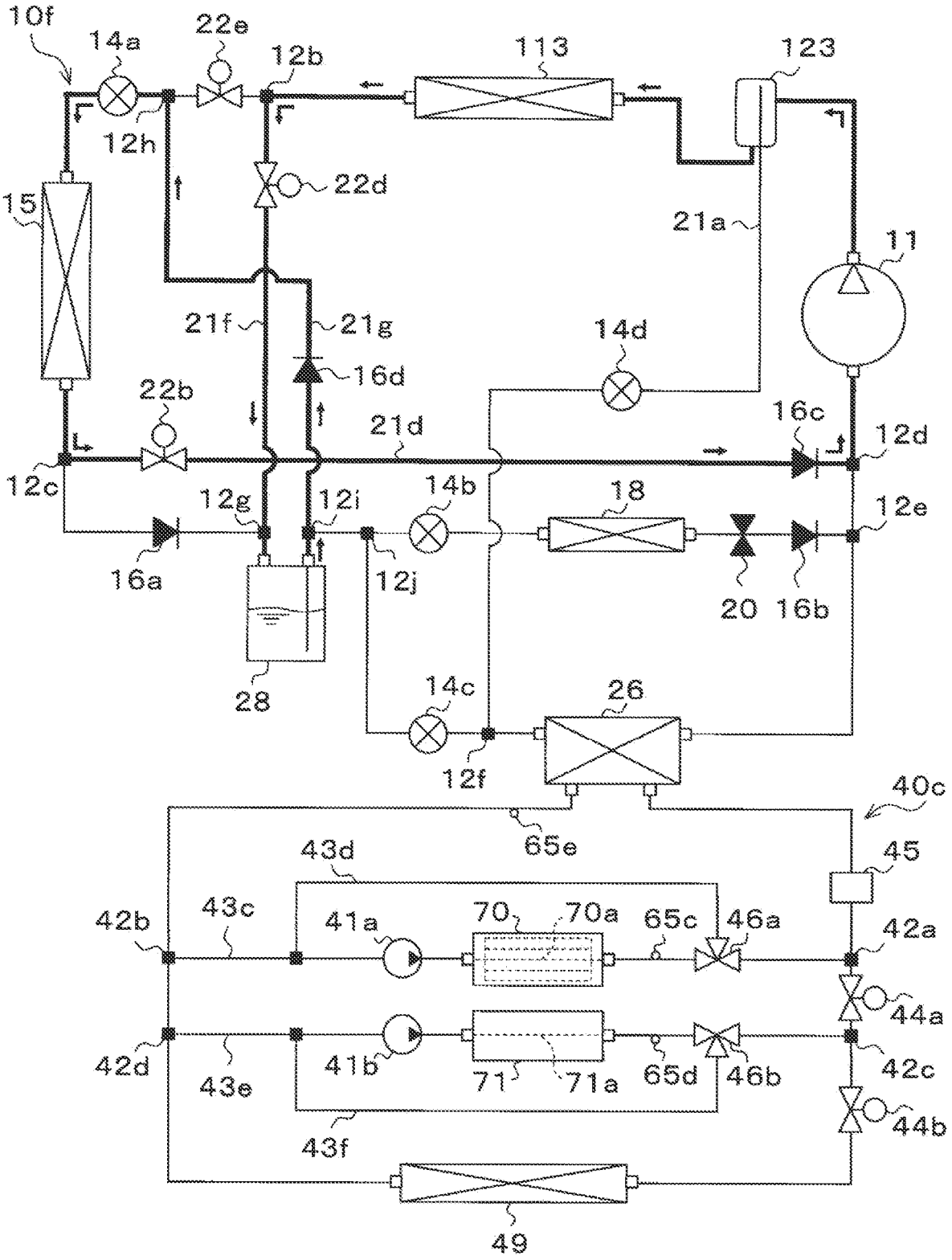
FIG. 47 is a schematic overall configuration diagram illustrating a refrigerant flow in an outside air heat-absorption heating mode of a refrigeration cycle device according to the thirteenth embodiment.

Therefore, in the refrigeration cycle device 10*f* in the outside air heat-absorption heating mode, as indicated by solid arrows in FIG. 47, the refrigerant discharged from the compressor 11 circulates through the interior condenser 113, the receiver 28, the fourth check valve 16*d*, the heating expansion valve 14*a*, the exterior heat exchanger 15, the low-pressure passage 21*d*, and the suction port of the compressor 11 in this order. In FIG. 47, the refrigerant flow in the outside air heat-absorption heating mode when the device cooling mode is not executed is illustrated.

In a similar manner to the outside air heat-absorption heating mode of the first embodiment, the controller 60 appropriately controls the operation of other control target devices.

Accordingly, in the refrigeration cycle device 10*f* in the outside air heat-absorption heating mode, the vapor compression refrigeration cycle is configured in which the interior condenser 113 functions as a condenser and the exterior heat exchanger 15 function as an evaporator.

In the interior air-conditioning unit 50 in the outside air heat-absorption heating mode, the air having passed through the interior evaporator 18 is heated by the interior condenser 113 and blown into the vehicle interior. According to this, heating of the vehicle interior is realized. Also in the parallel dehumidifying and heating mode, the device cooling mode can be executed in a similar manner to the air cooling mode.

(g) Hot-Gas Heating Mode

In the hot-gas heating mode, the controller 60 opens the first inlet side opening/closing valve 22*d*, closes the second inlet side opening/closing valve 22*e*, and closes the low-pressure passage opening/closing valve 22*b*. The controller 60 makes the heating expansion valve 14*a* in a fully closed state, the air cooling expansion valve 14*b* in the fully closed state, the cooling expansion valve 14*c* in a throttled state, and the bypass flow adjustment valve 14*d* in the throttled state.

Figure 48:
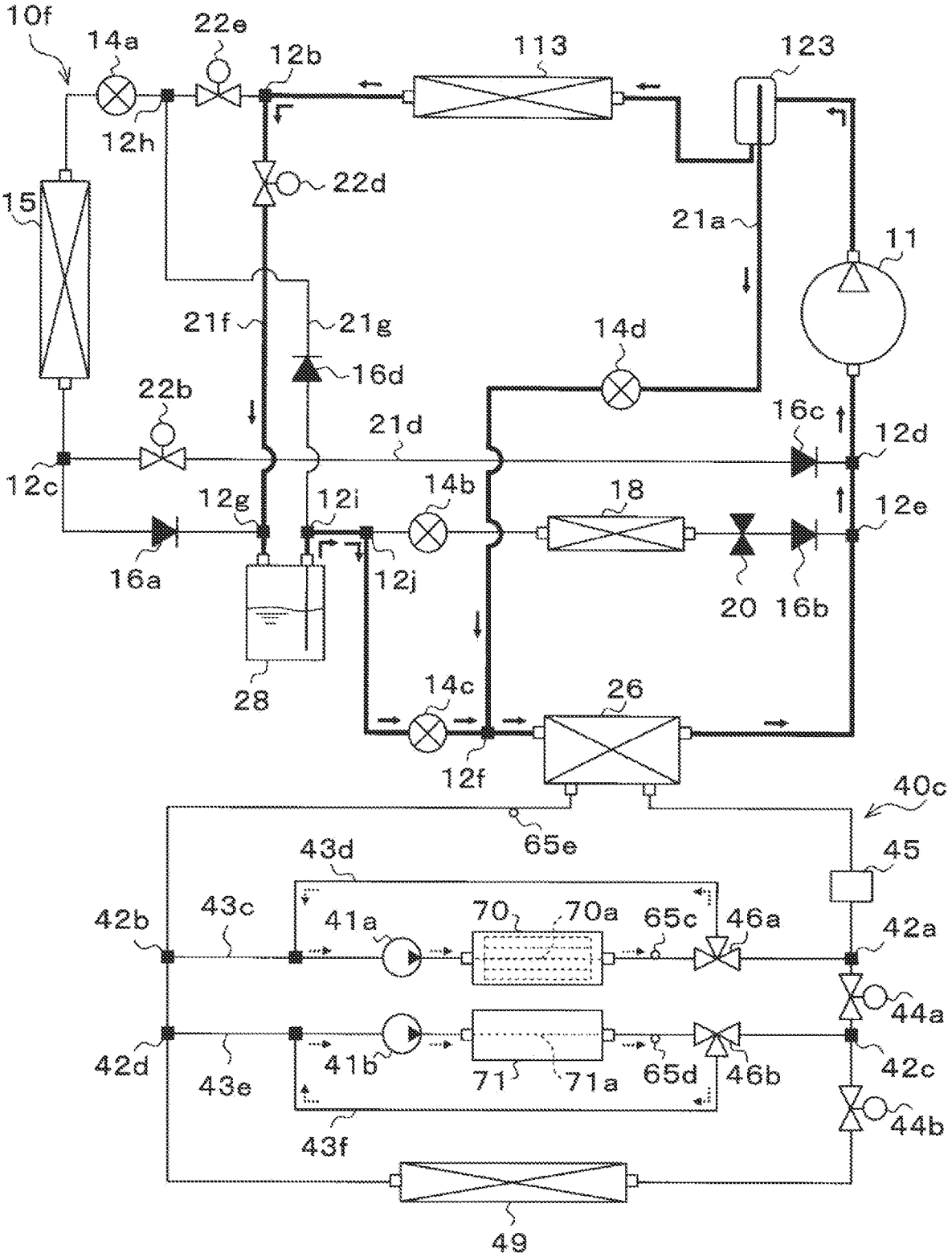
FIG. 48 is a schematic overall configuration diagram illustrating a refrigerant flow in a hot-gas heating mode and a refrigerant warm-up mode of a refrigeration cycle device according to the thirteenth embodiment.

Therefore, in the refrigeration cycle device 10*f* in the hot-gas heating mode, as indicated by solid arrows in FIG. 48, the refrigerant discharged from the compressor 11 circulates through the branch portion 123, the interior condenser 113, the inlet side passage 21*f*, the receiver 28, the cooling expansion valve 14*c*, the mixing-portion integrated chiller 26, and the suction port of the compressor 11 in this order. At the same time, a part of the refrigerant discharged from the compressor 11 circulates through the branch portion 123, the bypass flow adjustment valve 14*d*, the mixing-portion integrated chiller 26, and the suction port of the compressor 11 in this order.

In a similar manner to the hot-gas heating mode of the first embodiment, the controller 60 appropriately controls the operation of other control target devices. Accordingly, in the refrigeration cycle device 10*f* in the hot-gas heating mode, similarly to the first embodiment, it is possible to suppress a decrease in a heating capacity of the air even at the cryogenic outside air temperature.

In the hot-gas heating mode, the device warm-up mode similar to that of the twelfth embodiment can be executed. In FIG. 48, the flow of the device coolant in the device coolant circuit 40*c* in the hot-gas heating mode during execution of the device warm-up mode is indicated by a thin broken line arrow.

In the device warm-up mode of the present embodiment, the controller 60 closes the first water opening/closing valve 44*a* and opens the second water opening/closing valve 44*b*. The controller 60 operates the first device coolant pump 41*a* and the second device coolant pump 41*b* so as to exhibit a predetermined reference discharge capacity.

Therefore, in the device coolant circuit 40*c* during execution of the device warm-up mode, the flow is switched to the coolant circuit that circulates the device coolant between the coolant passage 70*a* of the battery 70 and the mixing-portion integrated chiller 26 and circulates the device coolant between the coolant passage 71*a* of the motor generator 71 and the low temperature side radiator 49.

The controller 60 controls the operation of the first water flow rate adjustment valve 46*a* by using the first device coolant temperature TWL1.

Specifically, in the present embodiment, in a case where a temperature difference ΔTWL1 obtained by subtracting the first device coolant temperature TWL1 from the temperature of the inflow side refrigerant flowing into the mixing-portion integrated chiller 26 is greater than a predetermined reference temperature difference KΔTWL1, the operation of the first water flow rate adjustment valve 46*a* is controlled so as to return substantially the entire flow rate of the device coolant flowing out from the coolant passage 70*a* to the suction port side of the first device coolant pump 41*a*.

When the temperature difference ΔTWL1 is equal to or less than the reference temperature difference KΔTWL1 due to self-heating of the battery 70, the operation of the first water flow rate adjustment valve 46*a* is controlled so as to increase the flow rate of the device coolant flowing out to the mixing-portion integrated chiller 26 side in accordance with a decrease in the temperature difference ΔTWL1.

In the hot-gas heating mode, the temperature of the inflow side refrigerant flowing into the mixing-portion integrated chiller 26 is substantially constant. Therefore, increasing the flow rate of the device coolant flowing out to the mixing-portion integrated chiller 26 side in accordance with the decrease in the temperature difference ΔTWL1 is substantially equivalent to increasing the flow rate of the device coolant flowing out to the mixing-portion integrated chiller 26 side in accordance with an increase in the first device coolant temperature TWL1.

The controller 60 controls the operation of the second water flow rate adjustment valve 46*b* such that the second device coolant temperature TWL2 detected by the second device coolant-temperature sensor 65*d* approaches the reference second coolant temperature KTWL2. In FIG. 48, the flow of the device coolant when the temperature difference ΔTWL1 is greater than a predetermined reference temperature difference KΔTWL1 is indicated by a thin broken line arrow.

As described above, in the vehicle air conditioner of the present embodiment, the refrigeration cycle device 10*e* switches the refrigerant circuit according to each operation mode, and thus comfortable air conditioning in the vehicle interior can be realized.

Since the refrigeration cycle device 10*f* of the present embodiment includes the mixing-portion integrated chiller 26, similarly to the seventh embodiment, it is possible to sufficiently suppress variation in the enthalpy of the suction side refrigerant. Accordingly, even when the flow is switched to the refrigerant circuit in which the refrigerants having different enthalpies are mixed and sucked into the compressor 11, a stable heating capacity can be exhibited, and the compressor 11 can be protected.

In the vehicle air conditioner of the present embodiment, before heating of the vehicle interior is started at the cryogenic outside air temperature, the operation in the (h-1) assist warm-up mode or the (h-2) assistless warm-up mode, which is described in the ninth embodiment, can be executed. In a similar manner to the (h-3) heater warm-up mode described in the tenth embodiment, the device coolant can be heated by the electric heater 45. The operation in the (h-4) refrigerant warm-up mode described in the twelfth embodiment can be executed.

However, in the refrigeration cycle device 10*f* of the present embodiment, the receiver 28 as the high-pressure side gas-liquid separator is adopted instead of the accumulator 27 as the low-pressure side gas-liquid separator. Therefore, when each warm-up mode described above is executed at a low outside air temperature, there is a possibility that the compressor 11 sucks the refrigerant with low dryness stagnating on a low pressure side of the cycle in the mixing-portion integrated chiller 26.

In the refrigeration cycle device 10*f* of the present embodiment, the operation in the warm-up preparation mode is executed before execution of each warm-up mode. The warm-up preparation mode is an operation mode for storing the refrigerant in the cycle in the receiver 28. The detailed operation of the warm-up preparation mode will be described below.

(i) Warm-Up Preparation Mode

The warm-up preparation mode of the present embodiment is executed before execution of the (h-4) refrigerant warm-up mode. In the warm-up preparation mode, the controller 60 opens the first inlet side opening/closing valve 22*d*, closes the second inlet side opening/closing valve 22*e*, and closes the low-pressure passage opening/closing valve 22*b*. The controller 60 makes the heating expansion valve 14*a* in a fully closed state, the air cooling expansion valve 14*b* in a fully closed state, the cooling expansion valve 14*c* in the fully closed state, and the bypass flow adjustment valve 14*d* in the throttled state.

Figure 49:
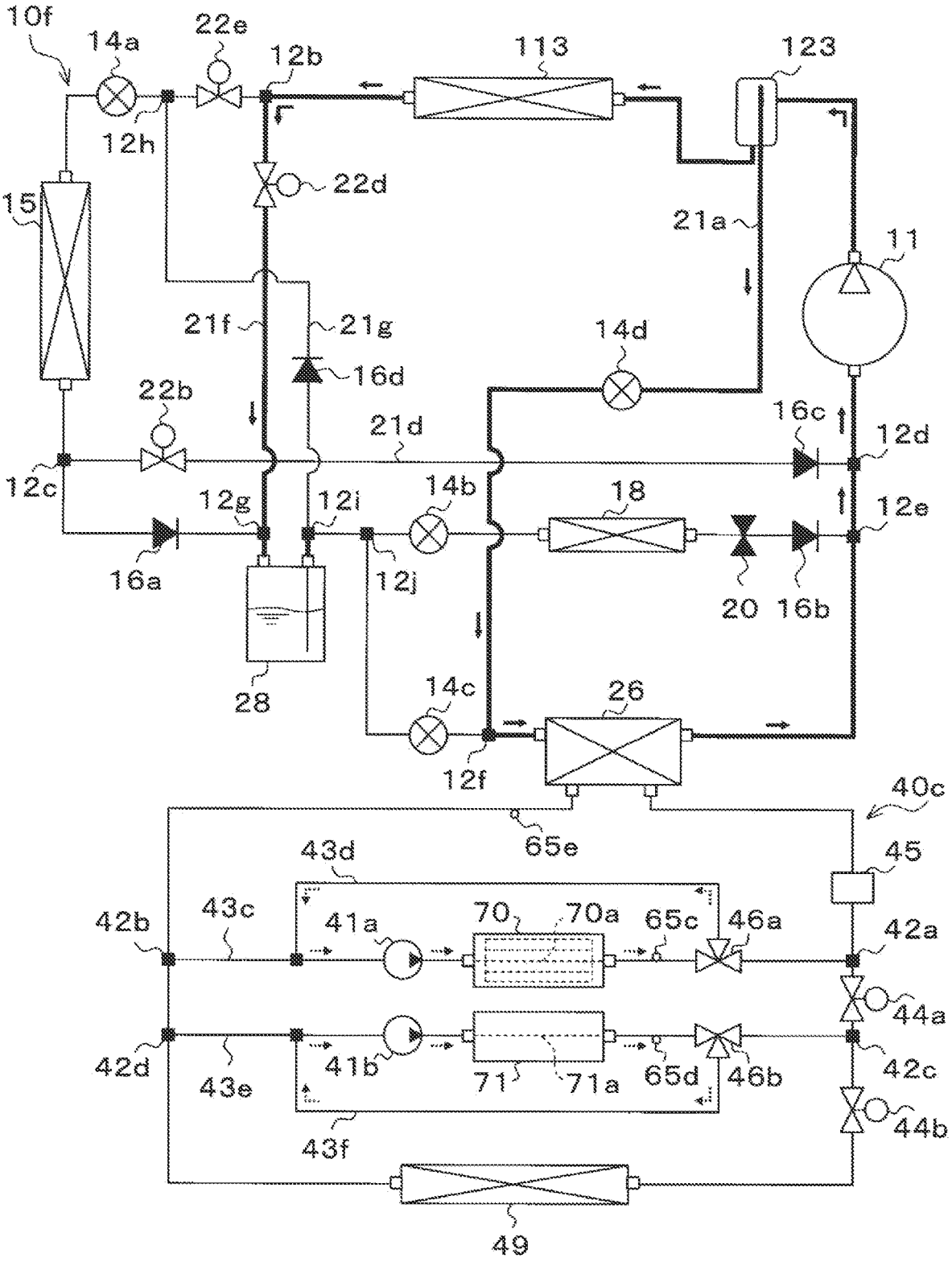
FIG. 49 is a schematic overall configuration diagram illustrating a refrigerant flow in a warm-up preparation mode of a refrigeration cycle device according to the thirteenth embodiment.

Therefore, in the refrigeration cycle device 10*f* in the warm-up preparation mode, as indicated by solid arrows in FIG. 49, the refrigerant discharged from the compressor 11 flows through the branch portion 123, the interior condenser 113, the inlet side passage 21*f*, and the receiver 28 in this order. At the same time, a part of the refrigerant discharged from the compressor 11 circulates through the branch portion 123, the bypass flow adjustment valve 14*d*, the mixing-portion integrated chiller 26, and the suction port of the compressor 11 in this order.

The controller 60 appropriately controls the operation of other control target devices. For example, the compressor 11 is controlled so as to exhibit a predetermined refrigerant discharge capacity for the warm-up preparation mode. The refrigerant discharge capacity for the warm-up preparation mode is set to a value lower than the refrigerant discharge capacity for the refrigerant warm-up mode.

The controller 60 stops the interior ventilator 52 of the interior air-conditioning unit 50. The controller 60 stops the first device coolant pump 41*a* and the second device coolant pump 41*b*. That is, in the warm-up preparation mode, the device coolant is prevented from flowing into the mixing-portion integrated chiller 26 side.

Accordingly, in the refrigeration cycle device 10*f* in the warm-up preparation mode, the refrigerant having a relatively high temperature discharged from the compressor 11 is branched at the branch portion 123.

The refrigerant having relatively high dryness branched at the branch portion 123 is decompressed by the bypass flow adjustment valve 14*d* of the bypass passage 21*a*, and flows into the mixing-portion integrated chiller 26 via the sixth three-way joint 12*f*. In the warm-up preparation mode, since the first device coolant pump 41*a* and the second device coolant pump 41*b* are stopped, the heat exchange between the refrigerant and the device coolant is not performed in the mixing-portion integrated chiller 26.

The refrigerant flowing out from the mixing-portion integrated chiller 26 is sucked into the compressor 11 and is compressed again. According to this, the refrigerant circulating in the cycle is heated by compression work of the compressor 11. The refrigerant having a relatively low dryness branched at the branch portion 123 flows into the interior condenser 113 due to a pressure difference. In the warm-up preparation mode, since the interior ventilator 52 is stopped, heat exchange between the refrigerant and the air is not performed in the interior condenser 113.

However, in the warm-up preparation mode, since the interior condenser 113 has a cryogenic temperature, the refrigerant flowing into the interior condenser 113 radiates heat to the interior condenser 113 and is condensed when passing through the interior condenser 113. Accordingly, in the warm-up preparation mode, the refrigerant having a relatively low dryness and branched at the branch portion 123 can be condensed and stored in the receiver 28 as a liquid-phase refrigerant.

The warm-up preparation mode is executed until the dryness of the refrigerant on the outlet side of the mixing-portion integrated chiller 26 is detected. When the dryness of the refrigerant on the outlet side of the mixing-portion integrated chiller 26 is detected, the warm-up preparation mode is ended, and the mode shifts to the refrigerant warm-up mode.

(h-4) Refrigerant Warm-Up Mode

In the refrigerant warm-up mode, the controller 60 opens the first inlet side opening/closing valve 22*d*, closes the second inlet side opening/closing valve 22*e*, and closes the low-pressure passage opening/closing valve 22*b*. The controller 60 makes the heating expansion valve 14*a* in a fully closed state, the air cooling expansion valve 14*b* in the fully closed state, the cooling expansion valve 14*c* in a throttled state, and the bypass flow adjustment valve 14*d* in the throttled state.

Therefore, in the refrigeration cycle device 10*f* in the outside air heat-absorption heating mode, as illustrated in FIG. 48, the refrigerant discharged from the compressor 11 circulates in the same order in a similar manner to the hot-gas heating mode.

The controller 60 appropriately controls the operation of other control target devices. For example, the compressor 11 is controlled so as to exhibit a predetermined refrigerant discharge capacity for the predetermined refrigerant warm-up mode.

The controller 60 controls the bypass flow adjustment valve 14*d* so as to have a predetermined opening degree for the predetermined refrigerant warm-up mode. The controller 60 controls the throttle opening degree of the cooling expansion valve 14*c* such that the superheat degree SH of the refrigerant on the outlet side of the mixing-portion integrated chiller 26 approaches the reference superheat degree KSH.

The operations of other control target devices are similar to those in the refrigerant warm-up mode of the twelfth embodiment. Accordingly, in the refrigeration cycle device 10*f* in the refrigerant warm-up mode, in a similar manner to the refrigerant warm-up mode of the twelfth embodiment, the refrigerant circulating in the cycle is heated by the compression work of the compressor 11.

In a similar manner to other warm-up modes, the refrigerant warm-up mode is continued until the third temperature T3 on the outlet side of the refrigerant passage of the mixing-portion integrated chiller 26 becomes equal to or higher than a predetermined reference heating temperature. When the refrigerant warm-up mode is ended, the mode described above shifts to the hot-gas heating mode.

In the hot-gas heating mode, the flow rate of the device coolant flowing out to the mixing-portion integrated chiller 26 side is increased in accordance with a decrease in the temperature difference ΔTWL1. In other words, the heat exchange amount between the device coolant and the refrigerant in the mixing-portion integrated chiller 26 is increased in accordance with an increase in the first device coolant temperature TWL1. According to this, the battery 70 can be appropriately warmed up while protecting the compressor 11.

More specifically, when the refrigerant warm-up mode is shifted to the hot-gas heating mode, it is possible to prevent a low temperature device coolant from flowing into the mixing-portion integrated chiller 26 at once and decreasing the enthalpy of the suction side refrigerant flowing out from the mixing-portion integrated chiller 26. Accordingly, when the refrigerant warm-up mode is shifted to the hot-gas heating mode, it is possible to prevent the compressor 11 from sucking the refrigerant having low dryness.

As a result, in the hot-gas heating mode of the present embodiment, the battery 70 can be warmed up while protecting the compressor 11. After completion of the warm-up of the battery 70, the temperature of the battery 70 can be maintained at an appropriate temperature.

The first water flow rate adjustment valve 46*a* returns the device coolant not allowed to flow into the mixing-portion integrated chiller 26 to the suction port side of the first device coolant pump 41*a* via the first return passage 43*d*. Accordingly, even when the battery temperature TB changes, the flow rate of the device coolant flowing through the coolant passage 70*a* does not change. As a result, occurrence of temperature distribution in the battery 70 can be suppressed.

As described above, in the refrigeration cycle device 10*f* of the present embodiment, since the warm-up preparation mode is executed before an operation in the refrigerant warm-up mode is executed, the refrigerant in the cycle can be stored in the receiver 28 before the operation in the refrigerant warm-up mode is executed. Accordingly, when the warm-up preparation mode is shifted to the refrigerant warm-up mode, it is possible to prevent the compressor 11 from sucking the refrigerant having low dryness even when the number of rotations (that is, refrigerant discharge capacity) of the compressor 11 is increased.

As a result, in a similar manner to the refrigerant warm-up mode, it is possible to provide the refrigeration cycle device capable of appropriately protecting the compressor even when the refrigerants having different enthalpies are mixed and sucked into the compressor.

In the refrigeration cycle device 10*f* of the present embodiment, in the warm-up preparation mode, specifically, the heating expansion valve 14*a*, the air cooling expansion valve 14*b*, and the cooling expansion valve 14*c* are made into the fully closed state, and thus one refrigerant branched at the branch portion 123 can be stored in the receiver 28.

In the present embodiment, since the branch portion 123 is adopted, as described in the eleventh embodiment, the refrigerant having lower dryness among the branched refrigerants can flow out to the receiver 28 side. Accordingly, the liquid-phase refrigerant can be quickly stored in the receiver 28. That is, the warm-up preparation mode can be quickly completed.

In the refrigeration cycle device 10*f* of the present embodiment, the warm-up preparation mode is executed until the refrigerant becomes the gas-phase refrigerant having the dryness of the refrigerant on the outlet side of the mixing-portion integrated chiller 26. According to this, even when the number of rotations of the compressor 11 is increased when shifting to the refrigerant warm-up mode, the liquid compression of the compressor 11 can be reliably suppressed.

In the refrigeration cycle device 10*f* of the present embodiment, in the warm-up preparation mode, the refrigerant discharge capacity decreases as compared with the refrigerant warm-up mode. Accordingly, even when the compressor 11 sucks the refrigerant having relatively low dryness in the warm-up preparation mode, the refrigerant is less likely to be adversely affected by liquid compression.

In the refrigeration cycle device 10*f* of the present embodiment, in the warm-up preparation mode, the operation of the cooling expansion valve 14*c* is controlled such that the bypass side flow rate is greater than the decompression portion side flow rate. According to this, the pressure difference of the cycle is easily increased. Accordingly, the temperature of the refrigerant and each component of the refrigeration cycle device 10*d* can be quickly increased, and heating of the vehicle interior can be quickly started.

In the refrigeration cycle device 10*f* of the present embodiment, the throttle opening degree of the cooling expansion valve 14*c* is adjusted such that the superheat degree SH of the refrigerant on the outlet side of the mixing-portion integrated chiller 26 approaches the reference superheat degree KSH after the warm-up preparation mode is ended. According to this, liquid compression of the compressor 11 can be avoided and the compressor 11 can be protected even after the warm-up preparation mode is ended.

Fourteenth Embodiment

Figure 50:
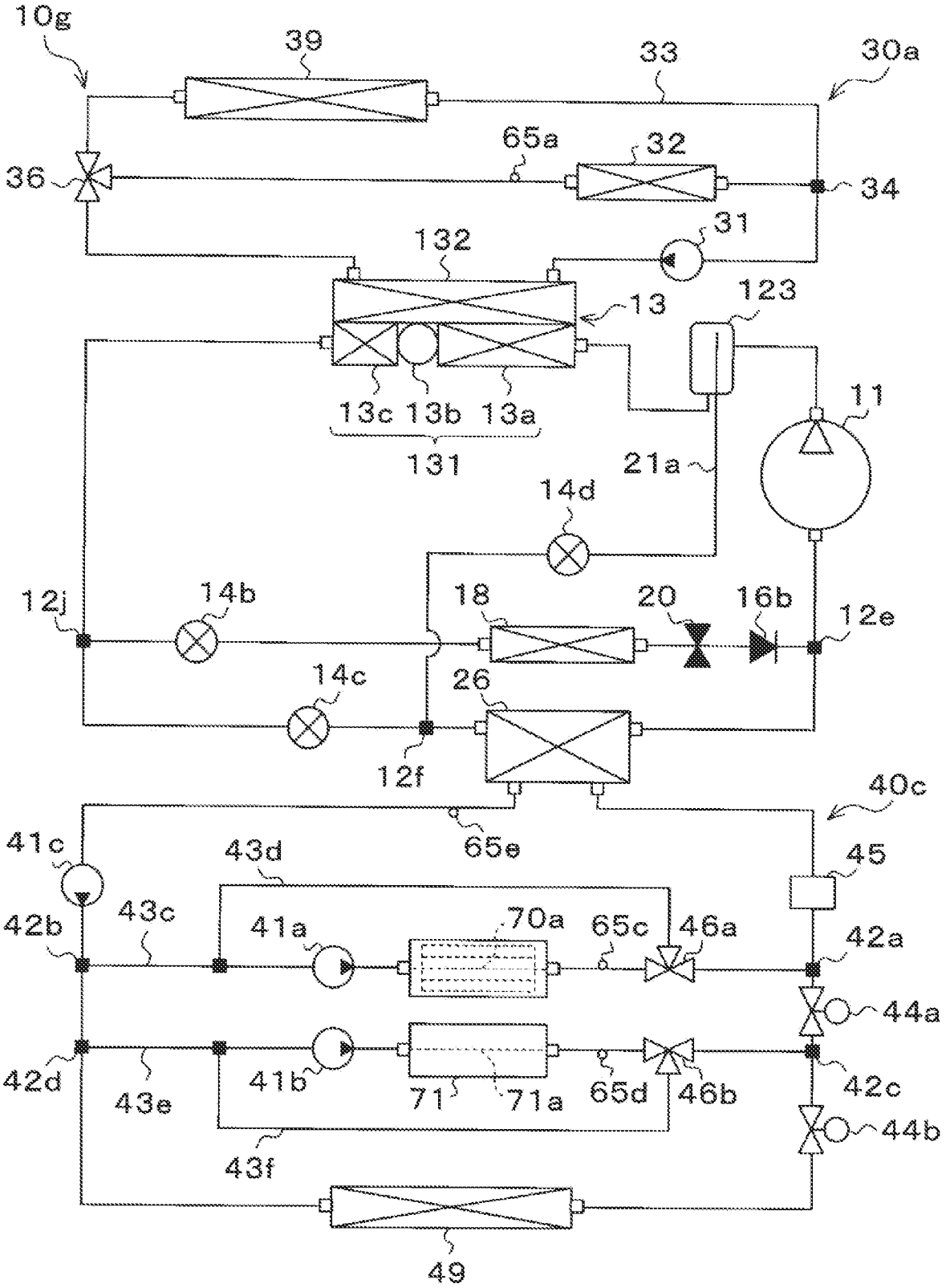
FIG. 50 is a schematic overall configuration diagram of a refrigeration cycle device according to a fourteenth embodiment.

In the present embodiment, as illustrated in FIG. 50, a refrigeration cycle device 10*g* including a heating-coolant circuit 30*a* will be described.

In the refrigeration cycle device 10*g*, the interior condenser 113, the heating expansion valve 14*a*, the exterior heat exchanger 15, the low-pressure passage 21*d*, the low-pressure passage opening/closing valve 22*b*, the receiver 28, and the like are removed from the refrigeration cycle device 10*f* described in the thirteenth embodiment.

In the refrigeration cycle device 10*g*, the refrigerant inlet side of the water refrigerant heat exchanger 13 is connected to one outflow port of the branch portion 123. The inflow port side of the tenth three-way joint 12*j* is connected to a refrigerant outlet of the water refrigerant heat exchanger 13. The inlet side of the cooling expansion valve 14*c* is connected to one outflow port of the tenth three-way joint 12*j*. The inlet side of the air cooling expansion valve 14*b* is connected to the other outflow port of the tenth three-way joint 12*j*.

A heating water bypass passage 33 is connected to the heating-coolant circuit 30*a* in addition to the water passage 132 of the water refrigerant heat exchanger 13, the heating-coolant pump 31, and the heater core 32. The heating water bypass passage 33 is a coolant passage that guides the heating-coolant flowing out from the water refrigerant heat exchanger 13 to the suction port side of the heating-coolant pump 31 by bypassing the heater core 32.

A high temperature side radiator 39 is disposed in the heating water bypass passage 33. The high temperature side radiator 39 is a heat exchanger that exchanges heat between the heating-coolant and the outside air. The high temperature side radiator 39 has the same basic structure as that of the low temperature side radiator 49 described in the twelfth embodiment.

An inlet side of a water flow rate adjustment valve 36 is connected to an inlet of the heating water bypass passage 33. The water flow rate adjustment valve 36 is a three-way flow rate adjustment valve that can continuously adjust a flow rate ratio between the coolant flow rate flowing out to the heater core 32 side and the coolant flow rate flowing out to the high temperature side radiator 39 side in the heating-coolants flowing out from the water refrigerant heat exchanger 13. The water flow rate adjustment valve 36 has the same basic structure as that of the first water flow rate adjustment valve 46*a*.

One inflow port side of a water three-way joint 34 is connected to an outlet of the heating water bypass passage 33. The water three-way joint 34 has the same basic structure as that of the first water three-way joint 42*a*. A refrigerant outlet side of the heater core 32 is connected to the other inflow port of the water three-way joint 34. The suction port side of the heating-coolant pump 31 is connected to an outflow port of the water three-way joint 34.

In the device coolant circuit 40*c* of the present embodiment, a third device coolant pump 41*c* is disposed. The third device coolant pump 41*c* is disposed to suck the device coolant flowing out from the mixing-portion integrated chiller 26 and discharge the device coolant to the inflow port side of the second water three-way joint 42*b*. The third device coolant pump 41*c* has the same basic structure as that of the first device coolant pump 41*a*.

Other configurations of the refrigeration cycle device 10*g* are similar to those of the refrigeration cycle device 10*d* described in the thirteenth embodiment.

Next, operation of the vehicle air conditioner of the present embodiment having the above configuration will be described. In the vehicle air conditioner of the present embodiment, various operation modes are switched in order to perform air conditioning of the vehicle interior and temperature adjustment of the in-vehicle devices (specifically, the battery 70 and the motor generator 71). Hereinafter, the operation of each operation mode will be described in detail.

(a) Air Cooling Mode

In the air cooling mode, the controller 60 makes the air cooling expansion valve 14*b* in a throttled state, and the bypass flow adjustment valve 14*d* in a fully closed state.

Figure 51:
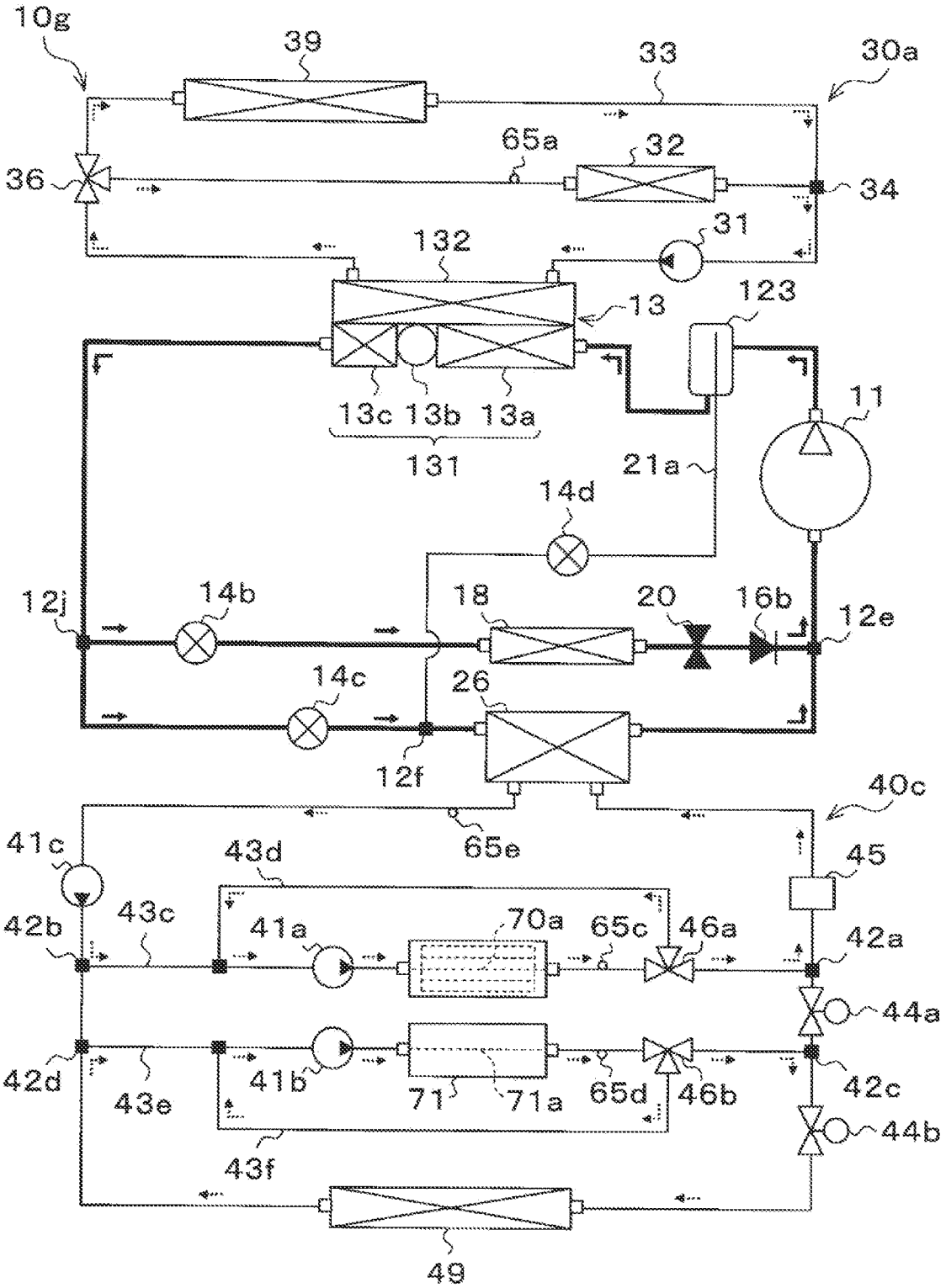
FIG. 51 is a schematic overall configuration diagram illustrating a refrigerant flow in an air cooling mode and a dehumidifying and heating mode of a refrigeration cycle device according to the fourteenth embodiment.

Therefore, in the refrigeration cycle device 10*g* in the air cooling mode, as indicated by solid arrows in FIG. 51, the refrigerant discharged from the compressor 11 circulates through the water refrigerant heat exchanger 13, the tenth three-way joint 12*j*, the air cooling expansion valve 14*b*, the interior evaporator 18, the evaporating pressure adjustment valve 20, the second check valve 16*b*, and the suction port of the compressor 11 in this order. In FIG. 51, the flow of the refrigerant during execution of the device cooling mode is indicated by solid arrows.

The controller 60 operates the heating-coolant pump 31 of the heating-coolant circuit 30*a* so as to exhibit a predetermined reference pumping capacity.

The controller 60 controls the operation of the water flow rate adjustment valve 36 such that the heating-coolant temperature TWH approaches the target water temperature TWHO. In the water flow rate adjustment valve 36 in the air cooling mode, substantially the entire flow rate of the heating-coolant flowing into the water flow rate adjustment valve 36 flows out to the high temperature side radiator 39 side.

In FIG. 51, the flow of the heating-coolant in the dehumidifying and heating mode is indicated by a thin broken line arrow. Therefore, in FIG. 51, the thin broken line arrow is illustrated in which the heating-coolant also flows through the heating water bypass passage 33, but in the air cooling mode, the heating-coolant may not flow through the heating water bypass passage 33.

Similarly to the seventh embodiment, the controller 60 causes the air mix door driving electric actuator to displace the air mix door 54. In the air cooling mode, the air mix door 54 is displaced such that the cold air bypass passage 55 is substantially fully opened and the air passage on the heater core 32 side is fully closed.

Accordingly, in the refrigeration cycle device 10*g* in the air cooling mode, a vapor compression refrigeration cycle is configured in which the water refrigerant heat exchanger 13 functions as a condenser that condenses the refrigerant and the interior evaporator 18 functions as an evaporator that evaporates the refrigerant. In the water refrigerant heat exchanger 13, the refrigerant radiates heat to the heating-coolant and is condensed. According to this, the heating-coolant is heated. In the interior evaporator 18, the refrigerant absorbs heat from the air and is evaporated. According to this, the air is cooled.

In the heating-coolant circuit 30*a* in the air cooling mode, the heating-coolant pumped from the heating-coolant pump 31 flows into the water refrigerant heat exchanger 13. The heating-coolant heated by the water refrigerant heat exchanger 13 flows into the water flow rate adjustment valve 36. In the water flow rate adjustment valve 36, substantially the entire flow rate of the heating-coolant flowing into the water flow rate adjustment valve 36 flows out to the high temperature side radiator 39 side. The heating-coolant flowing into the high temperature side radiator 39 is subjected to heat exchange with the outside air and the heat is radiated. According to this, the heating-coolant is cooled.

In the air cooling mode, the air mix door 54 fully closes the air passage on the heater core 32 side. Therefore, even when the heating-coolant flows into the heater core 32 via the water flow rate adjustment valve 36, heat exchange between the heating-coolant and the air is not performed in the heater core 32. Accordingly, the air is not heated.

The heating-coolant flowing out from the high temperature side radiator 39 is sucked into the heating-coolant pump 31 via the water three-way joint 34 and pumped again.

In the interior air-conditioning unit 50 in the air cooling mode, the air cooled by the interior evaporator 18 is blown into the vehicle interior. According to this, air cooling of the vehicle interior is realized.

The vehicle air conditioner of the present embodiment can execute the device cooling mode in which the battery 70 and the motor generator 71 are cooled in the air cooling mode. In the device cooling mode of the present embodiment, the controller 60 makes the cooling expansion valve 14*c* in a throttled state.

Therefore, in the refrigeration cycle device 10*g* in the device cooling mode, as indicated by the solid arrows in FIG. 51, the refrigerant branched at the tenth three-way joint 12*j* flows through the cooling expansion valve 14*c*, the mixing-portion integrated chiller 26, and the suction port of the compressor 11 in this order. That is, in the air cooling mode during execution of the device cooling mode, the flow of the refrigerant flowing out from the water refrigerant heat exchanger 13 is switched to the refrigerant circuit in which the interior evaporator 18 is connected to the mixing-portion integrated chiller 26 in parallel.

The controller 60 closes the first water opening/closing valve 44*a* of the device coolant circuit 40*c* and opens the second water opening/closing valve 44*b* of the device coolant circuit 40*c*. The controller 60 controls the water pumping capacity of each of the first device coolant pump 41*a* to the third device coolant pump 41*c* so as to exhibit a reference pumping capacity in a predetermined device cooling mode.

The controller 60 controls the first water flow rate adjustment valve 46*a* such that the first device coolant temperature TWL1 approaches the reference first coolant temperature KTWL1. The controller 60 controls the second water flow rate adjustment valve 46*b* such that the second device coolant temperature TWL2 approaches the reference second coolant temperature KTWL2.

Therefore, in the device coolant circuit 40*c* in the device cooling mode, as indicated by a thin broken line arrow in FIG. 51, the flow can be switched to the coolant circuit that circulates the device coolant between the coolant passage 70*a* of the battery 70 and the mixing-portion integrated chiller 26 and circulates the device coolant between the coolant passage 71*a* of the motor generator 71 and the low temperature side radiator 49.

Accordingly, in the refrigeration cycle device 10*g* during execution of the device cooling mode, the refrigerant flowing into the mixing-portion integrated chiller 26 absorbs heat from the device coolant and is evaporated. According to this, the device coolant is cooled.

In the device coolant circuit 40*c* in the air cooling mode during execution of the device cooling mode, the device coolant cooled in the mixing-portion integrated chiller 26 flows into the coolant passage 70*a* of the battery 70. According to this, the battery 70 is cooled. The device coolant cooled by radiating heat to the outside air by the low temperature side radiator 49 flows into the coolant passage 71*a* of the motor generator 71. According to this, the motor generator 71 is cooled.

As a result, in the air cooling mode during execution of the device cooling mode, the battery 70 and the motor generator 71 can be cooled while cooling the vehicle interior.

In the device cooling mode, the first water opening/closing valve 44*a* may be opened and the second water opening/closing valve 44*b* may be closed. According to this, the device coolant cooled by the mixing-portion integrated chiller 26 flows into the coolant passage 70*a* of the battery 70 and the coolant passage 71*a* of the motor generator 71, and both of the battery 70 and the motor generator 71 can be cooled.

(b) Dehumidifying and Heating Mode

A basic operation in the dehumidifying and heating mode is similar to that in the air cooling mode. In the dehumidifying and heating mode, the controller 60 makes the air cooling expansion valve 14*b* in a throttled state, and the bypass flow adjustment valve 14*d* in a fully closed state.

Therefore, in the refrigeration cycle device 10*g* in the dehumidifying and heating mode, as indicated by the solid arrows in FIG. 51, the refrigerant discharged from the compressor 11 circulates in the same order in a similar manner to the air cooling mode.

The controller 60 operates the heating-coolant pump 31 of the heating-coolant circuit 30*a* so as to exhibit a predetermined reference pumping capacity.

The controller 60 controls the operation of the water flow rate adjustment valve 36 such that the heating-coolant temperature TWH approaches the target water temperature TWHO. Accordingly, in the heating-coolant circuit 30*a* in the dehumidifying and heating mode, as indicated by the thin broken line arrow in FIG. 51, the heating-coolant heated by the water refrigerant heat exchanger 13 flows out to both of the heater core 32 side and the high temperature side radiator 39 side from the water flow rate adjustment valve 36. Therefore, in the dehumidifying and heating mode, the heat radiation amount with which the heating-coolant radiates heat to the outside air in the high temperature side radiator 39 decreases as compared with the air cooling mode.

Similarly to the seventh embodiment, the controller 60 causes the air mix door driving electric actuator to displace the air mix door 54 such that the air temperature TAV approaches the target blown air temperature TAO. In a similar manner to the air cooling mode, the controller 60 appropriately controls the operation of other control target devices.

Accordingly, in the refrigeration cycle device 10*g* in the dehumidifying and heating mode, a vapor compression refrigeration cycle is configured in which the water refrigerant heat exchanger 13 functions as a condenser that condenses the refrigerant and the interior evaporator 18 functions as an evaporator that evaporates the refrigerant. In the water refrigerant heat exchanger 13, the refrigerant radiates heat to the heating-coolant and is condensed. According to this, the heating-coolant is heated. In the interior evaporator 18, the refrigerant absorbs heat from the air and is evaporated. According to this, the air is cooled.

In the heating-coolant circuit 30*a* in the dehumidifying and heating mode, the heating-coolant heated by the water refrigerant heat exchanger 13 flows into the heater core 32 and the high temperature side radiator 39. The heating-coolant flowing into the heater core 32 radiates heat to the air cooled by the interior evaporator 18.

In the interior air-conditioning unit 50 in the dehumidifying and heating mode, the air cooled and dehumidified by the interior evaporator 18 is reheated by the heater core 32 and blown into the vehicle interior. According to this, dehumidifying and heating of the vehicle interior is realized.

Also in the dehumidifying and heating mode, the device cooling mode can be executed in a similar manner to the air cooling mode.

(e) Outside Air Heat-Absorption Heating Mode

In the outside air heat-absorption heating mode, the controller 60 makes the air cooling expansion valve 14*b* in a fully closed state, and the bypass flow adjustment valve 14*d* in the fully closed state.

Figure 52:
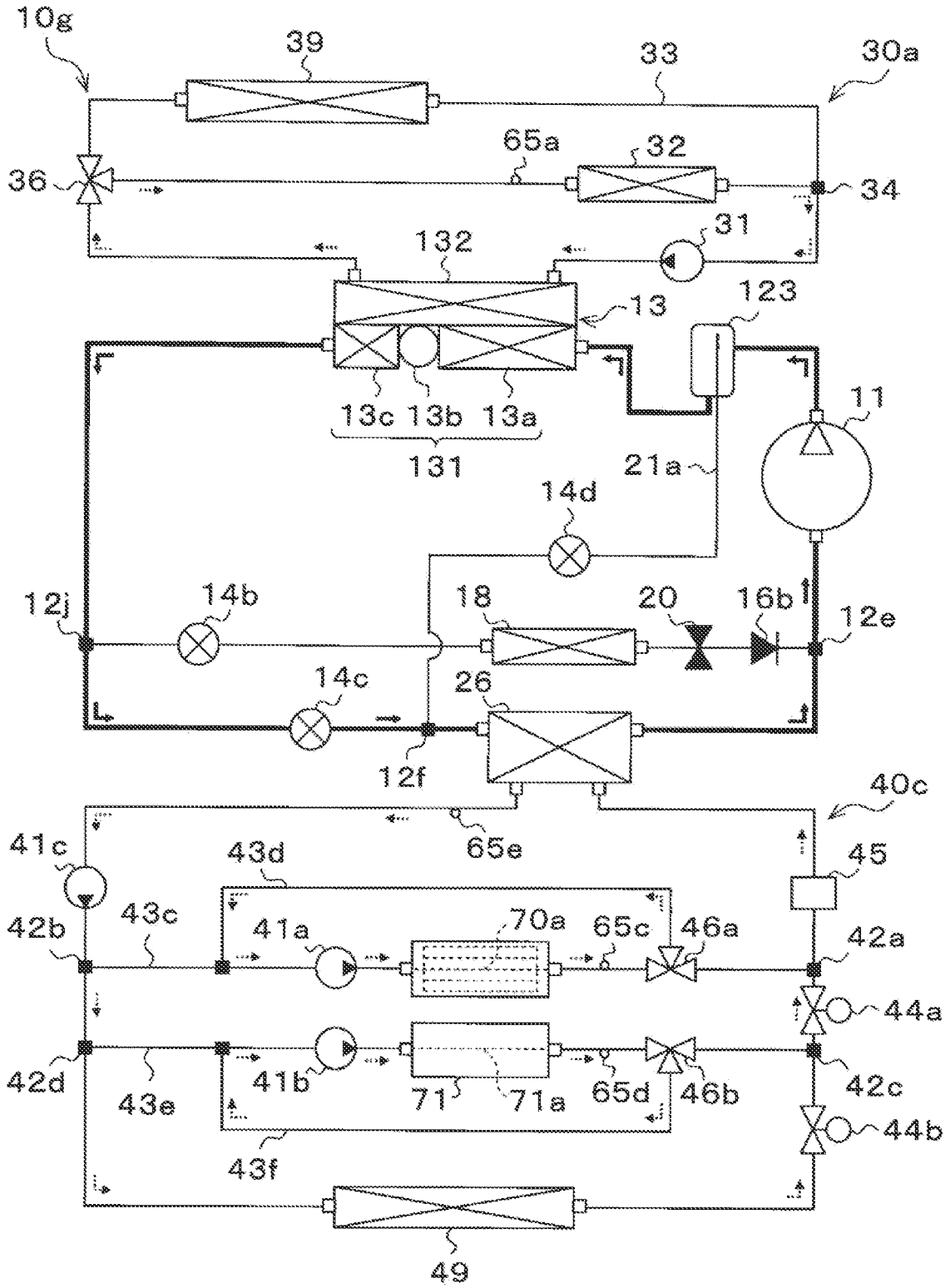
FIG. 52 is a schematic overall configuration diagram illustrating a refrigerant flow in an outside air heat-absorption heating mode of a refrigeration cycle device according to the fourteenth embodiment.

Therefore, in the refrigeration cycle device 10*g*, as indicated by solid arrows in FIG. 52, the refrigerant discharged from the compressor 11 circulates through the water refrigerant heat exchanger 13, the tenth three-way joint 12*j*, the cooling expansion valve 14*c*, the mixing-portion integrated chiller 26, and the suction port of the compressor 11 in this order.

In a similar manner to the air cooling mode and the dehumidifying and heating mode, the controller 60 controls the operations of the heating-coolant pump 31 of the heating-coolant circuit 30*a* and the water flow rate adjustment valve 36 of the heating-coolant circuit 30*a*. In the outside air heat-absorption heating mode, as indicated by a thin broken line arrow in FIG. 52, the water flow rate adjustment valve 36 causes substantially the entire flow rate of the heating-coolant flowing into the water flow rate adjustment valve 36 to flow out to the heater core 32 side.

The controller 60 opens the first water opening/closing valve 44*a* of the device coolant circuit 40*c* and opens the second water opening/closing valve 44*b* of the device coolant circuit 40*c*. The controller 60 controls the water pumping capacity of the third device coolant pump 41*c* so as to exhibit a predetermined reference pumping capacity for the outside air heat-absorption heating mode.

As illustrated in FIG. 52, the controller 60 controls the operation of the first water flow rate adjustment valve 46*a* such that substantially the entire flow rate of the device coolant flowing into the first water flow rate adjustment valve 46*a* returns to the suction port side of the first device coolant pump 41*a*. The controller 60 controls the operation of the second water flow rate adjustment valve 46*b* such that substantially the entire flow rate of the device coolant flowing into the second water flow rate adjustment valve 46*b* returns to the suction port side of the second device coolant pump 41*b*.

The controller 60 controls the water pumping capacity of the first device coolant pump 41*a* such that the first device coolant temperature TWL1 approaches the reference first coolant temperature KTWL1. The water pumping capacity of the second device coolant pump 41*b* is controlled such that the second device coolant temperature TWL2 approaches the reference second coolant temperature KTWL2.

In a similar manner to the outside air heat-absorption heating mode of the seventh embodiment, the controller 60 appropriately controls the operation of other control target devices.

Accordingly, in the refrigeration cycle device 10*g* in the outside air heat-absorption heating mode, a vapor compression refrigeration cycle is configured in which the water refrigerant heat exchanger 13 functions as a condenser that condenses the refrigerant and the mixing-portion integrated chiller 26 functions as an evaporator that evaporates the refrigerant.

In the water refrigerant heat exchanger 13, the refrigerant radiates heat to the heating-coolant and is condensed. According to this, the heating-coolant is heated. In the mixing-portion integrated chiller 26, the refrigerant absorbs heat from the device coolant and is evaporated. According to this, the device coolant is cooled.

In the heating-coolant circuit 30*a* in the outside air heat-absorption heating mode, the heating-coolant heated by the water refrigerant heat exchanger 13 flows into the heater core 32 via the water flow rate adjustment valve 36. The heating-coolant flowing into the heater core 32 is subjected to heat exchange with the air cooled by the interior evaporator 18 according to an opening degree of the air mix door 54. According to this, the air is heated.

In the device coolant circuit 40*c* in the outside air heat-absorption heating mode, the device coolant cooled by the mixing-portion integrated chiller 26 flows into the low temperature side radiator 49. In the low temperature side radiator 49, the device coolant absorbs heat from the outside air and the temperature of the device coolant increases. The device coolant of which the temperature increases in the low temperature side radiator 49 flows into the water passage of the mixing-portion integrated chiller 26 and is cooled again.

In the interior air-conditioning unit 50 in the outside air heat-absorption heating mode, the air having passed through the interior evaporator 18 is heated by the heater core 32 and blown into the vehicle interior. According to this, heating of the vehicle interior is realized.

In the device coolant circuit 40*c* in the outside air heat-absorption heating mode, the first water flow rate adjustment valve 46*a* causes the device coolant flowing out from the coolant passage 70*a* of the battery 70 to return to the inlet side of the coolant passage 70*a* of the battery 70. The water pumping capacity of the first device coolant pump 41*a* is adjusted such that the first device coolant temperature TWL1 approaches the reference first coolant temperature KTWL1. According to this, the temperature of the battery 70 is maintained at an appropriate temperature.

Similarly, the second water flow rate adjustment valve 46*b* causes the device coolant flowing out from the coolant passage 71*a* of the motor generator 71 to return to the inlet side of the coolant passage 71*a* of the motor generator 71. The water pumping capacity of the second device coolant pump 41*b* is adjusted such that the second device coolant temperature TWL2 approaches the reference second coolant temperature KTWL2. According to this, the temperature of the motor generator 71 is maintained at an appropriate temperature.

When the first device coolant temperature TWL1 exceeds the reference first coolant temperature KTWL1, the first water flow rate adjustment valve 46*a* may cause a part of the device coolant flowing out from the coolant passage 70*a* of the battery 70 to flow out to the water passage side of the mixing-portion integrated chiller 26. Similarly, when the second device coolant temperature TWL2 exceeds the reference second coolant temperature KTWL2, the second water flow rate adjustment valve 46*b* may cause a part of the device coolant flowing out from the coolant passage 71*a* of the motor generator 71 to flow out to the water passage side of the mixing-portion integrated chiller 26.

According to this, the mixing-portion integrated chiller 26 causes the refrigerant to absorb heat of the device coolant to use the refrigerant as a heat source of the heating-coolant.

(g) Hot-Gas Heating Mode

In the hot-gas heating mode, the controller 60 makes the air cooling expansion valve 14*b* in a fully closed state, and the bypass flow adjustment valve 14*d* in a throttled state.

Figure 53:
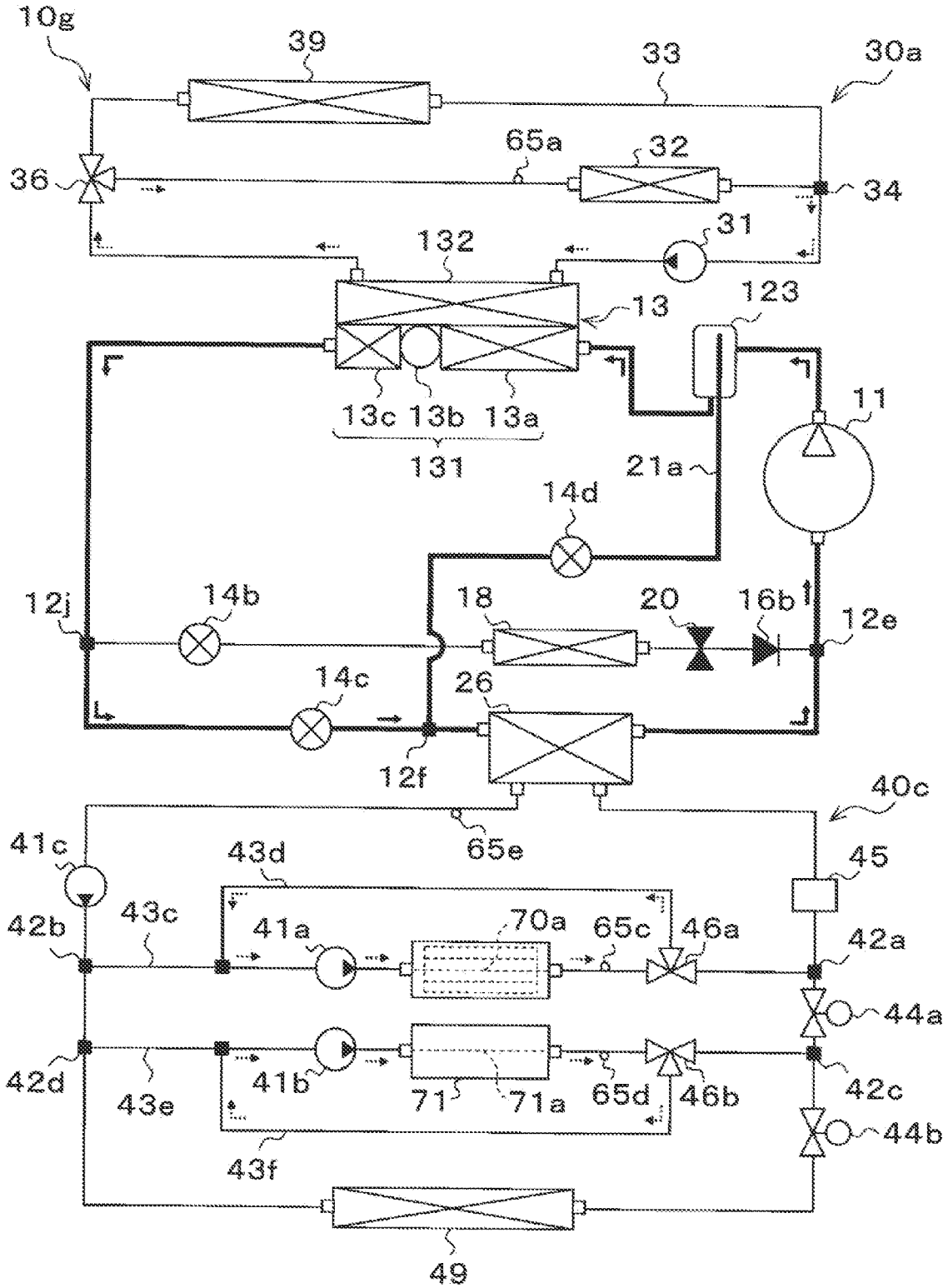
FIG. 53 is a schematic overall configuration diagram illustrating a refrigerant flow in a hot-gas heating mode and a refrigerant warm-up mode of a refrigeration cycle device according to the fourteenth embodiment.

Therefore, in the refrigeration cycle device 10*g* in the hot-gas heating mode, as indicated by solid arrows in FIG. 53, the refrigerant discharged from the compressor 11 circulates through the water refrigerant heat exchanger 13, the tenth three-way joint 12*j*, the cooling expansion valve 14*c*, the mixing-portion integrated chiller 26, and the suction port of the compressor 11 in this order. At the same time, a part of the refrigerant discharged from the compressor 11 circulates through the branch portion 123, the bypass flow adjustment valve 14*d*, the mixing-portion integrated chiller 26, and the suction port of the compressor 11 in this order.

In a similar manner to the outside air heat-absorption heating mode, the controller 60 operates the heating-coolant pump 31 of the heating-coolant circuit 30*a* and the water flow rate adjustment valve 36 of the heating-coolant circuit 30*a*.

In a similar manner to the outside air heat-absorption heating mode, the controller 60 opens the first water opening/closing valve 44*a* of the device coolant circuit 40*c* and opens the second water opening/closing valve 44*b* of the device coolant circuit 40*c*. In a similar manner to the outside air heat-absorption heating mode, the controller 60 controls the operations of the first device coolant pump 41*a*, the second device coolant pump 41*b*, the first water flow rate adjustment valve 46*a*, and the second water flow rate adjustment valve 46*b*. The controller 60 stops the third device coolant pump 41*c*.

In a similar manner to the hot-gas heating mode of the seventh embodiment, the controller 60 appropriately controls the operation of other control target devices.

Accordingly, in the refrigeration cycle device 10*f* in the hot-gas heating mode, similarly to the seventh embodiment, it is possible to suppress a decrease in a heating capacity of the air even at the cryogenic outside air temperature. In the hot-gas heating mode, in a similar manner to the outside air heat-absorption heating mode, the temperature of the battery 70 and the temperature of the motor generator 71 can be maintained at appropriate values.

In addition, when the first device coolant temperature TWL1 exceeds the reference first coolant temperature KTWL1, heat of the device coolant is absorbed by the refrigerant, and the refrigerant can be used as a heat source of the heating-coolant. Similarly, when the second device coolant temperature TWL2 exceeds the reference second coolant temperature KTWL2, heat of the device coolant is absorbed by the refrigerant, and the refrigerant can be used as a heat source of the heating-coolant.

Since the refrigeration cycle device 10*g* of the present embodiment includes the mixing-portion integrated chiller 26, similarly to the seventh embodiment, it is possible to sufficiently suppress variation in the enthalpy of the suction side refrigerant. Accordingly, even when the flow is switched to the refrigerant circuit in which the refrigerants having different enthalpies are mixed and sucked into the compressor 11, a stable heating capacity can be exhibited, and the compressor 11 can be protected.

In the vehicle air conditioner of the present embodiment, before heating of the vehicle interior is started at the cryogenic outside air temperature, the operation in the (h-1) assist warm-up mode or the (h-2) assistless warm-up mode, which is described in the ninth embodiment, can be executed. In a similar manner to the (h-3) heater warm-up mode described in the tenth embodiment, the device coolant can be heated by the electric heater 45.

In the vehicle air conditioner of the present embodiment, the operation in the (h-4) refrigerant warm-up mode described in the twelfth embodiment can be executed. In the (h-4) refrigerant warm-up mode, as illustrated in FIG. 53, the refrigerant discharged from the compressor 11 circulates in the same order in a similar manner to the hot-gas heating mode.

The refrigeration cycle device 10*g* of the present embodiment further includes the receiver portion 13*b* that is the high-pressure side gas-liquid separator. Accordingly, the operation in the (i) warm-up preparation mode described in the thirteenth embodiment can be executed.

In the (i) warm-up preparation mode of the present embodiment, the controller 60 makes the air cooling expansion valve 14*b* in a fully closed state, the cooling expansion valve 14*c* in the fully closed state, and the bypass flow adjustment valve 14*d* in a throttled state.

Figure 54:
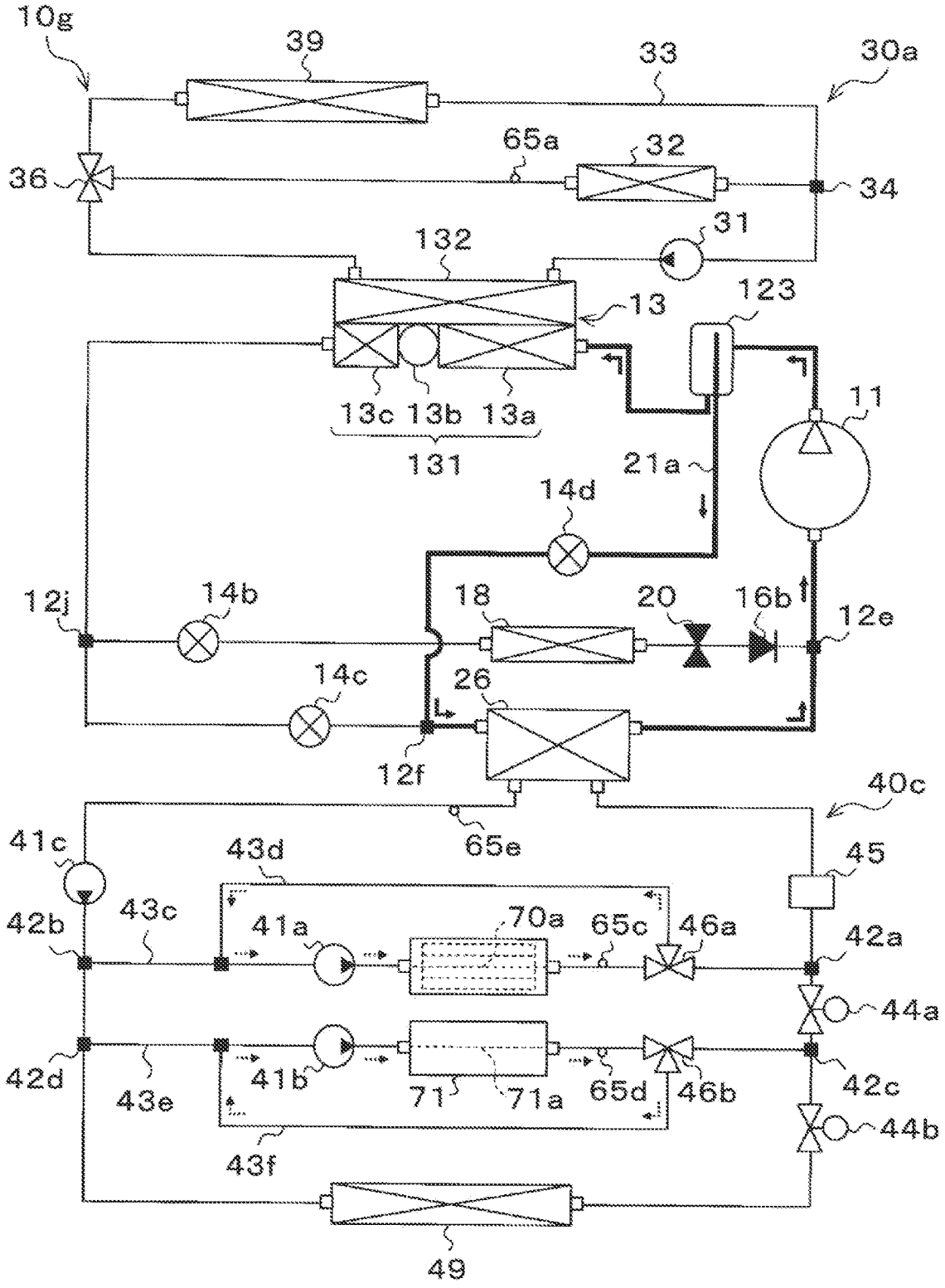
FIG. 54 is a schematic overall configuration diagram illustrating a refrigerant flow in a warm-up preparation mode of a refrigeration cycle device according to the fourteenth embodiment.

Therefore, in the refrigeration cycle device 10*g* in the warm-up preparation mode, as indicated by solid arrows in FIG. 54, the refrigerant discharged from the compressor 11 flows through the branch portion 123, the condensing portion 13*a* of the water refrigerant heat exchanger 13, and the receiver portion 13*b* in this order. At the same time, a part of the refrigerant discharged from the compressor 11 circulates through the branch portion 123, the bypass flow adjustment valve 14*d*, the mixing-portion integrated chiller 26, and the suction port of the compressor 11 in this order.

The controller 60 stops the heating-coolant pump 31. In a similar manner to the warm-up preparation mode of the thirteenth embodiment, the controller 60 appropriately controls the operation of other control target devices. Accordingly, in the warm-up preparation mode, similarly to the thirteenth embodiment, the refrigerant having a relatively low dryness and branched at the branch portion 123 can be condensed and stored as a liquid-phase refrigerant in the receiver portion 13*b* of the water refrigerant heat exchanger 13.

The present disclosure is not limited to the above-described embodiments, and can be variously modified as follows without departing from the gist of the present disclosure.

In the above-described embodiment, an example has been described in which the refrigeration cycle devices 10 to 10*e* according to the present disclosure is applied to a vehicle air conditioner mounted on an electric vehicle, but the present disclosure is not limited to this. For example, the refrigeration cycle devices 10 to 10*e* may be applied to a stationary air conditioner used in a cold district or the like. The refrigeration cycle device 10*e* may be applied to a so-called hybrid vehicle that obtains a vehicle traveling drive force from both an internal combustion engine and a traveling electric motor.

An example has been described in which in the refrigeration cycle devices 10 to 10*g* according to the present disclosure, the battery 70 and the motor generator 71 are cooled as the heat generating devices. However, the present disclosure is not limited to this. For example, an inverter, a PCU, a transaxle, an ADAS controller, and the like may be cooled.

The inverter supplies power to the motor generator or the like. The PCU is a power control unit that performs transformation and power distribution. The transaxle is a power transmission mechanism in which a transmission, a differential gear, and the like are integrated. The ADAS controller is an advanced driver assistance system controller. When applied to a stationary air conditioner, other heat generating devices may be cooled.

The configurations of the refrigeration cycle devices 10 to 10*g* are not limited to those disclosed in the above-described embodiment.

For example, an example has been described in which in the refrigeration cycle devices 10, 10*e*, and 10*g*, the subcooling heat exchanger is adopted as the water refrigerant heat exchanger 13, but the present disclosure is not limited to this. For example, a receiver integrated heat exchanger not including the subcooling portion may be adopted. As the water refrigerant heat exchanger 13, a so-called counter flow heat exchanger in which a flow direction of the refrigerant and a flow direction of the heating-coolant are opposite to each other may be adopted, or a so-called parallel flow heat exchanger in which the flow direction of the refrigerant and the flow direction of the heating-coolant are equivalent to each other may be adopted.

In the mixing portion 23 described in the first embodiment, a so-called parallel flow heat exchanger in which a flow direction of the bypass side refrigerant and a flow direction of the decompression-portion side refrigerant are equivalent to each other is adopted, but the present disclosure is not limited to this. A so-called counter flow heat exchanger in which the flow direction of the bypass side refrigerant and the flow direction of the decompression-portion side refrigerant are opposite to each other may be adopted. Of course, the flow direction of the refrigerant may be changed inside the mixing portion 23. Also in the mixing-portion integrated chiller 26, either the parallel flow heat exchanger or the counter flow heat exchanger may be adopted.

In the mixing portion 23 described in the first embodiment, in a similar manner to the mixing-portion integrated chiller 26, the mixed refrigerant obtained by mixing the bypass side refrigerant and the decompression-portion side refrigerant in advance at the sixth three-way joint 12*f* may flow.

An example has been described in which in the mixing portions 24, 24*a*, and 24*b* described in the second embodiment, spherical zeolite is adopted as the particulate member 242, but the present disclosure is not limited to this. As long as the wetting area can be enlarged, for example, a metal ball, a carbon limp, or the like may be adopted. An example has been described in which a mesh-like resin is adopted as the filter 244, but the present disclosure is not limited to this. For example, a mesh-like metal, a nonwoven fabric, or the like may be adopted.

An example has been described in which in the mixing portion 25 described in the third embodiment, a metal net-like member is adopted as the porous member 251, but the present disclosure is not limited to this. For example, a foamed metal, a sintered material, a nonwoven fabric, or the like may be adopted. For example, a member formed by further spirally winding a plate obtained by folding a metal thin plate in a wavelike shape may be adopted.

In the sixth embodiment, an example has been described in which the bypass passage opening/closing valve 22*c* is adopted as the bypass passage opening/closing portion, but the present disclosure is not limited to this. For example, a three-way valve that switches the refrigerant circuit in which the refrigerant flows into the mixing-portion bypass passage 21*e* and the refrigerant circuit in which the refrigerant does not flow into the mixing-portion bypass passage 21*e* may be adopted at an inlet portion of the mixing-portion bypass passage 21*e*.

Similarly, as other refrigerant circuit switching portion, an opening/closing valve or a three-way valve may be adopted as long as the refrigerant circuit in the various operation modes described above can be realized.

In the seventh, ninth, and tenth embodiments and the like, an example has been described in which the mixing-portion integrated chiller 26 formed by one stacked heat exchanger is adopted as the mixing portion configured to be capable of exchanging heat among the bypass side refrigerant, the decompression-portion side refrigerant, and the heat exchange target fluid, but the present disclosure is not limited to this.

That is, the mixing portion configured to be capable of exchanging heat among the bypass side refrigerant, the decompression-portion side refrigerant, and the heat exchange target fluid may include a plurality of heat exchange portions that perform heat exchange among the bypass side refrigerant, the decompression-portion side refrigerant, and the heat exchange target fluid in a stepwise manner. For example, a plurality of heat exchange portions such as a heat exchange portion that performs heat exchange between the bypass side refrigerant and the device coolant and a heat exchange portion that performs heat exchange between the decompression-portion side refrigerant and the device coolant may be included.

For example, a plurality of heat exchange portions such as a heat exchange portion that performs heat exchange between the decompression-portion side refrigerant and the device coolant and a heat exchange portion that performs heat exchange between the decompression-portion side refrigerant and the bypass side refrigerant may be included. Therefore, in the refrigeration cycle device 10 described in the first embodiment, the chiller 19 and the mixing portion 23 form a mixing portion configured to be capable of exchanging heat among the bypass side refrigerant, the decompression-portion side refrigerant, and the heat exchange target fluid.

Therefore, the device coolant circuit 40*a* may be applied to the refrigeration cycle device 10 of the first embodiment, and the device coolant flowing out from the coolant passage 70*a* of the battery 70 may flow into the chiller 19 in the refrigerant circuit in the hot-gas heating mode described in FIG. 13. According to this, an operation mode corresponding to the assist warm-up mode described in the ninth embodiment can be executed.

The device coolant circuit 40*b* may be applied to the refrigeration cycle device 10 of the first embodiment, and the device coolant heated by the electric heater 45 may flow into the chiller 19 in the refrigerant circuit in the hot-gas heating mode described in FIG. 13. According to this, an operation mode corresponding to the heater warm-up mode described in the tenth embodiment can be executed.

The evaporating pressure adjustment valve 20 is not an essential component. The evaporating pressure adjustment valve 20 may be removed in the refrigeration cycle device in which the refrigerant evaporating temperature in the chiller 19 or the mixing-portion integrated chiller 26 is higher than the refrigerant evaporating temperature in the interior evaporator 18.

In the above-described embodiment, an example has been described in which R1234yf is adopted as the refrigerant of the refrigeration cycle device 10, but the present disclosure is not limited to this. For example, R134a, R600a, R410A, R404A, R32, R407C, and the like may be adopted. A mixed refrigerant obtained by mixing a plurality of these refrigerants may be adopted.

The configurations of the heating-coolant circuit 30, the device coolant circuits 40, 40*a*, 40*b*, and 40*c*, and the outside air heat absorption coolant circuit 80 are not limited to those disclosed in the above-described embodiment.

For example, in the ninth embodiment, an example has been described in which the first water opening/closing valve 44*a* and the second water opening/closing valve 44*b* are adopted as the heat medium circuit switching portion, but the present disclosure is not limited to this. For example, instead of the first water three-way joint 42*a*, a three-way valve that performs switching between a circuit in which the device coolant pumped from the device coolant pump 41 flows out to the mixing-portion integrated chiller 26 side and a circuit in which the device coolant flows out to the water bypass passage 43 side may be adopted.

Similarly, as other heat medium circuit switching portion, an opening/closing valve or a three-way valve may be adopted as long as the heat medium circuit in the various operation modes described above can be realized.

In the tenth embodiment, an example has been described in which the electric heater 45 is adopted as the heat medium heating unit, but the present disclosure is not limited to this. For example, an electric heating wire or the like that generates heat when power is supplied may be adopted as the heat medium heating unit.

As illustrated in FIG. 41, an electric heater 35 as a high temperature side heat medium heating unit may be disposed in the heating-coolant circuit 30. The electric heater 35 has the same basic structure as that of the electric heater 45 described in the tenth embodiment.

According to this, the electric heater 35 can heat the heating-coolant flowing into the heater core 32. Accordingly, in the hot-gas heating mode or the like, by supplying power to the electric heater 35, it is possible to suppress a decrease in a heating capacity in the vehicle interior while suppressing power consumption of the compressor 11. The mixing portion 23 can be downsized.

Figure 55:
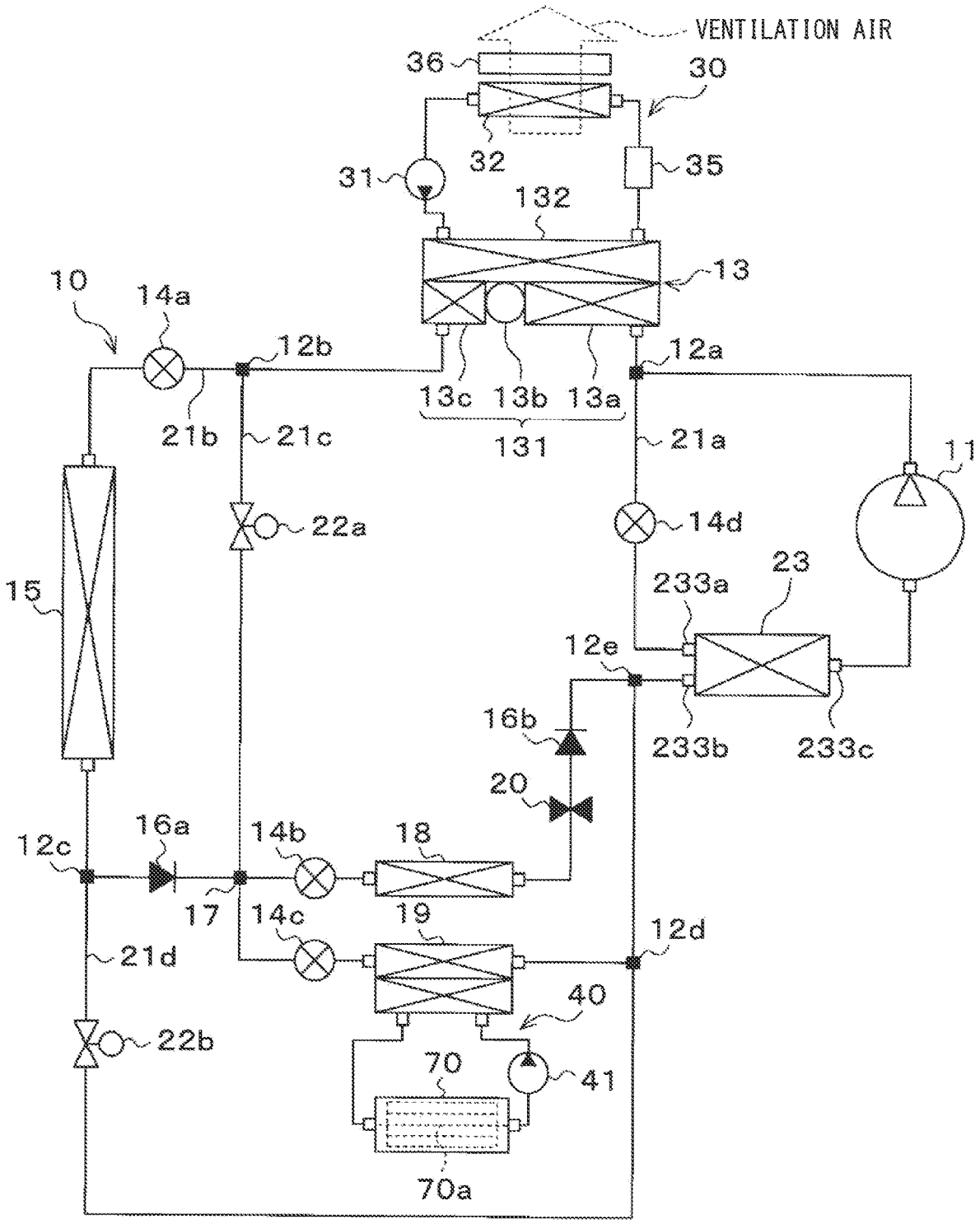
FIG. 55 is a schematic overall configuration diagram of a refrigeration cycle device according to another embodiment.

As illustrated in FIG. 55, in the refrigeration cycle devices 10 and 10*e*, an air electric heater 36 as an auxiliary air heating unit that heats the air may be disposed on a downstream side of the heater core 32 in a air flow direction. The air electric heater 36 is disposed in an air passage on the heater core 32 side in the interior air-conditioning unit 50.

According to this, the air electric heater 36 can heat the air having passed through the heater core 32. Accordingly, in the hot-gas heating mode or the like, by supplying power to the air electric heater 36, it is possible to suppress a decrease in a heating capacity in the vehicle interior while suppressing power consumption of the compressor 11. Of course, in the refrigeration cycle devices 10*b* to 10*d*, the same effects can be obtained by disposing the air electric heater 36 on a downstream side of the interior condenser 113 in the air flow direction.

In the twelfth and thirteenth embodiments, an example has been described in which the first water flow rate adjustment valve 46*a* and the second water flow rate adjustment valve 46*b* are adopted as the fluid flow adjustment portion, but the present disclosure is not limited to this. As in the fourteenth embodiment, the first device coolant pump 41*a* and the second device coolant pump 41*b* may be used as the fluid flow adjustment portion. In this case, the heat exchange amount between the device coolant and the refrigerant in the mixing-portion integrated chiller 26 only need to be adjusted by adjusting the water pumping capacity of the first device coolant pump 41*a* and the second device coolant pump 41*b*.

In the above-described embodiment, an example has been described in which the ethylene glycol aqueous solution is adopted as the coolant of the heating-coolant circuit 30, the device coolant circuit 40, and the outside air heat absorption coolant circuit 80, but the present disclosure is not limited to this. For example, a solution containing dimethylpolysiloxane or a nanofluid, an aqueous liquid refrigerant containing antifreeze, alcohol or the like, or a liquid medium containing oil or the like may be adopted.

Control modes of the refrigeration cycle devices 10 to 10*g* are not limited to those disclosed in the above-described embodiment.

For example, in determining whether the frosting occurs in the exterior heat exchanger 15, it may be determined that the frosting has occurred in the exterior heat exchanger 15 when the time during which the outside air temperature Tam is equal to or lower than the frosting determination temperature is equal to or longer than the frosting determination time.

When the hot-gas heating mode is selected at the time of starting, it is desirable to stop the heating-coolant pump 31 until the pressure of the refrigerant discharged from the compressor 11 exceeds a predetermined reference high pressure. According to this, the heating-coolant can be quickly warmed, and an immediate heating effect can be expected.

In the above-described embodiment, an example is not described in which the bypass flow adjustment valve 14*d* is made into the throttled state in the refrigerant circuit similar to the series dehumidifying and heating mode, but the bypass flow adjustment valve 14*d* may be opened and made into the throttled state as necessary.

As an execution condition of the assist warm-up mode, the assist warm-up mode may be executed when heating of the vehicle interior is started at a cryogenic outside air temperature and when the battery temperature TB is higher than a predetermined reference temperature KTBA. The reference temperature KTBA is desirably set to a temperature higher than the outside air temperature Tam when the hot-gas heating mode is executed.

An example has been described in which in the refrigerant warm-up mode described in the twelfth and thirteenth embodiments, the throttle opening degree of the cooling expansion valve 14*c* is controlled such that the bypass side flow rate is greater than the decompression portion side flow rate, but the present disclosure is not limited to this. For example, the throttle opening degree of the cooling expansion valve 14*c* may be controlled so as to have a predetermined opening degree for the predetermined refrigerant warm-up mode, and the throttle opening degree of the bypass flow adjustment valve 14*d* may be controlled such that the bypass side flow rate is greater than the decompression portion side flow rate.

The refrigerant warm-up mode described in the twelfth and thirteenth embodiments may be executed by the refrigeration cycle device including the accumulator 27 such as the refrigeration cycle devices 10*a* to 10*d*.

In the above-described embodiment, an example has been described in which the refrigerant warm-up mode is continued until the third temperature T3 on the outlet side of the refrigerant passage of the mixing-portion integrated chiller 26 becomes equal to or higher than the reference heating temperature, but the present disclosure is not limited to this. For example, a detector that directly detects the refrigerant temperature in the accumulator 27 may be provided, and the refrigerant warm-up mode may be continued until the detected refrigerant temperature becomes equal to or higher than a predetermined reference temperature.

In the thirteenth embodiment, an example has been described in which the throttle opening degree of the cooling expansion valve 14*c* is adjusted such that the superheat degree SH of the refrigerant on the outlet side of the mixing-portion integrated chiller 26 approaches the reference superheat degree KSH after the warm-up preparation mode is ended, but the present disclosure is not limited to this.

For example, the throttle opening degree of the cooling expansion valve 14*c* may be controlled so as to have a predetermined opening degree for the predetermined refrigerant warm-up mode, and the throttle opening degree of the bypass flow adjustment valve 14*d* may be controlled such that the superheat degree SH of the refrigerant on the outlet side of the mixing-portion integrated chiller 26 approaches the reference superheat degree KSH.

The operation the fluid flow adjustment portion may be controlled such that the superheat degree SH of the refrigerant on the outlet side of the mixing-portion integrated chiller 26 approaches the reference superheat degree KSH. That is, the heat exchange amount between the device coolant and the refrigerant in the mixing-portion integrated chiller 26 may be adjusted such that the superheat degree SH of the refrigerant on the outlet side of the mixing-portion integrated chiller 26 approaches the reference superheat degree KSH.

In the fourteenth embodiment, an example has been described in which in the hot-gas heating mode, the operation of the first water flow rate adjustment valve 46*a* is controlled so as to increase the flow rate of the device coolant flowing out to the mixing-portion integrated chiller 26 side in accordance with a decrease in the temperature difference ΔTWL1. However, the present disclosure is not limited to this.

For example, since the first device coolant temperature TWL1 is a temperature of the device coolant flowing out from the coolant passage 70*a* of the battery 70, it has a strong correlation with the battery temperature TB. The flow rate of the device coolant flowing out to the mixing-portion integrated chiller 26 side may be increased in accordance with an increase in the battery temperature TB.

In the fourteenth embodiment, the temperature of the inflow side refrigerant flowing into the mixing-portion integrated chiller 26 is substantially constant in the hot-gas heating mode, but the present disclosure is not limited to this. For example, the inflow side refrigerant may be changed in the hot-gas heating mode. In this case, for example, the flow rate of the device coolant flowing out to the mixing-portion integrated chiller 26 side may be increased in accordance with an increase in the temperature of the inflow side refrigerant. For example, the flow rate of the device coolant flowing out to the mixing-portion integrated chiller 26 side may be increased in accordance with an increase in a pressure difference obtained by subtracting the pressure of the suction side refrigerant from the pressure of the high-pressure refrigerant discharged from the compressor 11.

An example has been described in which in the air cooling mode and the dehumidifying and heating mode of the fourteenth embodiment, the operation of the water flow rate adjustment valve 36 is controlled such that the heating-coolant temperature TWH approaches the target water temperature TWHO. However, the present disclosure is not limited to this. The controller 60 may control the water pumping capacity of the heating-coolant pump 31 such that the heating-coolant temperature TWH approaches the target water temperature TWHO.

In the twelfth to fourteenth embodiments, in each operation mode, the device coolant circuit 40*c* is mainly switched to the coolant circuit that circulates the device coolant between the coolant passage 70*a* of the battery 70 and the mixing-portion integrated chiller 26 and circulates the device coolant between the coolant passage 71*a* of the motor generator 71 and the low temperature side radiator 49. However, the present disclosure is not limited to this.

For example, in the hot-gas heating mode, the flow may be switched to the coolant circuit in which the device coolant flowing out from the mixing-portion integrated chiller 26 flows into both of the coolant passage 70*a* of the battery 70 and the coolant passage 71*a* of the motor generator 71.

Means disclosed in each of the above-described embodiments may be appropriately combined within a range capable of being carried out.

For example, the mixing portions 24, 24*a*, 24*b*, and 25 described in the second and third embodiments may be applied to the refrigeration cycle devices 10*a* to 10*c* described in the fourth to sixth embodiments.

For example, instead of the water refrigerant heat exchanger 13 and the heating-coolant circuit 30 in the refrigeration cycle device 10*e* described in the eighth embodiment, the interior condenser 113 may be adopted as the heating portion.

Instead of the outside air heat absorption chiller 119 and the outside air heat absorption coolant circuit 80 in the refrigeration cycle device 10*e*, the exterior heat exchanger 15 may be adopted. However, in order to effectively suppress a decrease in the heating capacity of the air in the (g) hot-gas heating mode, it is desirable to include a shutter member or the like that suppresses heat exchange between the refrigerant and the outside air in the exterior heat exchanger 15.

For example, the branch portions 121, 122, and 123 described in the eleventh embodiment may be applied to the upstream branch portion of the refrigeration cycle devices 10 to 10*e* described in the first to tenth embodiments and the twelfth embodiment.

Although the present disclosure has been described in accordance with examples, it is understood that the present disclosure is not limited to the examples and configurations. The present disclosure also includes various modifications and the modifications within an equivalent range. In addition, various combinations and modes, and other combinations and modes including only one element, more elements, or less elements are also within the scope and idea of the present disclosure.

What is claimed is:

1. A refrigeration cycle device comprising:

a compressor configured to compress and discharge a refrigerant;

an upstream branch portion configured to branch a flow of the refrigerant discharged from the compressor;

a heating portion configured to heat a heating target by using one refrigerant branched at the upstream branch portion as a heat source;

at least one decompression portion configured to decompress the refrigerant flowing out from the heating portion;

a bypass passage configured to guide another refrigerant branched at the upstream branch portion toward a suction port side of the compressor;

a bypass flow adjustment portion configured to adjust a flow rate of the refrigerant flowing through the bypass passage;

a first heat exchanger including a mixing portion in which a bypass side refrigerant flowing out from the bypass flow adjustment portion is mixed with a decompression-portion side refrigerant flowing out from the at least one decompression portion, the first heat exchanger being configured to exchange heat among the bypass side refrigerant, the decompression-portion side refrigerant and a heat exchange target fluid; and a heat medium circuit that circulates the heat exchange target fluid, wherein the mixing portion mixes the bypass side refrigerant and the decompression-portion side refrigerant to have a mixed refrigerant in which the bypass side refrigerant and the decompression-portion side refrigerant are homogeneously mixed, and to cause the mixed refrigerant to flow out to the suction port side of the compressor, the heat medium circuit is provided with a second heat exchanger configured to exchange heat between the heat exchange target fluid and a heat generating device that generates heat during operation, the heat medium circuit includes a heat medium bypass passage through which the heat exchange target fluid flowing out from the second heat exchanger flows while bypassing the first heat exchanger, and a heat medium circuit switching valve configured to switch a circuit configuration of the heat medium circuit, and the heat medium circuit switching valve is configured to be switched to (i) a first circuit in which the heat exchange target fluid flowing out from the second heat exchanger flows into the first heat exchanger when a temperature of the heat exchange target fluid flowing into the second heat exchanger is higher than a temperature of the refrigerant flowing out of the first heat exchanger, or to (ii) a second circuit in which the heat exchange target fluid flowing out from the second heat exchanger flows into the heat medium bypass passage when the temperature of the heat exchange target fluid flowing into the second heat exchanger is lower than the temperature of the refrigerant flowing out of the first heat exchanger.

2. The refrigeration cycle device according to claim 1, wherein the mixing portion includes a wetting area enlargement member that enlarges a wetting area of a liquid-phase refrigerant flowing into the mixing portion.

3. The refrigeration cycle device according to claim 1, wherein the mixing portion includes a bypass side refrigerant inlet portion into which the bypass side refrigerant flows, a decompression-portion side refrigerant inlet portion into which the decompression-portion side refrigerant flows, and a passage forming member configured to form a plurality of small-diameter passages through which the bypass side refrigerant and the decompression-portion side refrigerant flow, and a corresponding diameter of the small-diameter passages is smaller than a corresponding diameter of the bypass side refrigerant inlet portion and a corresponding diameter of the decompression-portion side refrigerant inlet portion.

4. The refrigeration cycle device according to claim 1, further comprising a heat absorption portion configured to exchange heat between the refrigerant decompressed by the at least one decompression portion and a heat source fluid, and to evaporate the refrigerant.

5. The refrigeration cycle device according to claim 4, further comprising:

a downstream branch portion that branches a flow of the refrigerant flowing out from the heating portion; and a branch circuit switching portion configured to switch a refrigerant circuit in which the refrigerant flows out from one outflow port of the downstream branch portion and a refrigerant circuit in which the refrigerant flows out from another outflow port of the downstream branch portion, wherein the at least one decompression portion includes a first decompression portion that decompresses one refrigerant branched at the downstream branch portion and a second decompression portion that decompresses another refrigerant branched at the downstream branch portion, and wherein the heat absorption portion is configured to evaporate the refrigerant decompressed by the first decompression portion.

6. The refrigeration cycle device according to claim 5, further comprising an auxiliary evaporating portion configured to evaporate the refrigerant decompressed by the second decompression portion, wherein a refrigerant outlet of the auxiliary evaporating portion is connected to an outlet side of the first heat exchanger.

7. The refrigeration cycle device according to claim 1, further comprising:

a controller configured to control at least one of operation of the at least one decompression portion or operation of the bypass flow adjustment portion, wherein in an operation mode in which the heating portion heats the heating target, the controller controls at least one of operation of the at least one decompression portion or the operation of the bypass flow adjustment portion, and a superheat degree of the refrigerant on an outlet side of the first heat exchanger approaches a predetermined reference superheat degree.

8. The refrigeration cycle device according to claim 1, further comprising:

a low-pressure side gas-liquid separator that separates the refrigerant flowing out from the first heat exchanger into gas and liquid, stores the separated liquid-phase refrigerant, and causes the separated gas-phase refrigerant to flow to the suction port side of the compressor; and a controller configured to control at least one of operation of the at least one decompression portion and operation of the bypass flow adjustment portion, wherein in a refrigerant warm-up mode in which the bypass side refrigerant and the decompression-portion side refrigerant are mixed by the mixing portion and the refrigerant sucked into the compressor is heated when the compressor is started, the controller controls at least one of the operation of the at least one decompression portion or the operation of the bypass flow adjustment portion to have a bypass side flow rate of the bypass side refrigerant greater than a decompression portion side flow rate of the decompression-portion side refrigerant.

9. The refrigeration cycle device according to claim 1, wherein the refrigerant includes a refrigerant oil that lubricates the compressor, and the upstream branch portion is configured to have a dryness of one branched refrigerant to be different from a dryness of the other branched refrigerant, and to cause the refrigerant having a higher dryness to flow to the bypass passage.

10. The refrigeration cycle device according to claim 1, wherein the heat medium circuit switching valve includes a first heat medium circuit switching valve and a second heat medium circuit switching valve.

11. A refrigeration cycle device comprising:

a compressor configured to compress and discharge a refrigerant;

an upstream branch joint configured to branch a flow of the refrigerant discharged from the compressor;

a heater configured to heat a heating target by using one refrigerant branched at the upstream branch joint as a heat source;

at least one decompression valve configured to decompress the refrigerant flowing out from the heater;

a bypass passage configured to guide another refrigerant branched at the upstream branch joint toward a suction port side of the compressor;

a bypass flow adjustment valve configured to adjust a flow rate of the refrigerant flowing through the bypass passage;

a first heat exchanger including a mixing portion in which a bypass side refrigerant flowing out from the bypass flow adjustment valve is mixed with a decompression-portion side refrigerant flowing out from the at least one decompression valve, and configured to exchange heat among the bypass side refrigerant, the decompression-portion side refrigerant, and a heat exchange target fluid;

a heat medium circuit that circulates the heat exchange target fluid, the heat medium circuit being provided with a second heat exchanger configured to exchange heat between the heat exchange target fluid and a heat generating device that generates heat during operation, a heat medium bypass passage through which the heat exchange target fluid flowing out from the second heat exchanger flows while bypassing the first heat exchanger, and a heat medium circuit switching valve configured to switch a circuit configuration of the heat medium circuit, and a controller including at least one processor and at least one memory storing computer program code, the controller being configured to control operation of the heat medium circuit switching valve, to switch a first circuit in which the heat exchange target fluid flowing out from the second heat exchanger flows into the first heat exchanger when a temperature of the heat exchange target fluid flowing into the second heat exchanger is higher than a temperature of the refrigerant flowing out of the first heat exchanger, and to switch a second circuit in which the heat exchange target fluid flowing out from the second heat exchanger flows into the heat medium bypass passage when the temperature of the heat exchange target fluid flowing into the second heat exchanger is lower than the temperature of the refrigerant flowing out of the first heat exchanger.

12. The refrigeration cycle device according to claim 11, wherein the controller controls the at least one decompression valve to be closed and controls the bypass flow adjustment valve to a throttle state during a warm-up mode in which all refrigerant discharged from the compressor flows through the first heat exchanger through the bypass passage, and the controller is configured to switch between the first circuit and the second switch in response to the temperature of the heat exchange target fluid flowing into the second heat exchanger and the temperature of the refrigerant flowing out of the first heat exchanger, during the warm-up mode.

13. The refrigeration cycle device according to claim 11, wherein the heat medium circuit switching valve includes a first heat medium circuit switching valve and a second heat medium circuit switching valve.

* * * * *